US006946800B2

(12) United States Patent
Takeuchi et al.

(10) Patent No.: US 6,946,800 B2
(45) Date of Patent: Sep. 20, 2005

(54) ELECTRON EMITTER, METHOD OF DRIVING ELECTRON EMITTER, DISPLAY AND METHOD OF DRIVING DISPLAY

(75) Inventors: Yukihisa Takeuchi, Nishikamo-gun (JP); Tsutomu Nanataki, Toyoake (JP); Iwao Ohwada, Nagoya (JP); Nobuyuki Kokune, Nagoya (JP); Tomoya Horiuchi, Nishikasugai (JP)

(73) Assignee: NGK Insulators, Ltd., Nagoya (JP)

( * ) Notice: Subject to any disclaimer, the term of this patent is extended or adjusted under 35 U.S.C. 154(b) by 101 days.

(21) Appl. No.: 10/374,955

(22) Filed: Feb. 25, 2003

(65) Prior Publication Data

US 2004/0100200 A1 May 27, 2004

(30) Foreign Application Priority Data

Feb. 26, 2002 (JP) ..... 2002-049754
Jun. 24, 2002 (JP) ..... 2002-183481

(51) Int. Cl.[7] ..... G09G 3/10
(52) U.S. Cl. ..... 315/169.3; 315/169.1; 315/297; 313/497; 345/75.2
(58) Field of Search ..... 315/169.1, 169.3, 315/291, 301, 297, 307; 313/311, 414, 447, 448, 491, 495, 497; 345/74.1–75.2

(56) References Cited

U.S. PATENT DOCUMENTS 5,280,221 A 1/1994 Okamoto et al. ..... 315/169.1
5,453,661 A 9/1995 Auciello et al. ..... 315/169.3

(Continued)

FOREIGN PATENT DOCUMENTS

| | | | |
|---|---|---|---|
| DE | 3833604 | | 4/1990 |
| DE | 10057072 | | 5/2001 |
| EP | 0 353 632 | | 2/1990 |
| EP | 428853 | | 5/1991 |
| EP | 0 953 958 | A2 | 11/1999 |
| FR | 2639151 | | 5/1990 |
| FR | 2675306 | | 10/1992 |
| FR | 2789221 | | 8/2000 |
| FR | 2789223 | | 8/2000 |
| JP | 44-26125 | | 11/1969 |
| JP | 46-20944 | | 6/1971 |
| JP | 59-208587 | | 11/1984 |
| JP | 63-150837 | A | 6/1988 |
| JP | 1-311533 | A | 12/1989 |
| JP | 05-325777 | | 12/1993 |
| JP | 7-147131 | A | 6/1995 |
| JP | 08-111166 | | 4/1996 |
| JP | 09-090882 | A | 4/1997 |
| JP | 10-27539 | A | 1/1998 |
| JP | 11-185600 | | 7/1999 |
| JP | 11-288249 | A | 10/1999 |
| JP | 2000-285801 | A | 10/2000 |
| JP | 2000-310970 | A | 11/2000 |
| JP | 3160213 | B2 | 2/2001 |
| JP | 3214256 | | 7/2001 |
| WO | 02/052600 | A1 | 7/2002 |

OTHER PUBLICATIONS

U.S. Appl. No. 10/951,509, filed Sep. 28, 2004, Takeuchi et al.

(Continued)

*Primary Examiner*—Haissa Philogene
(74) *Attorney, Agent, or Firm*—Burr & Brown

(57) ABSTRACT

An electron emitter has an electric field receiving member formed on a substrate, a cathode electrode formed on one surface of the electric field receiving member, and an anode electrode formed on the one surface of the electric field receiving member, with a slit defined between the cathode electrode and the anode electrode. The electric field receiving member is made of a dielectric material. The electron emitter also has a modulation circuit for modulating a pulse signal applied between the cathode electrode and the anode electrode based on a control signal supplied from a controller such as a CPU to control at least an amount of emitted electrons.

67 Claims, 93 Drawing Sheets

U.S. PATENT DOCUMENTS

| | | | | | |
|---|---|---|---|---|---|
| 5,508,590 | A | | 4/1996 | Sampayan et al. | 315/169.1 |
| 5,666,019 | A | * | 9/1997 | Potter | 313/306 |
| 5,726,524 | A | | 3/1998 | Debe | |
| 5,729,094 | A | | 3/1998 | Geis et al. | |
| 5,747,926 | A | | 5/1998 | Nakamoto et al. | 313/495 |
| 5,874,802 | A | * | 2/1999 | Choi et al. | 313/495 |
| 5,877,594 | A | | 3/1999 | Miyano et al. | |
| 5,910,792 | A | * | 6/1999 | Hansen et al. | 345/74.1 |
| 5,990,605 | A | | 11/1999 | Yoshikawa et al. | |
| 6,040,973 | A | | 3/2000 | Okamoto et al. | |
| 6,153,978 | A | | 11/2000 | Okamoto | |
| 6,157,145 | A | | 12/2000 | Vollkommer et al. | 315/339 |
| 6,184,612 | B1 | | 2/2001 | Negishi et al. | |
| 6,198,225 | B1 | | 3/2001 | Kano et al. | 315/169.3 |
| 6,274,881 | B1 | | 8/2001 | Akiyama et al. | |
| 6,285,123 | B1 | * | 9/2001 | Yamada et al. | 313/495 |
| 6,313,815 | B1 | * | 11/2001 | Takeda et al. | 345/75.2 |
| 6,359,383 | B1 | | 3/2002 | Chuang et al. | |
| 6,452,328 | B1 | | 9/2002 | Saito et al. | |
| 6,469,452 | B2 | | 10/2002 | Seo et al. | |
| 6,479,924 | B1 | | 11/2002 | Yoo | 313/310 |
| 6,580,108 | B1 | | 6/2003 | Utsumi et al. | |
| 6,809,469 | B1 | * | 10/2004 | Ito et al. | 313/495 |
| 2002/0060516 | A1 | | 5/2002 | Kawate et al. | |
| 2002/0153827 | A1 | | 10/2002 | Takeuchi et al. | |
| 2003/0098656 | A1 | | 5/2003 | Takeuchi et al. | |

OTHER PUBLICATIONS

U.S. Appl. No. 10/950,976, filed Sep. 27, 2004, Takeuchi et al.

U.S. Appl. No. 10/952,524, filed Sep. 28, 2004, Takeuchi et al.

U.S. Appl. No. 10/951,832, filed Sep. 28, 2004, Takeuchi et al.

U.S. Appl. No. 10/919,747, filed Aug. 17, 2004, Takeuchi et al.

U.S. Appl. No. 10/901,932, filed Jul. 29, 2004, Takeuchi et al.

U.S. Appl. No. 10/919,678, filed Aug. 17, 2004, Takeuchi et al.

Kanemaru, Seigou, "Featuring: All about Flat Displays 2000, Leading Technological Trend of FEDs," Electronic Engineering, Jul. 2000, pp. 38–41.

G. Benedek et al., "Electron Emission From Ferroelectric/Antiferroelectric Cathodes Excited by Short High–Voltage Pulses", Journal Applied Physics, vol. 81, No. 3, Feb. 1, 1997, pp. 1396–1403.

Gundel, H. et al., "Low Pressure Hollow Cathode Switch Triggered by a Pulsed Electron Beam Emitted From Ferroelectrics", Applied Physics Letter, American Institute of Physics, New York, US vol. 54, No. 21, May 22, 1989, pp. 2071–2073.

Gundel, H. et al., "Time–Dependent Electron Emission From Ferroelectrics by External Pulsed Electric Fields", Journal of Applied Physics, American Institute of Physics, New York, US vol. 69, No. 2, Jan. 15, 1991, pp. 975–982.

U.S. Appl. No. 10/719,521, filed Nov. 21, 2003, Takeuchi et al.

U.S. Appl. No. 10/719,596, filed Nov. 21, 2003, Takeuchi et al.

U.S. Appl. No. 10/730,754, filed Dec. 8, 2003, Takeuchi et al.

U.S. Appl. No. 10/731,901, filed Dec. 9, 2003, Takeuchi et al.

U.S. Appl. No. 10/459,415, filed Jun. 11, 2003, Takeuchi et al.

U.S. Appl. No. 10/459,110, filed Jun. 11, 2003, Takeuchi et al.

U.S. Appl. No. 10/459,416, filed Jun. 11, 2003, Takeuchi et al.

U.S. Appl. No. 10/459,386, filed Jun. 11, 2003, Takeuchi et al.

U.S. Appl. No. 10/647,794, filed Aug. 25, 2003, Takeuchi et al.

U.S. Appl. No. 10/673,384, filed Sep. 26, 2003, Takeuchi et al.

U.S. Appl. No. 10/671,763, filed Sep. 26, 2003, Takeuchi et al.

U.S. Appl. No. 10/678,958, filed Oct. 3, 2003, Takeuchi et al.

U.S. Appl. No. 10/699,186, filed Oct. 31, 2003, Takeuchi et al.

"Pulsed Electron Source Using a Ferroelectric Cathode," Tokyo Institute of Technology, vol. 68, No. 5, Jan. 7, 1999, pp. 546–550.

Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633–5637.

Riege, H., "Electron Emission from Ferroelectrics—a Review," Nucl. Instr. and Meth. A340, 1994, pp. 80–89.

Masatoshi Miyake et al., "Electron Emission from Ferroelectric Cathodes Excited by Pulsed Voltage," Tokyo Institute of Technology, vol. 119, No. 5, 1999 pp. 622–627.

U.S. Appl. No. 10/808,258, filed Mar. 24, 2004, Takeuchi et al.

* cited by examiner t0
t2
t3
t1
T2
T1
T2
Vf
Sp
Vo

Ia
0
Pa
(-80mA)

Ik
0
Pk
(-110mA)

Ic
0
Pc
(-30mA)

50V
Va
(-77V)
Vap
(-120V)

Sp

Sp

Sp

Sp1

Sp

Sp1

Sp

Sp1

114a

114c

114d

114e

114f

Sp
Vf
Vo

Vg

CURRENT
(AMOUNT OF EMISSION)

100C

ELECTRON EMITTER, METHOD OF DRIVING ELECTRON EMITTER, DISPLAY AND METHOD OF DRIVING DISPLAY

BACKGROUND OF THE INVENTION

1. Field of the Invention

The present invention relates to an electron emitter comprising a cathode electrode and an anode electrode which are formed on an electric field receiving member, a method of driving the electron emitter, a display employing the electron emitter, and a method of driving the display.

2. Description of the Related Art

Recently, electron emitters having a cathode electrode and an anode electrode have been used in various applications such as field emission displays (FEDs) and backlight units. In an FED, a plurality of electron emitters are arranged in a two-dimensional array, and a plurality of fluorescent bodies are positioned in association with the respective electron emitters with a predetermined gap therebetween.

Conventional electron emitters are disclosed in Japanese laid-open patent publication No. 1-311533, Japanese laid-open patent publication No. 7-147131, Japanese laid-open patent publication No. 2000-285801, Japanese patent publication No. 46-20944, and Japanese patent publication No. 44-26125, for example. All of these disclosed electron emitters are disadvantageous in that since no dielectric body is employed in the electric field receiving member, a forming process or a micromachining process is required between facing electrodes, a high voltage needs to be applied to emit electrons, and a panel fabrication process is complex and entails a high panel fabrication cost.

It has been considered to make an electric field receiving member of a dielectric material. However, though various theories have been presented in documents 1 through 3, shown below, about the emission of electrons from a dielectric material, the principles behind an emission of electrons have not yet been established, and advantages of an electron emitter having an electric field receiving member made of a dielectric material have not been achieved.

[Documents]

1. Yasuoka and Ishii, "Pulse electron source using a ferrodielectric cathode", Japanese J. Appl. Phys., Vol. 68, No. 5, p. 546–550 (1999).

2. V. F. Puchkarev, G. A. Mesyats, On the mechanism of emission from the ferroelectric ceramic cathode, J. Appl. Phys., Vol. 78, No. 9, 1 Nov. 1995, p. 5633–5637.

3. H. Riege, Electron emission ferroelectrics—a review, Nucl. Instr. and Meth. A340, p. 80–89 (1994).

The conventional electron emitters do not have a good straightness of electron emission, i.e., a good ability to cause emitted electrons to travel straight to a given object (e.g., a fluorescent body). In order to achieve a desired current density with electrons, it is necessary to apply a relatively high voltage to the electron emitter.

If conventional electron emitters are applied to a display, then the crosstalk is relatively large because the straightness of electron emission is not good. Specifically, electrons emitted from an electron emitter are highly likely to be applied to a fluorescent body positioned adjacent to the fluorescent body corresponding to the electron emitter from which the electrons have been emitted. As a result, it is difficult to reduce the pitch of the fluorescent bodies.

Most displays which incorporate conventional electron emitters are digitally controlled to either emit or not emit electrons. Those displays are not based on the idea of analog control over the amount and acceleration of electrons that are emitted from electric field receiving members, and fail to control finely divided gradations.

SUMMARY OF THE INVENTION

The present invention has been made in view of the above drawbacks. It is an object of the present invention to provide an electron emitter, a method of driving the electron emitter, a display employing the electron emitter, and a method of driving the display for providing a good straightness of electron emission and suppressing crosstalk between a plurality of electron emitters arranged in an array.

Another object of the present invention is to provide an electron emitter, a method of driving the electron emitter, a display employing the electron emitter, and a method of driving the display for achieving analog control over the amount and acceleration of electrons that are emitted and controlling finely divided gradations.

According to the present invention, an electron emitter has an electric field receiving member made of a dielectric material, a cathode electrode formed on one surface of the electric field receiving member, an anode electrode formed on the one surface of the electric field receiving member, with a slit defined between the cathode electrode and the anode electrode, and a modulation circuit for modulating a voltage signal applied between the cathode electrode and the anode electrode to control at least an amount of emitted electrons.

According to the present invention, an electron emitter has an anode electrode formed on a substrate, an electric field receiving member formed on the substrate to cover the anode electrode and made of a dielectric material, a cathode electrode formed on the electric field receiving member, and a modulation circuit for modulating a voltage signal applied between the cathode electrode and the anode electrode to control at least an amount of emitted electrons.

With the above arrangements, the amount of emitted electrons and the acceleration thereof can be controlled in an analog fashion. The electron emitter as it is applied to a display or the like is thus capable of controlling finely divided gradations.

According to the present invention, an electron emitter has an electric field receiving member made of a dielectric material, a cathode electrode formed on one surface of the electric field receiving member, an anode electrode formed on the one surface of the electric field receiving member, with a slit defined between the cathode electrode and the anode electrode, and a control electrode disposed over the cathode electrode and the anode electrode.

According to the present invention, an electron emitter has an anode electrode formed on a substrate, an electric field receiving member formed on the substrate to cover the anode electrode and made of a dielectric material, a cathode electrode formed on the electric field receiving member, and a control electrode disposed over the cathode electrode.

The ability of emitted electrons to travel straight can be increased by appropriately adjusting a voltage applied to the control electrode. If electron emitters are applied to a display or the like, then crosstalk between the electron emitters can effectively be suppressed.

With the above arrangements, a protective film may be formed on at least the surfaces of the cathode electrode and the anode electrode or at least the surface of the cathode electrode. The protective film greatly reduces the danger of damage to the cathode electrode and the anode electrode due to impingement of electrons and ions thereupon and heating. The protective film may comprise a conductive film made of a material having a high melting point or an insulating layer. Preferably, the protective film comprises a conductive carbon film made of a material having a high melting point.

The electron emitter may have a first modulation circuit for modulating a first voltage signal applied between the cathode electrode and the anode electrode to control at least an amount of emitted electrons, and a second modulation circuit for modulating a second voltage signal applied between the control electrode and the anode electrode to control at least an amount of emitted electrons.

The electron emitter as it is applied to a display or the like is thus capable of controlling finely divided gradations.

The control electrode may have a window defined in a position facing at least a central portion of the slit. The window may be in the shape of a slit extending along the longitudinal direction of the slit, or in the shape of a slit extending perpendicularly to the longitudinal direction of the slit, or in the shape of a circle or in the shape of an ellipse.

The control electrode may be formed on a spacer which is formed on a peripheral region of the electric field receiving member. The control electrode may be formed on a spacer which is formed on at least the cathode electrode and the anode electrode. Alternatively, the control electrode may be formed on a spacer which is formed on at least the cathode electrode.

The spacer may comprise an insulating layer formed by a film fabrication technology or beams disposed around the electric field receiving member. The beams may be fixed in position by adhesive bonding. Alternatively, the control electrode may comprise erected members disposed around the electric field receiving member and an electrode body lying parallel to the slit-forming surface of the electric field receiving member and integrally formed with the erected members.

With the above arrangement, a second control electrode may be disposed over the control electrode. The ability of emitted electrons to travel straight can be increased by appropriately adjusting voltages applied to the control electrode and the second control electrode. If electron emitters are applied to a display or the like, then crosstalk between the electron emitters can effectively be suppressed. The control electrode and the second control electrode make it possible to control the amount of emitted electrons and the acceleration thereof in finer steps. The electron emitter as it is applied to a display or the like is thus capable of controlling finely divided gradations.

The second control electrode may have a window defined in a position facing at least a central portion of the slit. The window may be in the shape of a slit extending along the longitudinal direction of the slit, or in the shape of a slit extending perpendicularly to the longitudinal direction of the slit, or in the shape of a circle or in the shape of an ellipse.

The second control electrode may be formed on a second spacer which is formed on a peripheral region of the electric field receiving member. The second spacer may comprise an insulating layer formed by a film fabrication technology or second beams disposed around the electric field receiving member. The second beams may be fixed in position by adhesive bonding. Alternatively, the second control electrode may comprise erected members disposed around the electric field receiving member and an electrode body lying parallel to the slit-forming surface of the electric field receiving member and integrally formed with the erected members.

The electric field receiving member may be made of a piezoelectric material, an anti-ferrodielectric material, or an electrostrictive material.

According to the present invention, a display has a two-dimensional array of electron emitters, a collector electrode facing the electron emitters, and a plurality of fluorescent layers spaced by respective distances from the electron emitters, each of the electron emitters having an electric field receiving member made of a dielectric material, a cathode electrode and an anode electrode which are formed in contact with the electric field receiving member, and a modulation circuit for modulating a voltage signal applied between the cathode electrode and the anode electrode to control a displayed gradation.

With the above arrangement, the amount of emitted electrons and the acceleration thereof can be controlled in an analog fashion for controlling finely divided gradations.

If the modulation circuit comprises a circuit for carrying out pulse-width-modulating the voltage signal based on a gradation command value, then a linearization correcting circuit may be connected to an input of the modulation circuit, for correcting the gradation command value in order to convert a change in the displayed gradation based on a change in the gradation command value into linear characteristics.

According to the present invention, a display has a two-dimensional array of electron emitters, a collector electrode facing the electron emitters, a plurality of fluorescent layers spaced by respective distances from the electron emitters, and a control electrode disposed between the fluorescent layers and the electron emitters, each of the electron emitters having an electric field receiving member made of a dielectric material, and a cathode electrode and an anode electrode which are formed in contact with the electric field receiving member.

With the above arrangement, the amount of emitted electrons and the acceleration thereof can be controlled in an analog fashion for controlling finely divided gradations. The ability of emitted electrons to travel straight can be increased to suppress crosstalk between adjacent ones of the electron emitters.

The display may have a first modulation circuit for modulating a first voltage signal applied between the cathode electrode and the anode electrode to control a displayed gradation, and a second modulation circuit for modulating a second voltage signal applied between the control electrode and the anode electrode to control a displayed gradation. The display thus arranged is capable of controlling finely divided gradations.

If the first modulation circuit comprises a circuit for carrying out pulse-width-modulating the first voltage signal based on a gradation command value, then a linearization correcting circuit may be connected to an input of the modulation circuit, for correcting the gradation command value in order to convert a change in the displayed gradation based on a change in the gradation command value into linear characteristics.

The cathode electrode may be formed on one surface of the electric field receiving member, and the anode electrode may be formed on the one surface of the electric field receiving member, with a slit defined between the cathode electrode and the anode electrode. A protective film may be formed on the least the surfaces of the cathode electrode and the anode electrode.

Alternatively, the anode electrode may be formed on a substrate, the electric field receiving member may be formed on the substrate to cover the anode electrode, and the cathode electrode may be formed on the electric field receiving member. A protective film may be formed on at least the surface of the cathode electrode. The protective film may comprise a carbon film or an insulating layer.

The electric field receiving member may be made of a piezoelectric material, an anti-ferrodielectric material, or an electrostrictive material.

A plurality of control electrodes capable of applying an independent voltage signal to one electron emitter may be facing each other.

The control electrode may be divided into control electrodes associated with respective rows, or control electrodes associated with respective columns, or control electrodes associated with the respective electron emitters. The control electrode may be divided into control electrodes associated with respective groups of the electron emitters. In this case, the control electrode may be divided into control electrodes associated with respective groups of the electron emitters each for displaying either one of three primary colors, so that the display can easily be arranged for displaying color images.

The control electrodes may have windows defined in positions facing at least central portions of the slits of the electron emitters. The windows may be in the shape of slits extending along the longitudinal direction of the above slits, or may be continuously formed in common to the electron emitters arrayed in the longitudinal direction of the slits, or may be in the shape of slits extending perpendicularly to the longitudinal direction of the above slits, or may be continuously formed in common to the electron emitters arrayed perpendicularly to the longitudinal direction of the slits. The windows may also be in the shape of circles or in the shape of ellipses.

The display according to the present invention may have a second control electrode disposed between the control electrode and the fluorescent layers.

The display may have a third modulation circuit for modulating a third voltage signal applied between the second control electrode and the anode electrode to convert a change in the displayed gradation modulated by at least the first modulation circuit into linear characteristics.

The display may have a self-diagnostic function for trapping emitted electrons with the second control electrode and detecting a current produced by the trapped electrons for diagnosis.

According to the present invention, a method of driving an electron emitter having an electric field receiving member made of a dielectric material and a cathode electrode and an anode electrode which are formed in contact with the electric field receiving member, has the step of modulating a pulse signal applied between the cathode electrode and the anode electrode to control at least an amount of emitted electrons.

The cathode electrode may be formed on one surface of the electric field receiving member, and the anode electrode may be formed on the one surface of the electric field receiving member, with a slit defined between the anode electrode and the cathode electrode.

Alternatively, the anode electrode may be formed on a substrate, the electric field receiving member may be formed on the substrate to cover the anode electrode, and the cathode electrode may be formed on the electric field receiving member.

With the above arrangement, the amount of emitted electrons and the acceleration thereof can be controlled in an analog fashion for controlling finely divided gradations.

According to the present invention, a method of driving an electron emitter having an electric field receiving member made of a dielectric material, a cathode electrode formed on one surface of the electric field receiving member, and an anode electrode formed on the one surface of the electric field receiving member, with a slit defined between the cathode electrode and the anode electrode, has the step of providing a control electrode disposed over the cathode electrode and the anode electrode, applying a constant first pulse signal between the cathode electrode and the anode electrode, and applying a second pulse signal between the control electrode and the anode electrode to control at least an amount of emitted electrons.

According to the present invention, a method of driving an electron emitter having an anode electrode formed on a substrate, an electric field receiving member formed on the substrate to cover the anode electrode and made of a dielectric material, and a cathode electrode formed on the electric field receiving member, has the steps of providing a control electrode disposed over the cathode electrode, applying a constant first pulse signal between the cathode electrode and the anode electrode, and modulating a second pulse signal applied between the control electrode and the anode electrode to control at least an amount of emitted electrons.

According to the present invention, a method of driving a display having a two-dimensional array of electron emitters, and a plurality of fluorescent layers spaced by respective distances from the electron emitters, each of the electron emitters having an electric field receiving member made of a dielectric material, and a cathode electrode and an anode electrode which are formed in contact with the electric field receiving member, has the step of modulating a voltage signal applied between the cathode electrode and the anode electrode of each of the electron emitters to control a displayed gradation.

If the step of modulating a voltage signal comprises the step of pulse-width-modulating the voltage signal based on a gradation command value, then the method may further comprise the step of correcting the gradation command value in order to convert a change in the displayed gradation based on a change in the gradation command value into linear characteristics.

According to the present invention, a method of driving a display having a two-dimensional array of electron emitters, a collector electrode facing the electron emitters, a plurality of fluorescent layers spaced by respective distances from the electron emitters; and a control electrode disposed between the fluorescent layers and the electron emitters, each of the electron emitters having an electric field receiving member made of a dielectric material, and a cathode electrode and an anode electrode which are formed in contact with the electric field receiving member, has the steps of modulating a first voltage signal applied between the cathode electrode and the anode electrode and modulating a second voltage signal applied between the control electrode and the anode electrode to control a displayed gradation.

If the step of modulating a first voltage signal comprises the step of pulse-width-modulating the first voltage signal based on a gradation command value, then the method may further comprise the step of correcting the gradation command value in order to convert a change in the displayed gradation based on a change in the gradation command value into linear characteristics.

In the above method, if a second control electrode is disposed between the control electrode and the fluorescent layers, and the step of modulating a first voltage signal comprises the step of pulse-width-modulating the first voltage signal based on a gradation command value, then the method may further comprise the step of modulating a third voltage signal applied between the second control electrode and the anode electrode, thereby to convert a change in the displayed gradation based on a change in the gradation command value into linear characteristics.

In the above electron emitter, the cathode electrode may be formed on one surface of the electric field receiving member, and the anode electrode may be formed on the one surface of the electric field receiving member, with a slit defined between the anode electrode and the drive electrode. Alternatively, the anode electrode may be formed on a substrate, the electric field receiving member may be formed on the substrate to cover the anode electrode, and the cathode electrode may be formed on the electric field receiving member, in the shape of a ring with a central slit defined therein.

The above and other objects, features, and advantages of the present invention will become more apparent from the following description of preferred embodiments when taken in conjunction with the accompanying drawings.

DESCRIPTION OF THE PREFERRED EMBODIMENTS

Embodiments of an electron emitter, a method of driving the electron emitter, a display employing the electron emitter, and a method of driving the display according to the present invention will be described below with reference to FIGS. 1 through 93.

Generally, electron emitters can be used in displays, electron beam irradiation apparatus, light sources, alternatives to LEDs, and electronic parts manufacturing apparatus.

An electron beam in an electron beam irradiation apparatus has a higher energy and a better absorption capability than ultraviolet rays in ultraviolet ray irradiation apparatus that are presently in widespread use. Electron emitters are used to solidify insulating films in superposing wafers for semiconductor devices, harden printing inks without irregularities for drying prints, and sterilize medical devices while being kept in packages.

Electron emitters are also used as high-luminance, high-efficiency light sources for use in projectors, for example.

Electron emitters are also used as alternatives to LEDs in chip light sources, traffic signal devices, and backlight units for small-size liquid-crystal display devices for cellular phones.

Electron emitters are also used in electronic parts manufacturing apparatus including electron beam sources for film growing apparatus such as electron beam evaporation apparatus, electron sources for generating a plasma (to activate a gas or the like) in plasma CVD apparatus, and electron sources for decomposing gases.

Electron emitters are also used in vacuum micro devices including ultrahigh-speed devices operable in a tera-Hz range and environment-resistant electronic parts that can be used in a wide temperature range.

Electron emitters are also used in electronic circuit parts including digital devices such as switches, relays, diodes, etc. and analog devices such as operational amplifiers, etc. as they can be designed for outputting large currents and high amplification factors.

Figure 1:
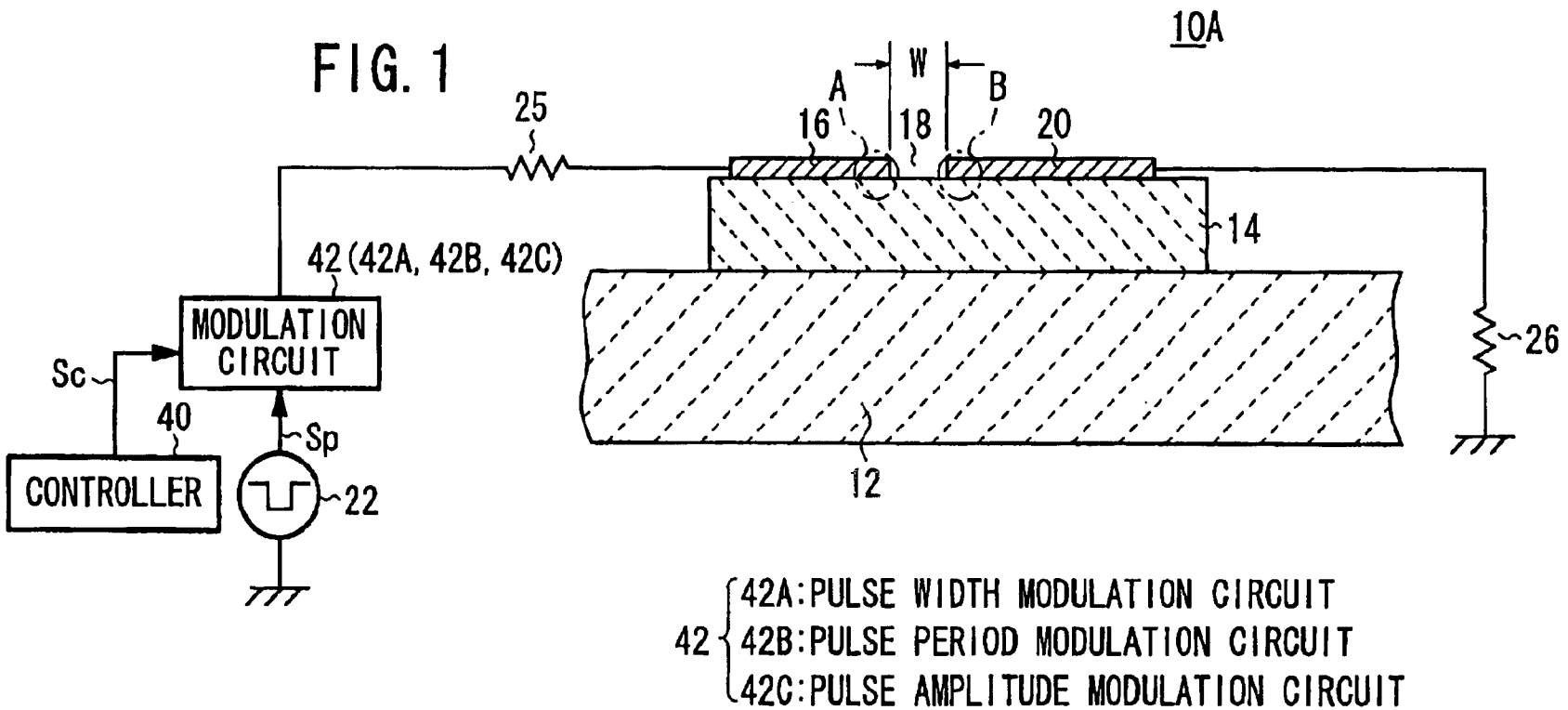
FIG. 1 is a view showing an electron emitter according to a first embodiment of the present invention.

As shown in FIG. 1, an electron emitter 10A according to a first embodiment has an electric field receiving member 14, a cathode electrode 16 formed on one surface of the electric field receiving member 14, and an anode electrode 20 formed on the same one surface of the electric field receiving member 14 with a slit 18 defined between the cathode electrode 16 and the anode electrode 20.

The electron emitter 10A according to the first embodiment is placed in a vacuum space. As shown in FIG. 1, the electron emitter 10A has electric field concentration points A, B. The point A can also be defined as a point including a triple point where the cathode electrode 16, the electric field receiving member 14, and the vacuum are present at one point. The point B can also be defined as a point including a triple point where the anode electrode 20, the electric field receiving member 14, and the vacuum are present at one point.

The vacuum level in the atmosphere should preferably in the range from $10^2$ to $10^{-6}$ Pa and more preferably in the range from $10^{-3}$ to $10^{-5}$ Pa.

The reason for the above range is that in a lower vacuum, many gas molecules would be present in the space, and (1) a plasma can easily be generated and, if an intensive plasma were generated, many positive ions thereof would impinge upon the cathode electrode 16 and damage the same, and (2) electrons would tend to impinge upon gas molecules prior to arrival at a target position (a collector electrode or the like).

In a higher vacuum, though electrons would be liable to be emitted from the electric field concentration points A, B, structural body supports and vacuum seals would be large in size, posing disadvantages on efforts to make the electron emitter lower in profile and smaller in size.

The electric field receiving member 14 is made of a dielectric material. The dielectric material should preferably have a relatively high dielectric constant, e.g., a dielectric constant of 1000 or higher. Dielectric materials of such a nature may be ceramics including barium titanate, lead zirconate, lead magnesium niobate, lead nickel niobate, lead zinc niobate, lead manganese niobate, lead magnesium tantalate, lead antimony tinate, lead titanate, barium titanate, lead magnesium tungstenate, lead cobalt niobate, etc. or a combination of any of these materials, or such ceramics to which there is added an oxide such as lanthanum, calcium, strontium, molybdenum, tungsten, barium, niobium, zinc, nickel, manganese, or the like, or a combination of these materials, or any of other compounds.

For example, a two-component material nPMN-mPT (n, m represent molar ratios) of lead magnesium niobate (PMN) and lead titanate (PT) has its Curie point lowered for a larger specific dielectric constant at room temperature if the molar ratio of PMN is increased.

Particularly, a dielectric material where n=0.85–1.0 and m=1.0–n is preferable because its specific dielectric constant is 3000 or higher. For example, a dielectric material where n=0.91 and m=0.09 has a specific dielectric constant of 15000 at room temperature, and a dielectric material where n=0.95 and m=0.05 has a specific dielectric constant of 20000 at room temperature.

For increasing the specific dielectric constant of a three-component dielectric material of lead magnesium niobate (PMN), lead titanate (PT), and lead zirconate (PZ), it is preferable to achieve a composition close to a morphotropic phase boundary (MPB) between a tetragonal system and a quasi-cubic system or a tetragonal system and a rhombohedral system, as well as to increase the molar ratio of PMN. For example, a dielectric material where PMN:PT:PZ=

0.375:0.375:0.25 has a specific dielectric constant of 5500, and a dielectric material where PMN:PT:PZ=0.5:0.375:0.125 has a specific dielectric constant of 4500, which is particularly preferable. Furthermore, it is preferable to increase the dielectric constant by introducing a metal such as platinum into these dielectric materials within a range to keep them insulative. For example, a dielectric material may be mixed with 20 weight % of platinum.

The electric field receiving member 14 may be a piezoelectric/electrostrictive layer or an anti-ferrodielectric layer. If the electric field receiving member 14 comprises a piezoelectric/electrostrictive layer, then it may be made of ceramics such as lead zirconate, lead magnesium niobate, lead nickel niobate, lead zinc niobate, lead manganese niobate, lead magnesium tantalate, lead antimony tinate, lead titanate, barium titanate, lead magnesium tungstenate, lead cobalt niobate, or the like. or a combination of any of these materials.

The electric field receiving member 14 may be made of chief components including 50 weight % or more of any of the above compounds. Of the above ceramics, the ceramics including lead zirconate is mostly frequently used as a constituent of the piezoelectric/electrostrictive layer of the electric field receiving member 14.

If the piezoelectric/electrostrictive layer is made of ceramics, then lanthanum, calcium, strontium, molybdenum, tungsten, barium, niobium, zinc, nickel, manganese, or the like, or a combination of these materials, or any of other compounds may be added to the ceramics.

For example, the piezoelectric/electrostrictive layer should preferably be made of ceramics including as chief components lead magnesium niobate, lead zirconate, and lead titanate, and also including lanthanum and strontium.

The piezoelectric/electrostrictive layer may be dense or porous. If the piezoelectric/electrostrictive layer is porous, then it should preferably have a porosity of 40% or less.

If the electric field receiving member 14 is an anti-ferrodielectric layer, then the anti-ferrodielectric layer may be made of lead zirconate as a chief component, lead zirconate and lead tin as chief components, lead zirconate with lanthanum oxide added thereto, or lead zirconate and lead tin as components with lead zirconate and lead niobate added thereto.

The anti-ferrodielectric layer may be porous. If the anti-ferrodielectric layer is porous, then it should preferably have a porosity of 30% or less.

The electric field receiving member 14 may be formed on a substrate 12 by any of various thick-film forming processes including screen printing, dipping, coating, electrophoresis, etc., or any of various thin-film forming processes including an ion beam process, sputtering, vacuum evaporation, ion plating, chemical vapor evaporation (CVD), plating, etc.

In the present embodiment, the electric field receiving member 14 is formed on the substrate 12 by any of various thick-film forming processes including screen printing, dipping, coating, electrophoresis, etc.

These thick-film forming processes are capable of providing good piezoelectric operating characteristics as the electric field receiving member 14 can be formed using a paste, a slurry, a suspension, an emulsion, a sol, or the like which is chiefly made of piezoelectric ceramic particles having an average particle diameter ranging from 0.01 to 5 μm, preferably from 0.05 to 3 μm.

Electrophoresis is capable of forming a film at a high density with high shape accuracy, and has features described in technical documents such as "Electrochemical and industrial physical chemistry, Vol. 53. No. 1 (1985), p. 63–68, written by Kazuo Anzai", and "1st electrophoresis high-degree ceramic forming process research/discussion meeting, collected preprints (1998), p. 5–6, p. 23–24". Any of the above processes may be chosen in view of the required accuracy and reliability.

The cathode electrode 16 may have a sharp corner. As shown in FIG. 1, a pulse generation source 22 applies a pulse voltage to the cathode electrode 16, enabling the cathode electrode 16 to emit electrons mainly from its corner. For the purpose of setting an upper limit for the amount of emitted electrons, a resistor 25 is connected between the pulse generation source 22 and the cathode electrode 16. For preventing damage due to an overcurrent flowing between the cathode electrode 16 and the anode electrode 20, a resistor 26 is connected in series between the anode electrode 20 and a DC offset voltage source (e.g., ground). For emitting electrons well, the width W of the slit 18 between the cathode electrode 16 and the anode electrode 20 is preferably set to 500 μm or less. A capacitor (not shown) may be connected in series between the cathode electrode 16 and the pulse generation source 22 for preventing the cathode electrode 16 and the anode electrode 20 from being short-circuited.

The cathode electrode 16 is made of materials described below. The cathode electrode 16 should preferably be made of a conductor having a small sputtering yield and a high evaporation temperature in vacuum. For example, materials having a sputtering yield of 2.0 or less at 600 V in $Ar^+$ and an evaporation pressure of $1.3\times10^{-3}$ Pa at a temperature of 1800 K or higher are preferable. Such materials include platinum, molybdenum, tungsten, etc. The cathode electrode 16 may be made of a conductor which is resistant to a high-temperature oxidizing atmosphere, e.g., a metal, an alloy, a mixture of insulative ceramics and a metal, or a mixture of insulative ceramics and an alloy. Preferably, the cathode electrode 16 should be chiefly composed of a precious metal having a high melting point, e.g., platinum, palladium, rhodium, molybdenum, or the like, or an alloy of silver and palladium, silver and platinum, platinum and palladium, or the like, or a cermet of platinum and ceramics. Further preferably, the cathode electrode 16 should be made of platinum only or a material chiefly composed of a platinum-base alloy. The electrodes should preferably be made of carbon or a graphite-base material, e.g., diamond thin film, diamond-like carbon, or carbon nanotube. Ceramics added to the electrode material should preferably have a proportion ranging from 5 to 30 volume %.

The cathode electrode 16 may be made of any of the above materials by any of various thick-film forming processes including screen printing, spray coating, dipping, coating, electrophoresis, etc., or any of various thin-film forming processes including sputtering, an ion beam process, vacuum evaporation, ion plating, CVD, plating, etc. Preferably, the cathode electrode 16 is made by any of the above thick-film forming processes.

If the cathode electrode 16 is made by a thick-film forming process, then it has a thickness of 20 μm or less and preferably 5 μm or less. To the anode electrode 20, there is applied a DC offset voltage via a wire extending through a through hole (not shown) and drawn from the reverse side of the substrate 12.

The anode electrode 20 is made of the same material by the same process as the cathode electrode 16. Preferably, the anode electrode 20 is made by any of the above thick-film forming processes. The anode electrode 20 has a thickness of 20 μm or less and preferably 5 μm or less.

The substrate 12 should preferably be made of an electrically insulative material in order to electrically isolate the wire electrically connected to the cathode electrode 16 and the wire electrically connected to the anode electrode 20 from each other.

The substrate 12 may be made of a highly heat-resistant metal or a metal material such as an enameled metal whose surface is coated with a ceramic material such as glass or the like. However, the substrate 12 should preferably be made of ceramics.

Ceramics which the substrate 12 is made of include stabilized zirconium oxide, aluminum oxide, magnesium oxide, titanium oxide, spinel, mullite, aluminum nitride, silicon nitride, glass, or a mixture thereof. Of these ceramics, aluminum oxide or stabilized zirconium oxide is preferable from the standpoint of strength and rigidity. Particularly preferable is stabilized zirconium oxide because its mechanical strength is relatively high, its tenacity is relatively high, and its chemical reaction with the cathode electrode 16 and the anode electrode 20 is relatively small. Stabilized zirconium oxide includes stabilized zirconium oxide and partially stabilized zirconium oxide. Stabilized zirconium oxide does not develop a phase transition as it has a crystalline structure such as a cubic system.

Zirconium oxide develops a phase transition between a monoclinic system and a tetragonal system at about 1000° C. and is liable to suffer cracking upon such a phase transition. Stabilized zirconium oxide contains 1 to 30 mol % of a stabilizer such as calcium oxide, magnesium oxide, yttrium oxide, scandium oxide, ytterbium oxide, cerium oxide, or an oxide of a rare earth metal. For increasing the mechanical strength of the substrate 12, the stabilizer should preferably contain yttrium oxide. The stabilizer should preferably contain 1.5 to 6 mol % of yttrium oxide, or more preferably 2 to 4 mol % of yttrium oxide, and furthermore should preferably contain 0.1 to 5 mol % of aluminum oxide.

The crystalline phase may be a mixed phase of a cubic system and a monoclinic system, a mixed phase of a tetragonal system and a monoclinic system, a mixed phase of a cubic system, a tetragonal system, and a monoclinic system, or the like. The main crystalline phase which is a tetragonal system or a mixed phase of a tetragonal system and a cubic system is optimum from the standpoints of strength, tenacity, and durability.

If the substrate 12 is made of ceramics, then the substrate 12 is made up of a relatively large number of crystalline particles. For increasing the mechanical strength of the substrate 12, the crystalline particles should preferably have an average particle diameter ranging from 0.05 to 2 μm, or more preferably from 0.1 to 1 μm.

Each time the electric field receiving member 14, the cathode electrode 16, or the anode electrode 20 is formed, the assembly is heated (sintered) into a structure integral with the substrate 12. After the electric field receiving member 14, the cathode electrode 16, and the anode electrode 20 are formed, they may simultaneously be sintered so that they may simultaneously be integrally coupled to the substrate 12. Depending on the process by which the cathode electrode 16 and the anode electrode 20 are formed, they may not be heated (sintered) so as to be integrally combined with the substrate 12.

The sintering process for integrally combining the substrate 12, the electric field receiving member 14, the cathode electrode 16, and the anode electrode 20 may be carried out at a temperature ranging from 500 to 1400° c., preferably from 1000 to 1400° C. For heating the electric field receiving member 14 which is in the form of a film, the electric field receiving member 14 should be sintered together with its evaporation source while their atmosphere is being controlled.

The electric field receiving member 14 may be covered with an appropriate member for concealing the surface thereof against direct exposure to the sintering atmosphere when the electric field receiving member 14 is sintered. The covering member should preferably be made of the same material as the substrate 12.

Various modifications of the cathode electrode 16 and the anode electrode 20 will be described below with reference to FIGS. 2 through 10B.

Figure 2:
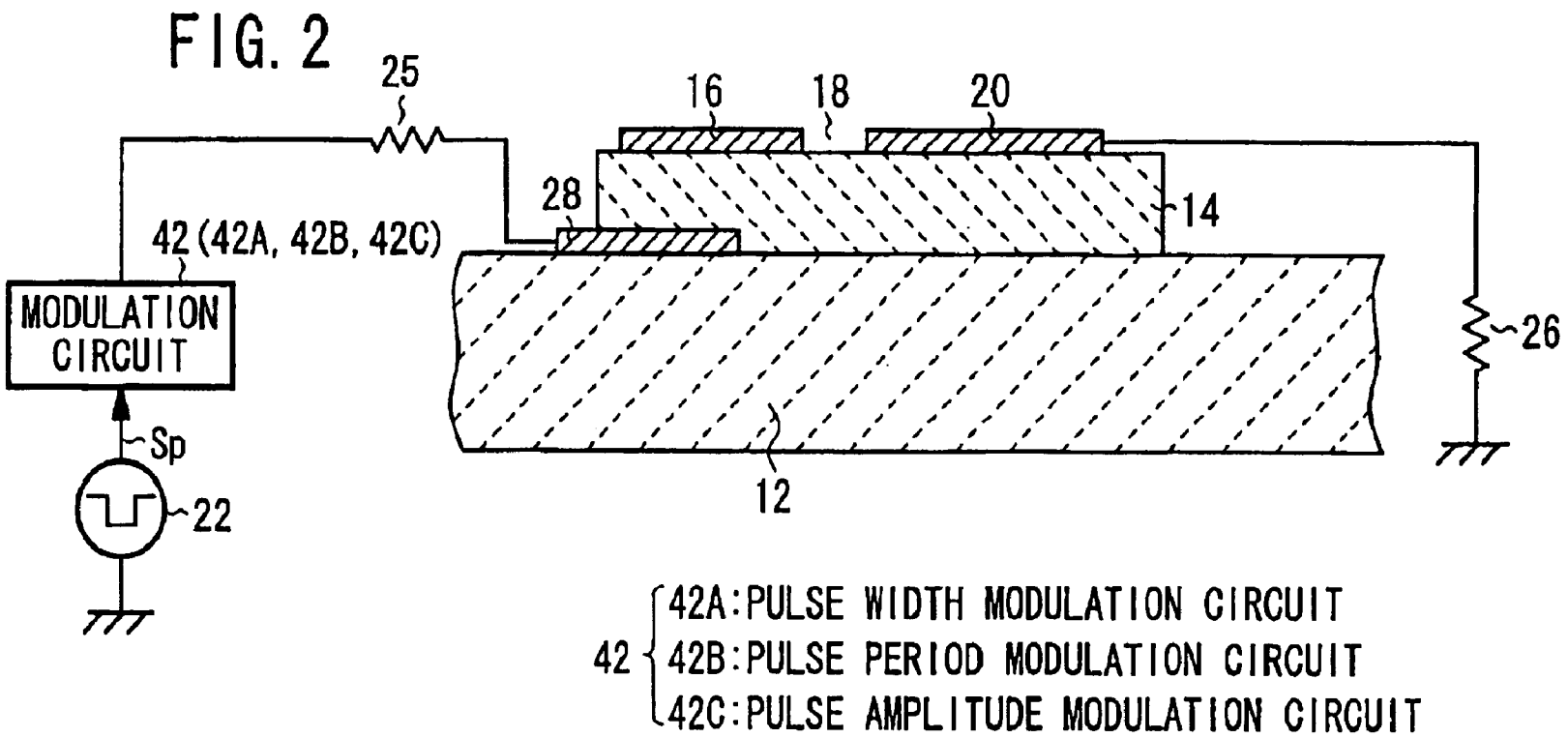
FIG. 2 is a view showing an electrode pattern according to a first modification.

As shown in FIG. 2, a first modification has an extraction electrode 28 formed on the other surface of the electric field receiving member 14 facing the cathode electrode 16. Since the cathode electrode 16, the extraction electrode 28, and part of the electric field receiving member 14 which is positioned therebetween act as a capacitor, no capacitor is required to be connected between the cathode electrode 16 and the pulse generation source 22. The extraction electrode 28 is formed of the same material by the same process as the cathode electrode 16 and the anode electrode 20. The extraction electrode 28 has a thickness of 20 μm or less, or more preferably 5 μm or less.

Figure 3A:
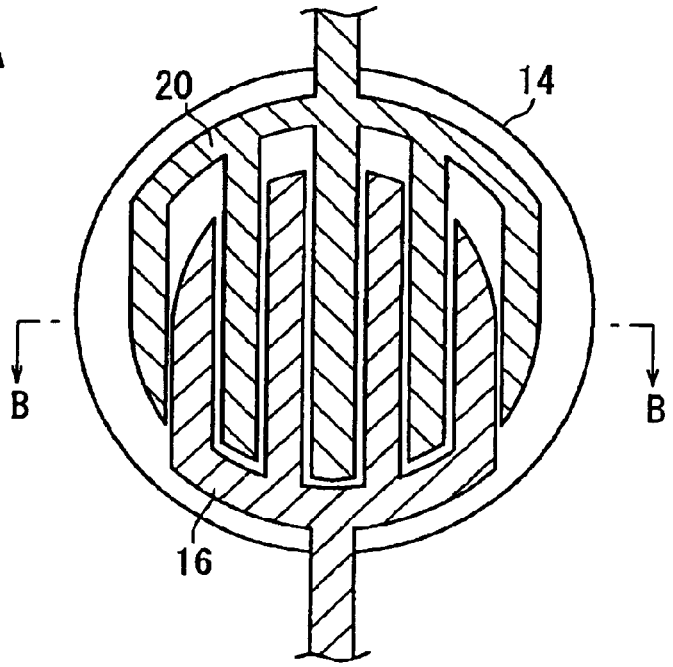
FIG. 3A is a plan view showing an electrode pattern according to a second modification.
Figure 3B:
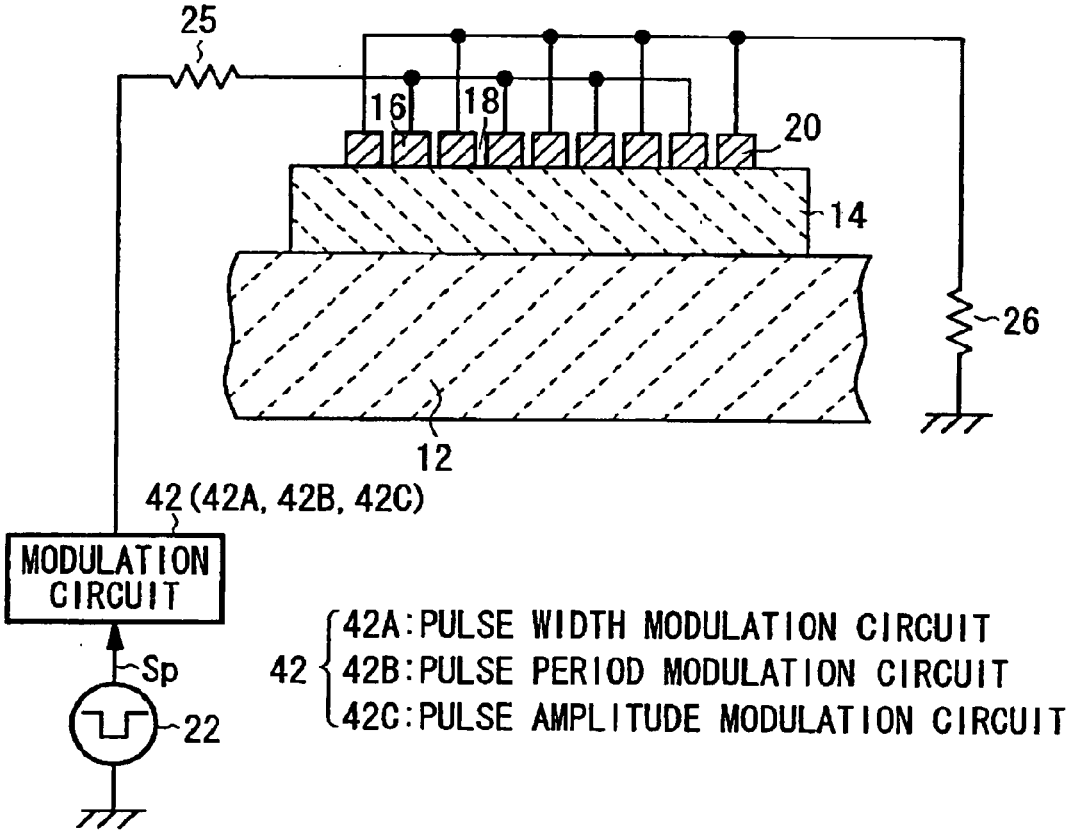
FIG. 3B is a cross-sectional view taken along line B-B of FIG. 3A.

According to a second modification, as shown in FIGS. 3A and 3B, each of the cathode electrode 16 and the anode electrode 20 has a comb-toothed shape. With this structure, electrons can easily be discharged from around the cathode electrode 16.

Figure 4:
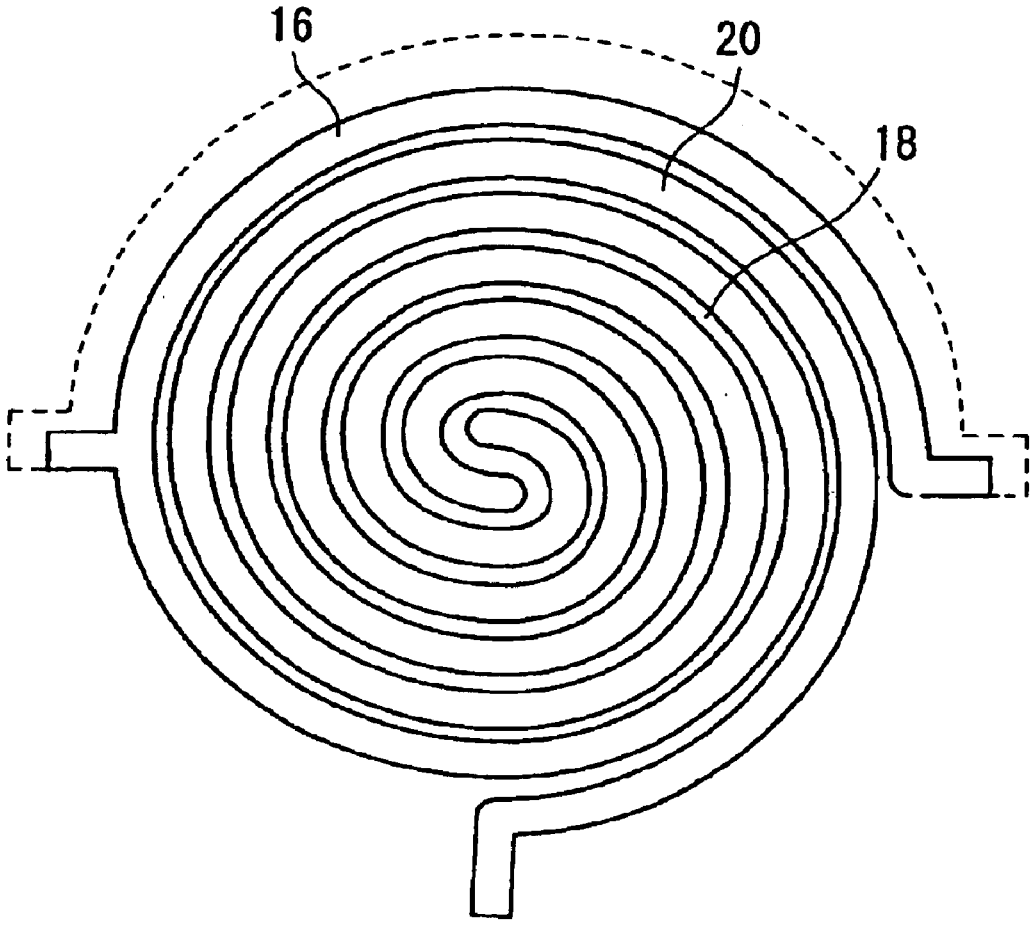
FIG. 4 is a view showing an electrode pattern according to a third modification.

According to a third modification, as shown in FIG. 4, the cathode electrode 16 and the anode electrode 20 extend parallel to each other, and have respective spiral shapes having several turns spaced from each other.

Figure 5:
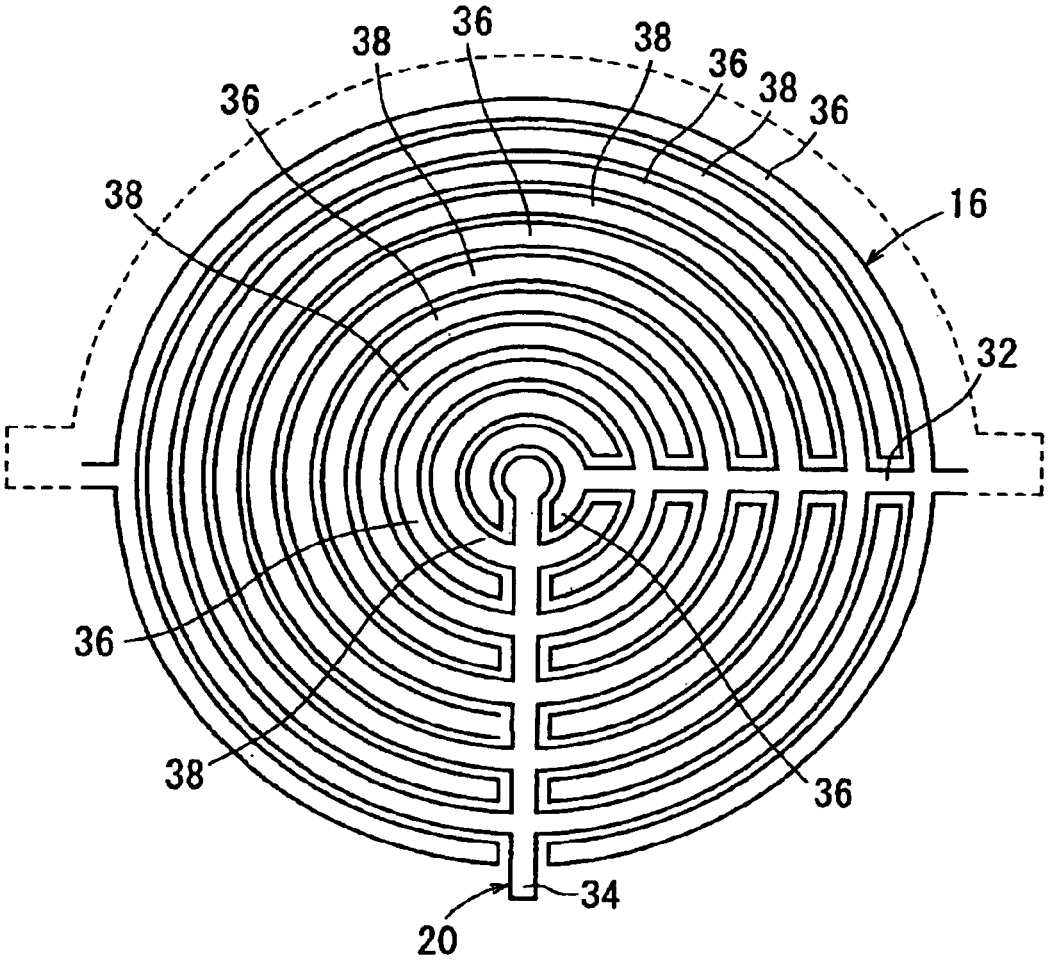
FIG. 5 is a view showing an electrode pattern according to a fourth modification.

According to a fourth modification, as shown in FIG. 5, the cathode electrode 16 and the anode electrode 20 have respective stems 32, 34 extending toward the center and respective numbers of branches 36, 38 branched from the stems 32, 34. The cathode electrode 16 and the anode electrode 20 are spaced from each other and shaped complementarily to each other.

Figure 6:
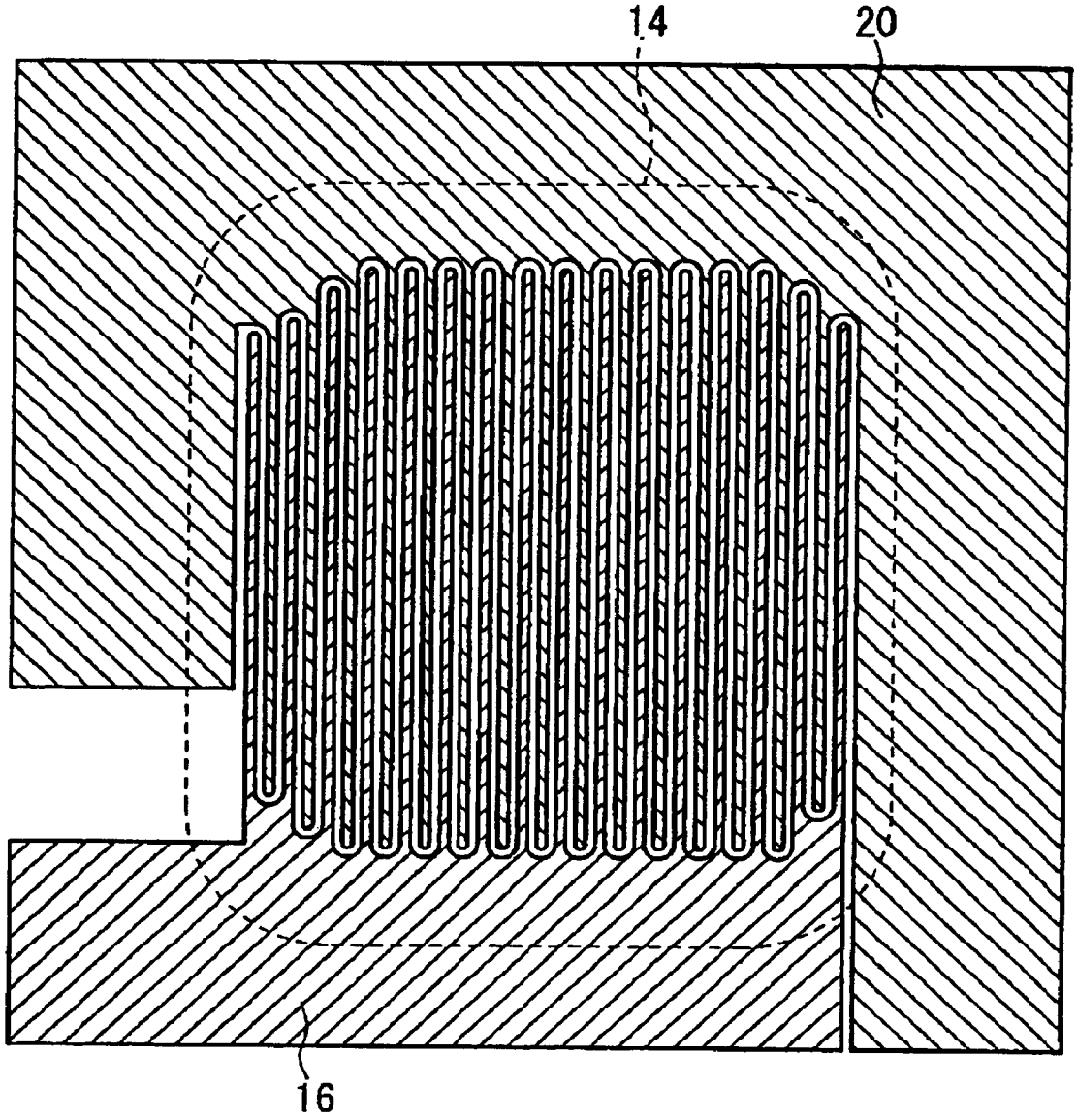
FIG. 6 is a view showing an electrode pattern according to a fifth modification.

According to a fifth modification, as shown in FIG. 6, the cathode electrode 16 and the anode electrode 20 have a comb-toothed shape and are shaped complementarily facing each other.

Figure 7A:
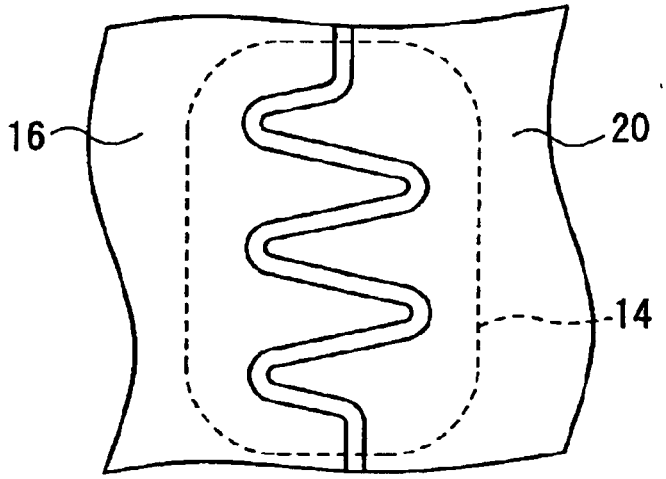
FIGS. 7A and 7B are plan views showing electrode patterns according to a sixth modification.
Figure 7B:
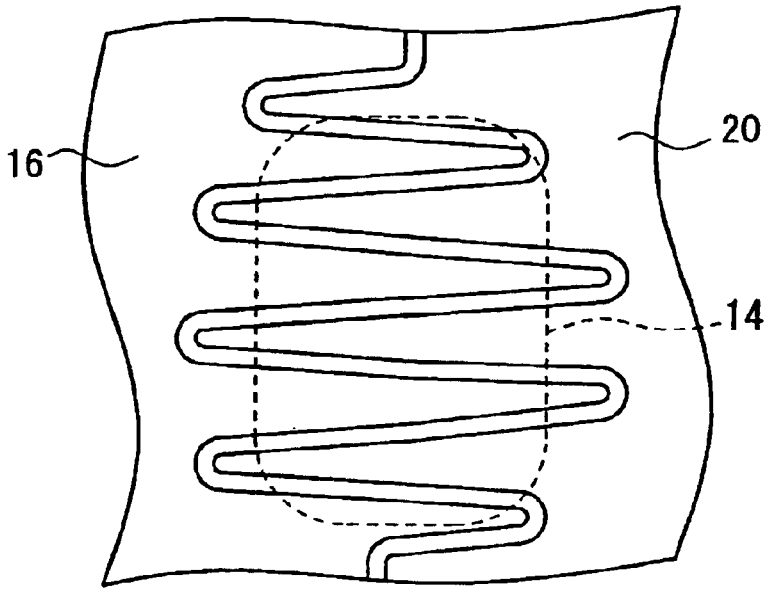
Figure 8A:
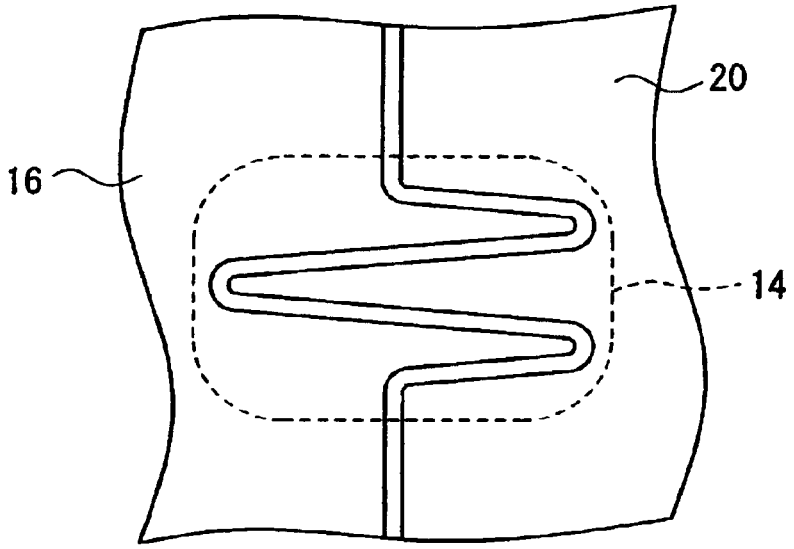
FIGS. 8A and 8B are plan views showing electrode patterns according to a seventh modification.
Figure 8B:
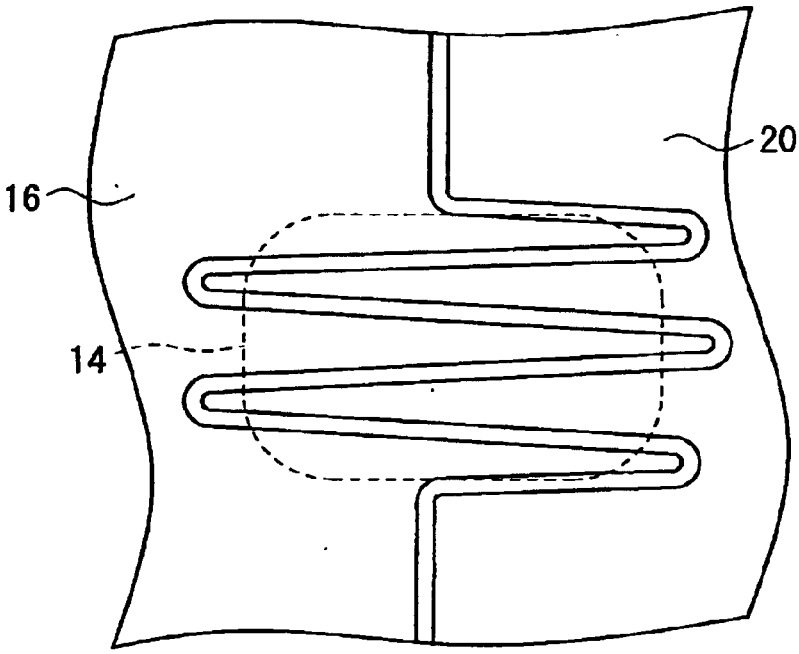

If the electric field receiving member 14 has an elliptical planar shape and both the cathode electrode 16 and the anode electrode 20 have a comb-toothed shape, then according to a sixth embodiment shown in FIGS. 7A and 7B, the cathode electrode 16 and the anode electrode 20 may have comb teeth arranged along the major axis of the electric field receiving member 14, or according to a seventh embodiment shown in FIGS. 8A and 8B, the cathode electrode 16 and the anode electrode 20 may have comb teeth arranged along the minor axis of the electric field receiving member 14.

According to the third through seventh modifications, as with the second modification, electrons can easily be discharged from around the cathode electrode 16.

As shown in FIG. 1, the electron emitter 10A according to the first embodiment has a modulation circuit 42 for modulating a pulse signal Sp to be applied between the cathode electrode 16 and the anode electrode 20 based on a control signal Sc supplied from a controller 40 such as a CPU, thereby to control at least the amount of emitted electrons.

Figure 9A:
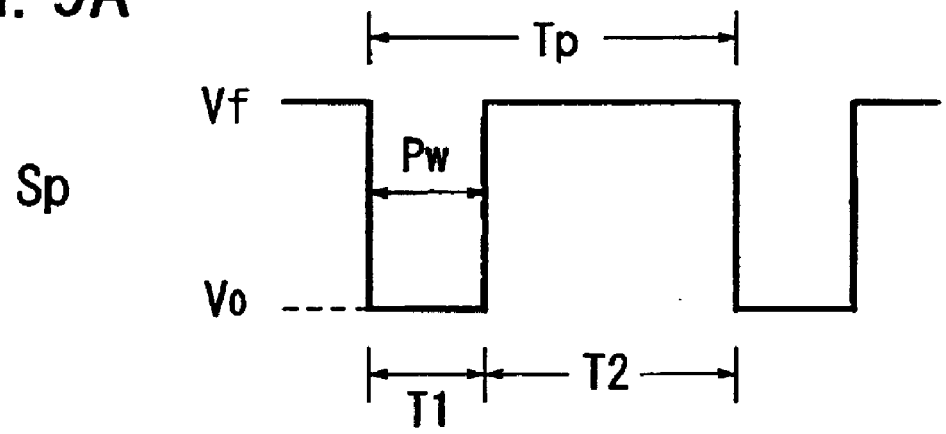
FIG. 9A is a waveform diagram showing a pulse signal applied between a cathode electrode and an anode electrode.

Specific examples of the modulation circuit 42 will be described below with reference to FIGS. 9A through 22B. As shown in FIG. 1, a first specific example of the modulation circuit 42 comprises a pulse width modulation circuit 42A connected between the pulse generation source 22 and the cathode electrode 16. As shown in FIG. 9A, the pulse signal Sp applied from the pulse generation source 22 between the cathode electrode 16 and the anode electrode 20 has an amplitude from the voltage Vf (hereinafter referred to as off voltage Vf) of a voltage level (off voltage level) applied to the anode electrode 20 to the voltage Vo (hereinafter referred to as on voltage Vo) of a voltage level (on voltage level) at which electrons are emitted around the cathode electrode 16, and also has a constant pulse period Tp.

The pulse signal Sp has repeated steps each including a period in which the on voltage Vo is outputted (electron emission period T1) and a period in which the off voltage Vf is outputted (preparatory period T2). Therefore, the pulse signal Sp comprises a rectangular pulse which has the on voltage Vo in the electron emission period T1 and the off voltage Vf in the preparatory period T2. The electron emission period T1 should preferably be in the range from 1 to 1000 $\mu$sec.

The principles of electron emission of the electron emitter 10A shown in FIG. 1 will be described below with reference to FIGS. 9A through 20E. In the description given below, the level of the off voltage Vf is a positive voltage level and the level of the on voltage Vo is a negative voltage level. For detecting an emission of electrons from the electron emitter 10A, a collector electrode 50 which comprises a transparent electrode, for example, is disposed above the electric field receiving member 14 at a position facing the slit 18 defined between the cathode electrode 16 and the anode electrode 20, and the surface of the collector electrode 50 which faces the slit 18 is coated with a fluorescent layer 106. In FIGS. 10A through 10C, a current flowing in the cathode electrode 16 is represented by Ik, a current flowing in the anode electrode 20 by Ia, and a current flowing in the collector electrode 50 by Ic. In FIGS. 10B and 10C, the collector electrode 50 and the fluorescent layer 106 are omitted from illustration.

The preparatory period T2 shown in FIG. 9A is a period in which the off voltage Vf is applied to the cathode electrode 16 to polarize the electric field receiving member 14. In this period, since the cathode electrode 16 is positively charged and the anode electrode 20 is negatively charged, dipole moments 17 in the surface of the electric field receiving member 14 are arrayed with their negative poles oriented toward the cathode electrode 16 and their positive poles oriented toward the anode electrode 20. The off voltage Vf may be a DC voltage, as shown in FIG. 9, but may be a single pulse voltage or a succession of pulse voltages.

The off voltage Vf and the on voltage Vo should preferably be of voltage levels for reliably polarizing the electric field receiving member 14 into positive and negative poles. For example, if the dielectric material of the electric field receiving member 14 has a coercive voltage, then the absolute values of the off voltage Vf and the on voltage Vo should preferably be higher than the coercive voltage.

The electron emission period T1 is a period in which the on voltage Vo is applied to the cathode electrode 16. When the voltage Vo is applied to the cathode electrode 16, as shown in FIG. 10B, the cathode electrode 16 quickly becomes negative and the anode electrode 20 quickly becomes positive, producing an electric field directed from the anode electrode 20 toward the cathode electrode 16. The electric field thus produced changes the direction of the dipole moments 17 of the electric field receiving member 14, so that the polarization of the electric field receiving member 14 is quickly inverted.

As shown in FIG. 10C, those dipole moments 17 which are charged in the interface between the electric field receiving member 14 whose polarization has been inverted and the cathode electrode 16 to which the negative voltage Vo is applied extract electrons when the direction of those dipole moments 17 is changed. The extracted electrons are considered to include primary electrons emitted from the cathode electrode 16 and secondary electrons emitted from the electric field receiving member 14 upon collision of primary electrons with the electric field receiving member 14, in a local concentrated electric field developed between the cathode electrode 16 and the positive poles of the dipole moments 17 near the cathode electrode 16.

Some of the emitted secondary electrons are guided to the collector electrode 50 (see FIG. 10A) and excite the fluorescent layer applied to the collector electrode 50, producing outward fluorescent light emission. The other emitted secondary electrons are attracted to the anode electrode 20.

Figure 11:
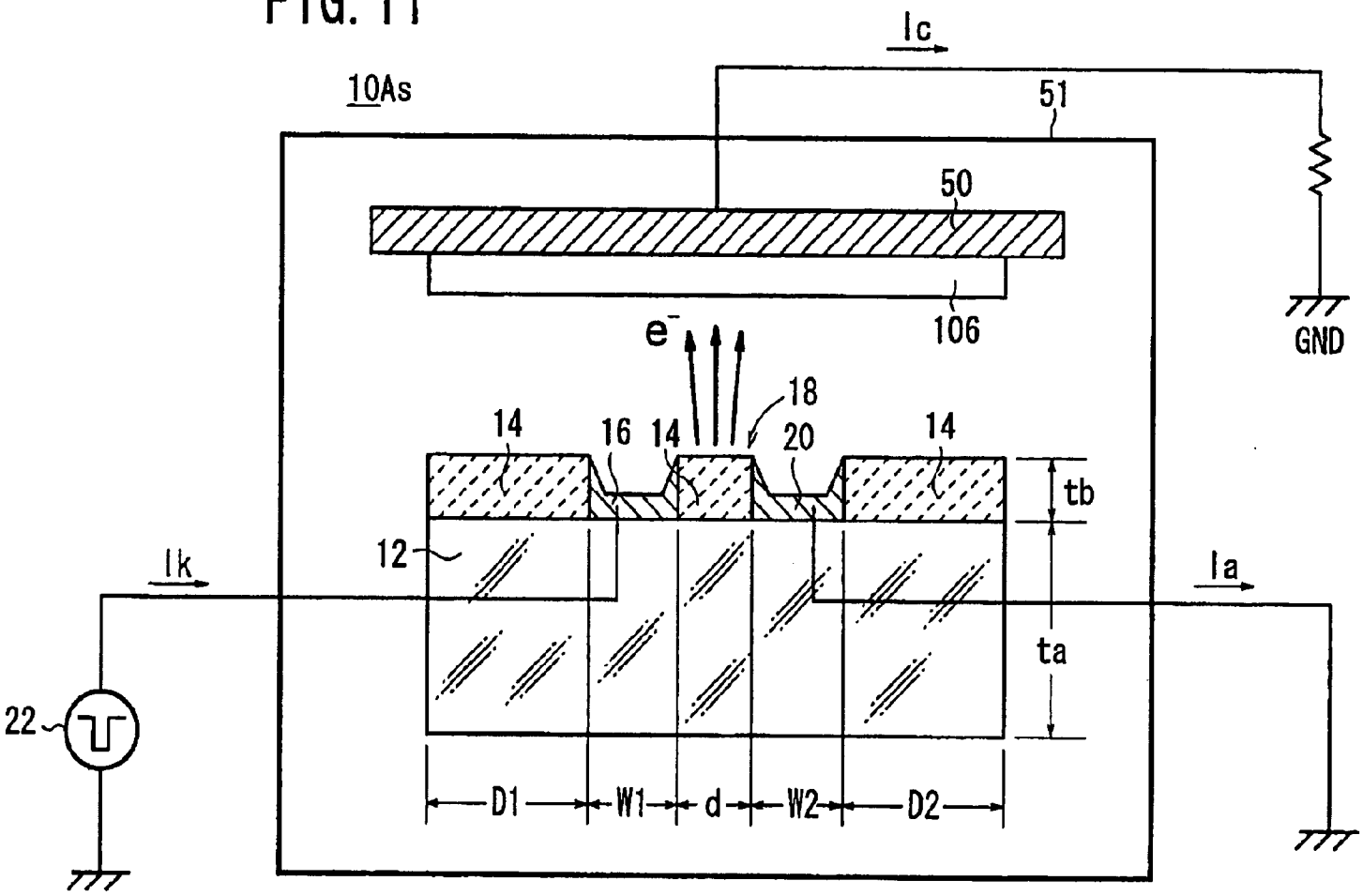
FIG. 11 is a view showing a sample used in a first experiment.
Figures 12A, 12B, 12C, 12D, 12E:
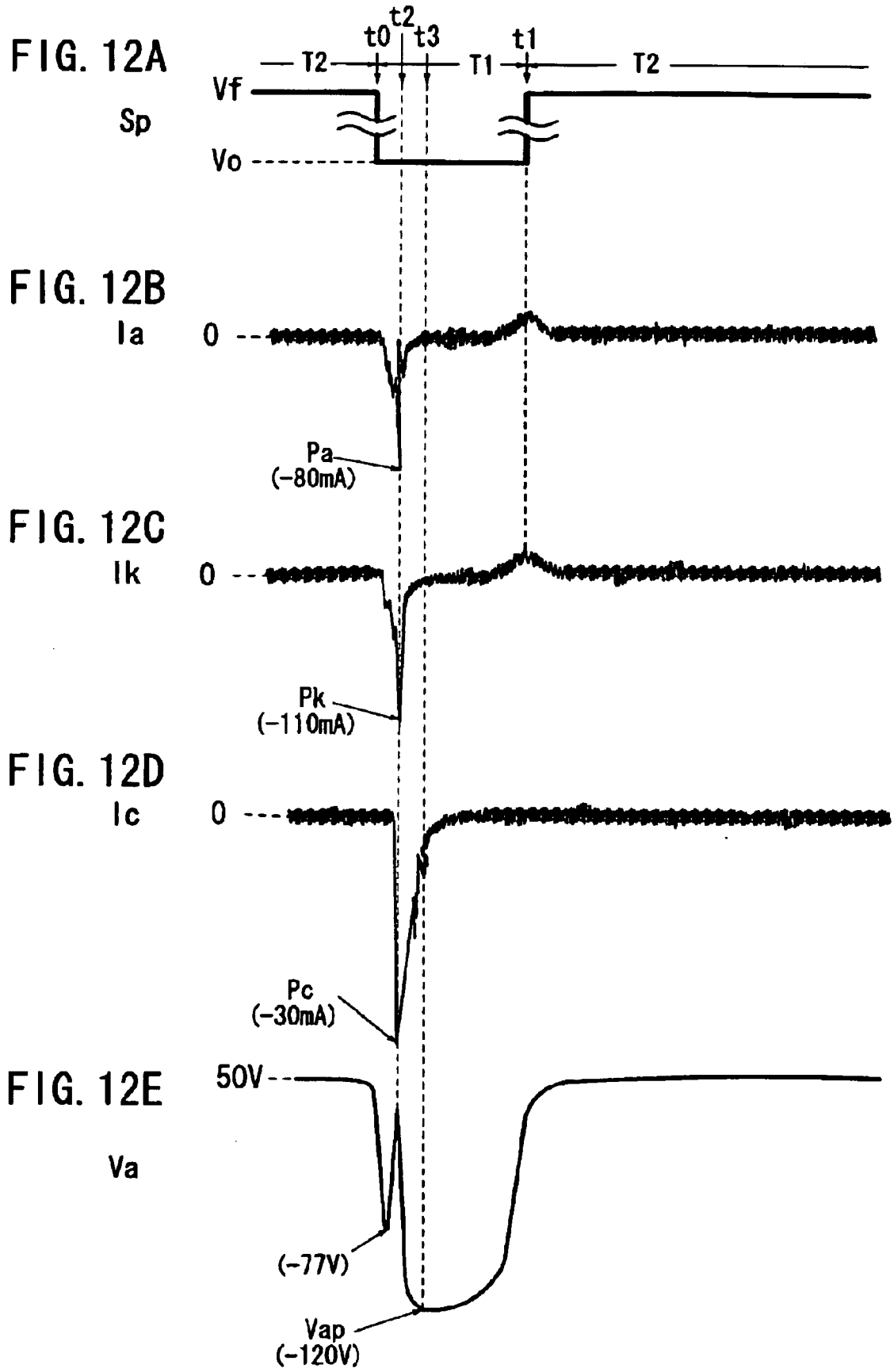
FIG. 12A is a waveform diagram showing a pulse signal.
FIG. 12B is a waveform diagram showing a current flowing from an anode electrode to GND.
FIG. 12C is a waveform diagram showing a current flowing from a pulse generation source to a cathode electrode.
FIG. 12D is a waveform diagram showing a current flowing from a collector electrode to GND.
FIG. 12E is a waveform diagram showing a voltage applied between the cathode electrode and the anode electrode.

An experimental example (first experimental example) with respect to electron emission will be described below. In the first experimental example, as shown in FIG. 11, a single electron emitter is placed as a sample 10As in a vacuum chamber 51 (the vacuum level=$4\times10^{-3}$ Pa), and, when a pulse signal Sp shown in FIG. 12 is supplied to the cathode electrode 16, the waveforms of currents Ia, Ik, Ic flowing in respective part of the electron emitter and the waveform of a voltage (applied voltage Va) applied between the cathode electrode 16 and the anode electrode 20 are measured. The measured waveforms are shown in FIGS. 12B through 12E.

In the sample 10As, as shown in FIG. 11, the electric field receiving member 14 made of a dielectric material is disposed on the substrate 12, and the cathode electrode 16 and the anode electrode 20 are embedded in respective windows defined in the electric field receiving member 14, the cathode electrode 16 and the anode electrode 20 having respective thicknesses smaller than the electric field receiving member 14. The cathode electrode 16 and the anode electrode 20 is held in contact with side walls of the electric field receiving member 14 that are present in at least the slit 18.

In the sample 10As, since the cathode electrode 16 and the anode electrode 20 can be made of a reduced amount of metal, they may be made of a precious metal (e.g., platinum or gold) for increased characteristics.

The sample 10As is dimensioned as follows: The substrate 12 has a thickness ta of 140 $\mu$m. The electric field receiving member 14 has a thickness tb of 40 $\mu$m. The cathode electrode 16 has a width W1 of 40 $\mu$m. The anode electrode 20 has a width W2 of 40 $\mu$m. The slit 18 has a width d of 30 $\mu$m. The end of the cathode electrode 16 (which is opposite to the end thereof in the slit 18) is spaced from a near side end of the electric field receiving member 14 by a distance D1 of 40 $\mu$m. The end of the anode electrode 20 (which is opposite to the end thereof in the slit 18) is spaced from a near side end of the electric field receiving member 14 by a distance D2 of 40 $\mu$m.

Both the cathode electrode 16 and the anode electrode 20 are made of gold (Au), and the electric field receiving member 14 is made of PZT.

As shown in FIG. 12A, the pulse signal Sp has a positive voltage Vf of 50 V in the preparatory period T2. The pulse signal Sp changes from the preparatory period T2 to the electron emission period T1 at a time t0. The pulse signal Sp has a negative voltage Vo of −120 V in the electron emission period T1. The pulse signal Sp changes to the preparatory period T2 at a time t1.

FIG. 12B shows the measured waveform of the current Ia flowing from the anode electrode 20 to GND. The current Ia has a peak Pa at a time t2 which is about 1 μsec. later than the time t0 of the negative-going edge of the pulse signal Sp. The peak Pa has a value of about −80 mA.

FIG. 12C shows the measured waveform of the current Ik flowing into the cathode electrode 16. The current Ik has a peak Pk from the pulse generation source 22 at the time t2 which is about 1 μsec. later than the time t0 as with the current Ia. The peak Pk has a value of about −110 mA.

FIG. 12D shows the measured waveform of the current Ic flowing from the collector electrode 50 to GND. The current Ic has a peak Pc at a time t2 which is about 1 μsec. later than the time t0 as with the currents Ia, Ik. The peak Pc has a value of about −30 mA.

FIG. 12E shows the measured waveform of the voltage Va applied between the cathode electrode 16 and the anode electrode 20. The voltage Va has a peak Vap at a time t3 which is about 2 μsec. later than the time t0 of the negative-going edge of the pulse signal Sp. The peak Vap has a value of about −120 V.

In the first experimental example, the applied voltage Va has a large value of about 170 V for the purpose of reliably emitting electrons. According to the measured waveforms, electrons are emitted at the time t2 which is about 1 μsec. prior to the time t3 when the peak Vap of the applied voltage Va occurs, and the voltage Va has a value Vs of about −77 V at the time t2. The electron emission efficiency (Ic/Ik) at this time is 27%.

This indicates that the level of the applied voltage Va which is actually required to emit electrons is not required to be as high as 170 V, but is 127 V to emit electrons, and that the applied voltage Va can be lowered to emit electrons.

The applied voltage Va may be lowered by optimizing the electron emitter 10A itself and also optimizing drive circuits including various modulation circuits. The embodiments that are disclosed in the present specification are aimed at optimization of drive circuits based on the present experimental example.

Figure 13:
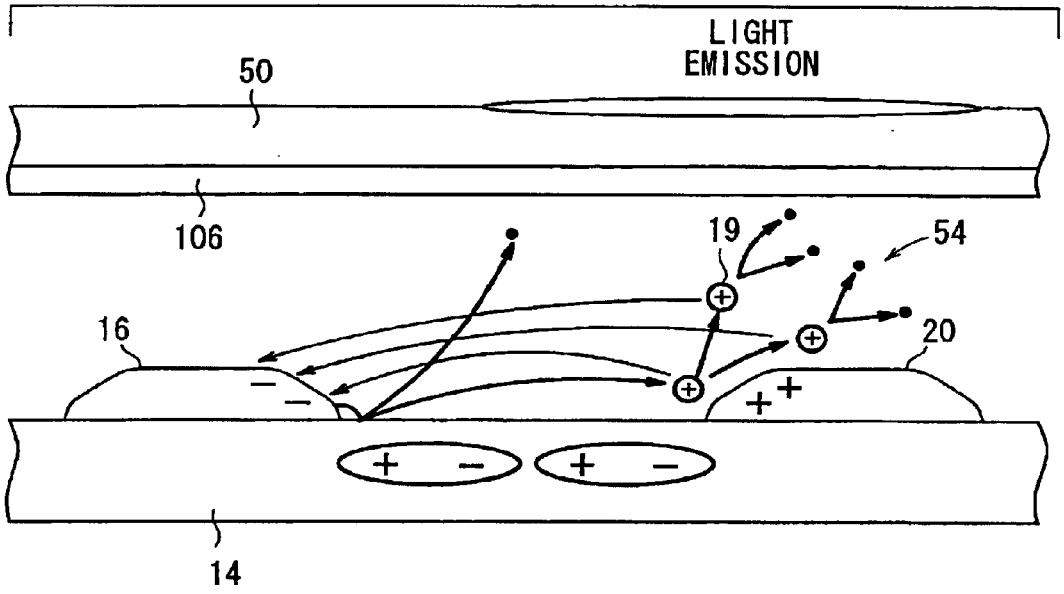
FIG. 13 is a view illustrative of an ionization of atoms, which are floating near the anode electrode due to evaporation of the electrode, based on secondary electrons, increasing the amount of electrons.

As shown in FIG. 13, electrons attracted to the anode electrode 20 impinge upon the electric field receiving member 14, which emits secondary electrons serving as a trigger. Some of the secondary electrons are guided to the collector electrode 50 and excite the fluorescent layer 106 thereon, and the other emitted secondary electrons are attracted to the anode electrode 20. The secondary electrons attracted to the anode electrode 20 ionize a gas present primarily in the vicinity of the anode electrode 20 or atoms floating in the vicinity of the anode electrode 20 due to evaporation of the electrode, producing positive ions 19 and electrons. Since the electrons produced by the ionization also ionize the gas or the electrode atoms, electrons are increased exponentially to generate a local plasma 54 in which the electrons and the positive ions 19 are neutrally present. As a result, as shown in FIG. 13, the area of the surface of the collector electrode 50 (transparent electrode) which is close to the anode electrode 20 emits excessive light, making it difficult to adjust luminance.

The voltage occurring between the cathode electrode 16 and the anode electrode 20 at the time the electrons are emitted is greatly reduced as the above ionization progresses, causing a nearly short-circuited state between the cathode electrode 16 and the anode electrode 20. At this time, the positive ions 19 produced by the ionization impinges upon the cathode electrode 16, for example, possibly damaging the cathode electrode 16.

Figure 14:
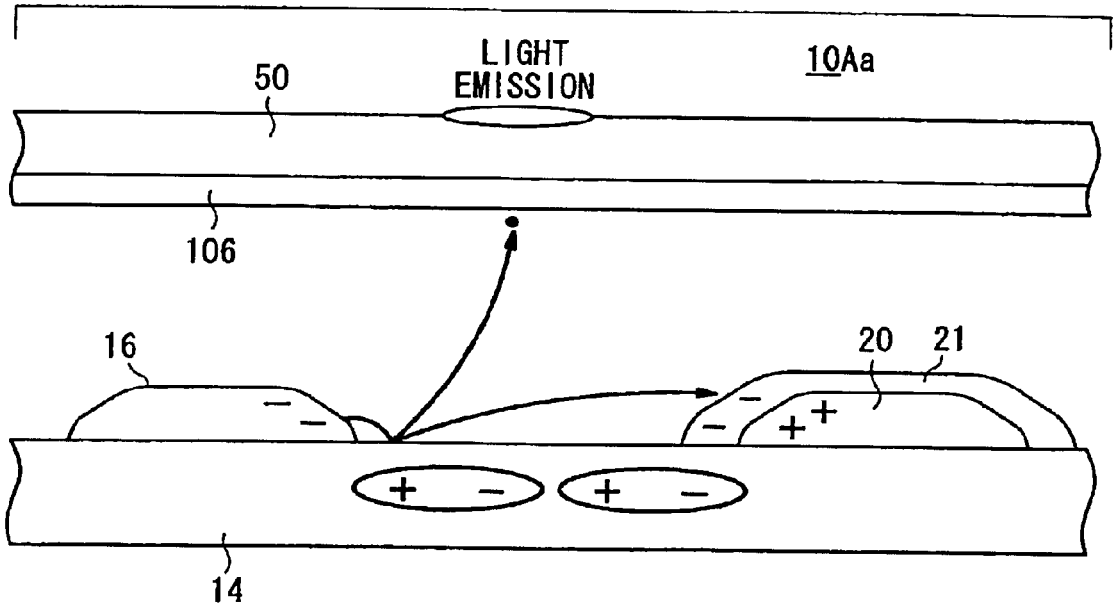
FIG. 14 is a view showing an electron emitter according to a first modification.

Therefore, it is preferable for an electron emitter 10Aa according to a first modification shown in FIG. 14 to have a charged film 21 on the surface of the anode electrode 20. When some of the emitted secondary electrons are attracted to the anode electrode 20, the surface of the charged film 21 is negatively charged. Thus, the anode electrode 20 becomes less positive, reducing the intensity E of the electric field between the anode electrode 20 and the cathode electrode 16 thereby to stop the ionization instantaneously.

That is, the voltage between the cathode electrode 16 and the anode electrode 20 at the time the electrons are emitted remains substantially unchanged. Consequently, almost no positive ions are generated, thus preventing the cathode electrode 16 from being damaged by positive ions. This arrangement is thus effective to increase the service life of the electron emitter 10A.

As a result, as shown in FIG. 14, the area of the surface of the collector electrode 50 (transparent electrode) which lies between the cathode electrode 16 and the anode electrode 20 emits light based on secondary electrons (trigger), making it easy to adjust luminance.

Figure 15:
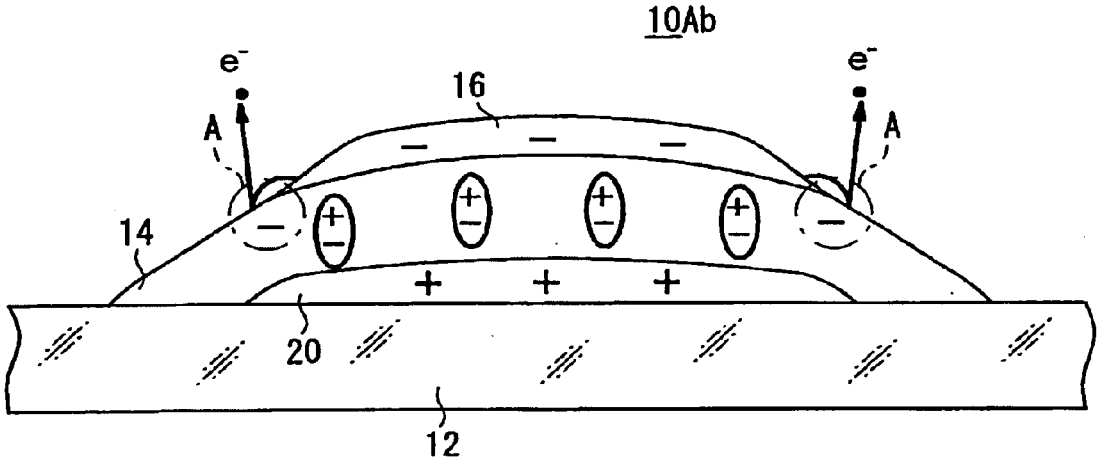
FIG. 15 is a view showing an electron emitter according to a second modification.

FIG. 15 shows an electron emitter 10Ab according to a second modification. In the electron emitter 10Ab, the anode electrode 20 is formed on the substrate 12, the electric field receiving member 14 on the substrate 12 facing the anode electrode 20, and the cathode electrode 16 on the electric field receiving member 14.

The principles behind an emission of electrons from the electron emitter 10Ab according to the second modification will be described below with reference to FIGS. 9A, 16 through 20E.

Figure 16:
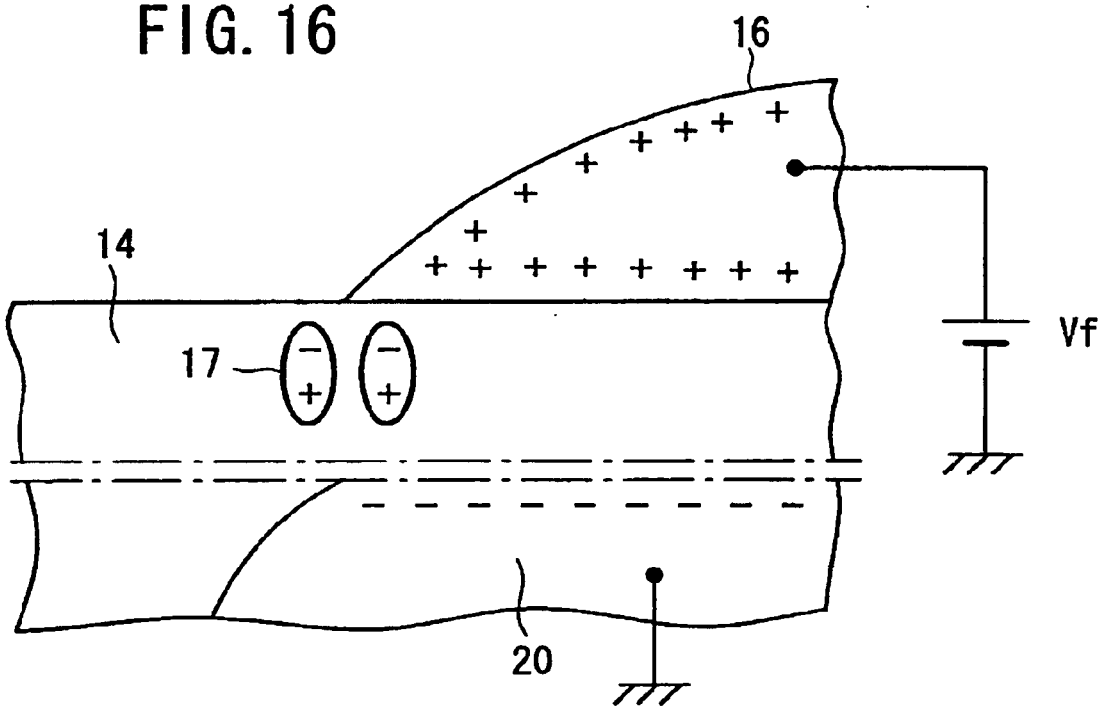
FIG. 16 is a view illustrative of operation when an off voltage is applied to a cathode electrode of the electron emitter according to the second modification.

When the positive off voltage Vf is applied to the cathode electrode 16 in the preparatory period T2 shown in FIG. 9A, the electric field receiving member 14 is polarized in one direction as shown in FIG. 16.

Figure 17:
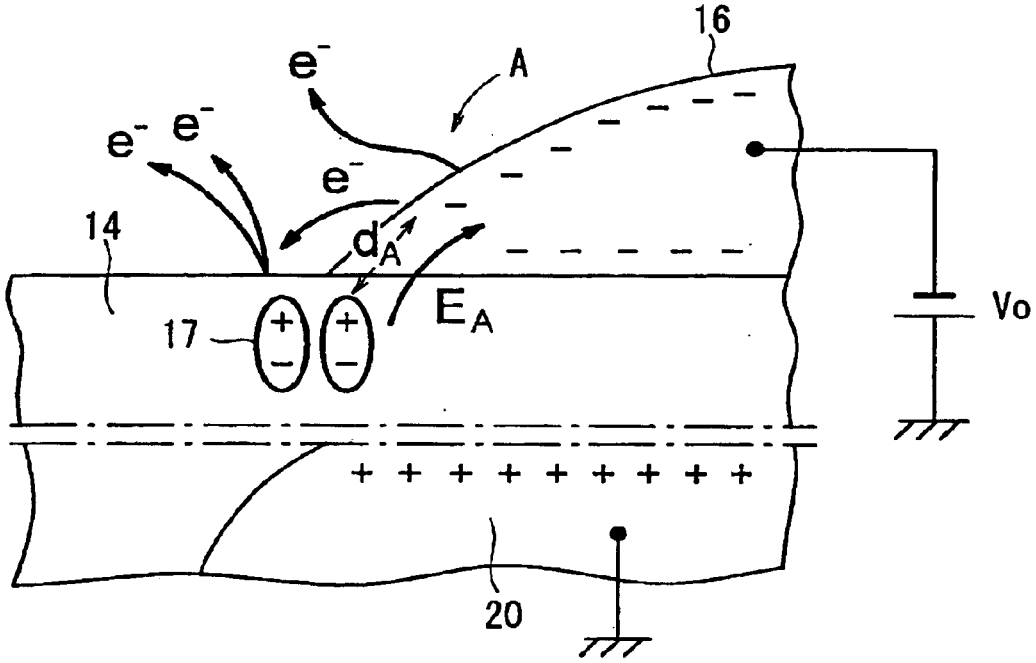
FIG. 17 is a view illustrative of an electron emission when an on voltage is applied to the cathode electrode of the electron emitter according to the second modification.

When the negative on voltage Vo is applied to the cathode electrode 16 in the next electron emission period T1, as shown in FIG. 17, electrons are emitted from the electric field concentration point A, for example. Specifically, those dipole moments 17 which are charged closely to the cathode electrode 16 in the electric field receiving member 14 whose polarization has been inverted extract emitted electrons.

Specifically, a local cathode is formed in the cathode electrode 16 in the vicinity of the interface between the cathode electrode 16 and the electric field receiving member 14, and positive poles of the dipole moments 17 charged in the area of the electric field receiving member 14 close to the cathode electrode 16 serve as a local anode which extracts electrons from the cathode electrode 16. Some of the extracted electrons impinge upon the electric field receiving member 14, causing the electric field receiving member 14 to emit secondary electrons as a trigger. The secondary electrons are guided to the collector electrode 50 to excite the fluorescent layer 106.

The intensity $E_A$ of the electric field at the electric field concentration point A satisfies the equation $E_A = Vak/d_A$ where Vak represents the voltage applied between the cathode electrode 16 and the anode electrode 20 and $d_A$ represents the distance between the local anode and the local cathode. Because the distance $d_A$ between the local anode and the local cathode is very small, it is possible to easily obtain the intensity $E_A$ of the electric field which is required to emit electrons (the large intensity $E_A$ of the electric field is indicated by the solid-line arrow in FIG. 17). This ability to easily obtain the intensity $E_A$ of the electric field leads to a reduction in the voltage Vak.

As the electron emission from the cathode electrode 16 progresses, floating atoms of the electric field receiving member 14 which are evaporated due to the Joule heat are ionized into positive ions and electrons by the emitted secondary electrons, and those electrons further ionize atoms of the electric field receiving member 14. Therefore, electrons are increased exponentially to generate a local plasma in which the electrons and the positive ions are neutrally present. The positive ions generated by the ionization may impinge upon the cathode electrode 16, possibly damaging the cathode electrode 16.

Figure 18:
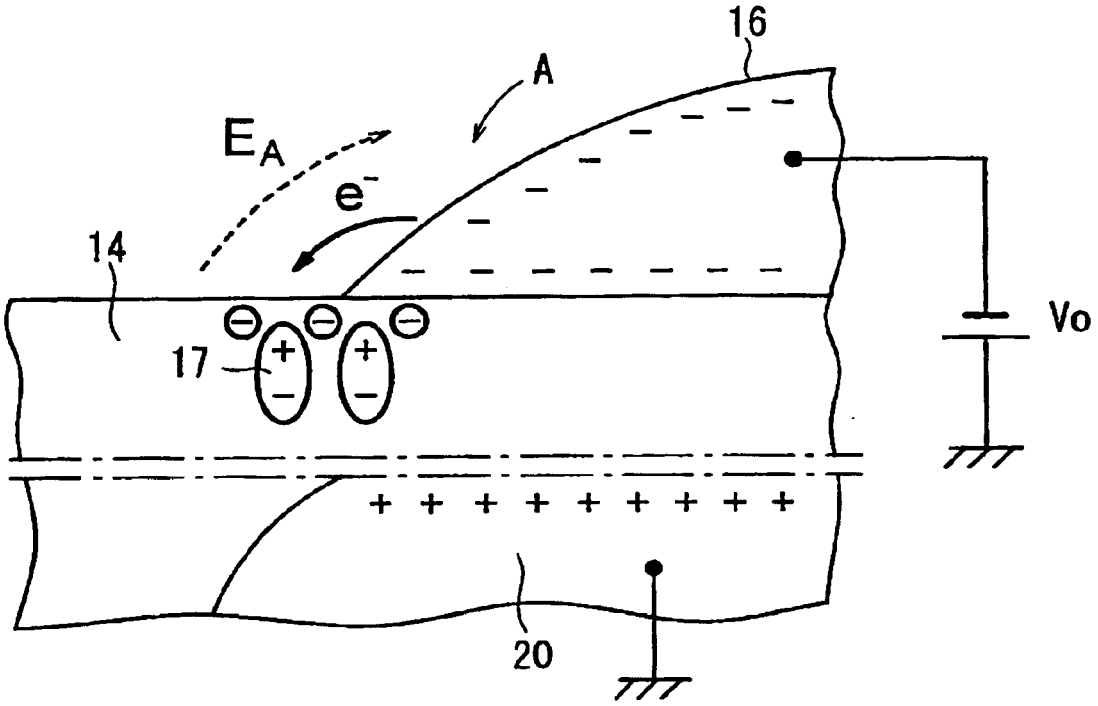
FIG. 18 is a view illustrative of a self-inactivation of an electron emission due to a negative charge on the surface of an electric field receiving member.

With the electron emitter 10Ab, as shown in FIG. 18, the electrons emitted from the cathode electrode 16 are attracted to the positive poles, which are present as the local anode, of the dipole elements 17 in the electric field receiving member 14, negatively charging the surface of the electric field receiving member 14 close to the cathode electrode 16. As a result, the factor for accelerating the electrons (the local potential difference) is lessened, and any potential for emitting secondary electrons is eliminated, further progressively negatively charging the surface of the electric field receiving member 14.

Therefore, the positive nature of the local anode provided by the dipole moments 17 is weakened, and the intensity $E_A$ of the electric field between the local anode and the local cathode is reduced (the small intensity $E_A$ of the electric field is indicated by the broken-line arrow in FIG. 18). Thus, the electron emission is self-inactivated.

Consequently, almost no positive ions are generated, and the cathode electrode 16 is prevented from being damaged by positive ions, making it effective to increase the service life of the electron emitter 10Ab. Even if positive ions are slightly generated and directed toward the cathode electrode 16, since an insulating layer 112 is formed on the surface of the cathode electrode 16, the positive ions are prevented from impinging upon the cathode electrode 16.

Figure 19:
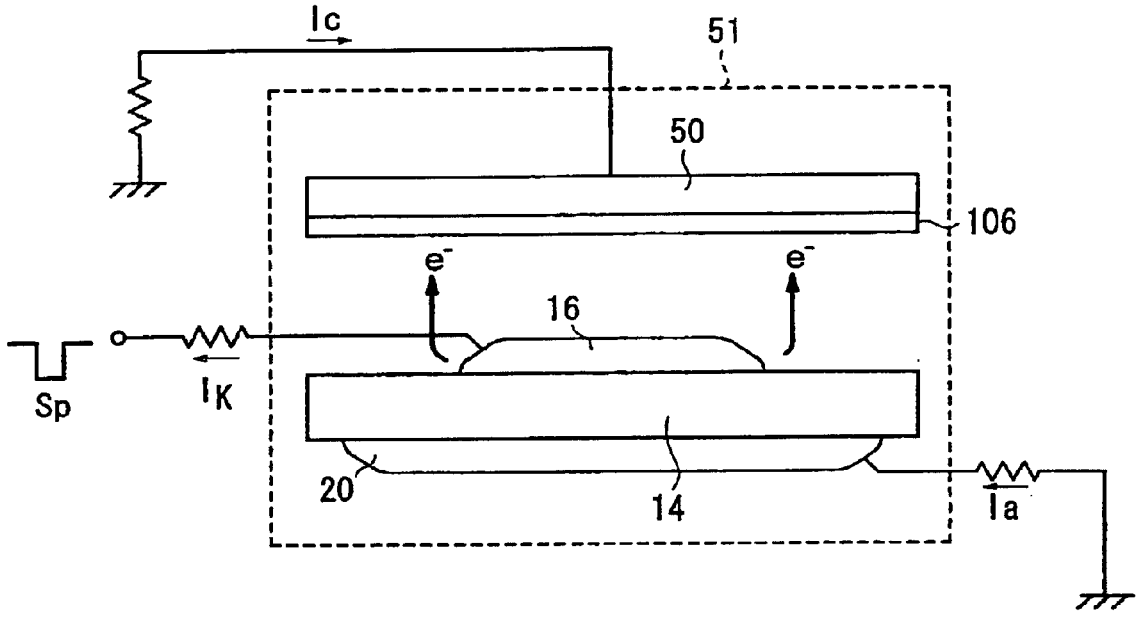
FIG. 19 is a view showing a sample used in a second experiment.
Figure 20A:
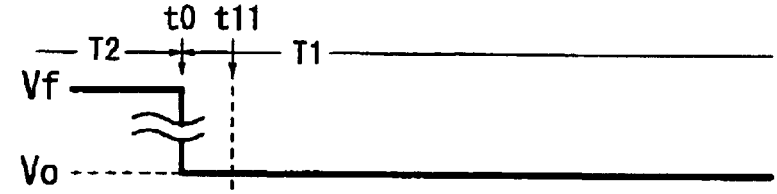
FIG. 20A is a waveform diagram showing a pulse signal.
Figure 20B:
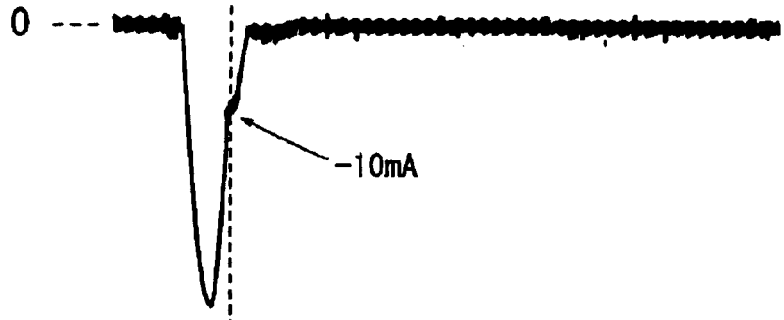
FIG. 20B is a waveform diagram showing an anode current.
Figure 20C:
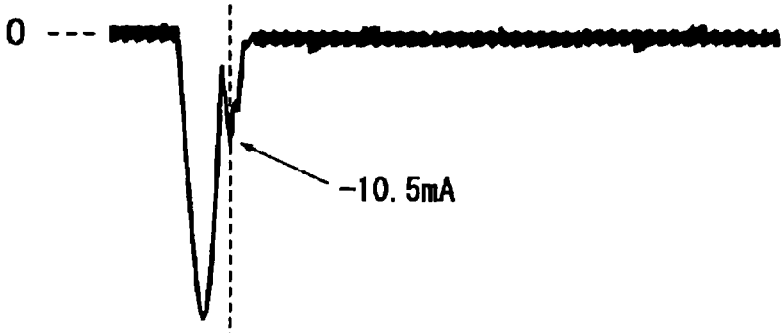
FIG. 20C is a waveform diagram showing a cathode current.
Figure 20D:
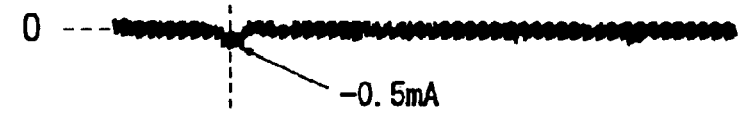
FIG. 20D is a waveform diagram showing a collector current.

An experimental example (second experimental example) will be described below. In the second experimental example, as shown in FIG. 19, a single electro emitter is placed as a sample 10At in a vacuum chamber 51 (the vacuum level=$4\times10^{-3}$ Pa), and, when a pulse signal Sp shown in FIG. 20A is supplied to the cathode electrode 16, the waveforms of currents Ia, Ik, Ic flowing in respective parts of the electron emitter and the waveform of a voltage (applied voltage vak) applied between the cathode electrode 16 and the anode electrode 20 are measured. The measured waveforms are shown in FIGS. 20B through 20E.

In the sample 10At, as shown in FIG. 19, the cathode electrode 16 is formed on an upper surface (facing the collector electrode 50) of a plate (the electric field receiving member 14) made of a piezoelectric material, and the anode electrode 20 is formed on a lower surface of the electric field receiving member 14.

As shown in FIG. 20A, the pulse signal Sp has a positive voltage Vf of 50 V in the preparatory period T2. The pulse signal Sp changes to the electron emission period T1 at a time t0. The pulse signal Sp has a negative voltage Vo of −100 V in the electron emission period T1

Electrons are emitted at a time t11 which is about 5 μsec later than the time t0 of the negative-going edge of the pulse signal Sp. When the electrons are emitted, the anode current Ia has a value (peak) of about −10 mA (see FIG. 20B), the cathode current Ik has a value (peak) of about −10.5 mA (see FIG. 20C), and the collector current Ic has a value (peak) of about −0.5 mA (see FIG. 20D).

Figure 20E:
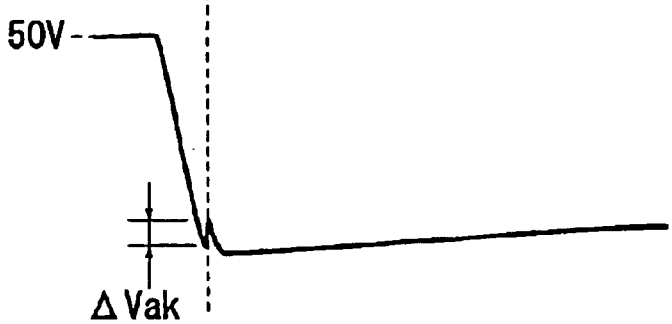
FIG. 20E is a waveform diagram showing a voltage applied between the cathode electrode and the anode electrode.

As shown in FIG. 20E, a voltage change ΔVak between the cathode electrode 16 and the anode electrode 20 at the time t11 when the electrons are emitted is so small that the voltage Vak remains substantially unchanged. Consequently, almost no positive ions are generated, thus preventing the cathode electrode 16 from being damaged by positive ions. This arrangement is thus effective to increase the service life of the electron emitter 10A.

Figure 9B:
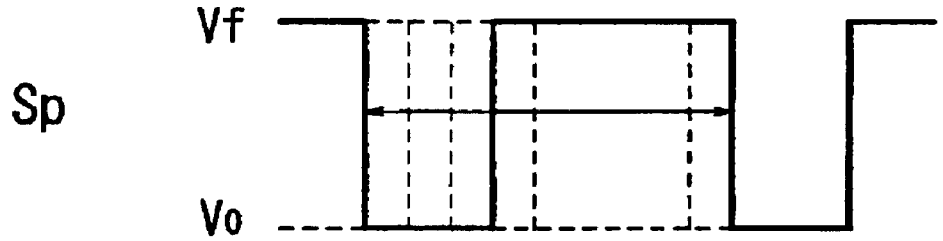
FIG. 9B is a waveform diagram illustrative of pulse width modulation on the pulse signal.
Figure 10A:
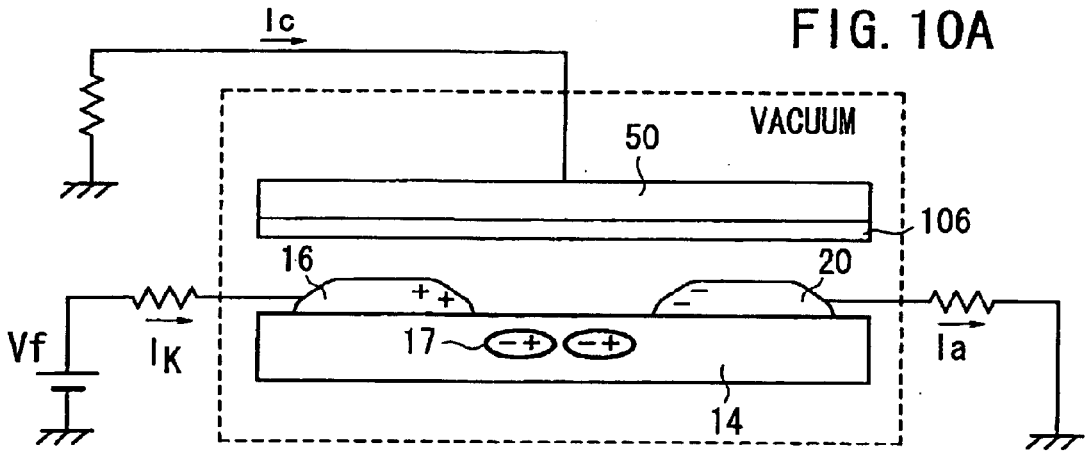
FIG. 10A is a view illustrative of operation when an off voltage is applied to the cathode electrode.
Figure 10B:
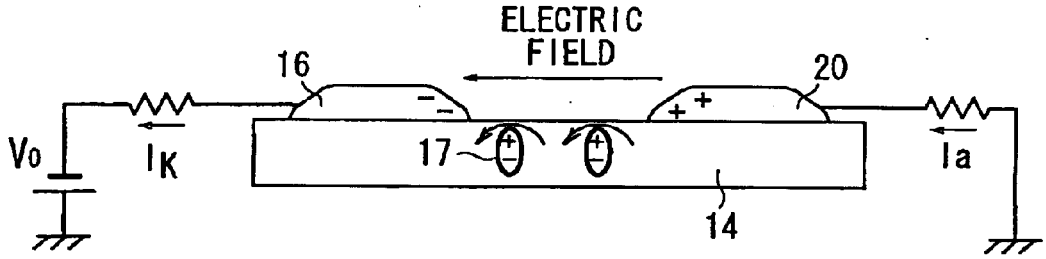
FIG. 10B is a view illustrative of a quick polarization inversion of an electric field receiving member when an on voltage is applied to the cathode electrode.
Figure 10C:
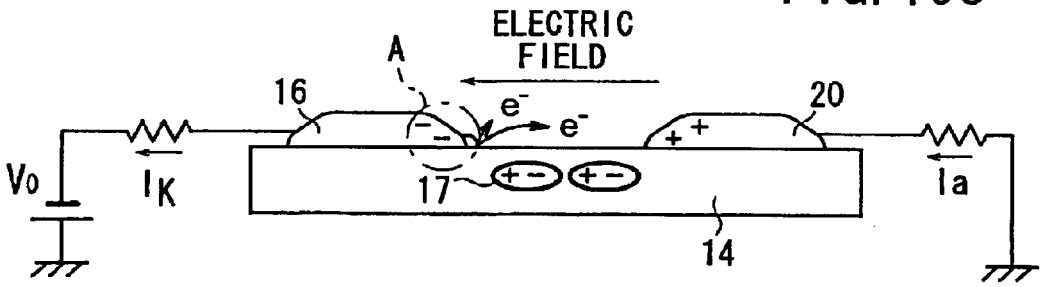
FIG. 10C is a view illustrative of an emission of electrons.

As shown in FIG. 9B, the pulse width modulation circuit 42A modulates the pulse width Pw (the time in which the on voltage Vo continues) of the pulse signal Sp based on the control signal Sc supplied from the controller 40, thereby controlling at least the amount of emitted electrons.

In this manner, the amount of electrons emitted from around the cathode electrode 16 can be controlled in an analog fashion. The electron emitter 10A as it is applied to a display or the like is thus capable of controlling finely divided gradations.

Figure 21A:
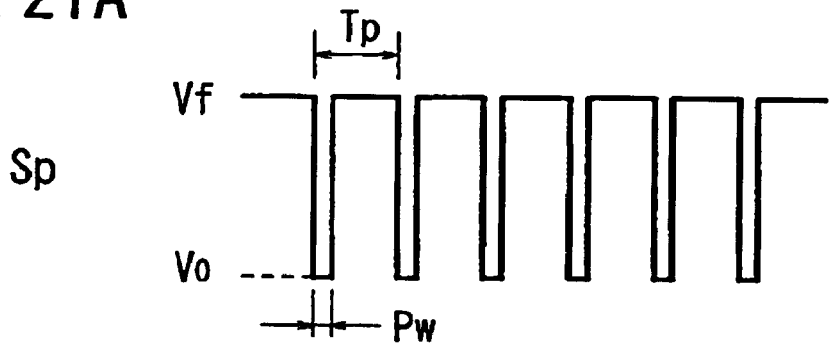
FIG. 21A is a waveform diagram showing a pulse signal applied between the cathode electrode and the anode electrode.

As shown in FIG. 1, a second specific example of the modulation circuit 42 comprises a pulse period modulation circuit 42B connected between the pulse generation source 22 and the cathode electrode 16. As shown in FIG. 21A, the pulse signal Sp applied between the cathode electrode 16 and the anode electrode 20 has an amplitude from the off voltage Vf to the on voltage Vo and a constant pulse period Tp and a constant pulse width Pw.

Figure 21B:
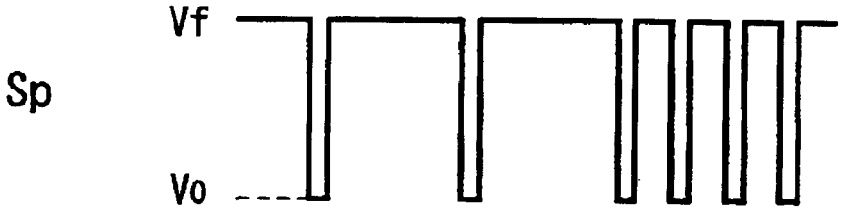
FIG. 21B is a waveform diagram illustrative of pulse period modulation on the pulse signal.

As shown in FIG. 21B, the pulse period modulation circuit 42B modulates the pulse period Tp of the pulse signal Sp based on the control signal Sc supplied from the controller 40, thereby controlling at least the amount of emitted electrons.

Figure 22A:
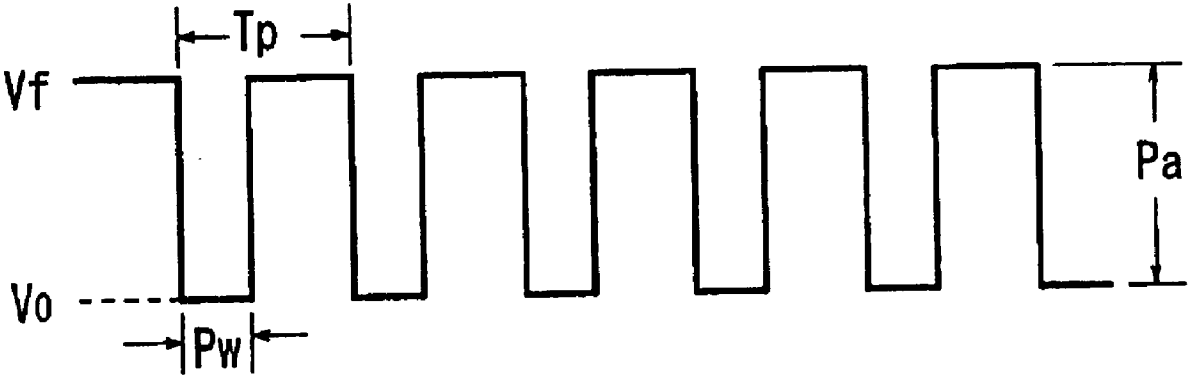
FIG. 22A is a waveform diagram showing a pulse signal applied between the cathode electrode and the anode electrode.

As shown in FIG. 1, a third specific example of the modulation circuit 42 comprises a pulse amplitude modulation circuit 42C connected between the pulse generation source 22 and the cathode electrode 16. As shown in FIG. 22A, the pulse signal Sp between the cathode electrode 16 and the anode electrode 20 has an amplitude Pa from the off voltage Vf to the on voltage Vo and a constant pulse period Tp and a constant pulse width Pw.

Figure 22B:
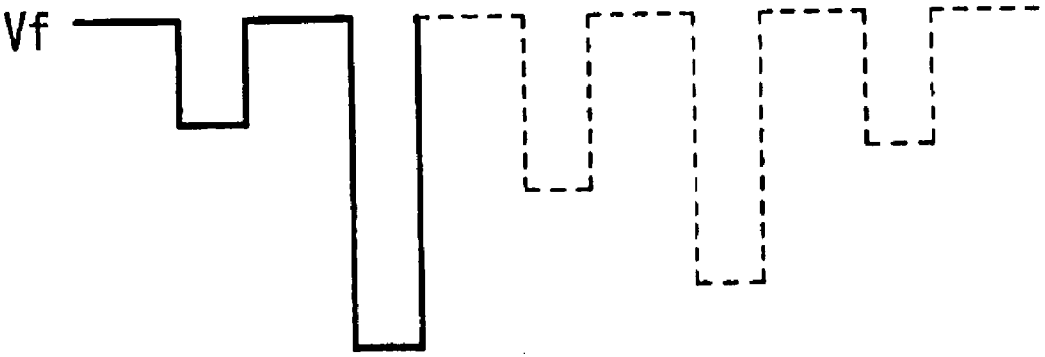
FIG. 22B is a waveform diagram illustrative of pulse amplitude modulation on the pulse signal.

As shown in FIG. 22B, the pulse amplitude modulation circuit 42C modulates the pulse amplitude Pa of the pulse signal Sp based on the control signal Sc supplied from the controller 40, thereby controlling at least the amount of emitted electrons.

As the pulse amplitude Pa is reduced, the amount of emitted electrons per unit time is reduced, and, if the electron emitter is applied to a display, the luminance of light emission is lowered (darkened). As the pulse amplitude Pa is increased, the amount of emitted electrons per unit time is increased, and, if the electron emitter is applied to a display, the luminance of light emission is increased (brightened).

The modulation circuits according to the second and third specific examples (the pulse period modulation circuit 42B and the pulse amplitude modulation circuit 42C) can control the amount of electrons emitted from around the cathode electrode 16 in an analog fashion. The electron emitter 10A as it is applied to a display or the like is thus capable of controlling finely divided gradations.

Figure 23:
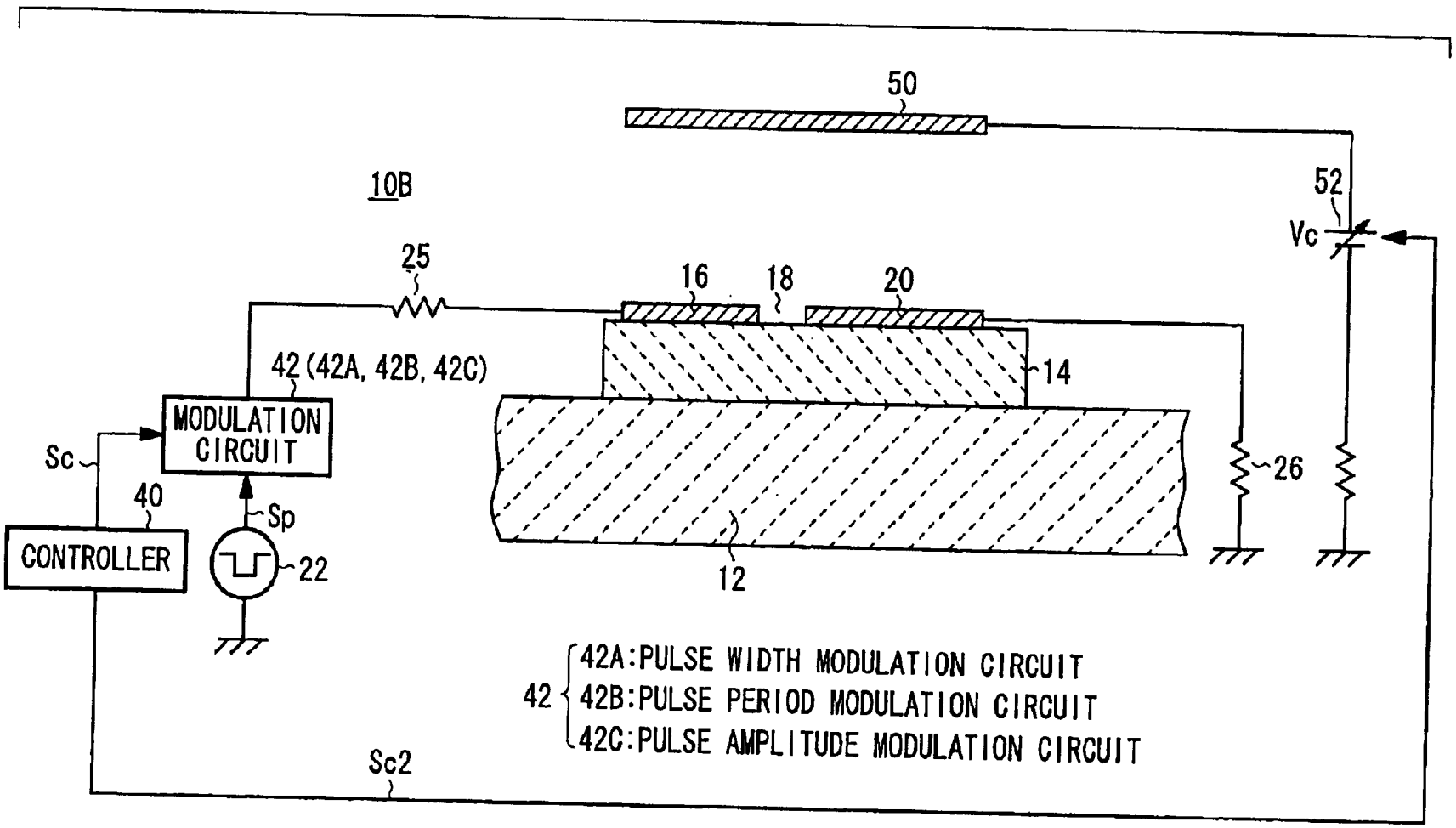
FIG. 23 is a view showing an electron emitter according to a second embodiment of the present invention.

An electron emitter 10B according to a second embodiment will be described below with reference to FIG. 23.

The electron emitter 10B according to the second embodiment has substantially the same structure as the electron emitter 10A according to the first embodiment, but differs therefrom in that the collector electrode 50 is disposed in a position above the electric field receiving member 14 which faces the slit 18 defined between the cathode electrode 16 and the anode electrode 20, and a variable voltage source 52 is connected between the collector electrode 50 and the anode electrode 20.

The variable voltage source 52 varies a bias voltage Vc applied between the collector electrode 50 and the anode electrode 20 based on a control signal Sc2 supplied from the controller 40.

For increasing the amount of electrons emitted from around the cathode electrode 16, the bias voltage Vc of the variable voltage source 52 has a large positive value.

The variable voltage source 52 can also be used as a switching circuit. Specifically, for emitting electrons, the bias voltage Vc which has a constant value is applied, and for preventing electrons from being emitted, the bias voltage Vc is set to a small value. In this case, the bias voltage Vc may has a small positive value, set to zero, or has a large positive value.

An electron emitter 10C according to a third embodiment will be described below with reference to FIG. 24.

The electron emitter 10C according to the third embodiment has substantially the same structure as the electron emitter 10A according to the first embodiment, but differs therefrom in that a control electrode 60 is disposed above the electric field receiving member 14 and below the collector electrode 50 (shown by the two-dot-and-dash lines in FIG. 24) in the electron emitter 10B according to the second embodiment, and a variable voltage source 62 is connected between the control electrode 60 and the anode electrode 20.

The control electrode 60 has a window 64 facing at least a central region of the slit 18 defined between the cathode electrode 16 and the anode electrode 20.

Figure 25A:
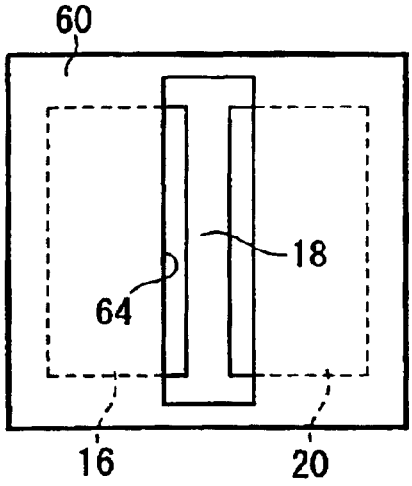
FIGS. 25A through 25D are plan views showing examples of shapes of control electrodes.
Figure 25B:
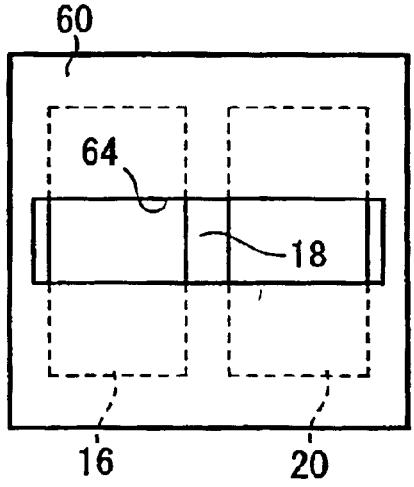
Figure 25C:
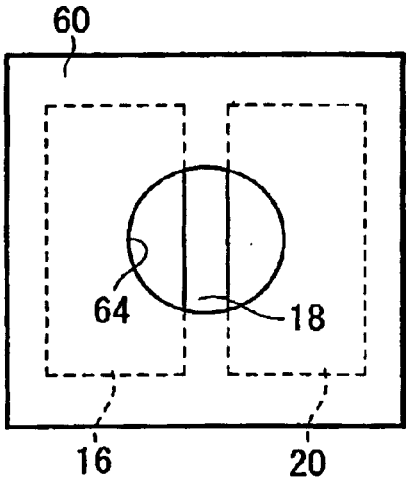
Figure 25D:
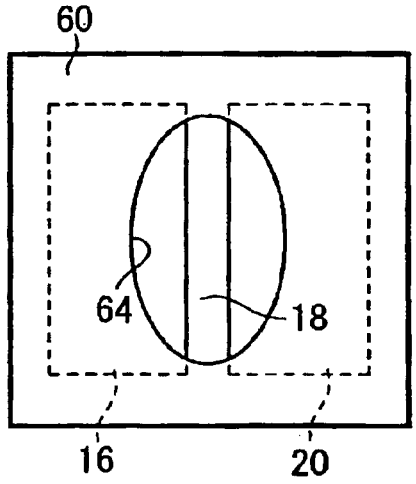

The window 64 may be in the shape of a slit extending along the longitudinal direction of the slit 18 as shown in FIG. 25A, or in the shape of a slit extending perpendicularly to the longitudinal direction of the slit 18 as shown in FIG. 25B, or in the shape of a circle as shown in FIG. 25C, or in the shape of an ellipse as shown in FIG. 25D.

Figure 24:
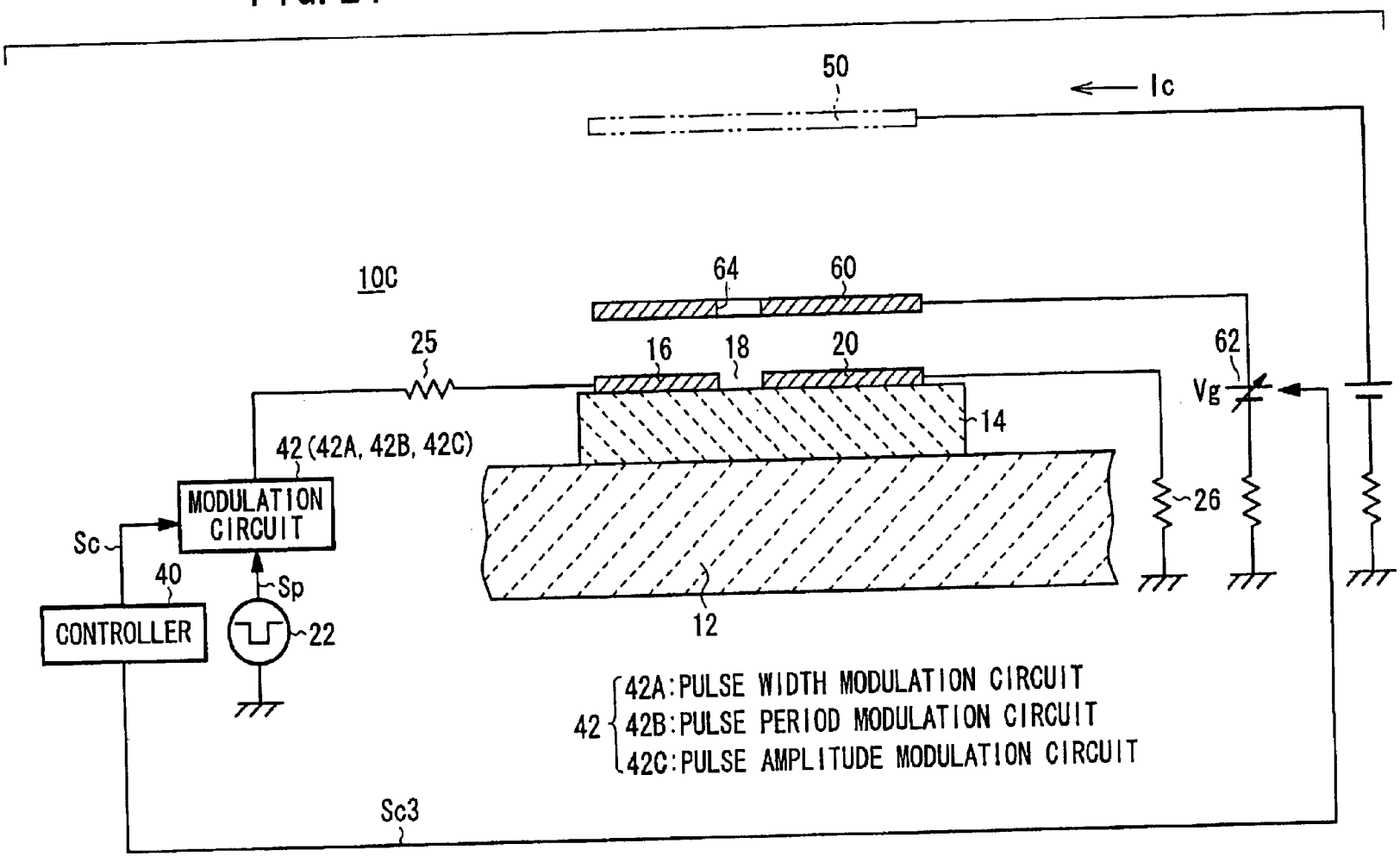
FIG. 24 is a view showing an electron emitter according to a third embodiment of the present invention.

As shown in FIG. 24, the variable voltage source 62 varies a control voltage Vg applied between the control electrode 60 and the anode electrode 20 based on a control signal supplied from the controller 40.

Figure 26:
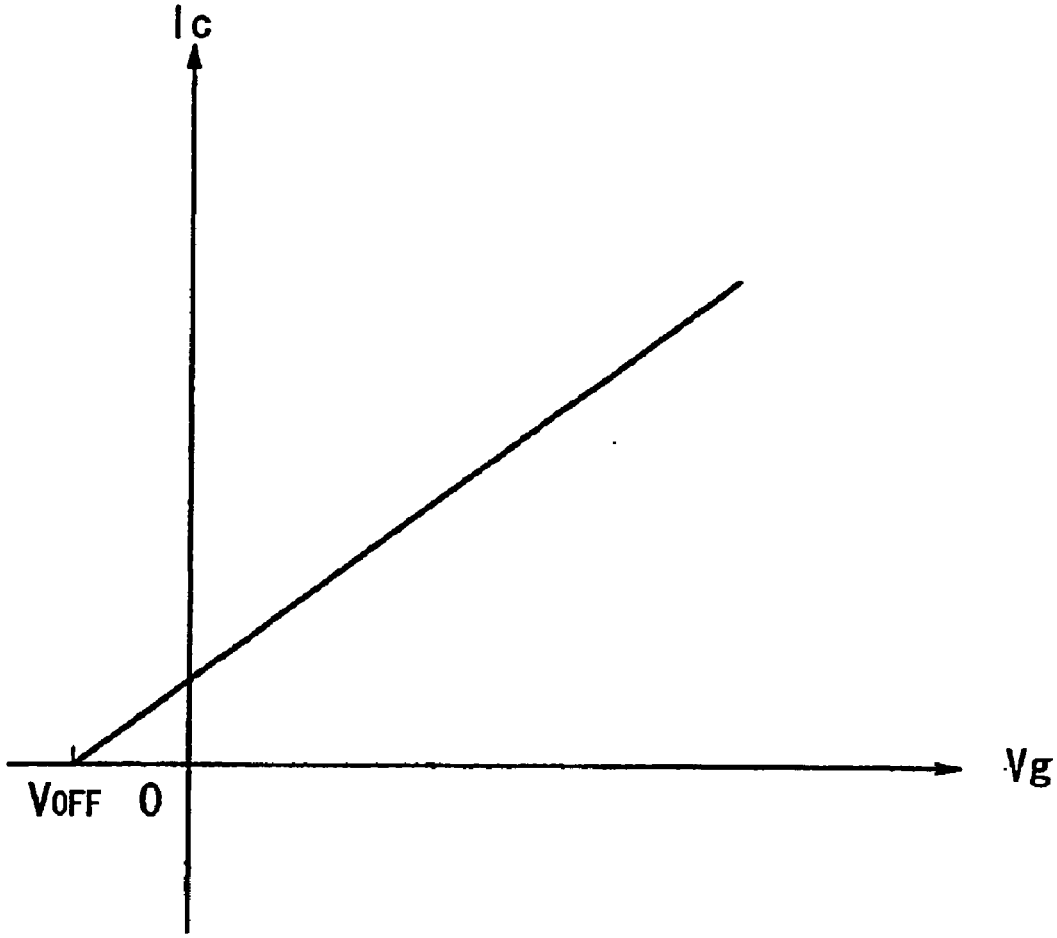
FIG. 26 is a characteristic diagram showing the relationship between a collector current flowing through a collector electrode and a control voltage.

The relationship between the collector current flowing to the collector electrode 50 and the control voltage Vg will be described below with reference to FIG. 26. When the control voltage Vg is set to an electron emission inactivation voltage $V_{OFF}$, then almost no collector current Ic flows, indicating that no electrons are emitted. As the control voltage Vg having a positive value is gradually increased, the collector current Ic increases substantially proportionally to the control voltage Vg.

Therefore, for increasing the amount of electrons emitted from around the cathode electrode 16, the control voltage Vg may have a large positive value.

The variable voltage source 62 can also be used as a switching circuit. Specifically, for emitting electrons, the control voltage Vg which has a constant value is applied, and for preventing electrons from being emitted, the control voltage Vg is set to a small value. In this case, the control voltage Vg may have small positive value, set to zero, or have a large negative value.

In this manner, the amount of electrons emitted from around the cathode electrode 16 can be controlled in an analog fashion. The electron emitter 10C as it is applied to a display or the like is thus capable of controlling finely divided gradations.

The ability of emitted electrons to travel straight can be increased by appropriately adjusting the control voltage Vg applied to the control electrode 60. If a plurality of electron emitters 10C are applied to a display or the like, then crosstalk between the electron emitters 10C can effectively be suppressed.

Figure 27:
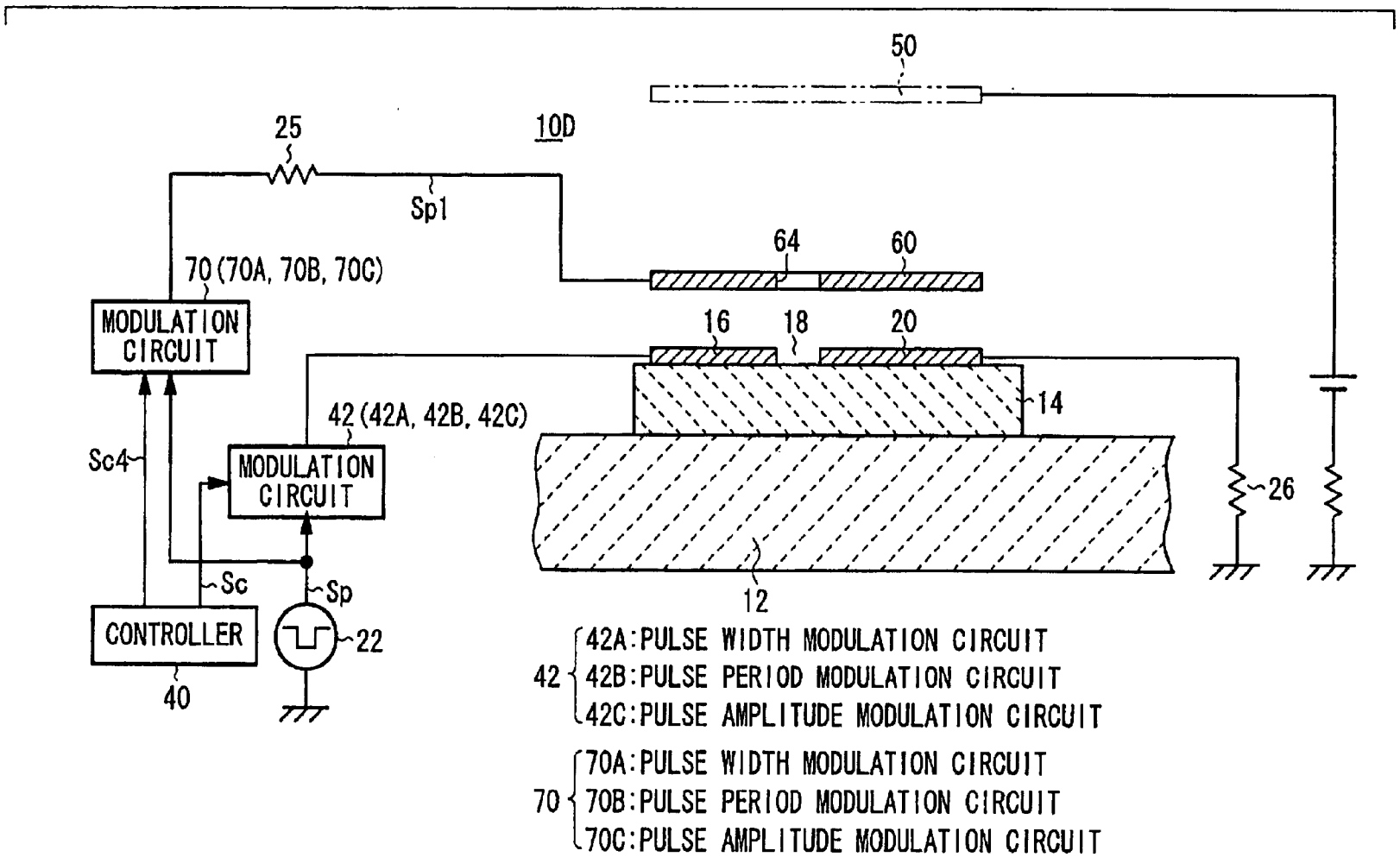
FIG. 27 is a view showing an electron emitter according to a fourth embodiment of the present invention.

An electron emitter 10D according to a fourth embodiment will be described below with reference to FIG. 27.

The electron emitter 10D according to the fourth embodiment has substantially the same structure as the electron emitter 10C according to the third embodiment, but differs therefrom in that it has a modulation circuit 70 for modulating the pulse signal Sp from the pulse generation source 22 to control at least the amount of emitted electrons.

Specific examples of the modulation circuit 70 will be described below with reference to FIGS. 27 through 30B. As shown in FIG. 27, a first specific example of the modulation circuit 70 comprises a pulse width modulation circuit 70A connected between the pulse generation source 22 and the control electrode 60.

Figure 28A:
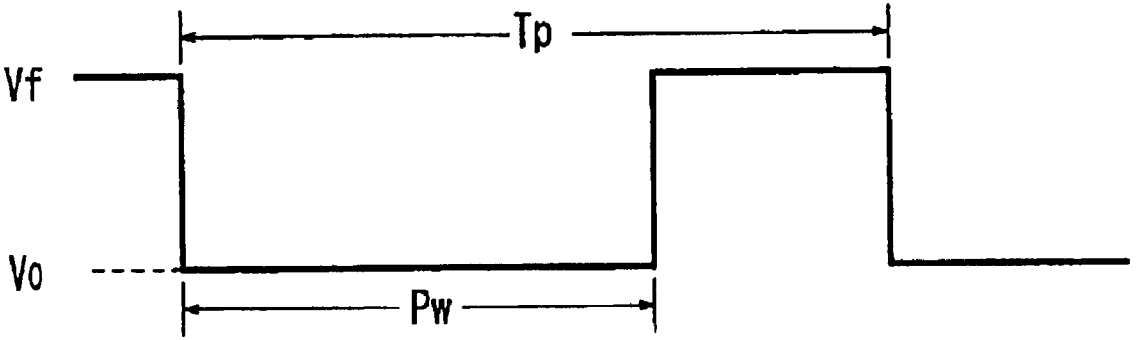
FIG. 28A is a waveform diagram showing a pulse signal applied between a cathode electrode and an anode electrode.

The pulse signal Sp applied from the pulse generation source 22 between the cathode electrode 16 and the anode electrode 20 has an amplitude from the off voltage Vf to the on voltage Vo and also has a constant pulse period Tp and a constant pulse width Pw, as shown in FIG. 28A.

Figure 28B:
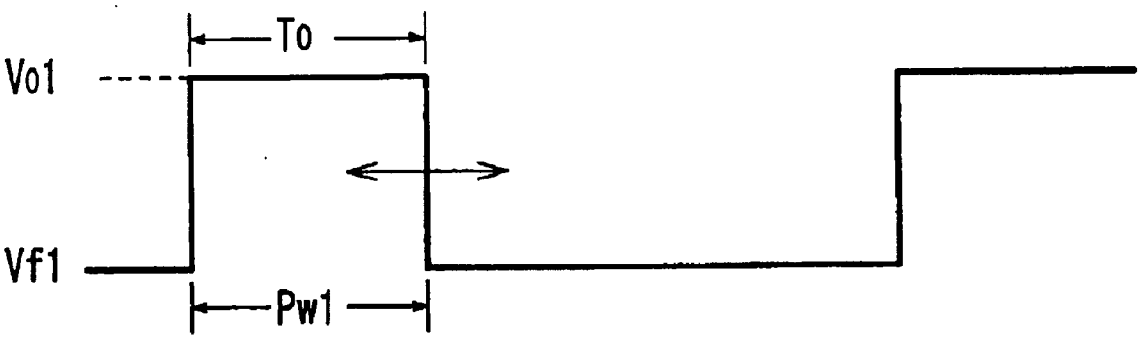
FIG. 28B is a waveform diagram illustrative of pulse amplitude modulation on the pulse signal.

As shown in FIG. 28B, a pulse signal Sp1 applied from the pulse generation source 22 between the control electrode 60 and the anode electrode 20 has an amplitude from a voltage level (the level of an off voltage Vf1) applied to the anode electrode 20 to a level (the level of an on voltage Vo1) for passing electrons emitted from around the cathode electrode 16, and also has a constant pulse period Tp.

As shown in FIG. 28B, the pulse width modulation circuit 70A modulates the pulse width Pw1 (the time in which the on voltage Vo1 continues) of the pulse signal Sp1 based on a control signal Sc4 supplied from the controller 40, thereby controlling at least the amount of emitted electrons.

Electrons are emitted only during a time To in which the pulse signal Sp applied between the cathode electrode 16 and the anode electrode 20 and the pulse signal Sp1 applied between the control electrode 60 and the anode electrode 20 are on voltages Vo, Vo1.

By keeping constant the pulse width Pw of the pulse signal Sp applied between the cathode electrode 16 and the anode electrode 20 and shortening the pulse width Pw1 of the pulse signal Sp1 applied between the control electrode 60 and the anode electrode 20, the amount of emitted electrons per unit time is reduced, and, if the electron emitter is applied to a display, the luminance of light emission is lowered (darkened). As the pulse width Pw1 of the pulse signal Sp1 is increased, the amount of emitted electrons per unit time is increased, and, if the electron emitter is applied to a display, the luminance of light emission is increased (brightened).

In this manner, the amount of electrons emitted from around the cathode electrode 16 can be controlled in an analog fashion. The electron emitter 10D as it is applied to a display or the like is thus capable of controlling finely divided gradations.

Figure 29A:
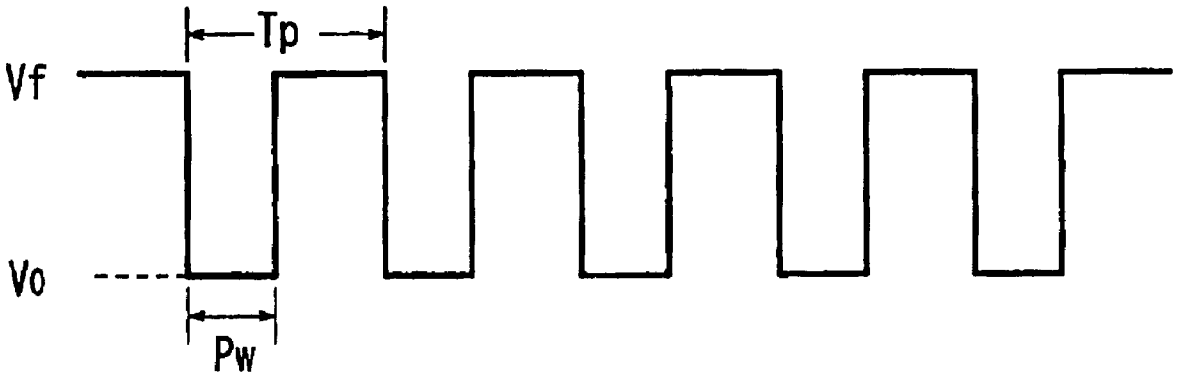
FIG. 29A is a waveform diagram showing a pulse signal applied between the cathode electrode and the anode electrode.
Figure 29B:
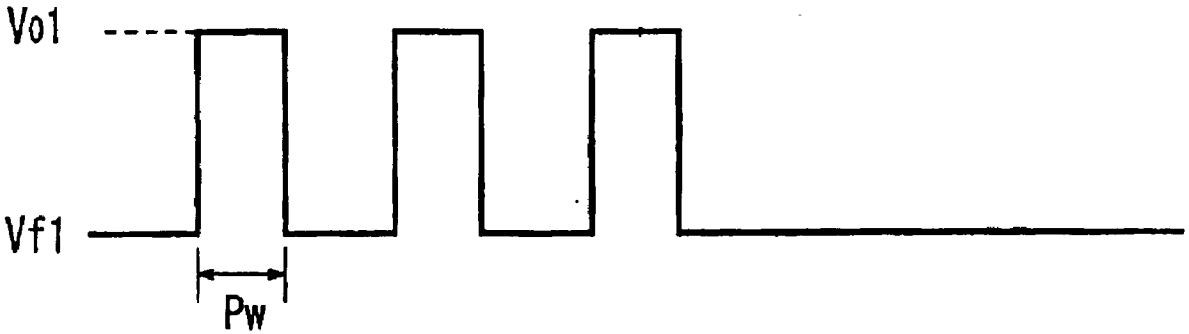
FIG. 29B is a waveform diagram illustrative of pulse number modulation on the pulse signal.

A second specific example of the modulation circuit 70 comprises a pulse number modulation circuit 70B connected between the pulse generation source 22 and the control electrode 60. As shown in FIG. 29B, the pulse signal Sp1 applied between the control electrode 60 and the anode electrode 20 has an amplitude from the off voltage Vf1 to the on voltage Vo1, and also has a constant pulse period Tp and a constant pulse width Pw. Thus, the pulse signal Sp1 has substantially the same waveform as the pulse signal Sp applied between the cathode electrode 16 and the anode electrode 20 (see FIG. 29A).

As shown in FIG. 29B, the pulse number modulation circuit 70B varies the number of pulses contained in the pulse signal Sp1 based on the control signal Sc4 supplied from the controller 40, thereby controlling at least the amount of emitted electrons.

Electrons are emitted only during the time in which the pulse signal Sp applied between the cathode electrode 16 and the anode electrode 20 and the pulse signal Sp1 applied between the control electrode 60 and the anode electrode 20 are on voltages Vo, Vo1.

As the number of pulses of the pulse signal Sp1 is reduced, the effective number of pulses involved in the emission of electrons per unit time is reduced, and, if the electron emitter is applied to a display, the luminance of light emission is lowered (darkened). As the number of pulses of the pulse signal Sp1 is increased, the effective number of pulses involved in the emission of electrons per unit time is increased, and, if the electron emitter is applied to a display, the luminance of light emission is increased (brightened).

Figure 30A:
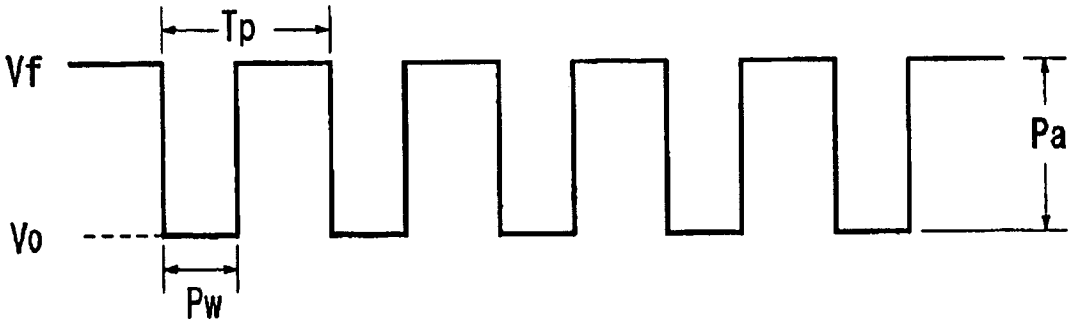
FIG. 30A is a waveform diagram showing a pulse signal applied between the cathode electrode and the anode electrode.
Figure 30B:
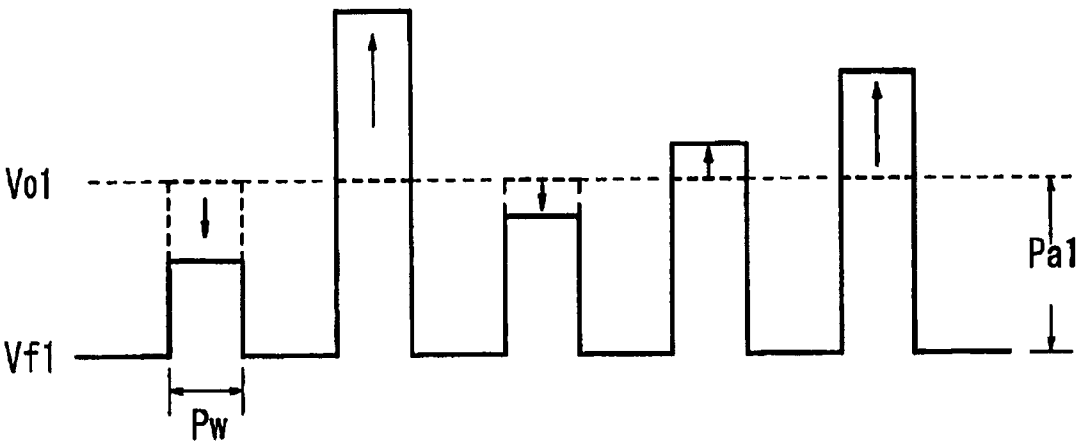
FIG. 30B is a waveform diagram illustrative of pulse amplitude modulation on the pulse signal.

A third specific example of the modulation circuit 70 comprises a pulse amplitude modulation circuit 70C connected between the pulse generation source 22 and the control electrode 60. As shown in FIG. 30B (see the broken-line curve), the pulse signal applied between the control electrode and the anode electrode has an amplitude Pa1 from the off voltage Vf1 to the on voltage Vo1, and also has a constant pulse period Tp and a constant pulse width Pw. Thus, the pulse signal has substantially the same waveform as the pulse signal Sp applied between the cathode electrode 16 and the anode electrode 20 (see FIG. 30A).

As shown in FIG. 30B, the pulse amplitude modulation circuit 70C modulates the amplitude Pa1 of pulses contained in the pulse signal Sp1 based on the control signal Sc4 supplied from the controller 40, thereby controlling at least the amount of emitted electrons.

Electrons are emitted only during the time in which the pulse signal Sp applied between the cathode electrode 16 and the anode electrode 20 and the pulse signal Sp1 applied between the control electrode 60 and the anode electrode 20 are on voltages Vo, Vo1.

As the pulse amplitude Pa1 of the pulse signal Sp1 is reduced, the amount of emitted electrons per unit time is reduced, and, if the electron emitter is applied to a display, the luminance of light emission is lowered (darkened). As the pulse amplitude Pa1 is increased, the amount of emitted electrons per unit time is increased, and, if the electron emitter is applied to a display, the luminance of light emission is increased (brightened).

The modulation circuits according to the second and third specific examples (the pulse number modulation circuit 70B and the pulse amplitude modulation circuit 70C) can control the amount of electrons emitted from around the cathode electrode 16 in an analog fashion. The electron emitter 10D as it is applied to a display or the like is thus capable of controlling finely divided gradations.

In the fourth embodiment, the modulation circuit 70 is connected between the pulse generation source 22 and the control electrode 60 for modulating the pulse signal Sp1 applied between the control electrode 60 and the anode electrode 20. Alternatively, the modulation circuit 70 may be connected between the collector electrode 50 and the pulse generation source 22 in the electron emitter 10B according to the second embodiment for modulating the pulse signal applied between the collector electrode 50 and the anode electrode 20.

Figure 31:
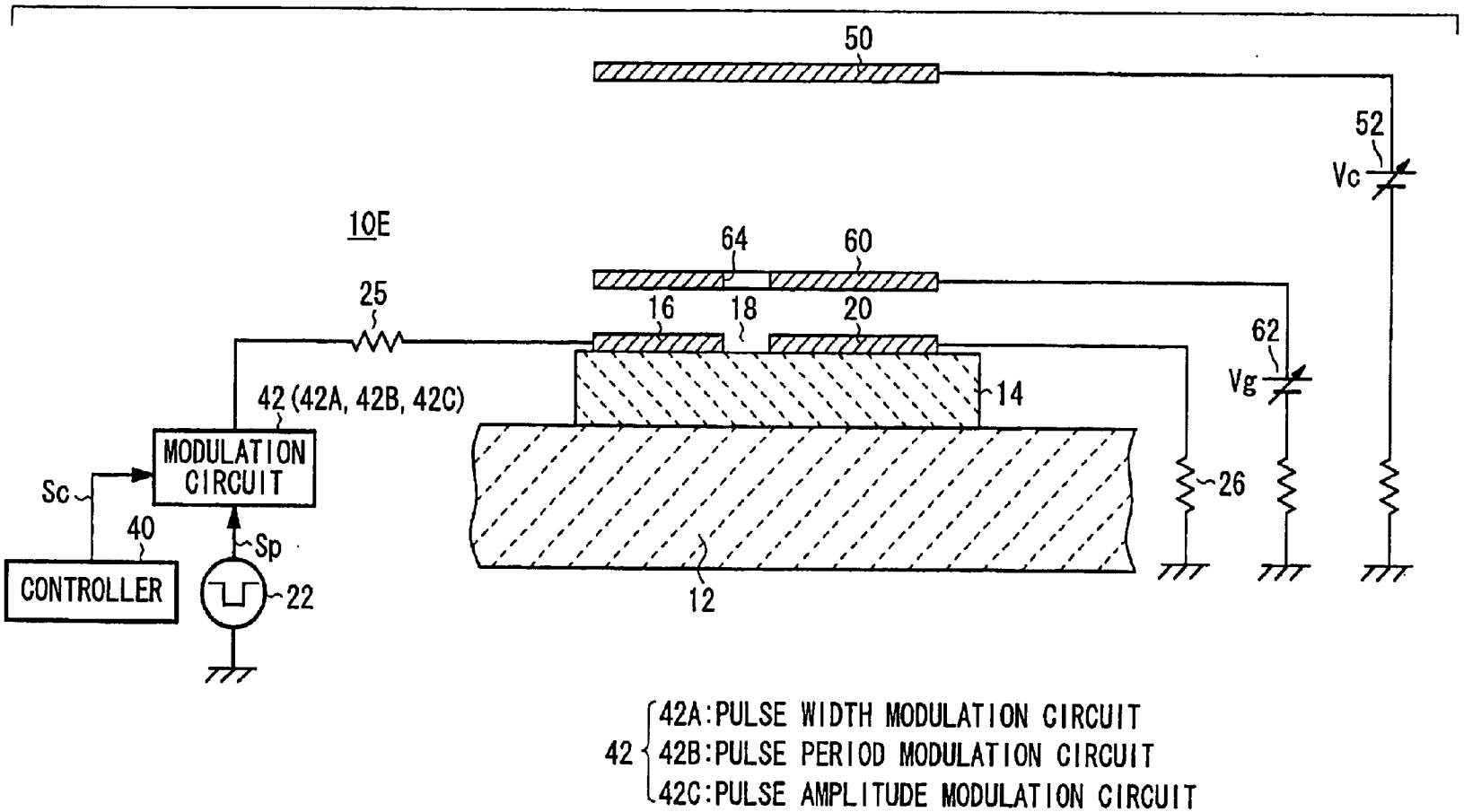
FIG. 31 is a view showing an electron emitter according to a fifth embodiment of the present invention.

An electron emitter 10E according to a fifth embodiment will be described below with reference to FIG. 31.

The electron emitter 10E according to the fifth embodiment has substantially the same structure as the electron emitter 10B according to the second embodiment described above, but differs therefrom in that it has the control electrode 60 and the variable voltage source 62 of the electron emitter 10C according to the third embodiment.

The electron emitter 10E according to the fifth embodiment can incorporate any desired combination of three modulation methods (pulse width modulation, pulse period modulation, and pulse amplitude modulation) described with respect to the electron emitter 10A according to the first embodiment, two control methods (level control and switching control over the bias voltage) effected by the variable voltage source 62 for the collector electrode 50, and two control methods (level control and switching control over the bias voltage) effected by the variable voltage source 62 for the control electrode 60, i.e., twelve methods.

If the switching control method effected by the variable voltage source 52 for the collector electrode 50 and the switching control method effected by the variable voltage source 62 for the control electrode 60 are employed, then, if the electron emitter is applied to a display, the display can be controlled in a matrix drive (dynamic drive) mode.

In the electron emitters 10A through 10E according to the first through fifth embodiments, a high current density can be achieved by setting the vacuum level in the electron emitters 10A through 10E to about $1\times10^{-3}$ Pa. In the electron emitter 10B according to the second embodiment, a high current density can be achieved by setting the voltage between the collector electrode 50 and the anode electrode 20 to about 400 V.

Displays incorporating the electron emitters 10A through 10E according to the above embodiments will be described below. Identical parts of those displays are denoted by identical reference characters, and will not be described repeatedly. Since the displays can incorporate the electron emitters 10A through 10E according to the first through fifth embodiments, the electron emitters 10A through 10E according to those embodiments will collectively be referred to as the electron emitter 10 in the description which follows.

Figure 32:
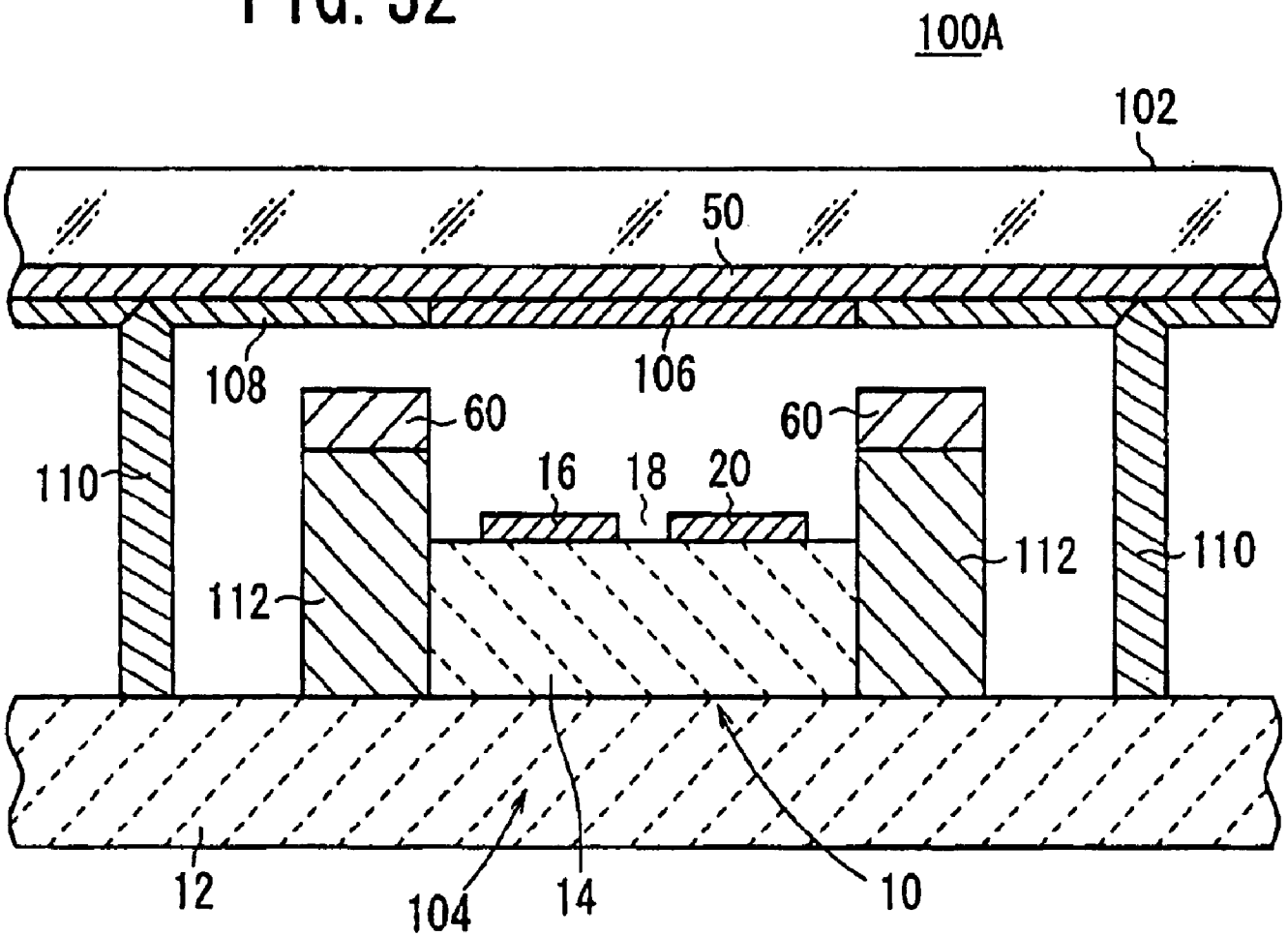
FIG. 32 is a view showing a portion of a display according to a first embodiment of the present invention.

As shown in FIG. 32, a display 100A according to a first embodiment has a glass substrate 102 providing a display surface and a display unit 104 facing the rear surface of the glass substrate 102 and comprising a matrix or staggered pattern of electron emitters 10 corresponding to respective pixels.

The display unit 104 has a substrate 12 made of ceramics, and the electron emitters 10 are disposed in respective positions associated with the pixels on the substrate 12. The substrate 12 has a principal surface facing the rear surface of the glass substrate 102, the principal surface being a continuous surface (flush surface). A collector electrode 50 is disposed on the rear surface of the glass substrate 102, and a fluorescent surface 108 having fluorescent layers 106 corresponding to the respective pixels is disposed on the collector electrode 50.

In the display 100A, beams 110 are disposed between the glass substrate 102 and the substrate 12 in areas other than the electron emitters 10. In FIG. 32, the glass substrate 102 is fixed to upper surfaces of the beams 110. The beams 110 should preferably be made of a material which will not be deformed with heat and pressure. The beams 110 may be fixed between the substrate 12 and the glass substrate 102 by an adhesive or may be formed by a thick-film fabrication technology such as screen printing or the like.

The display 100A according to the first embodiment has an insulating layer 112 formed along the side wall of the electric field receiving member 14 in each of the electron emitters 10, with the control electrode 60 being disposed on only the upper surface of the insulating layer 112. The insulating layer 112 is formed by a thick-film fabrication technology such as screen printing or the like.

The insulating layer 112 has a thickness larger than the electric field receiving member 14, but smaller than the distance from the upper surface of the substrate 12 to the glass substrate 102 (precisely, the fluorescent surface 108).

Figure 33:
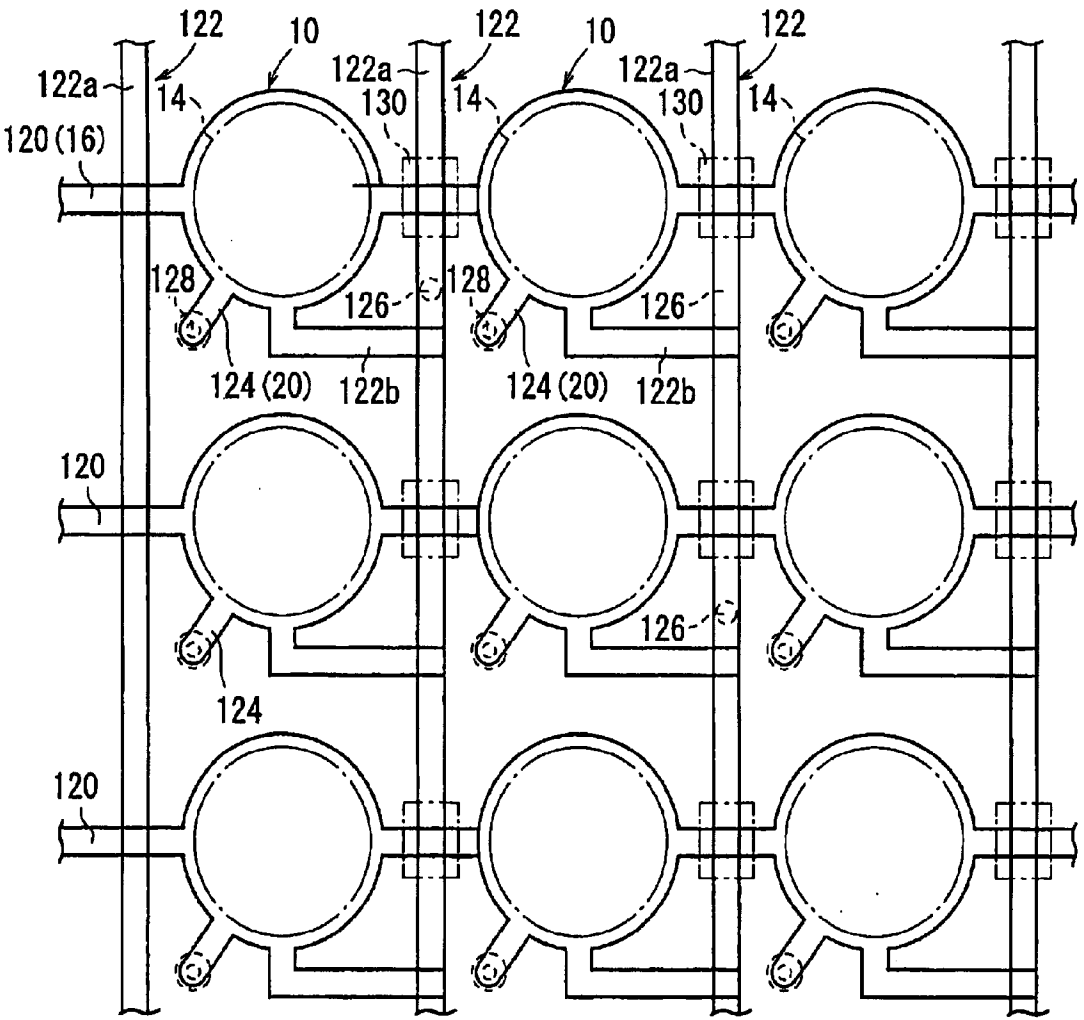
FIG. 33 is a view showing an interconnection pattern according to a first specific example.

As shown in FIG. 33 (which illustrates an interconnection pattern 114*a* according to a first specific example), interconnections connected to the electron emitters 10 include as many row select lines 120 as the number of rows of pixels, as many signal lines 122 as the number of columns of pixels, and as many common leads 124 as the number of pixels.

The row select lines 120 are electrically connected to the cathode electrodes 16 of the respective pixels (the electron emitters 10, see FIG. 32). The signal lines 122 are electrically connected to the control electrodes 60 of the respective pixels. The common leads 124 are electrically connected to the anode electrodes 20 of the respective pixels.

Each of the row select lines 120 extends from the cathode electrodes 16 of the pixels in preceding columns and is connected to the cathode electrodes 16 of the pixels to which the row select line 120 belongs. The row select line 120 which belong to one row is connected in series to the pixels. Each of the signal lines 122 comprises a main line 122*a* extending along the column to which the signal line 122 belongs, and branch lines 122*b* branched from the main line 122*a* and connected to the control electrodes 60 of the respective electron emitters 10 belonging to the column.

Voltage signals are supplied to the row select lines 120 via an interconnection pattern printed on an end face of the substrate 12, for example. Voltage signals are supplied to the signal lines 122 via through holes 126 connected to the main lines 122*a*. Voltages are applied to the common leads 124 via through holes 128.

In order to insulate the row select lines 120 and the signal lines 122 from each other, insulating films 130 (shown by the dot-and-dash lines) in the form of silicon oxide films, glass films, resin films, or the like are interposed in areas where the row select lines 120 and the signal lines 122 extend across each other.

Figure 34:
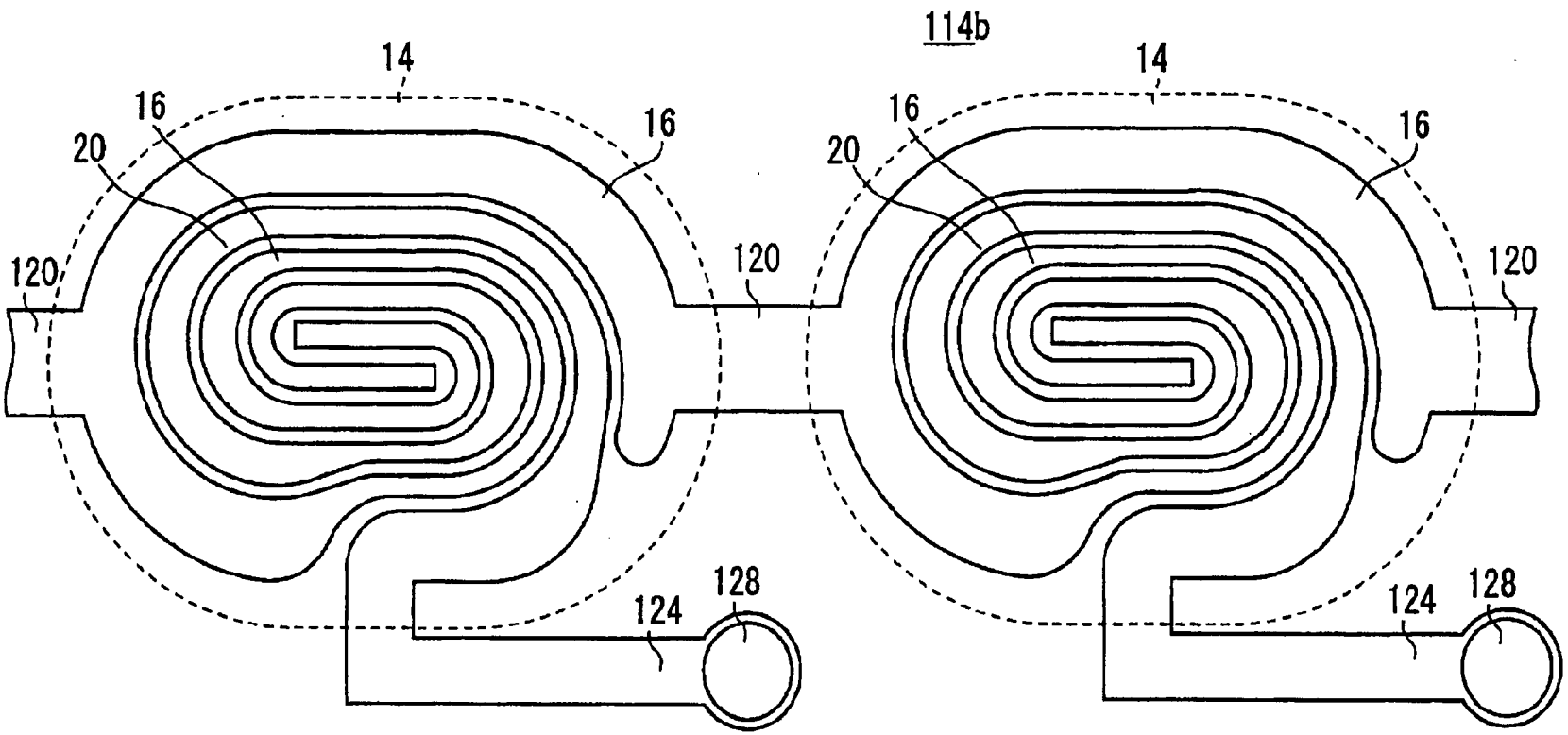
FIG. 34 is a view showing an interconnection pattern according to a second specific example.
Figure 35:
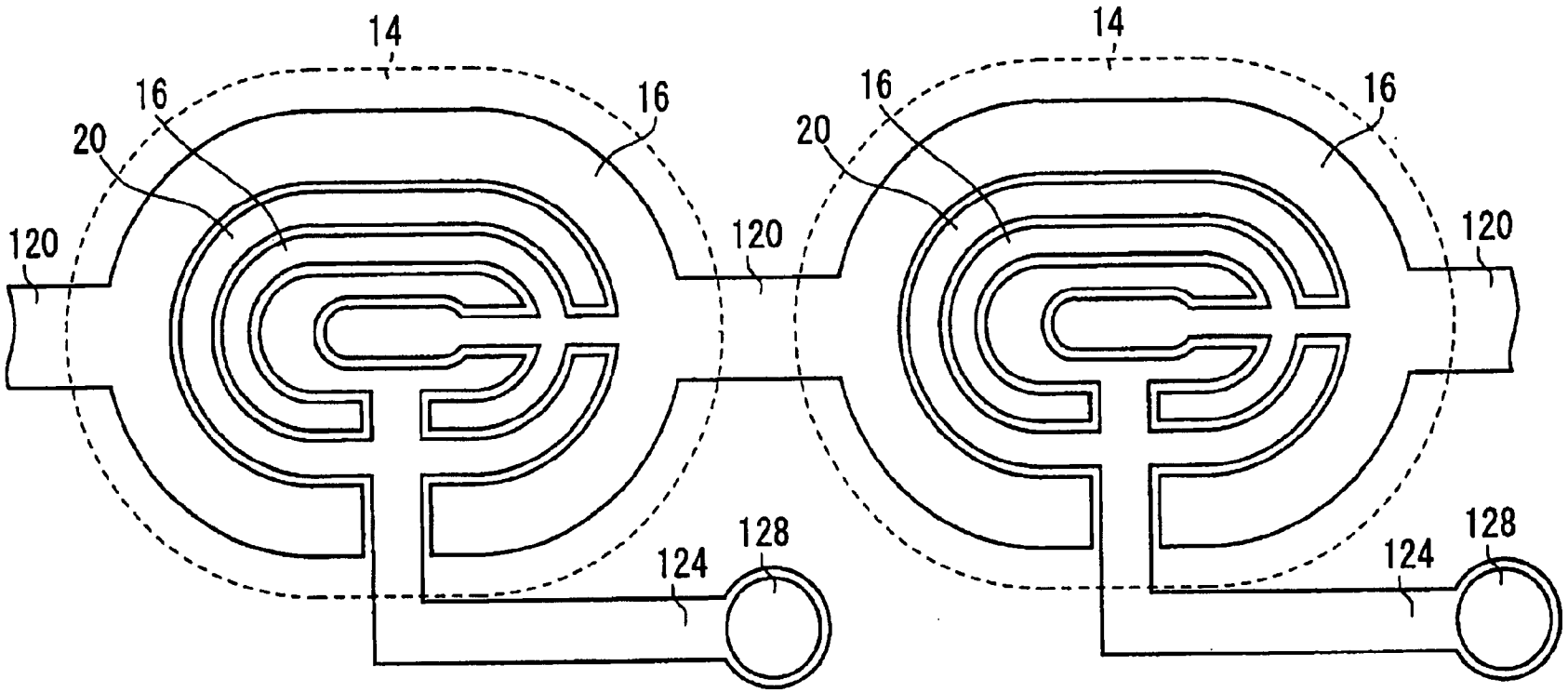
FIG. 35 is a view showing an interconnection pattern according to a third specific example.

With the interconnection pattern 114*a* shown in FIG. 33, the planar shape of the electric field receiving member 14 and the planar shapes of the cathode electrode 16, the anode electrode 20, and the control electrode 60 provide a circular outer profile. However, they may provide an oblong outer profile as with an interconnection pattern 114*b* according to a second specific example shown in FIG. 34 and an interconnection pattern 114*c* according to a third specific example shown in FIG. 35. Alternatively, they may provide an elliptical outer profile as with an interconnection pattern 114*d* according to a fourth specific example shown in FIG. 36. The signal lines 122 are omitted from illustration in FIGS. 34 and 35.

Figure 37:
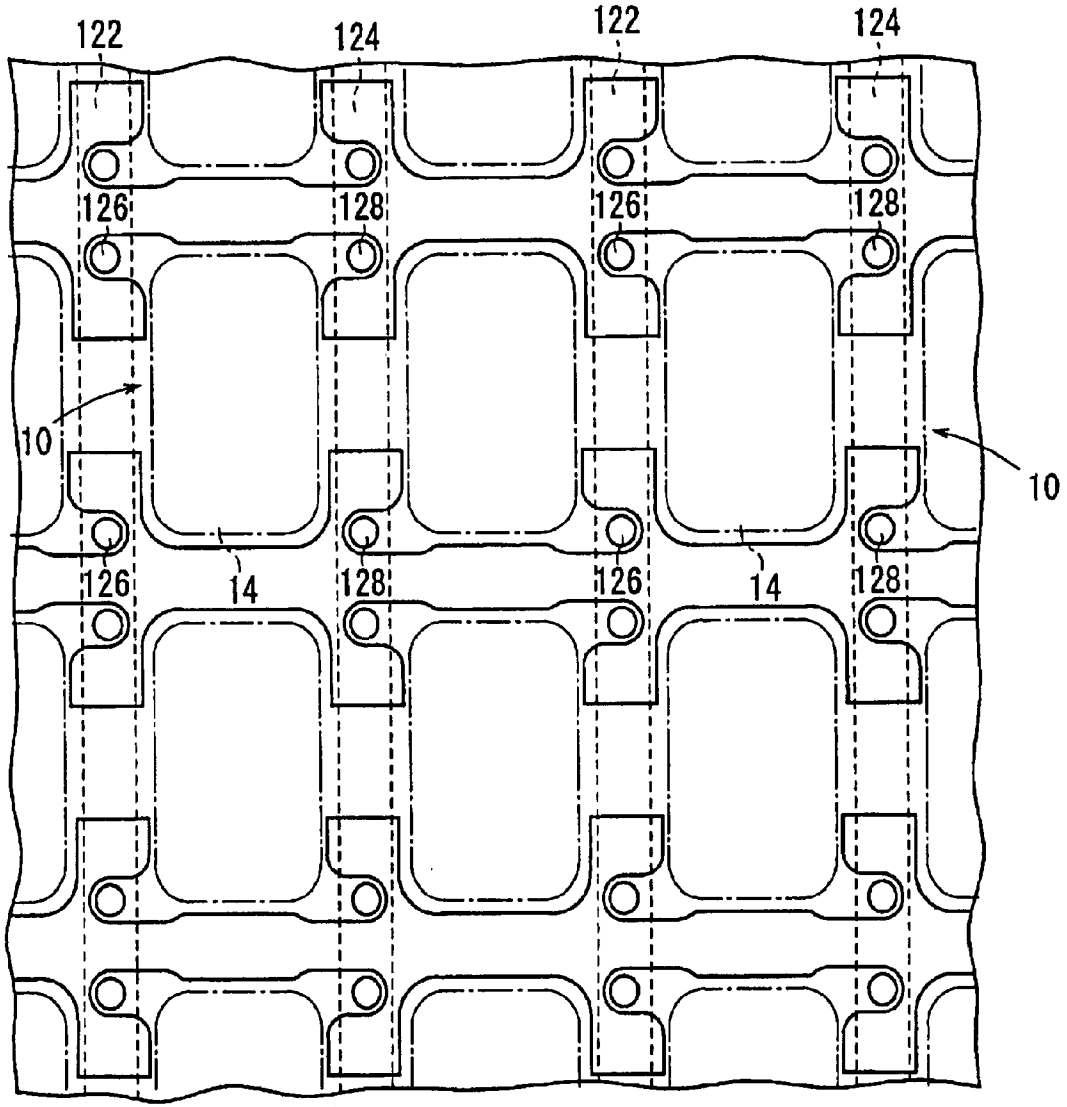
FIG. 37 is a view showing an interconnection pattern according to a fifth specific example.
Figure 38:
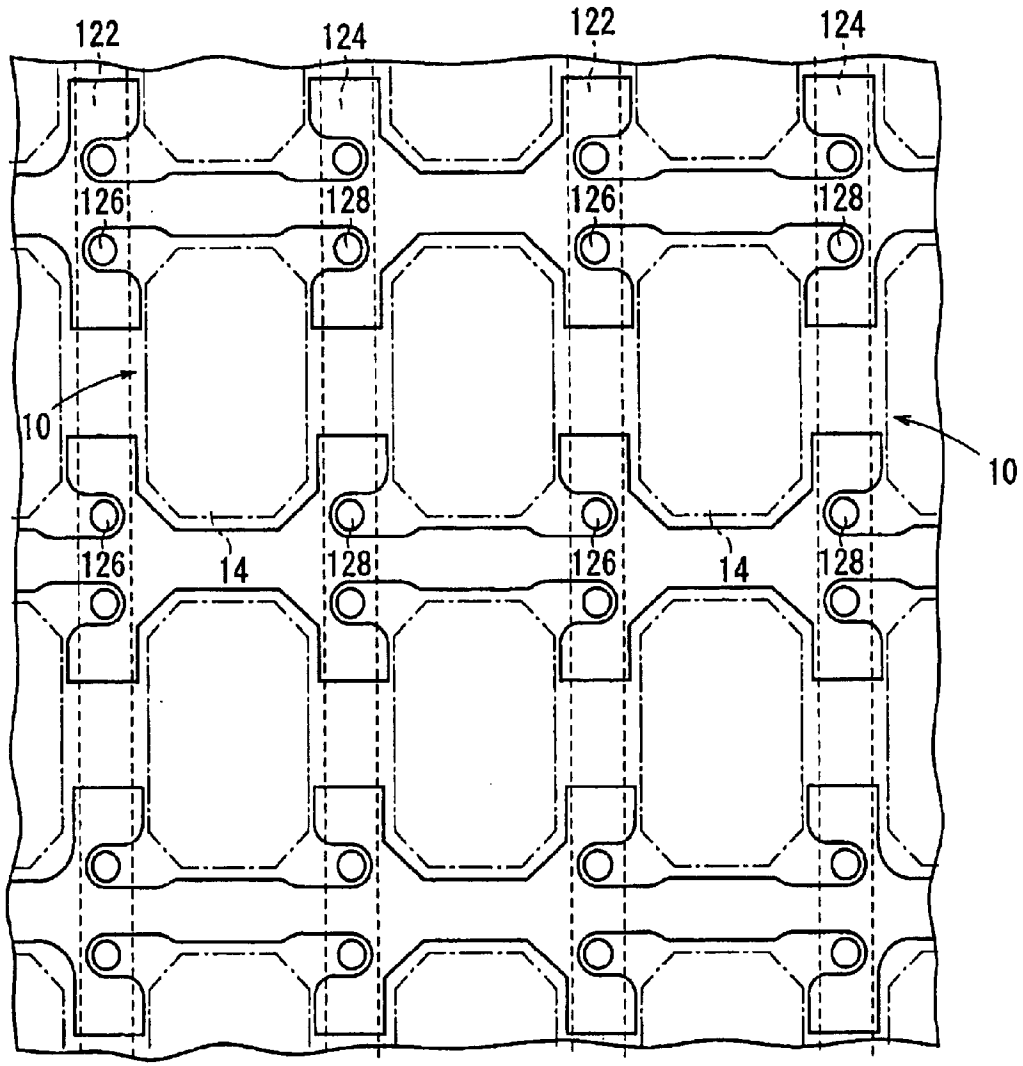
FIG. 38 is a view showing an interconnection pattern according to a sixth specific example.

Further alternatively, with an interconnection pattern 114*e* according to a fifth specific example shown in FIG. 37, both the planar shape of the electric field receiving member 14 and the planar shapes of the cathode electrode 16, the anode electrode 20, and the control electrode 60 provide a rectangular outer profile with rounded corners, or with an interconnection pattern 114*f* according to a sixth specific example shown in FIG. 38, both the planar shape of the electric field receiving member 14 and the planar shapes of the cathode electrode 16, the anode electrode 20, and the control electrode 60 provide a polygonal outer profile (e.g., an octagonal outer profile) with round vertexes.

Moreover, the planar shape of the electric field receiving member 14 and the planar shapes of the cathode electrode 16, the anode electrode 20, and the control electrode 60 may provide an outer profile which is a combination of circular and elliptical shapes or a combination of rectangular and elliptical shapes, and are not limited to any shapes. The planar shape of the electric field receiving member 14 may also of a ring shape having a circular, elliptical, or rectangular outer profile.

In the examples shown in FIGS. 33, 37, and 38, the electron emitters 10 (pixels) on the substrate 12 are arranged in a matrix. However, as shown in FIG. 36, the electron emitters 10 (pixels) may be arranged in a staggered pattern along each row.

Figure 36:
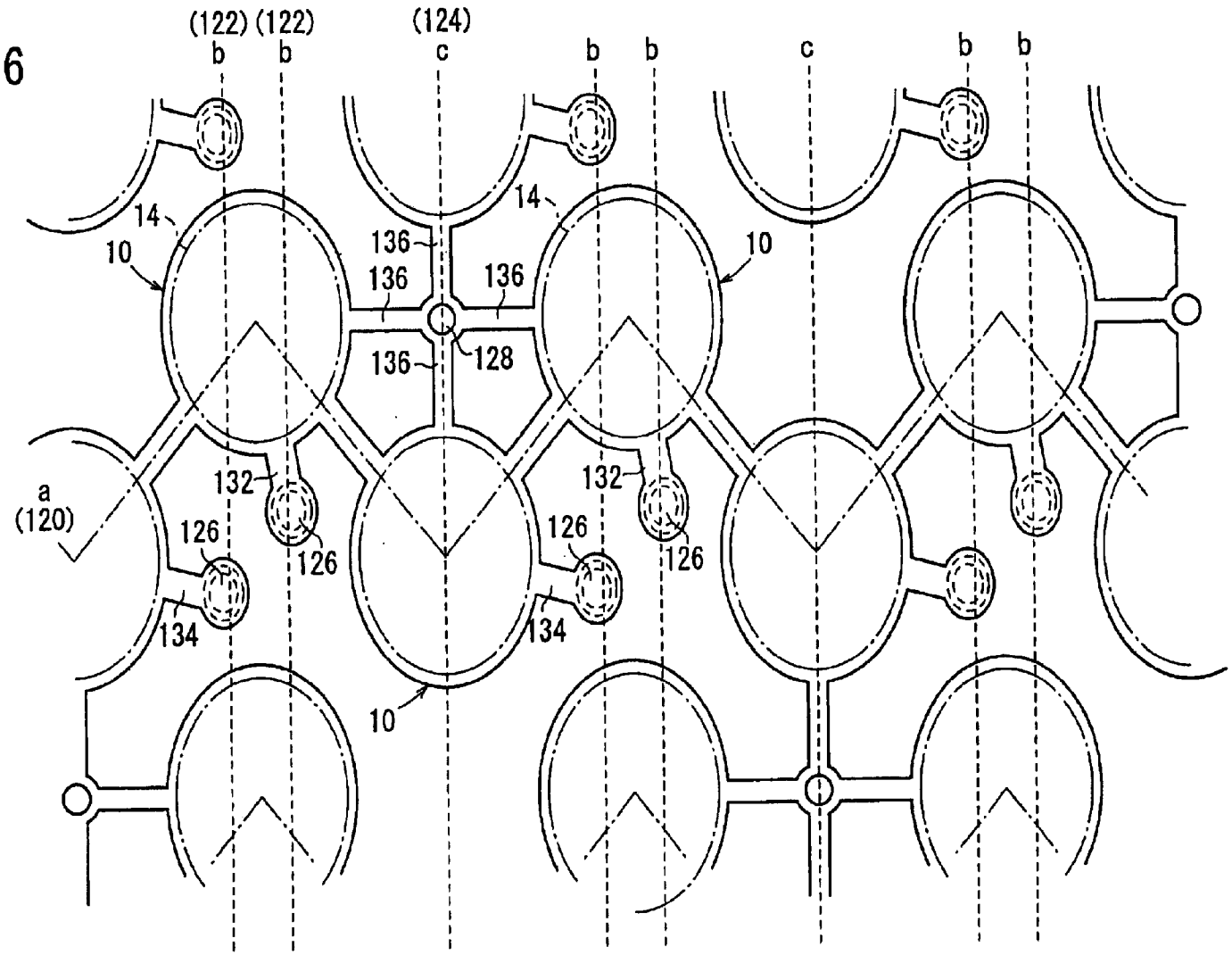
FIG. 36 is a view showing an interconnection pattern according to a fourth specific example.

With the interconnection pattern 114*d* shown in FIG. 36, since the electron emitters 10 (pixels) are arranged in a staggered pattern along each row, each of the row select lines 120 as indicated by the dot-and-dash line a has a zigzag shape.

On the reverse side of the substrate 12, the signal lines 122 are arranged in such a pattern that two signal lines 122 are closely disposed in an area corresponding to each of the upper ones of the staggered pixels (electron emitters 10).

In FIG. 36, the control electrodes 60 of the upper ones of the staggered pixels (electron emitters 10) are electrically connected to the right one of the two closely positioned signal lines 122 by relay conductors 132 and through holes 126, and the control electrodes 60 of the lower ones of the staggered pixels (electron emitters 10) are electrically connected to the left one of the two closely positioned signal lines 122 by relay conductors 134 and through holes 126.

The common leads 124 (indicated by the broken lines c) are arranged on the reverse side of the substrate 12. A single through hole 128 is defined so as to be common to four adjacent electron emitters 10. The common leads 124 are electrically connected to the through holes 128. The four adjacent electron emitters 10 are connected to the through hole 128 by respective relay conductors 136, thus electrically connecting the anode electrodes 20 thereof to the common leads 124.

Figure 39:
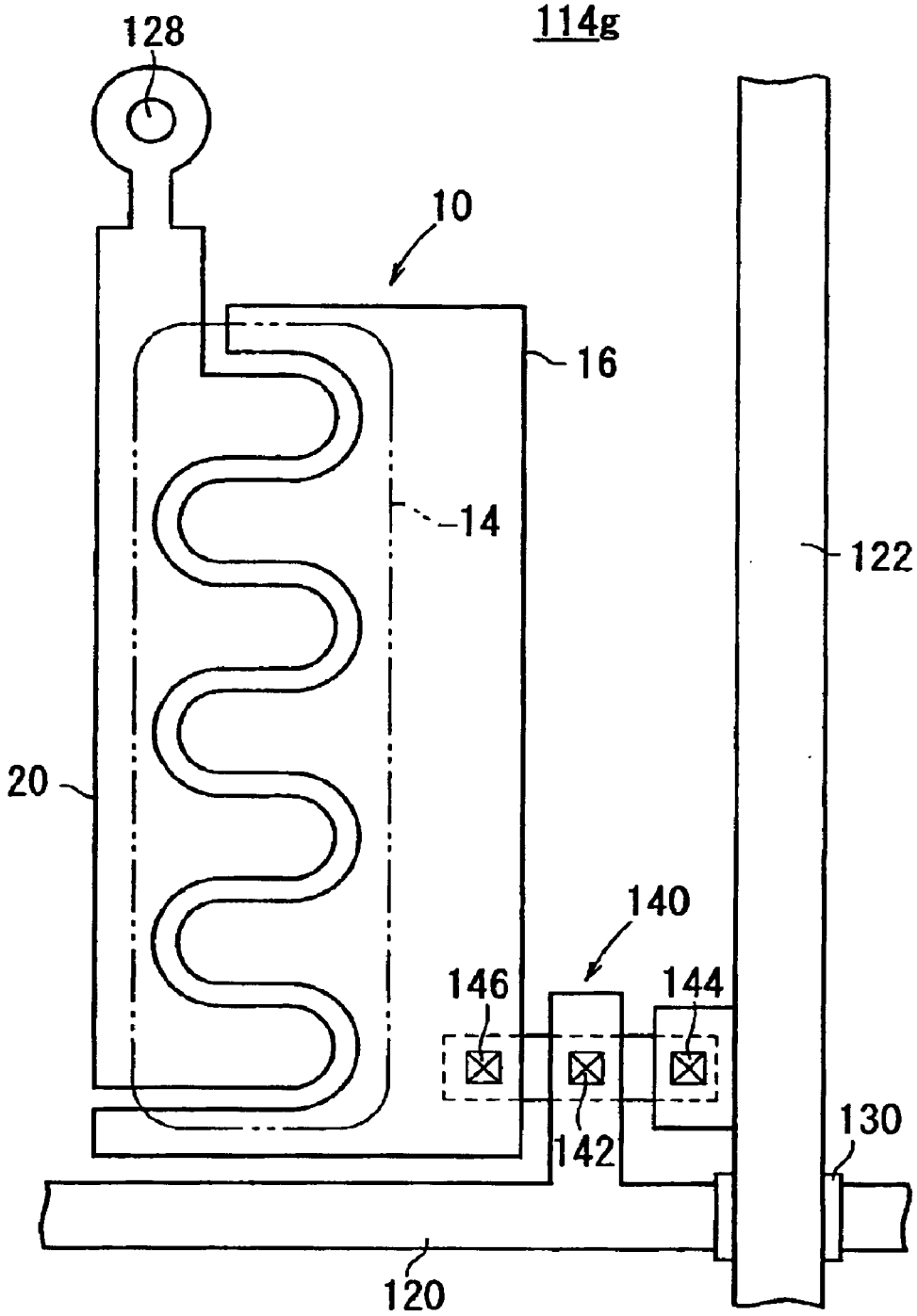
FIG. 39 is a view showing an interconnection pattern according to a seventh specific example.
Figure 40:
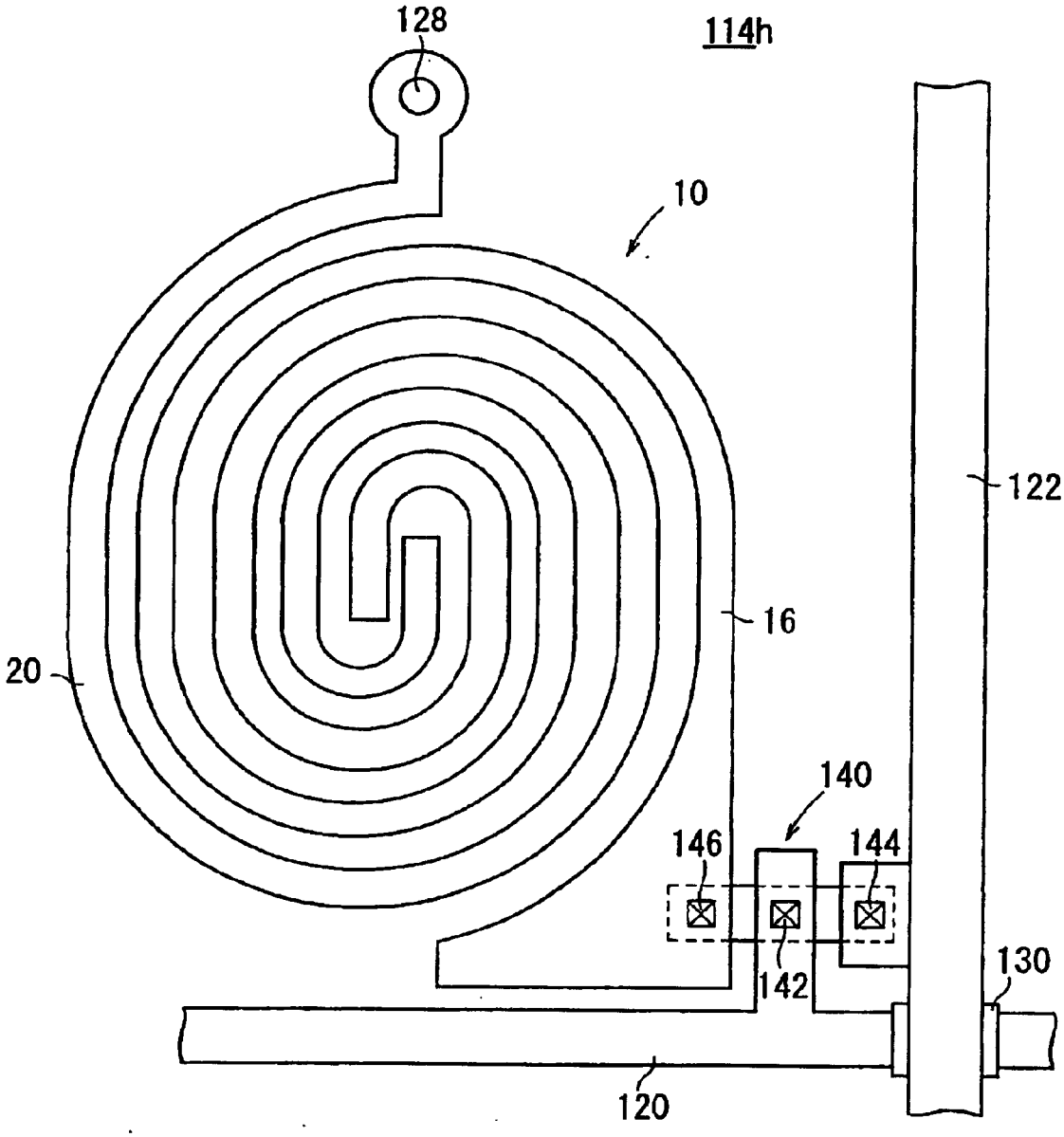
FIG. 40 is a view showing an interconnection pattern according to an eighth specific example.

In the above example, the signal lines 122 are connected to the control electrodes 60. However, as shown in FIGS. 39 and 40, the signal line 122 may be connected to the cathode electrode 16 by a switching device 140 (e.g., a TFT or the like). In this case, the row select line 120 is connected to a gate 142 of the switching device 140, the signal line 122 to one source/drain 144 of the switching device 140, and the cathode electrode 16 to the other source/drain 146 of the switching device 140. FIG. 39 shows an example (an interconnection pattern 114*g* according to a seventh specific example) in which the cathode electrode 16 and the anode electrode 20 have staggered comb-toothed shapes. FIG. 40 shows an example (an interconnection pattern 114*h* according to an eighth specific example) in which the cathode electrode 16 and the anode electrode 20 have spiral shapes extending parallel to each other and spaced from each other.

If the switching device 140 comprises a TFT, then the display can be energized in an active matrix mode.

The switching device 140 may comprise a nonlinear resistive component such as a varistor, a zener diode, an MIM, or the like, as well as a TFT. With the switching device 140 comprising such a nonlinear resistive component, the display can be energized in an active matrix mode, and the electron emitter 10 can be protected against overcurrents.

A drive circuit with an overcurrent suppression effect has a parallel-connected circuit of a capacitor and a resistor which is connected in series with the cathode or the anode. The resistor serves to suppress an overcurrent, and the capacitor provides a bypassing effect not to impair a startup current upon the application of a pulse.

The display is not limited to the examples shown in FIGS. 39 and 40. Rather than using the switching device 140, the row select line 120 may be connected directly to the cathode electrode 16, and the signal line 122 may be connected directly to the control electrode 60 (not shown).

Operation of the display 100A according to the first embodiment will be described below with reference to FIGS. 32 and 33. If the drive method shown in FIGS. 28A and 28B is employed, then when the on voltage Vo is applied to the row select line 120 of a certain row, the electron emitters 10 belonging to the row are selected, and the pulse widths Pw1 of the pulse signals Sp1 supplied to the respective signal lines 122 are modulated for the respective pixels depending on the attributes of an image signal.

The above operation is carried out for all rows to display a one-frame image on the surface of the glass substrate 102. The above frame operation is successively carried out to display a still image or a moving image on the surface of the glass substrate 102 depending on the image signal supplied to the display 100A. The drive methods shown in FIGS. 29A through 30B may also be employed.

The planar shape of the control electrode 60 will be described below with reference to FIGS. 41 through 54. In FIGS. 41 through 54, an array of pixels (electron emitters 10) in three rows and three columns is considered for the sake of brevity. Of course, a desired array (a matrix or staggered array) of pixels in n rows×m columns is applicable.

Figure 41:
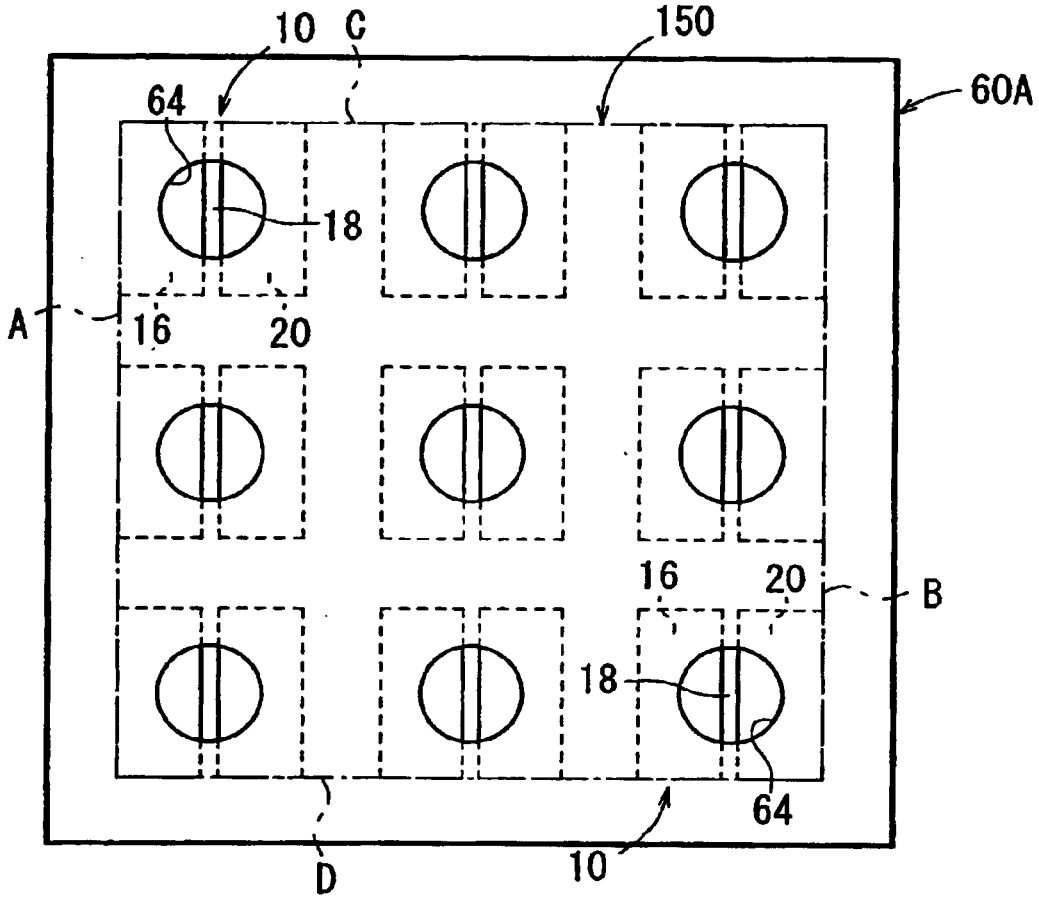
FIG. 41 is a plan view showing a portion of a control electrode according to a first specific example.

As shown in FIG. 41, a control electrode 60A according to a first specific example has an outer profile greater than a frame 150 provided by the array of electron emitters 10, and has circular windows 64 defined in respective positions corresponding to the electron emitters 10, particularly the centers of the slits 18. The control electrode 60A has a simple structure and can easily be fabricated.

The frame 150 is made up of a side (indicated by the dot-and-dash line A) interconnecting end faces of the cathode electrodes 16 of a group of electron emitters 10 arranged in the first column, a side (indicated by the dot-and-dash line B) interconnecting end faces of the anode electrodes 20 of a group of electron emitters 10 arranged in the last column, a side (indicated by the dot-and-dash line C) interconnecting end faces of the cathode and anode electrodes 16, 20 of a group of electron emitters 10 arranged in the first row, and a side (indicated by the dot-and-dash line D) interconnecting end faces of the cathode and anode electrodes 16, 20 of a group of electron emitters 10 arranged in the last row.

Figure 42:
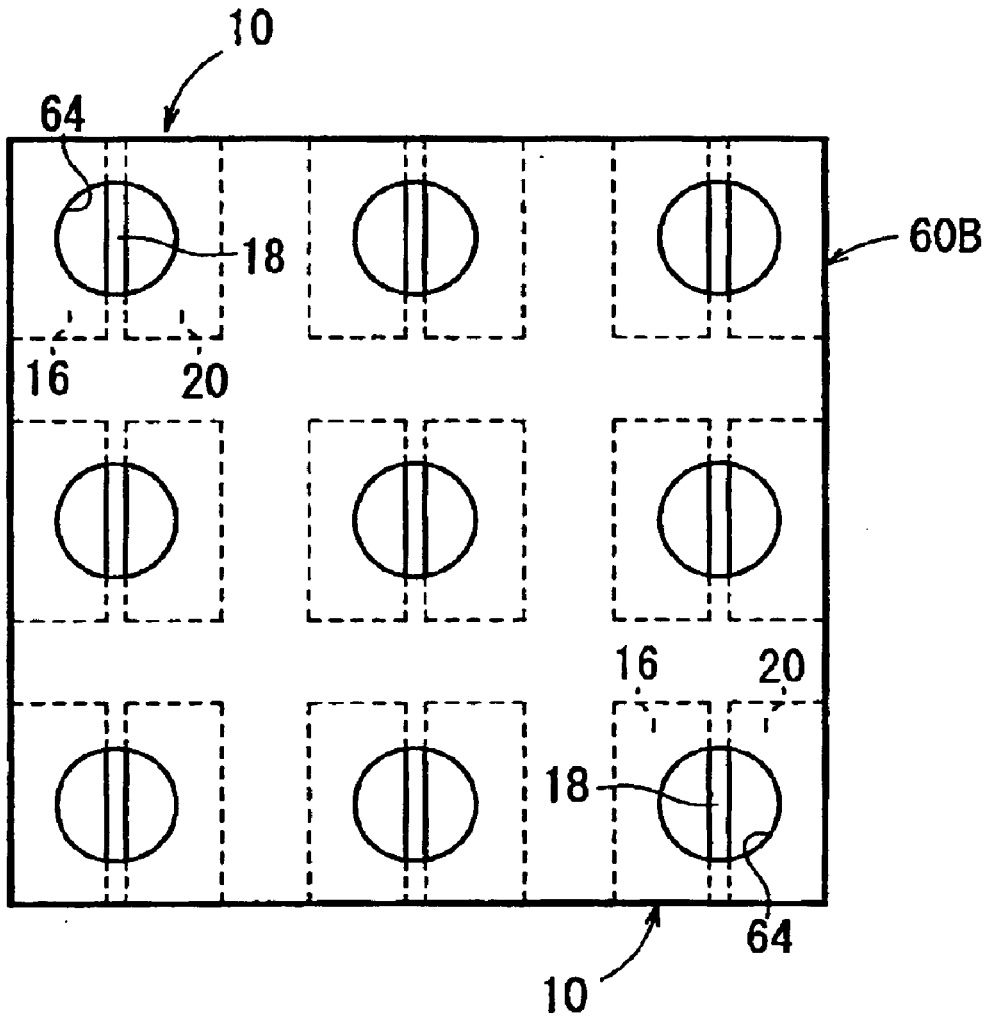
FIG. 42 is a plan view showing a portion of a control electrode according to a second specific example.
Figure 43:
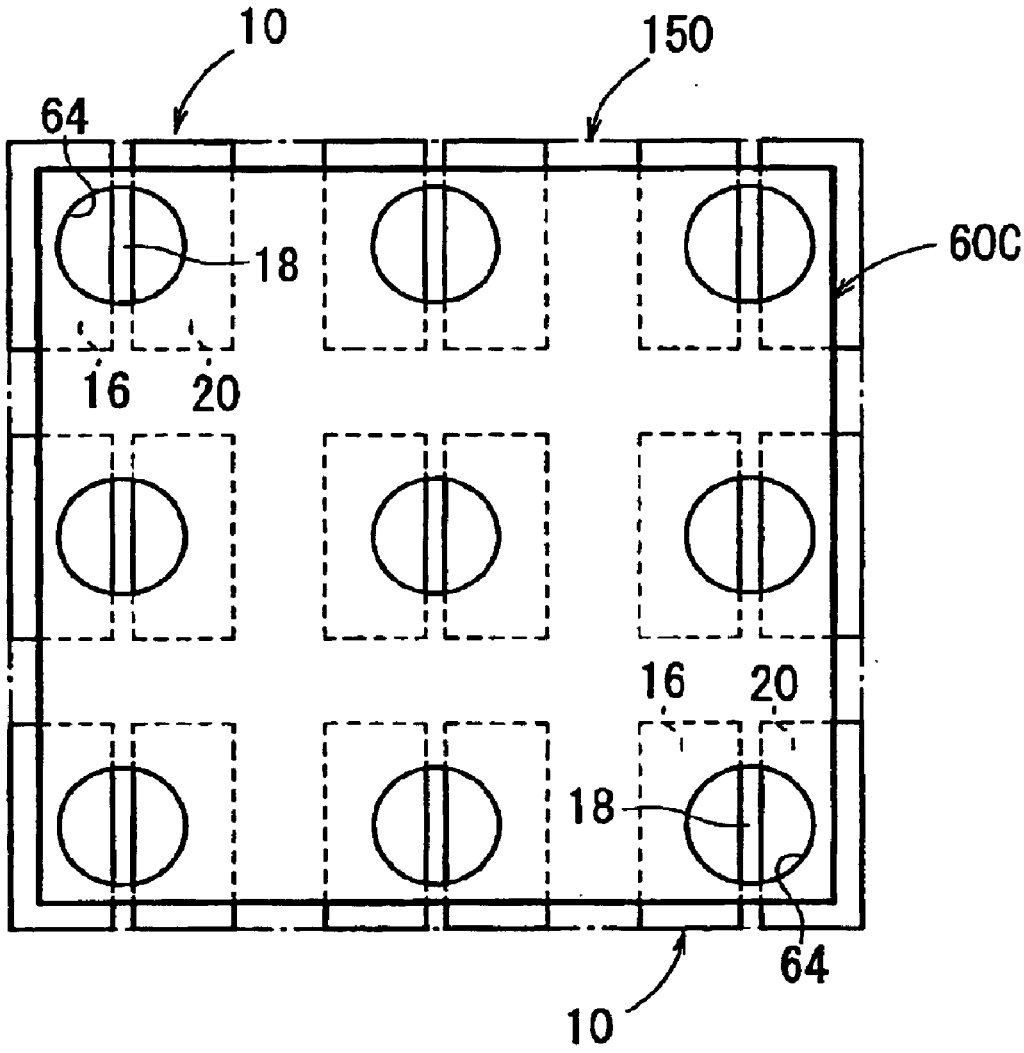
FIG. 43 is a plan view showing a portion of a control electrode according to a third specific example.

As shown in FIG. 42, a control electrode 60B according to a second specific example differs from the control electrode 60A according to the first specific example in that the control electrode 60B has an outer profile which is substantially the same as the frame 150. As shown in FIG. 43, a control electrode 60C according to a third specific example differs from the control electrode 60A according to the first specific example in that the control electrode 60C has an outer profile which is smaller than the frame 150. These control electrodes 60B, 60C have a simple structure and can easily be fabricated.

Figure 44:
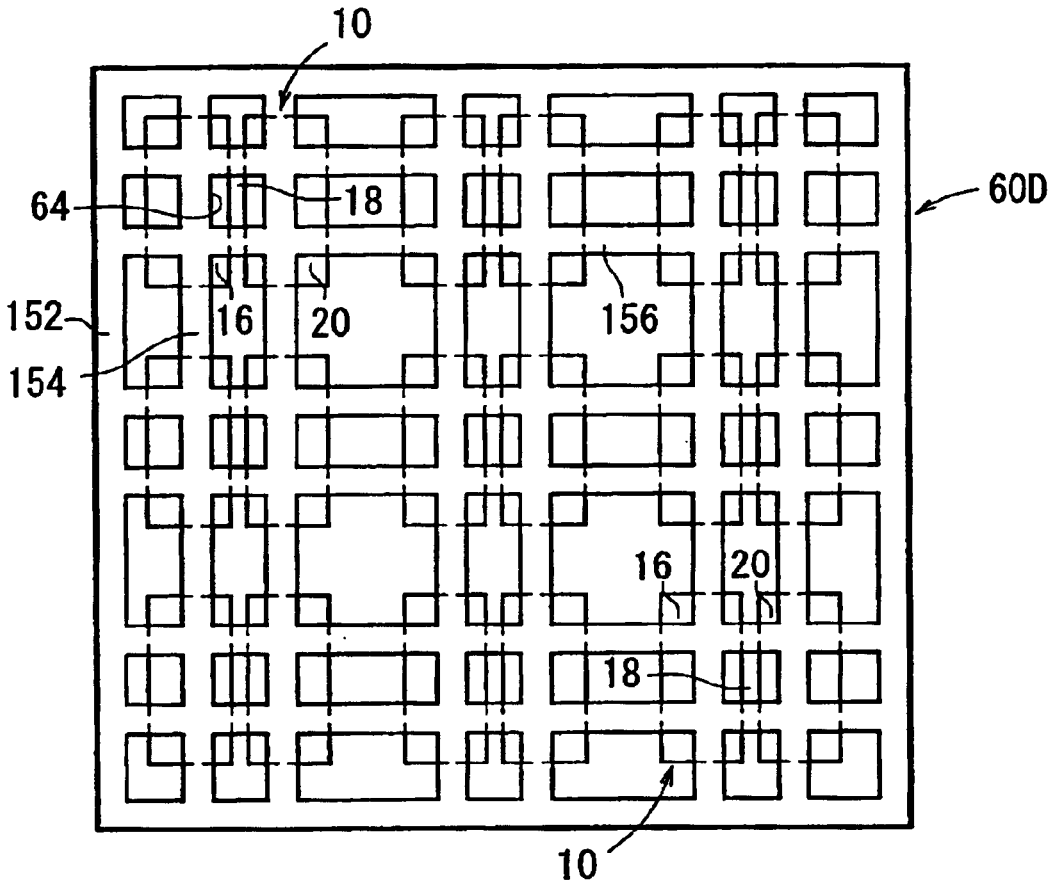
FIG. 44 is a plan view showing a portion of a control electrode according to a fourth specific example.

As shown in FIG. 44, a control electrode 60D according to a fourth specific example has an outer frame 152 and a mesh-like structure disposed within the outer frame 152 and having a plurality of vertical bars 154 and a plurality of horizontal bars 156. The control electrode 60D also has rectangular windows 64 (defined by the mesh-like structure) defined in respective positions corresponding to the centers of the slits 18 of the electron emitters 10. Since the control electrode 60D has many through holes, it is lightweight and advantageous in terms of cost.

Figure 45:
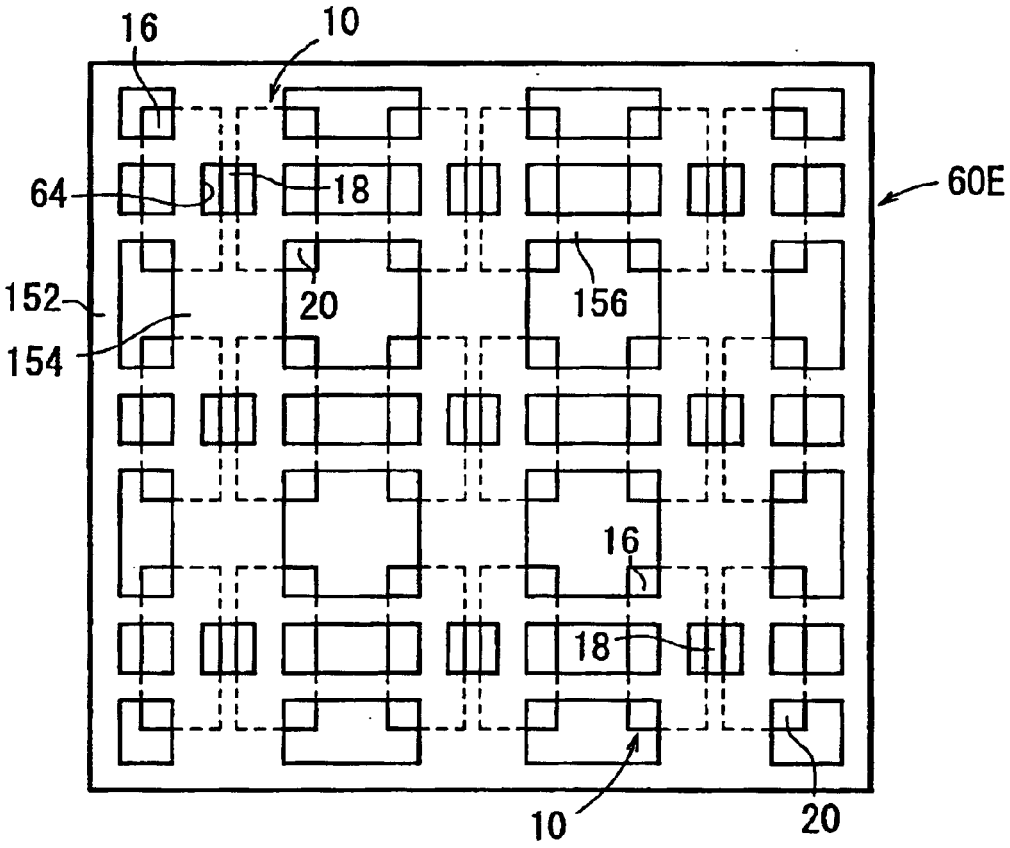
FIG. 45 is a plan view showing a portion of a control electrode according to a fifth specific example.

As shown in FIG. 45, a control electrode 60E according to a fifth specific example has substantially the same structure as the control electrode 60D according to the fourth specific example, but has a structure in which some of the vertical bars 154 are joined to close the windows therebetween. The control electrode 60E according to the fifth specific example has a mechanical strength in comparison with the control electrode 60D according to the fourth specific example.

Figure 46:
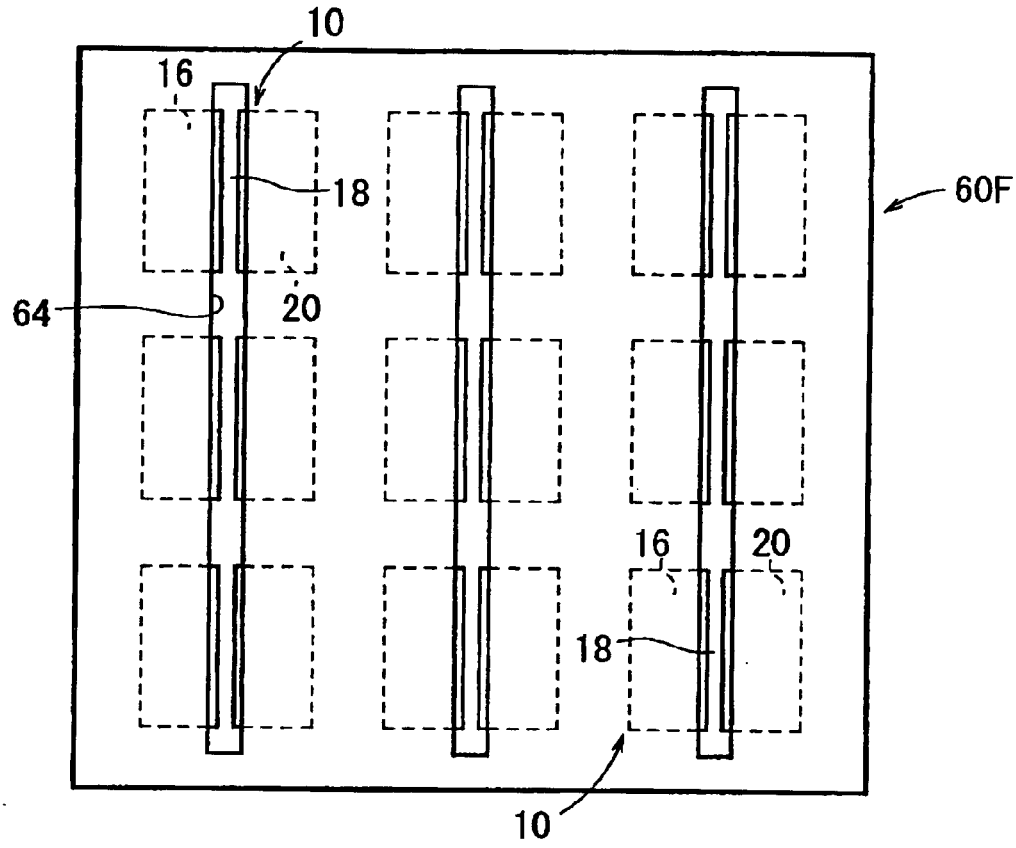
FIG. 46 is a plan view showing a portion of a control electrode according to a sixth specific example.

As shown in FIG. 46, a control electrode 60F according to a sixth specific example has substantially the same structure as the control electrode 60A according to the first specific example, but differs therefrom in that the windows 64 have a slit-shape extending in the longitudinal direction of the slits 18 of the electron emitters 10. Each of the windows 64 extends above the slits 18 corresponding to a vertical array of electron emitters 10. The control electrode 60F is advantageous in that it can easily be fabricated.

Figure 47:
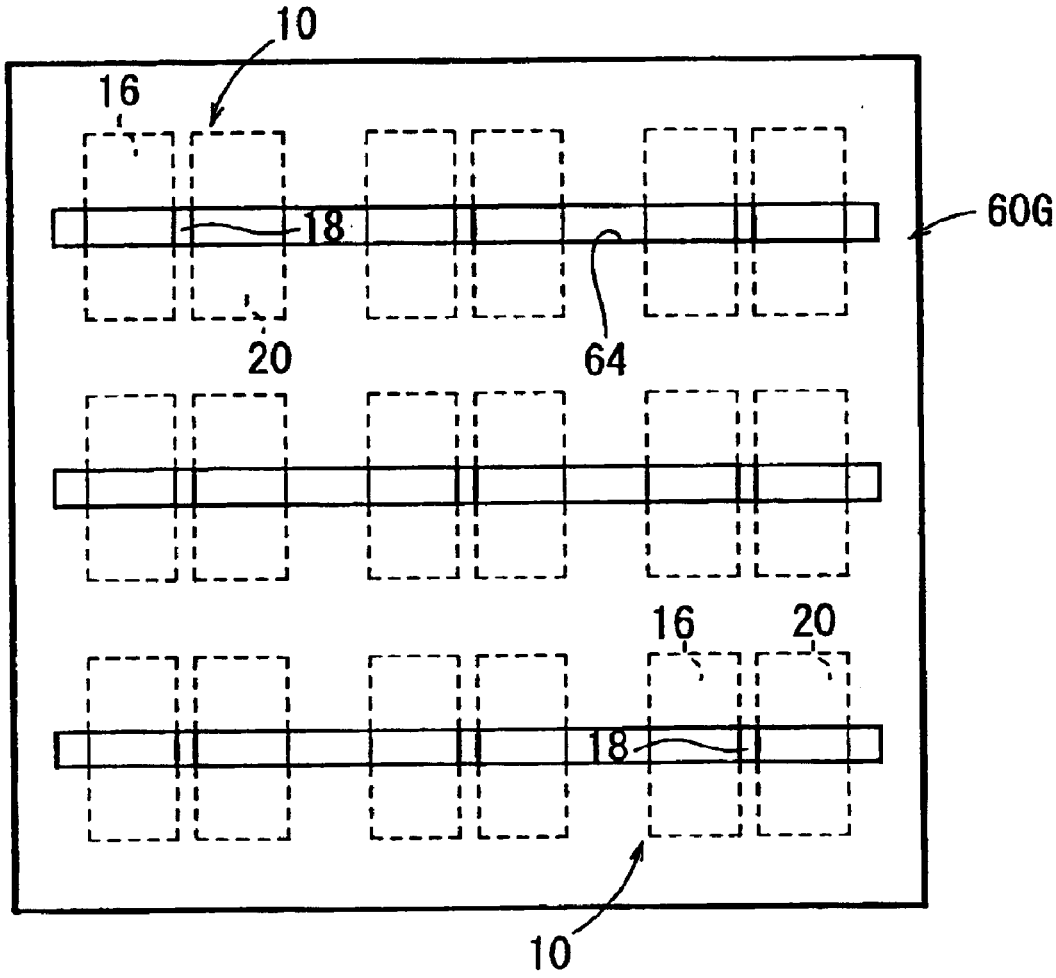
FIG. 47 is a plan view showing a portion of a control electrode according to a seventh specific example.

As shown in FIG. 47, a control electrode 60G according to a seventh specific example has substantially the same structure as the control electrode 60A according to the first specific example, but differs therefrom in that the windows 64 have a slit-shape extending in the longitudinal direction of the slits 18 of the electron emitters 10. Each of the windows 64 extends above the slits 18 corresponding to a horizontal array of electron emitters 10. The control electrode 60G is also advantageous in that it can easily be fabricated.

Figure 48:
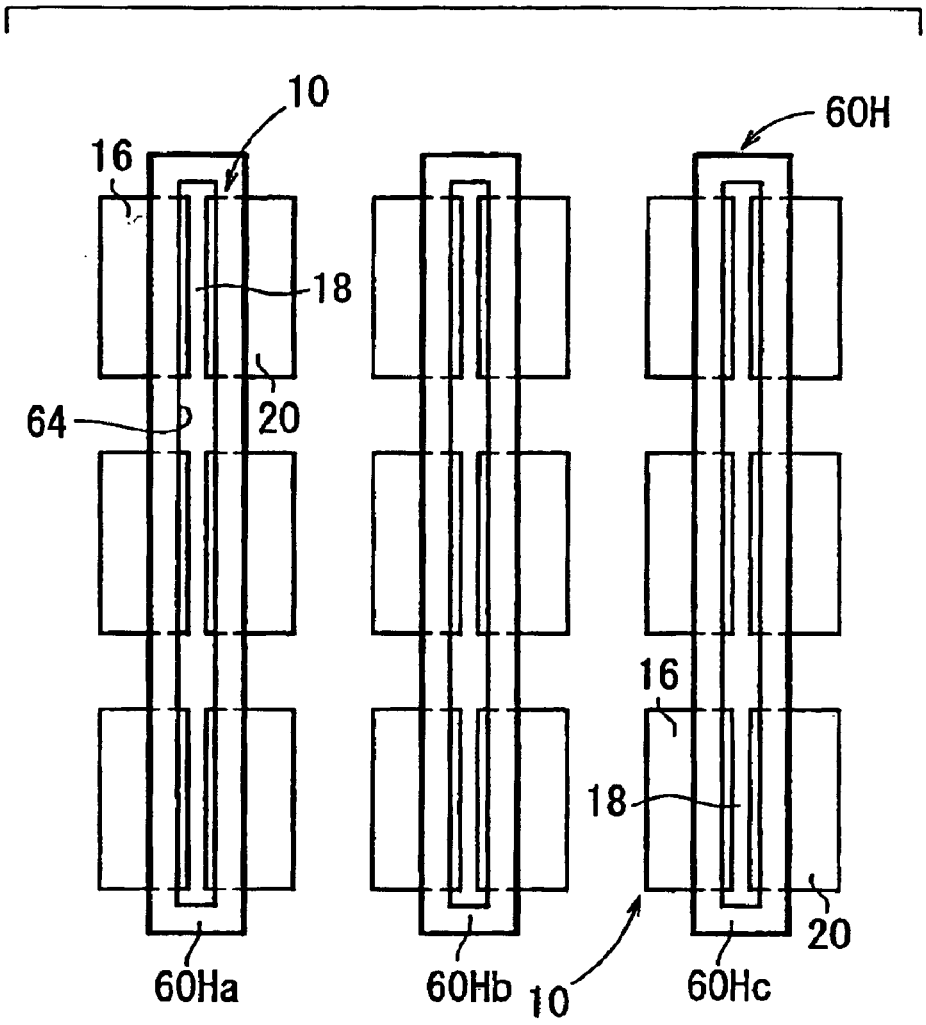
FIG. 48 is a plan view showing a portion of a control electrode according to an eighth specific example.

As shown in FIG. 48, a control electrode 60H according to an eighth specific example has substantially the same structure as the control electrode 60F according to the sixth specific example, but differs therefrom in that it has independent control electrodes in respective columns. The control electrodes can be driven in the respective columns.

For example, if the control electrode 60Ha in the first column is associated with red, the control electrode 60Hb in the second column with green, and the control electrode 60Hc in the third column with blue, then these different colors can independently be controlled for finely divided color adjustments. If the control electrode 60Ha in the first column is arranged in the left side of the screen, the control electrode 60Hb in the second column in the center of the screen, and the control electrode 60Hc in the third column in the right side of the screen, then these different positions of the screen can independently be controlled for luminance or color variation correction in each of different areas of the screen.

Figure 49:
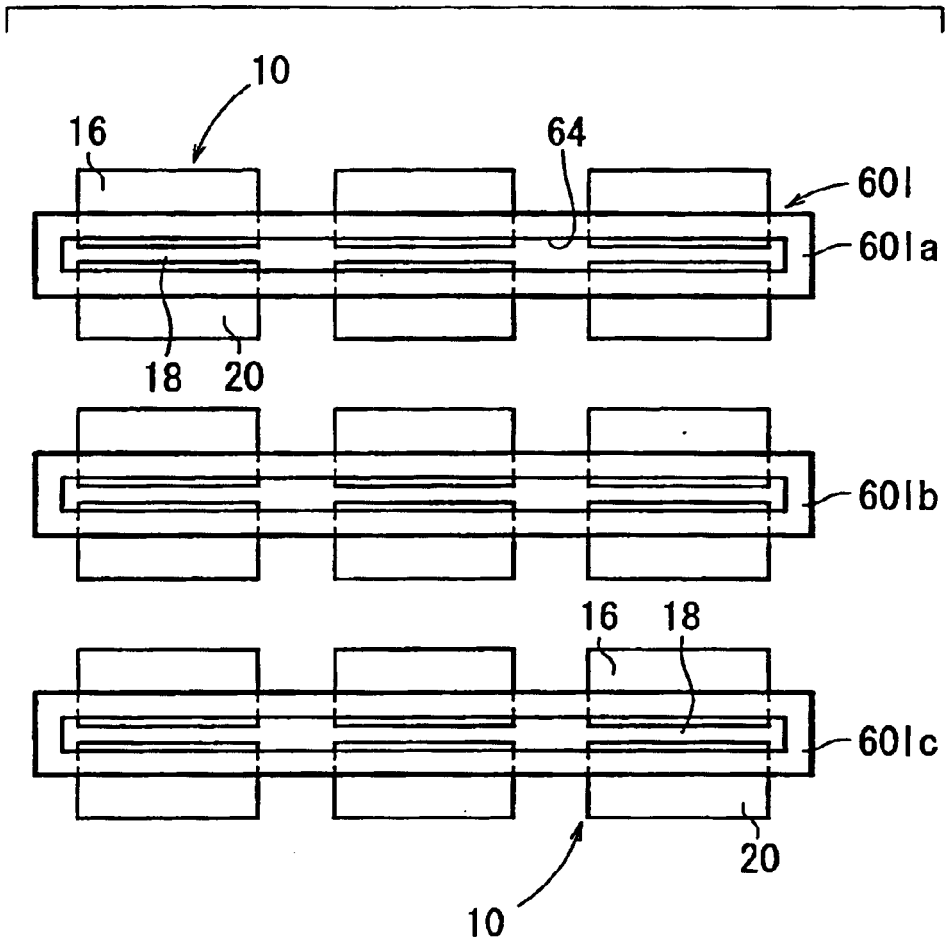
FIG. 49 is a plan view showing a portion of a control electrode according to a ninth specific example.

As shown in FIG. 49, a control electrode 60I according to a ninth specific example has substantially the same structure as the control electrode 60H according to the eighth specific example, but differs therefrom in that the slits 18 of the respective electron emitters 10 have their longitudinal directions oriented horizontally. In this case, the control electrodes 60I can be driven in the respective rows.

For example, if the control electrode 60Ia in the first row is associated with red, the control electrode 60Ib in the second row with green, and the control electrode 60Ic in the third row with blue, then these different colors can independently be controlled for finely divided color adjustments. If the control electrode 60Ia in the first row is arranged in the upper side of the screen, the control electrode 60Ib in the second row in the center of the screen, and the control electrode 60Ic in the third row in the lower side of the screen, then these different positions of the screen can independently be controlled for luminance or color variation correction in each of different areas of the screen.

Figure 50:
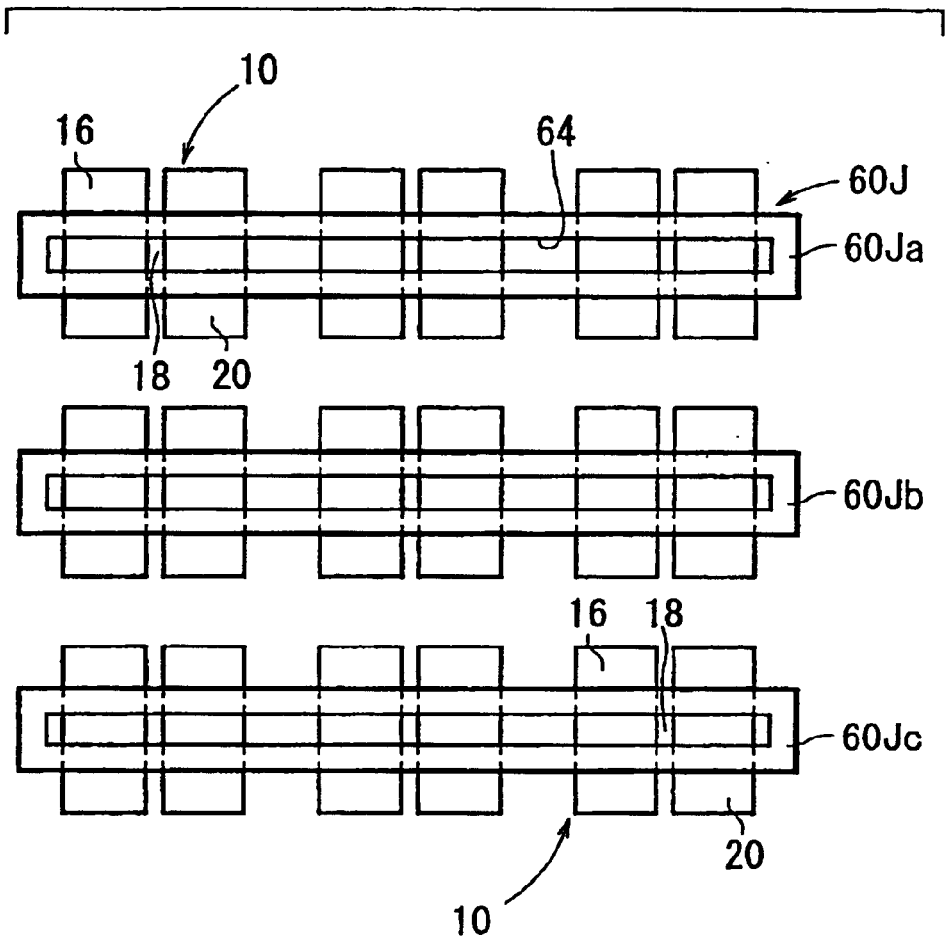
FIG. 50 is a plan view showing a portion of a control electrode according to a tenth specific example.

As shown in FIG. 50, a control electrode 60J according to a tenth specific example has substantially the same structure as the control electrode 60G according to the seventh specific example, but differs therefrom in that it has independent control electrodes in respective rows. The control electrodes 60J (60Ja, 60Jb, 60Jc) can be driven in the respective rows.

Figure 51:
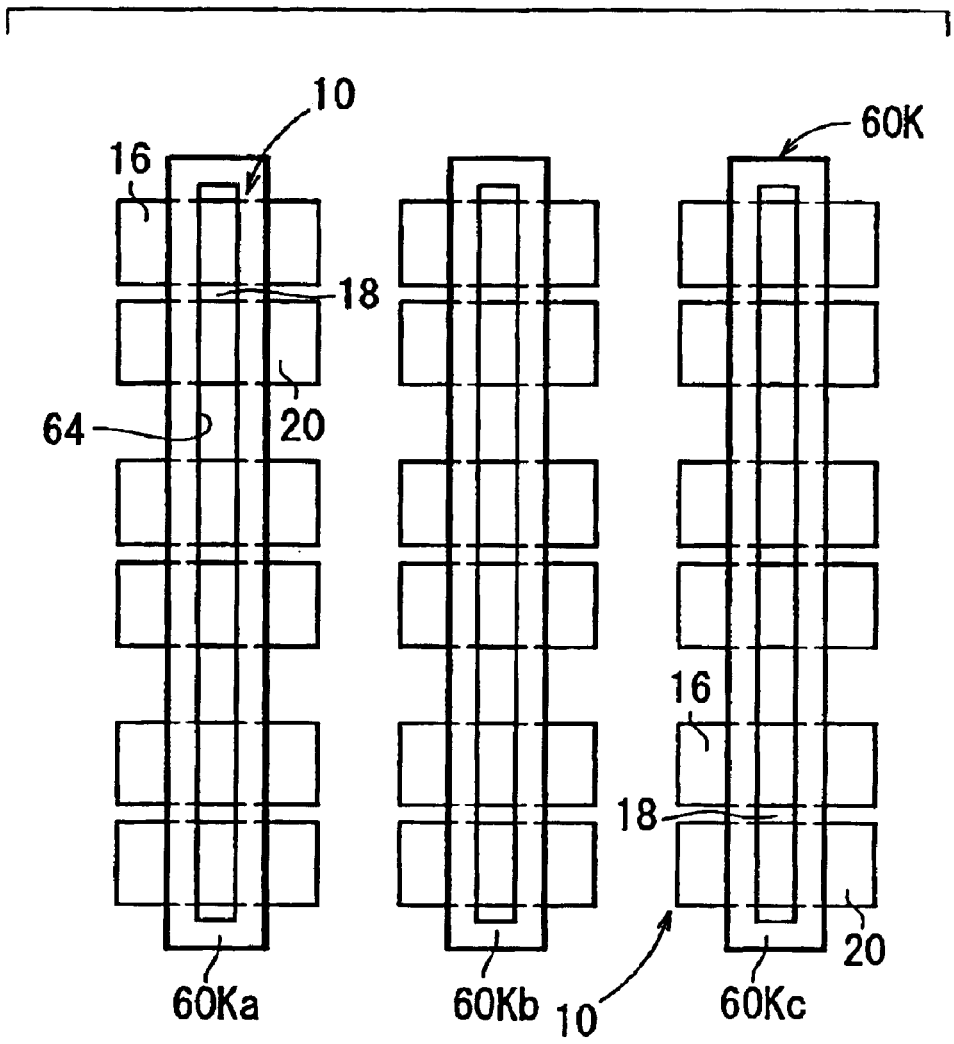
FIG. 51 is a plan view showing a portion of a control electrode according to an eleventh specific example.

As shown in FIG. 51, a control electrode 60K according to an eleventh specific example has substantially the same structure as the control electrode 60J according to the tenth specific example, but differs therefrom in that the slits 18 of the respective electron emitters 10 have their longitudinal directions oriented horizontally. In this case, the control electrodes 60K (60Ka, 60Kb, 60Kc) can be driven in the respective columns.

Figure 52:
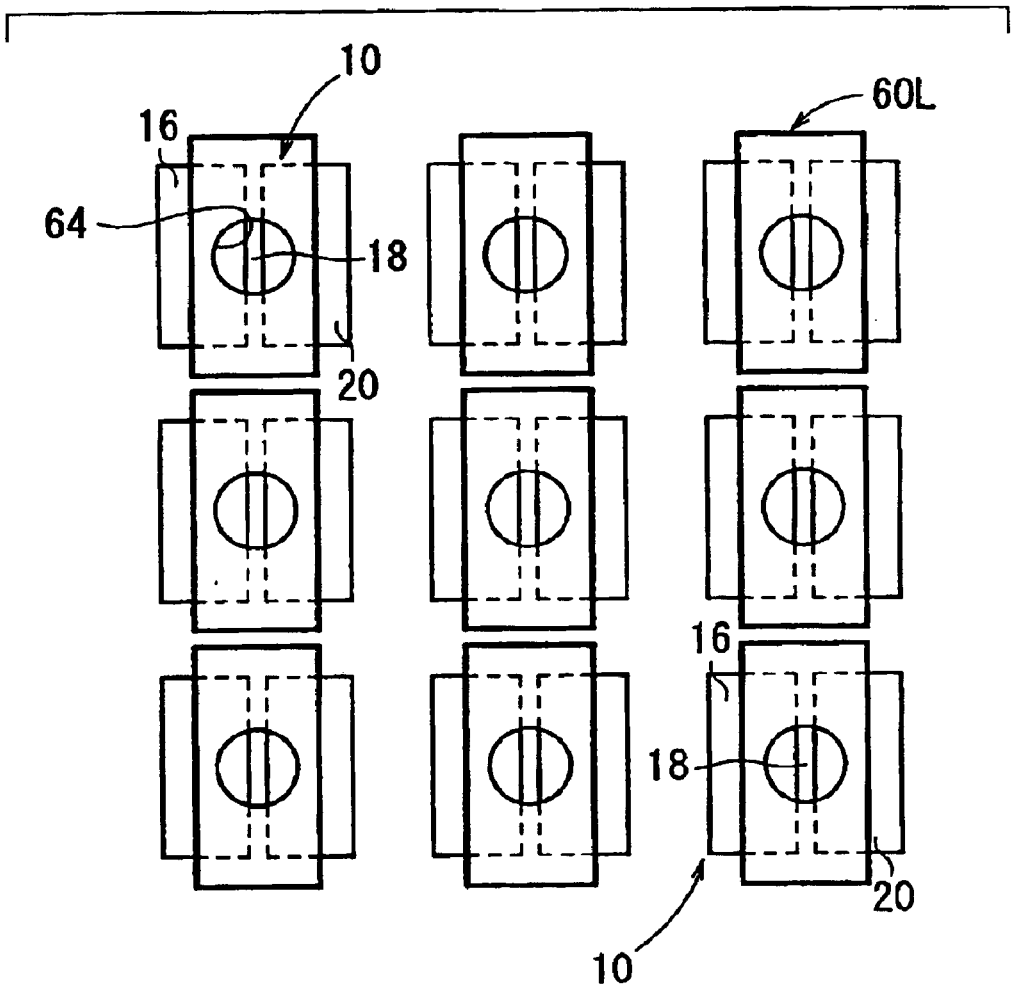
FIG. 52 is a plan view showing a portion of a control electrode according to a twelfth specific example.

As shown in FIG. 52, a control electrode 60L according to a twelfth specific example has substantially the same structure as the control electrode 60A according to the first specific example, but differs therefrom in that it has independent control electrodes associated with the respective electron emitters 10 (pixels). The control electrodes 60L can be driven for the respective electron emitters 10 (pixels) for luminance or color variation correction in each of the pixels.

Figure 53:
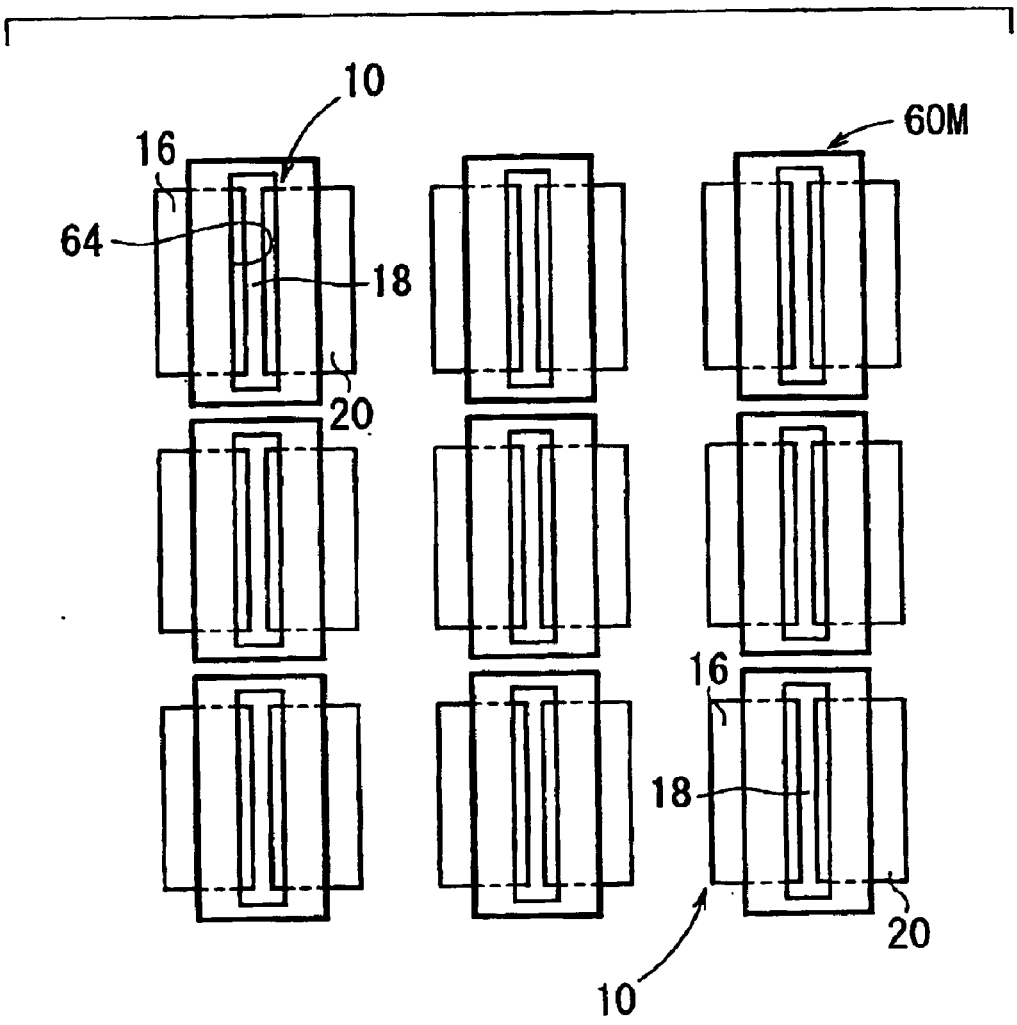
FIG. 53 is a plan view showing a portion of a control electrode according to a thirteenth specific example.

As shown in FIG. 53, a control electrode 60M according to a thirteenth specific example has substantially the same structure as the control electrode 60H according to the eighth specific example, but differs therefrom in that it has independent control electrodes associated with the respective electron emitters 10 (pixels). The control electrodes 60M can also be driven for the respective electron emitters 10 (pixels) for luminance or color variation correction in each of the pixels.

Figure 54:
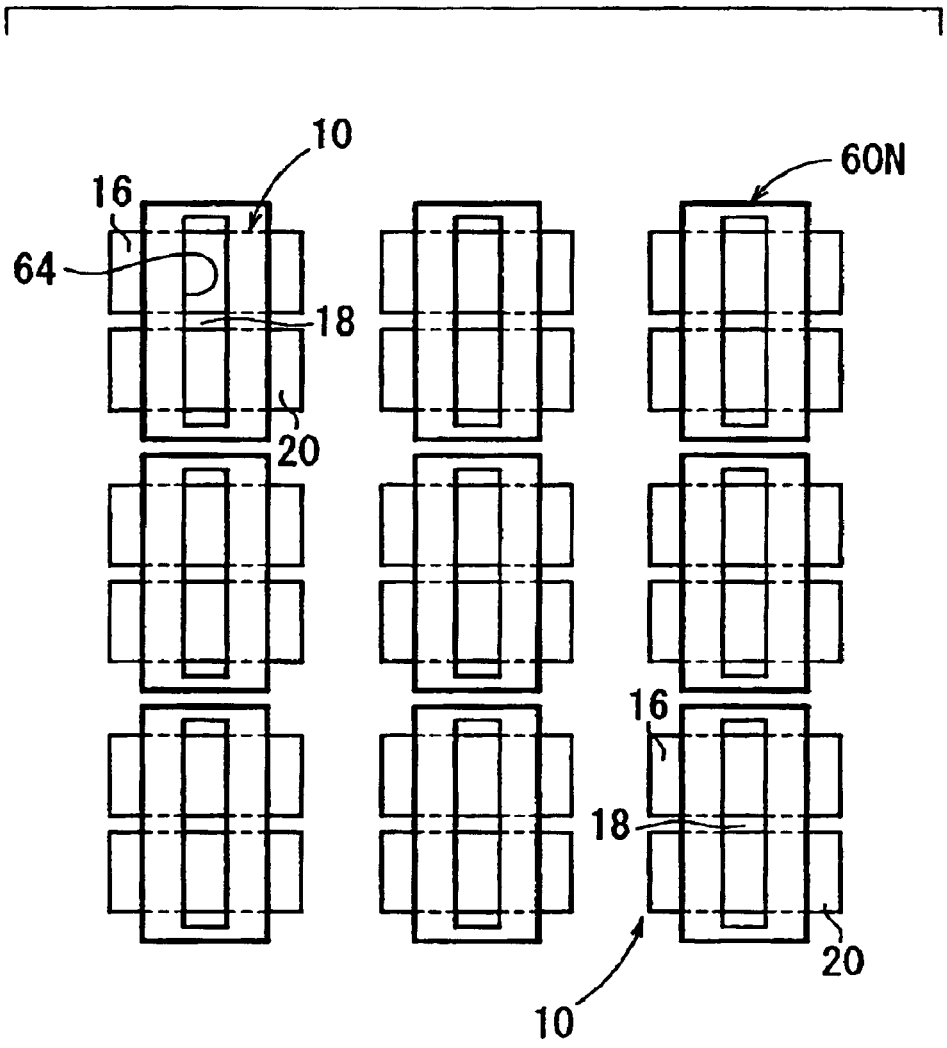
FIG. 54 is a plan view showing a portion of a control electrode according to a fourteenth specific example.

As shown in FIG. 54, a control electrode 60N according to a fourteenth specific example has substantially the same structure as the control electrode 60K according to the eleventh specific example, but differs therefrom in that it has independent control electrodes associated with the respective electron emitters 10 (pixels). The control electrodes 60N can also be driven for the respective electron emitters 10 (pixels) for luminance or color variation correction in each of the pixels.

As described above, with the display 100A according to the first embodiment, since each of the electron emitters 10 has the control electrode 60 disposed over the cathode electrode 16 and the anode electrode 20, the function of the collector electrode 50 can be made up for by the control electrode 60.

Specifically, the amount and acceleration of electrons can be controlled by appropriately adjusting the voltage applied between the collector electrode 50 and the anode electrode 20. In addition, the amount of electrons can be controlled by appropriately adjusting the level and pulse width of the signal applied to the control electrode 60. As a result, the amount and acceleration of electrons can be controlled independently to control finely divided gradations.

Since the ability of emitted electrons to travel straight can be increased by appropriately adjusting the level and pulse width of the signal applied to the control electrode 60, crosstalk between the electron emitters 10 can effectively be suppressed.

Figure 55:
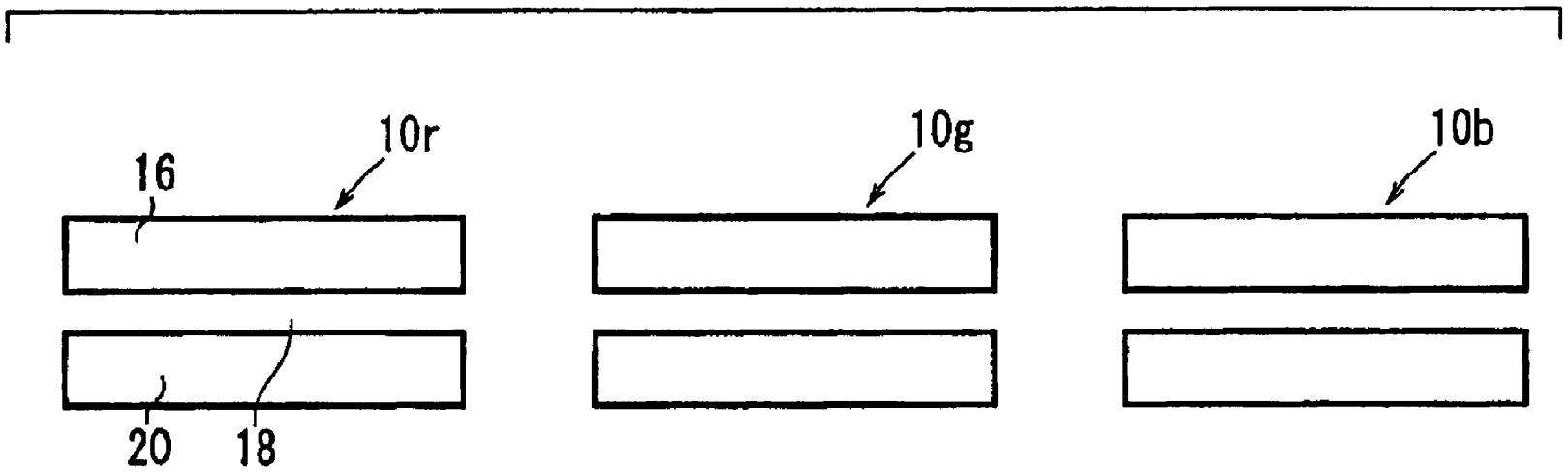
FIG. 55 is a view showing a pixel array for displaying a color image on a display free of a control electrode.

If color images are to be displayed by a display free of the control electrodes 60, then, as shown in FIG. 55, three kinds of electron emitters (electron emitters 10*r* for red, electron emitters 10*g* for green, and electron emitters 10*b* for blue) are required.

Figure 56:
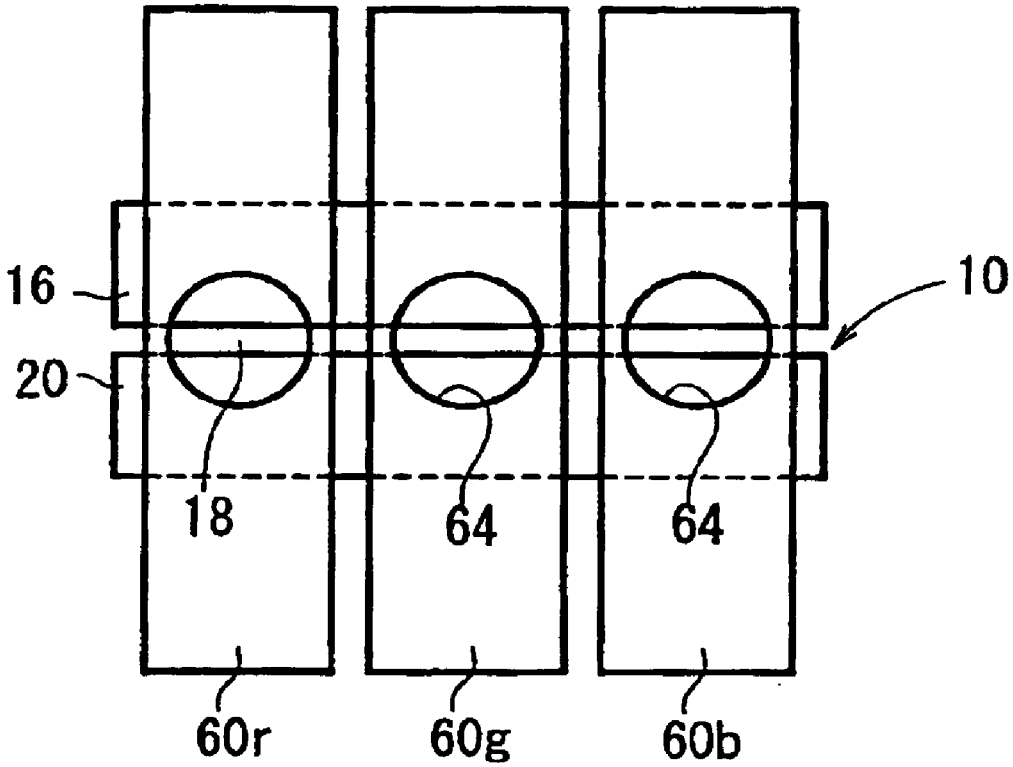
FIG. 56 is a view showing a pixel array for displaying a color image on the display according to the first embodiment.

With the display 100A according to the first embodiment which has the control electrodes 60, as shown in FIG. 56, a color image can be displayed by one electron emitter 10 by providing the electron emitter 10 with three control electrodes (a control electrode 60*r* for red, a control electrode 60*g* for green, and a control electrode 60*b* for blue). For example, the electron emitter 10 can emit blue light by setting the signal between the cathode electrode 16 and the anode electrode 20 thereof to an on voltage level and setting the signal between the blue control electrode 60*b* and the anode electrode 20 to an on voltage level.

With the above arrangement, the pitch of the pixels can be reduced for displaying high-definition images. If the control electrodes 60 are dispensed with, then the pitch of the pixels is determined by the size of the electron emitters 10. If the control electrodes 60 are provided, then the pitch of the pixels is determined by the line width of the control electrodes 60 and the line width of the fluorescent layer 106 (see FIG. 32). This indicates that the pitch of the pixels is not limited by the size of the electron emitters 10, allowing the display to be designed with increased freedom for displaying high-definition images.

In the example shown in FIG. 56, one electron emitter 10 is combined with three control electrodes 60*r*, 60*g*, 60*b*. However, the number of control electrodes 60 combined with one electron emitter 10 may be increased for displaying higher-definition images.

Modifications of the display 100A according to the first embodiment will be described below with reference to FIGS. 57 through 66.

Figure 57:
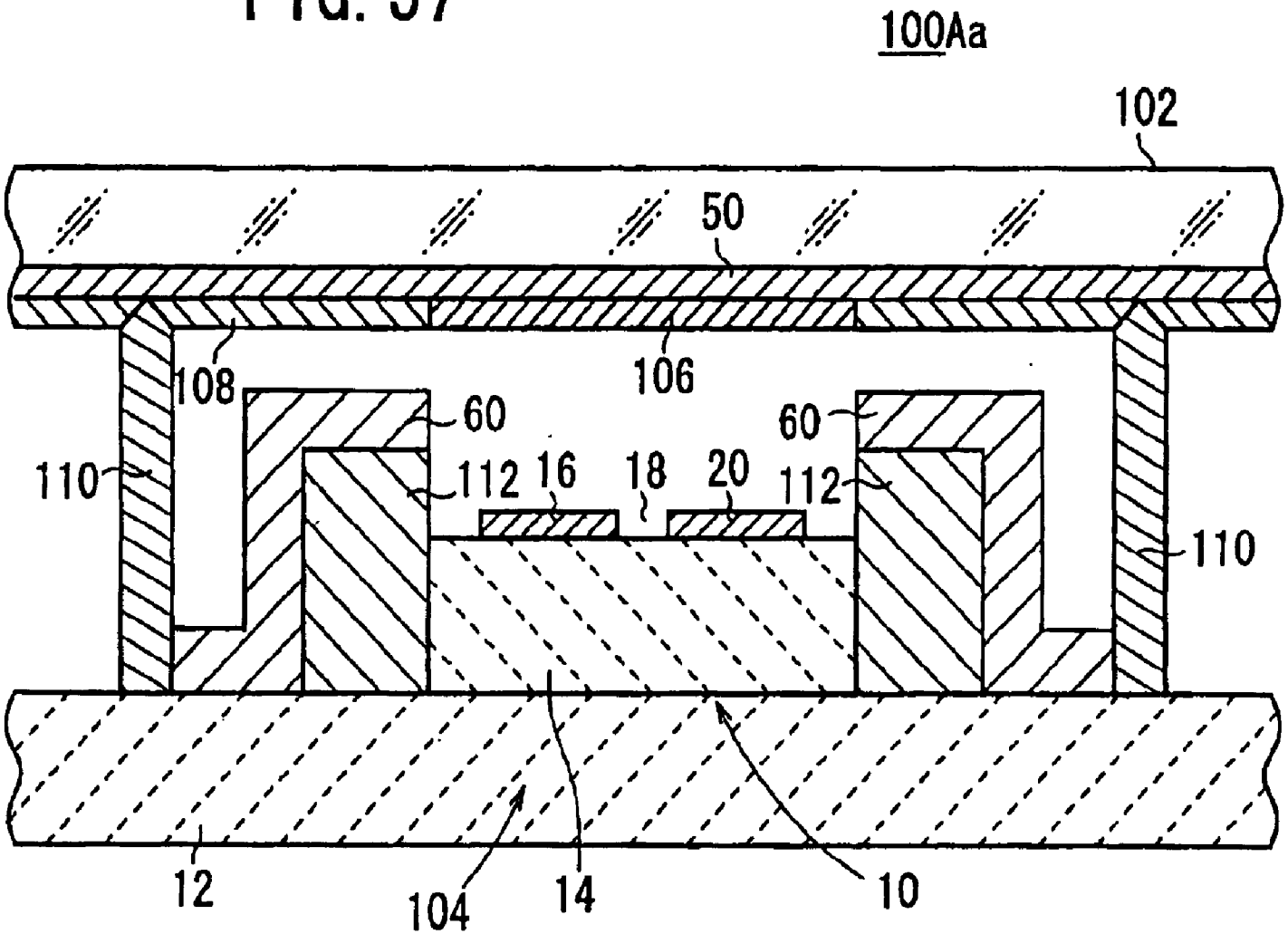
FIG. 57 is a view showing a portion of a display according to a first modification of the first embodiment.

As shown in FIG. 57, a display 100Aa according to a first modification has substantially the same structure as the display 100A according to the first embodiment, but differs therefrom in that the control electrode 60 is formed continuously from the upper surface of the insulating layer 112 to side faces thereof and a portion of the substrate 12. Since the control electrode 60 has a wider area, it is effective to reduce a parasitic resistance and a parasitic inductance, allowing the high-frequency pulse signal to be modulated with high fidelity.

If the thickness of the insulating layer 112 is increased, then when the control electrode 60 is formed on the upper surface of the insulating layer 112, the insulating layer 112 tends to warp due to the load from the control electrode 60, vibrations that occur when the display is used, and the weight of the insulating layer 112 itself, resulting in a failure to control emitted electrons with accuracy. According to the present example, however, since the portion of the control electrode 60 which continuously extends from the side faces of the insulating layer 112 to the portion of the substrate 12 functions as a support member for the insulating layer 112, the insulating layer 112 is prevented from warping, thus permitting emitted electrons to be controlled with accuracy.

Figure 58:
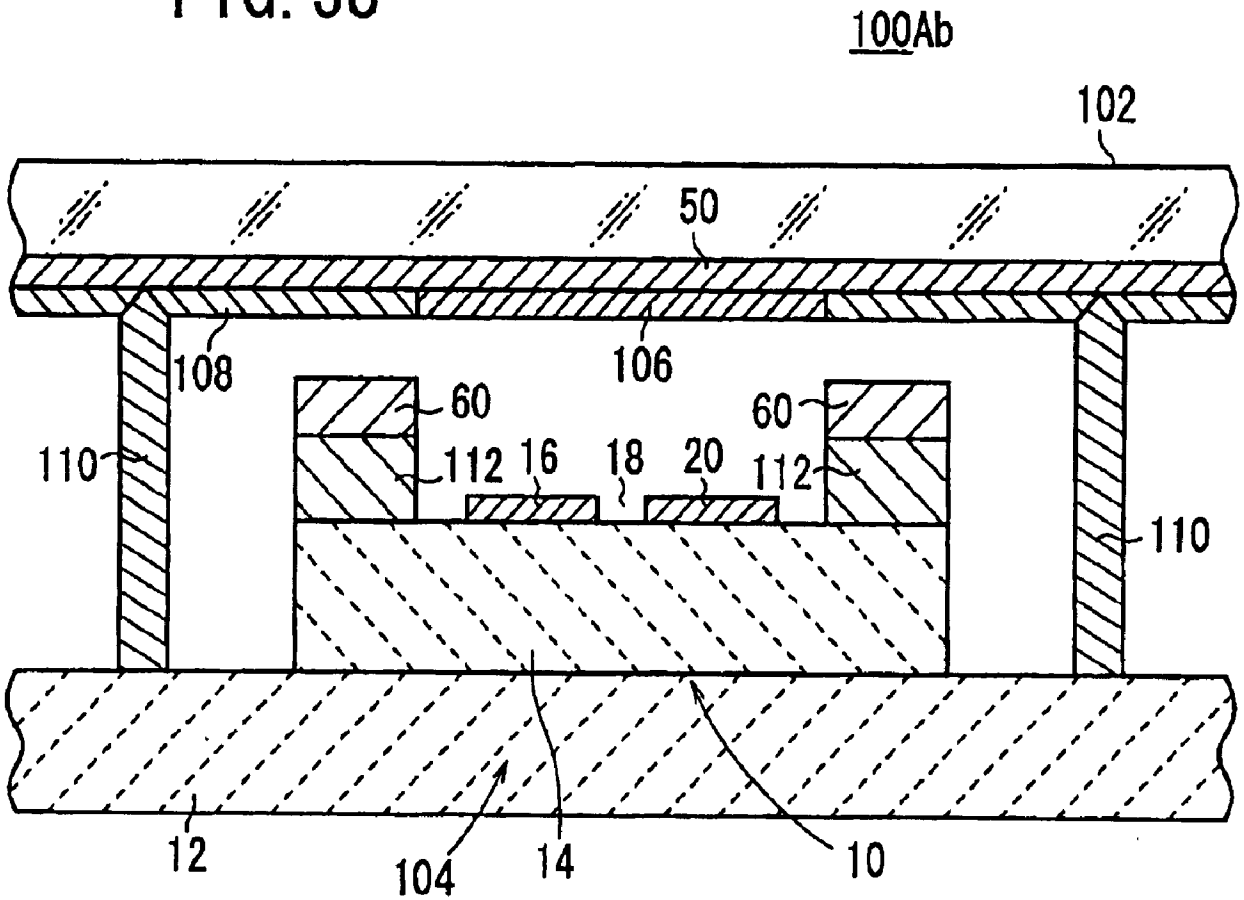
FIG. 58 is a view showing a portion of a display according to a second modification of the first embodiment.

As shown in FIG. 58, a display 100Ab according to a second modification has substantially the same structure as the display 100A according to the first embodiment, but differs therefrom in that the insulating layer 112 is formed on a peripheral region of the upper surface of the electric field receiving member 14 and the control electrode 60 is formed on the upper surface of the insulating layer 112.

Since the thickness of the insulating layer 112 is reduced, the insulating layer 112 does not warp and emitted electrons can be controlled with accuracy.

Figure 59:
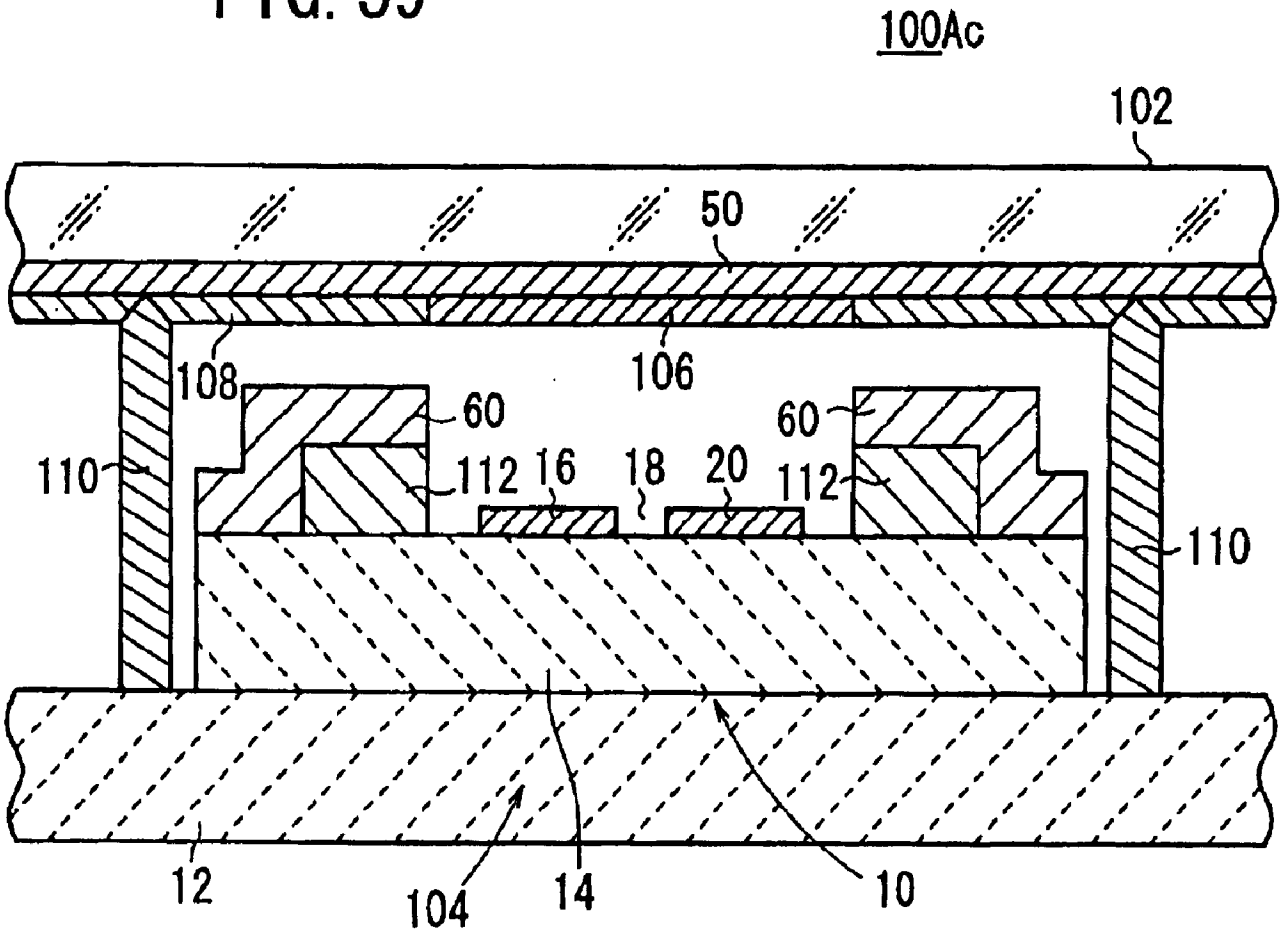
FIG. 59 is a view showing a portion of a display according to a third modification of the first embodiment.

As shown in FIG. 59, a display 100Ac according to a third modification has substantially the same structure as the display 100Ab according to the second modification, but differs therefrom in that the control electrode 60 is formed continuously from the upper surface of the insulating layer 112 to side faces thereof and a portion (peripheral portion) of the electric field receiving member 14.

Figure 60:
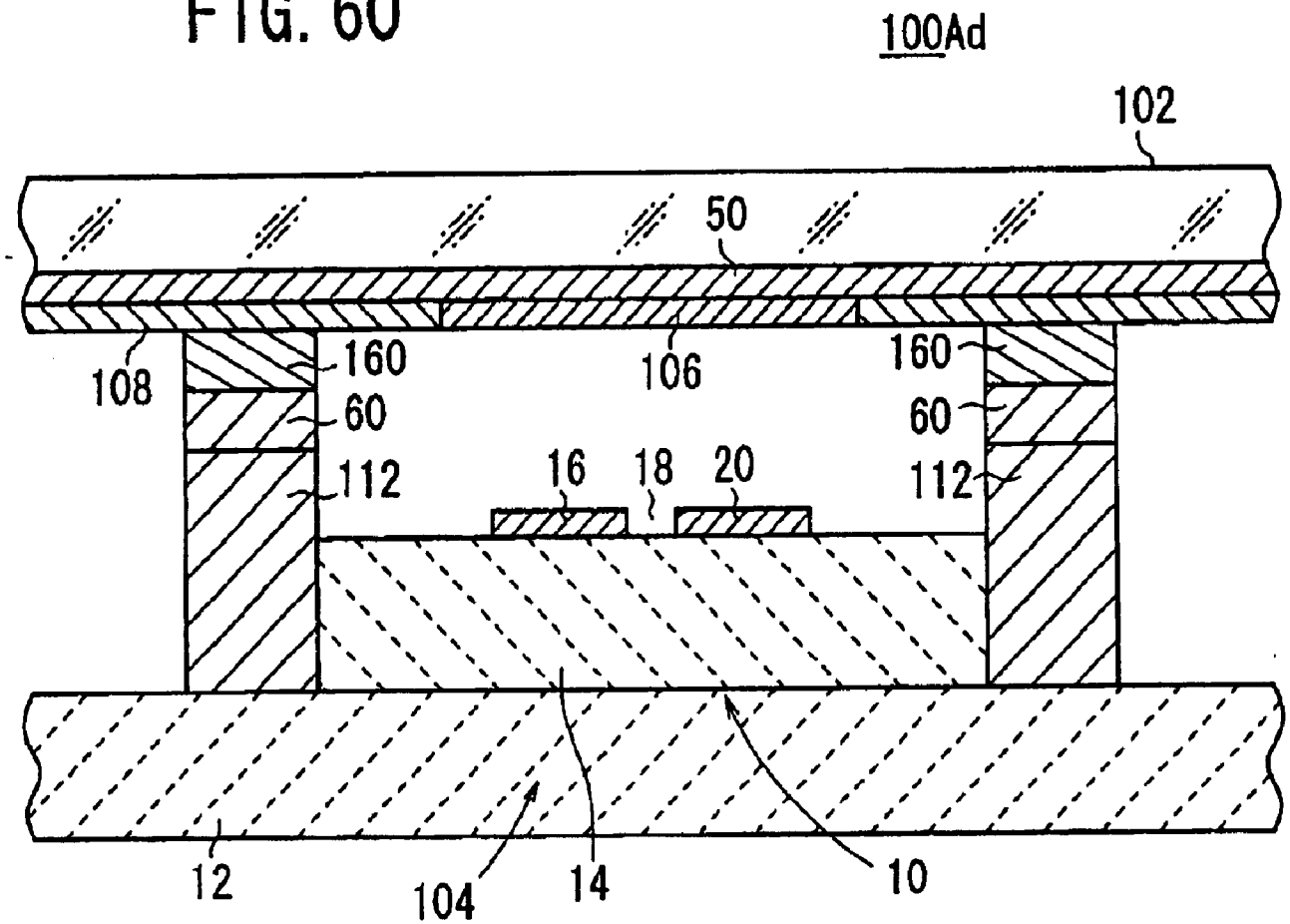
FIG. 60 is a view showing a portion of a display according to a fourth modification of the first embodiment.

As shown in FIG. 60, a display 100Ad according to a fourth modification has substantially the same structure as the display 100A according to the first embodiment, but differs therefrom in that an insulating layer 160 is interposed between the control electrode 60 and the glass substrate 102, with the insulating layer 112, the control electrode 60, and the insulating layer 160 jointly making up a multilayer structure doubling as the beam 110 (see FIG. 32).

Since no beams need to be formed between the electron emitters 10, the electron emitters 10 can be highly integrated.

Figure 61:
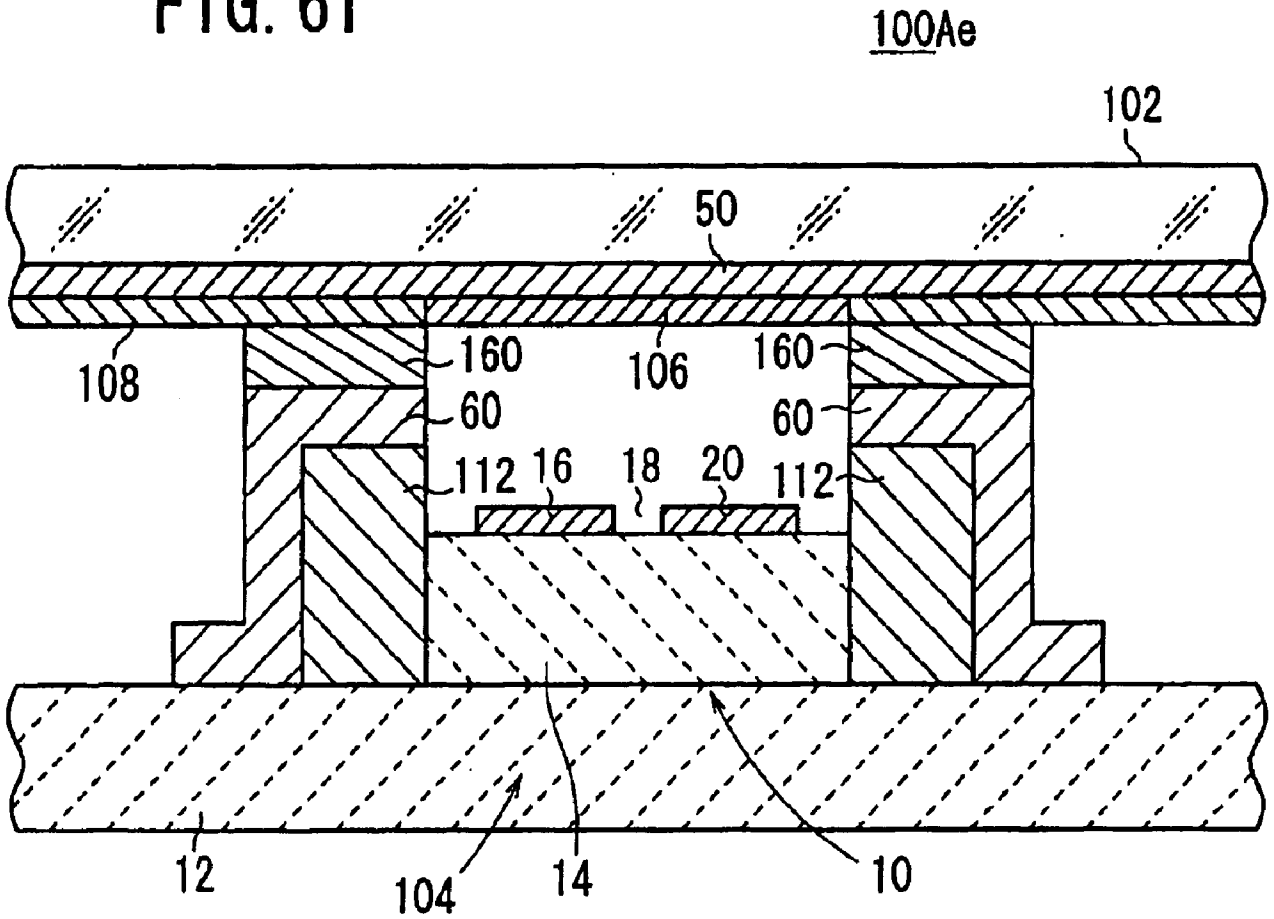
FIG. 61 is a view showing a portion of a display according to a fifth modification of the first embodiment.

As shown in FIG. 61, a display 100Ae according to a fifth modification has substantially the same structure as the display 100Aa according to the first modification, but differs therefrom in that the insulating layer 160 is interposed between the control electrode 60 and the glass substrate 102, with the insulating layer 112, the control electrode 60, and the insulating layer 160 jointly making up a multilayer structure doubling as the beam.

Figure 62:
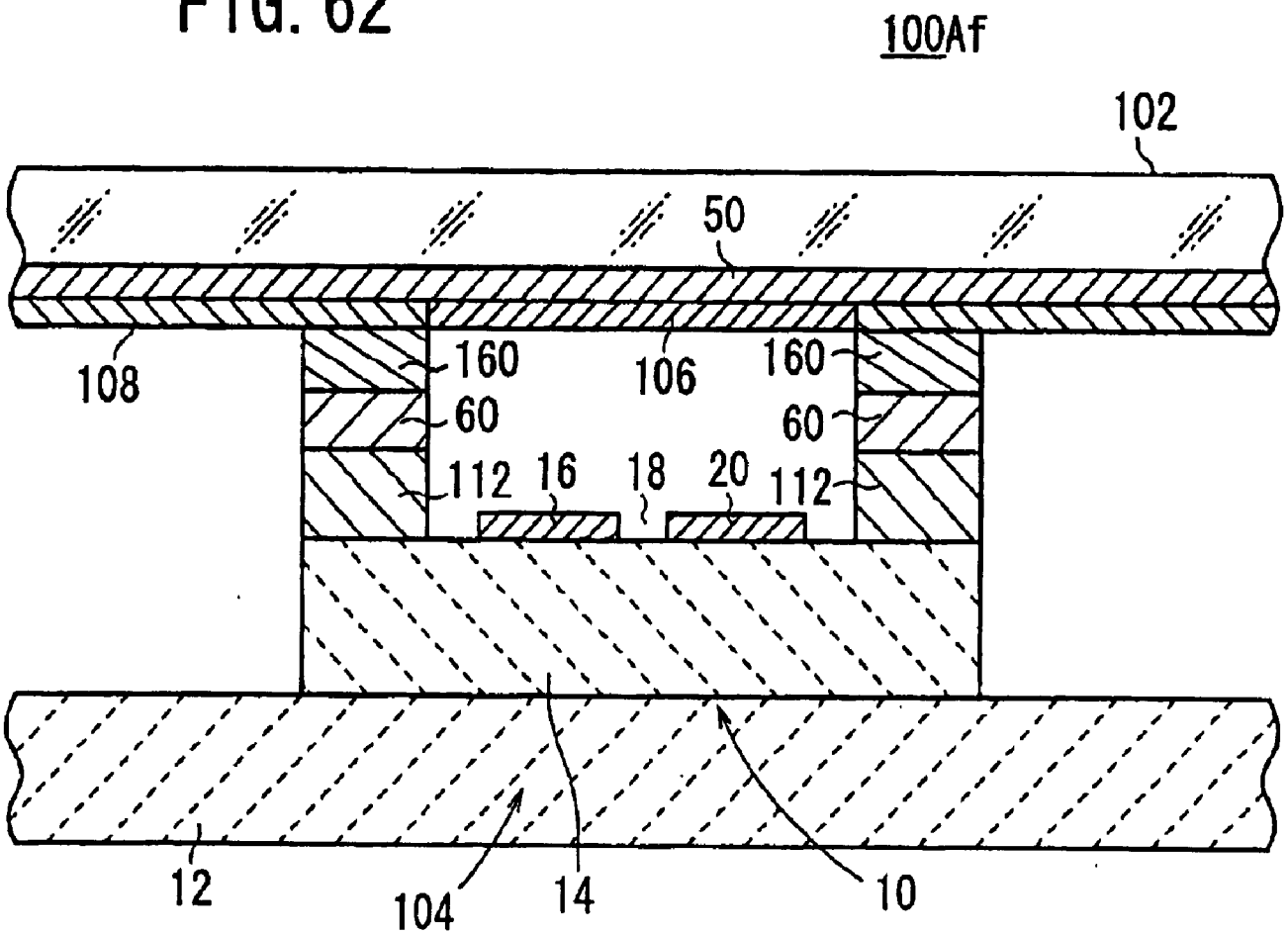
FIG. 62 is a view showing a portion of a display according to a sixth modification of the first embodiment.

As shown in FIG. 62, a display 100Af according to a sixth modification has substantially the same structure as the display 100Ab according to the second modification, but differs therefrom in that the insulating layer 160 is interposed between the control electrode 60 and the glass substrate 102, with the insulating layer 112, the control electrode 60, and the insulating layer 160 jointly making up a multilayer structure doubling as the beam.

Figure 63:
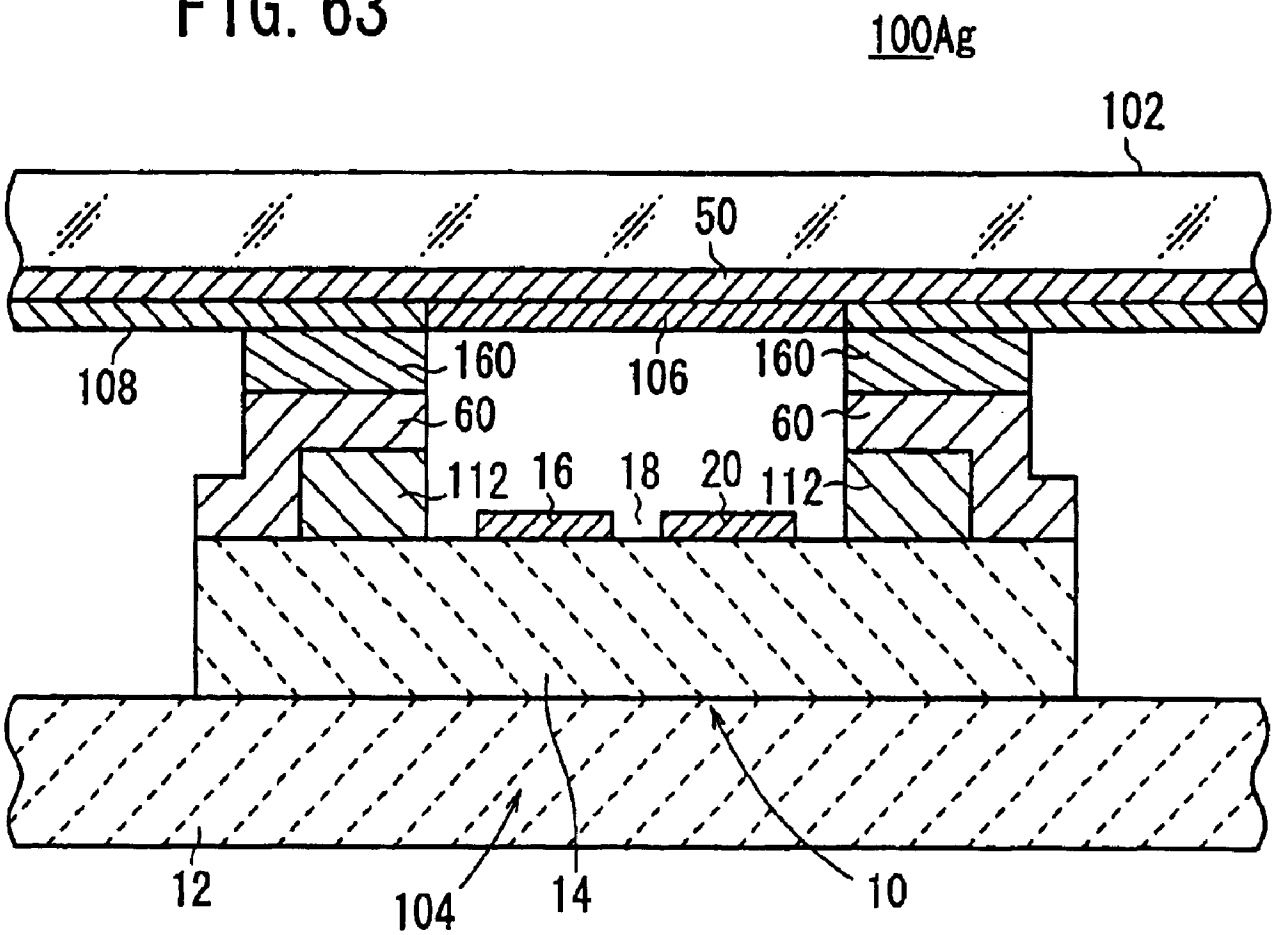
FIG. 63 is a view showing a portion of a display according to a seventh modification of the first embodiment.

As shown in FIG. 63, a display 100Ag according to a seventh modification has substantially the same structure as the display 100Ac according to the third modification, but differs therefrom in that the insulating layer 160 is interposed between the control electrode 60 and the glass substrate 102, with the insulating layer 112, the control electrode 60, and the insulating layer 160 jointly making up a multilayer structure doubling as the beam.

Figure 64:
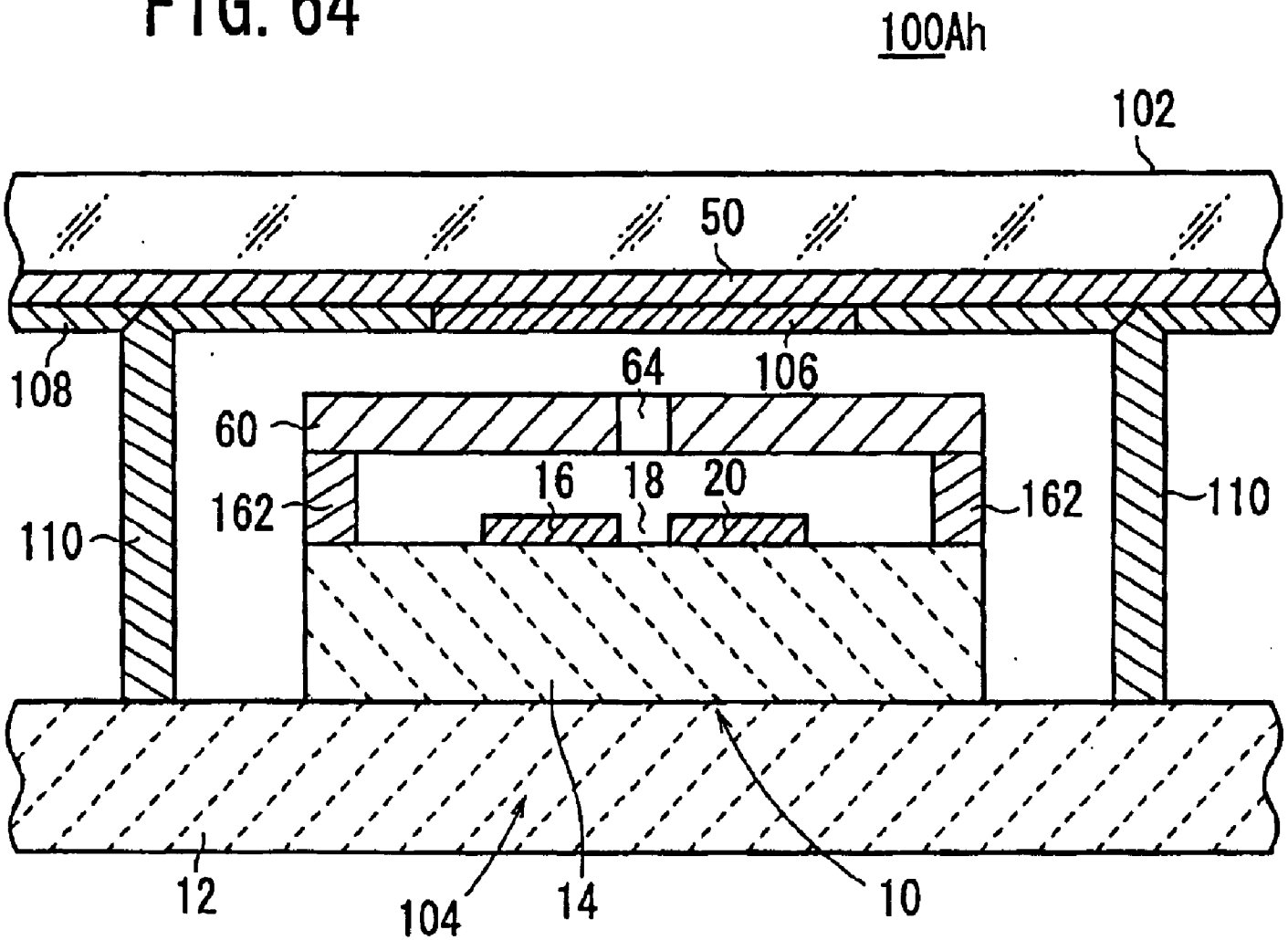
FIG. 64 is a view showing a portion of a display according to an eighth modification of the first embodiment.

As shown in FIG. 64, a display 100Ah according to an eighth modification has substantially the same structure as the display 100A according to the first embodiment, but differs therefrom in that second beams 162 are fixed to peripheral regions of the upper surface of the electric field receiving member 14 by an adhesive, for example, and the control electrode 60 is mounted on and kept taut between the upper surfaces of the second beams 162.

Figure 65:
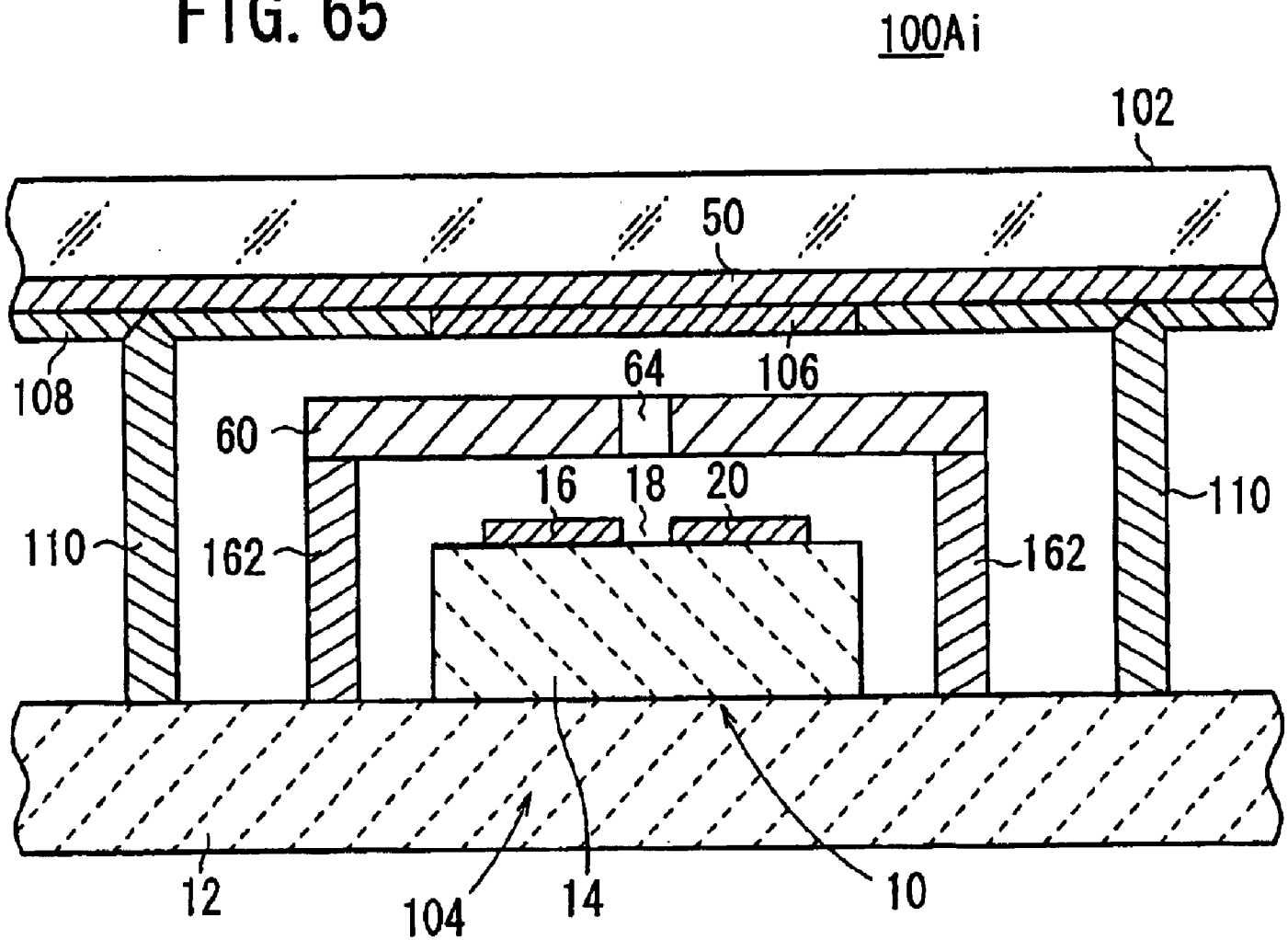
FIG. 65 is a view showing a portion of a display according to a ninth modification of the first embodiment.

As shown in FIG. 65, a display 100Ai according to a ninth modification has substantially the same structure as the display 100A according to the first embodiment, but differs therefrom in that the second beams 162 are fixed to regions of the upper surface of the substrate 12 close to the electric field receiving member 14 by an adhesive, for example, and the control electrode 60 is mounted on and kept taut between the upper surfaces of the second beams 162.

Figure 66:
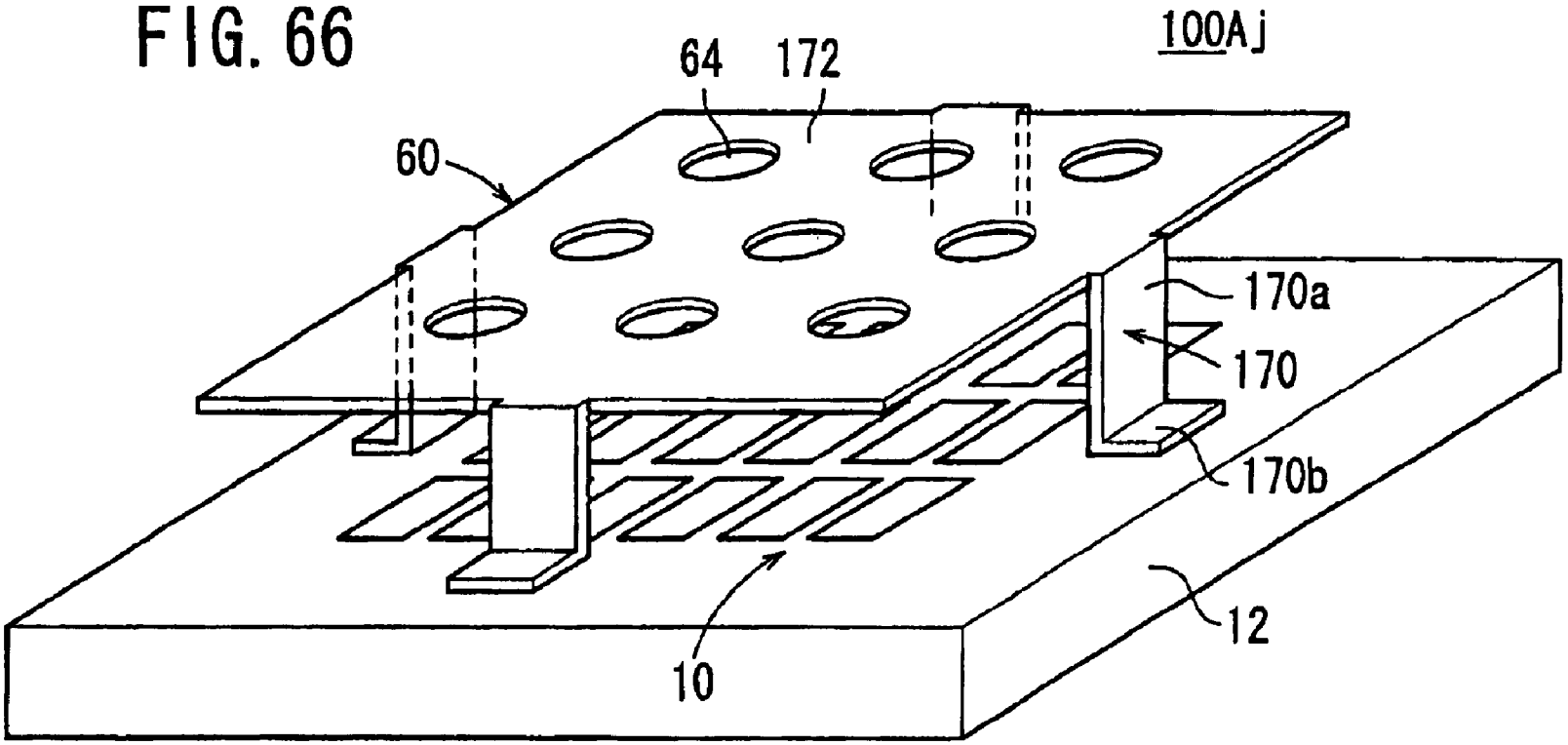
FIG. 66 is a view showing a portion of a display according to a tenth modification of the first embodiment.

As shown in FIG. 66, a display 100Aj according to a tenth modification differs in that the control electrode 60 comprises a plurality of erected members 170 and an electrode body 172 lying parallel to the substrate 12 and integrally formed with the erected members 170. Each of the vertical erected 170 comprises an erected leg 170*a* and a bent foot 170*b* which are integrally joined to each other, and has an L-shaped cross section. The bent feet 170*b* of the erected members 170 are fixed to peripheral regions of the upper surface of the substrate 12 by an adhesive, for example.

Figure 67:
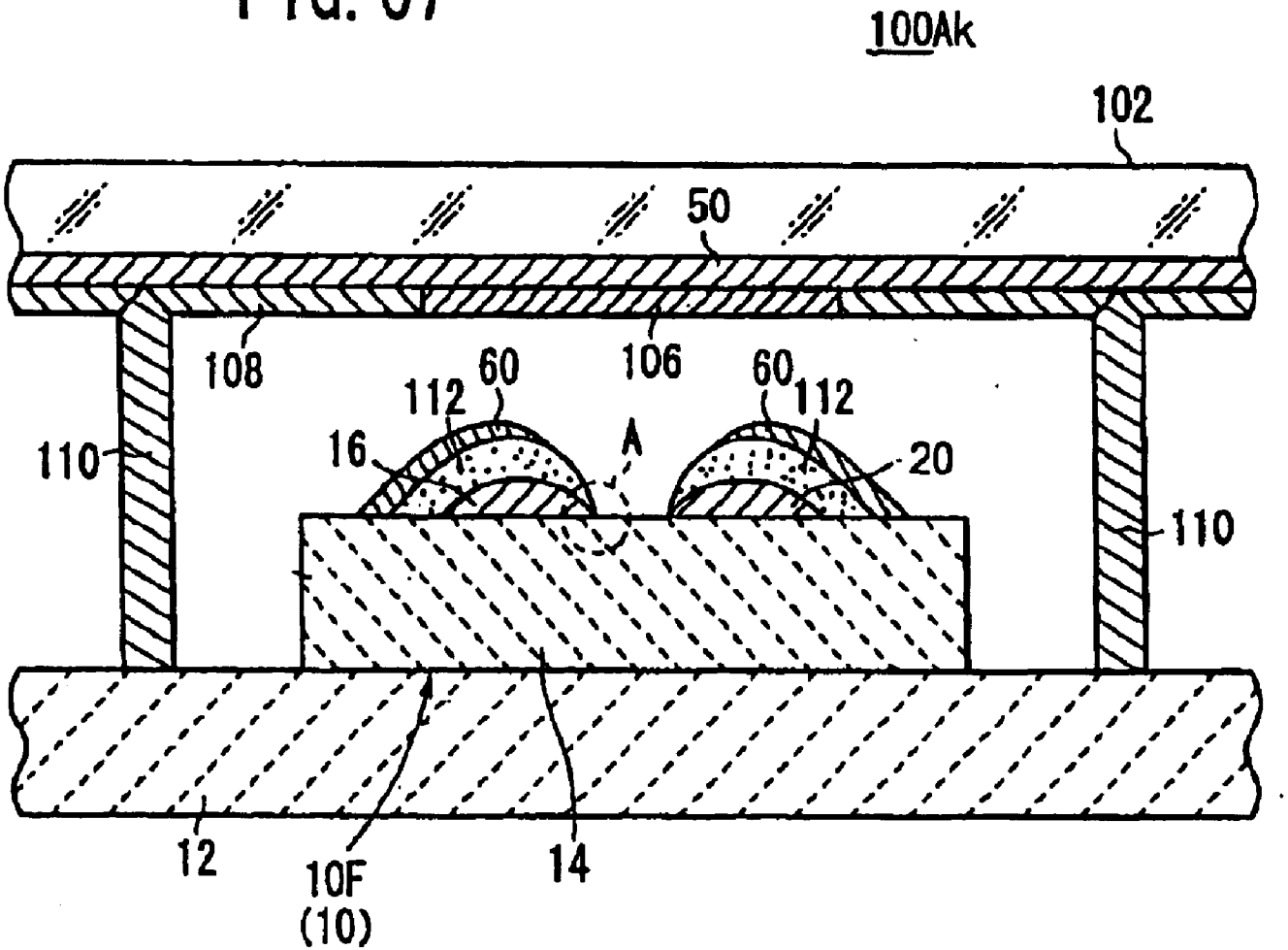
FIG. 67 is a view showing a portion of a display according to an eleventh modification of the first embodiment.

As shown in FIG. 67, a display 100Ak according to an eleventh modification differs in that its electron emitter (an electron emitter 10F according to a sixth embodiment) has insulating layers 112 formed on the cathode electrode 16 and the anode electrode 20 on the upper surface of the electric field receiving member 14, and also has control electrodes 60 in the form of an electrode film formed on the insulating layers 112.

As described above, when the voltage of an on voltage level is applied to the cathode electrode 16, electrons are emitted from the electric field concentration point A or the interface between the cathode electrode 16 and the electric field receiving member 14.

Of the emitted electrons (primary electrons), electrons attracted to the anode electrode 20 and secondary electrons generated when those electrons impinge upon the electric field receiving member 14 ionize a gas present in the vicinity of the anode electrode 20 or atoms floating in the vicinity of the anode electrode 20 due to evaporation of the electrode, producing positive ions and electrons.

The produced positive ions may impinge upon the cathode electrode 16, for example, and damage the cathode electrode 16.

With the electron emitter 10G in the display 100Ak according to the eleventh modification, however, since the insulating layers 112 are formed on the respective surfaces of the cathode electrode 16 and the anode electrode 20, positive ions are prevented from impinging upon the cathode electrode 16 and hence damaging the cathode electrode 16.

A display 10Am according to a twelfth modification will be described below with reference to FIG. 68.

Figure 68:
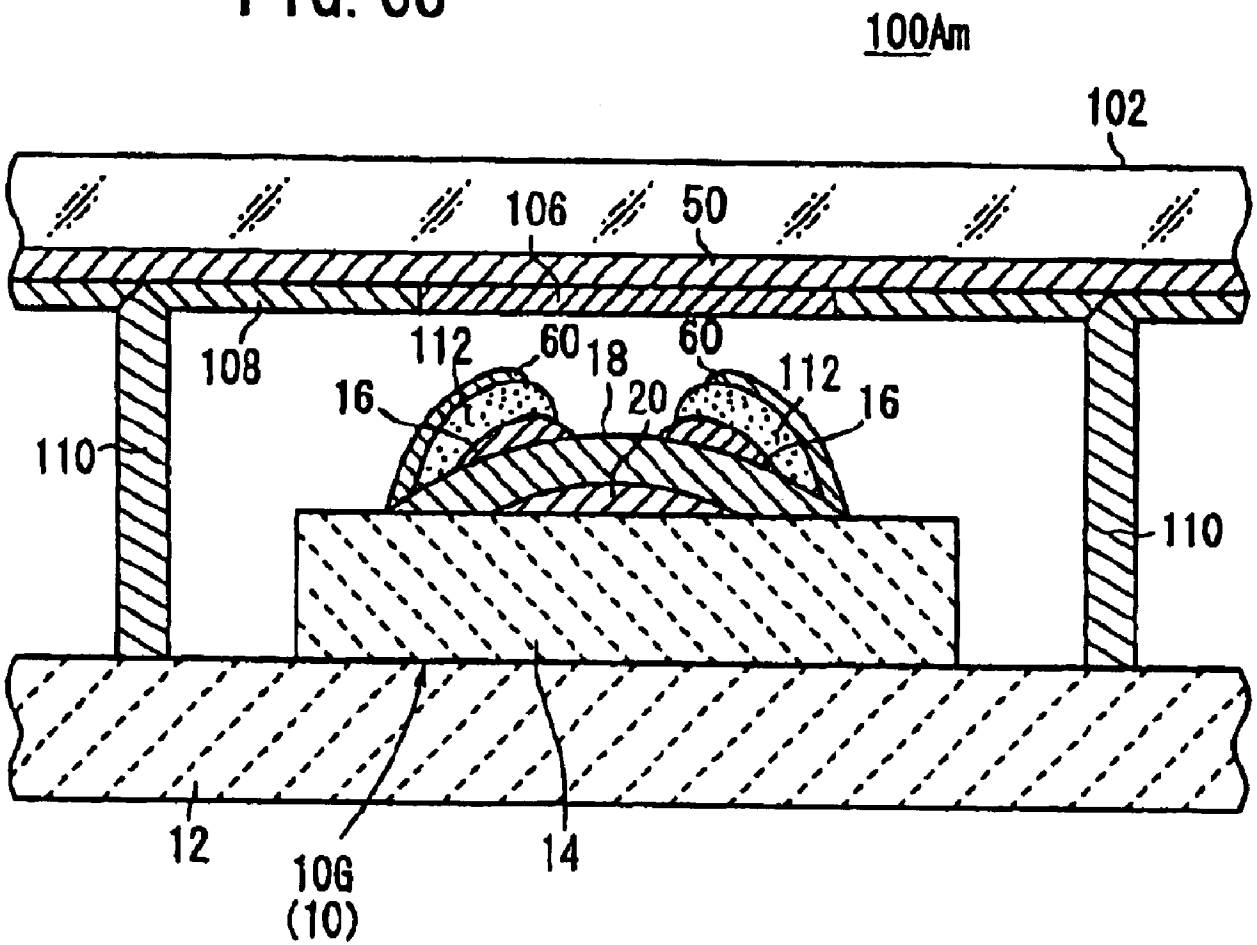
FIG. 68 is a view showing a portion of a display according to a twelfth modification of the first embodiment.

The display 10Am according to the twelfth modification has an electron emitter (an electron emitter 10G according to a seventh embodiment) has the following structure:

As shown in FIG. 68, the anode electrode 20 is formed on the substrate 12, the electric field receiving member 14 on the substrate 12 to cover the anode electrode 20, and the cathode electrode 16 on the electric field receiving member 14, the cathode electrode 16 being of a ring shape with the slit 18 defined centrally therein. The insulating layer 112 is formed on the ring-shaped cathode electrode 16, and the control electrode 60 in the form of an electrode film is formed on the insulating layer 112.

A display 100B according to a second embodiment will be described below with reference to FIG. 69. The electron emitters 10A through 10H according to the above embodiments will collectively be referred to as the electron emitter 10 in the description which follows.

Figure 69:
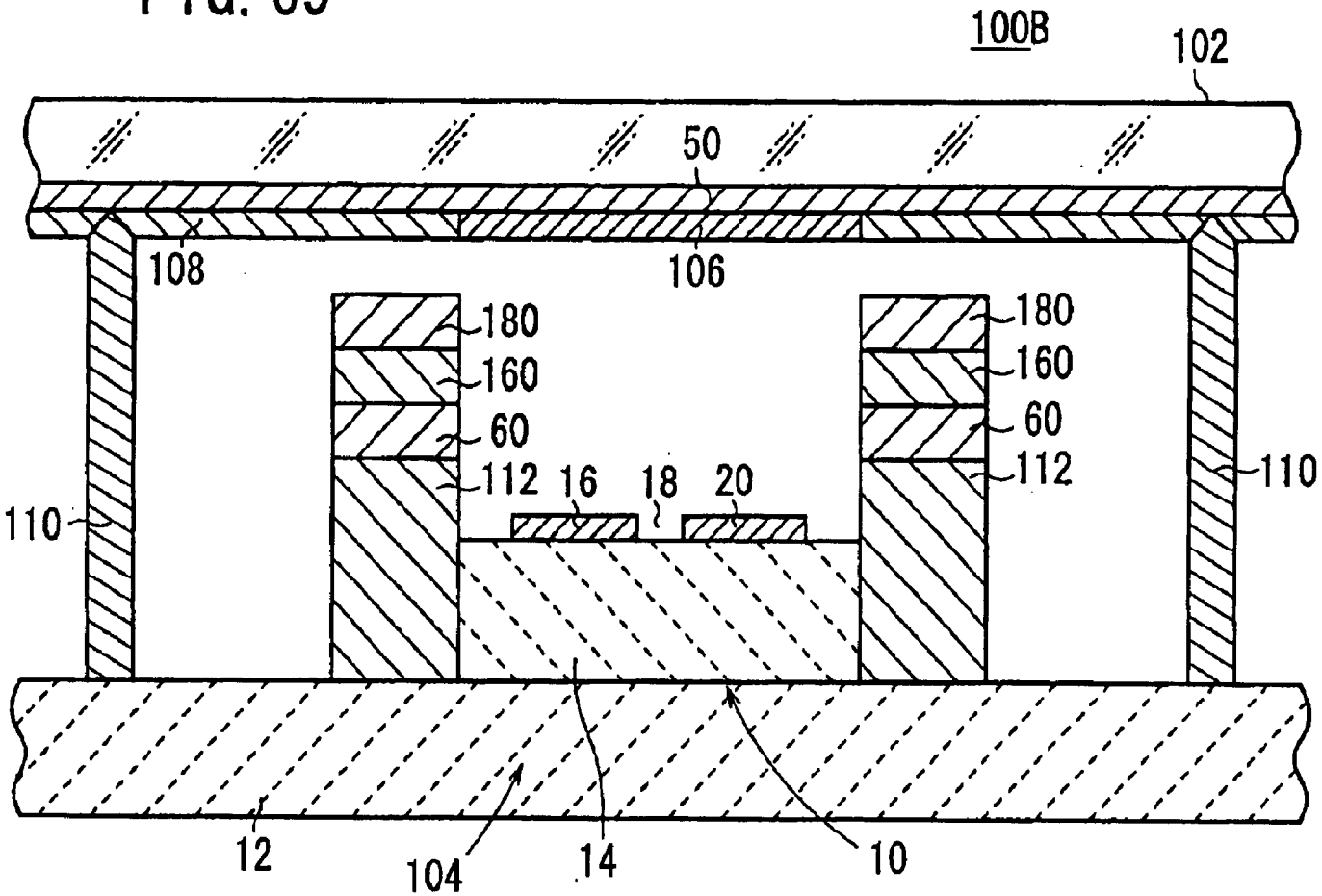
FIG. 69 is a view showing a portion of a display according to a second embodiment of the present invention.

As shown in FIG. 69, the display 100B according to the second embodiment has substantially the same structure as the display 100A according to the first embodiment, but differs therefrom in that the insulating layer 160 is formed on the upper surface of the control electrode 60, and a second control electrode 180 is formed on the upper surface of the insulating layer 160. The second control electrode 180 has a window 184 (not shown) defined in a position facing at least a central region of the slit 18 that is defined between the cathode electrode 16 and the anode electrode 20.

Figure 70A:
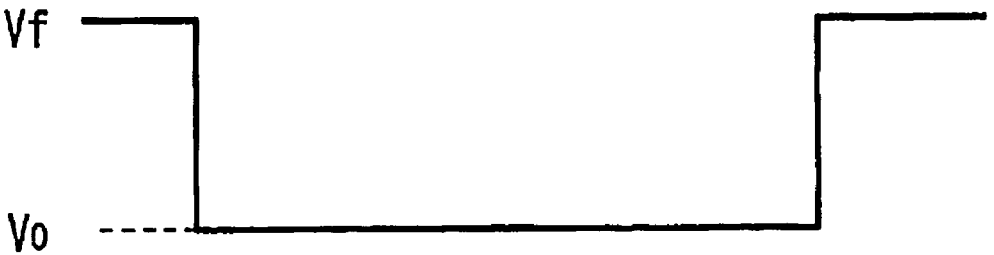
FIG. 70A is a waveform diagram showing a pulse signal applied between a cathode electrode and an anode electrode.
Figure 70B:
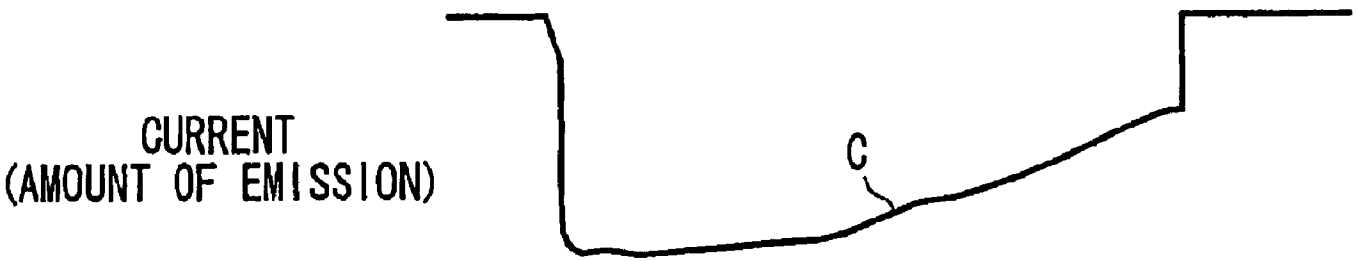
FIG. 70B is a diagram showing a change in the amount of emitted electrons upon elapse of a time.

Gradation control for the electron emitter 10 will be described below. As shown in FIGS. 70A and 70B, in an initial stage of the period in which the pulse signal Sp applied between the cathode electrode 16 and the anode electrode 20 is the on voltage Vo, the amount of emitted electrons depends on the on voltage Vo. Then, the amount of emitted electrons gradually decreases with time.

Figure 71:
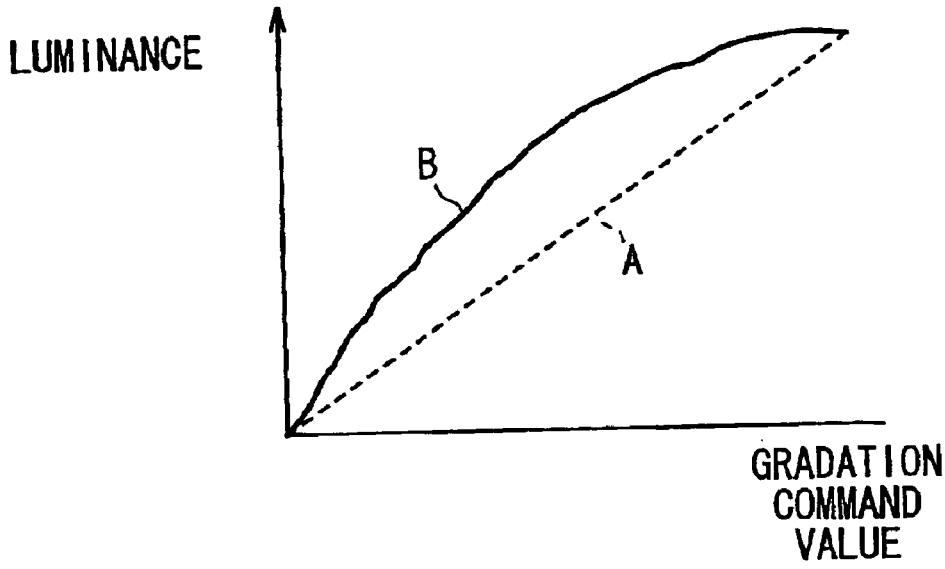
FIG. 71 is a diagram showing a change (nonlinear characteristics) in luminance with respect to a change in a gradation command value.

Therefore, controlling display gradations based on pulse width modulation may suffer the following shortcomings:

As shown in FIG. 71, when the logic value of the control signal Sc from the controller 40 is defined as a gradation command value, the relationship between the gradation command value and the luminance may be controlled logically as a proportional relationship (see the broken-line curve A). This idea is based on the assumption that the amount of emitted electrons is constant during the period in which the on voltage Vo continues.

However, since the amount of emitted electrons exhibits nonlinear characteristics such that it is reduced as the time in which the on voltage Vo continues increases, the luminance varies nonlinearly with respect to a change in the gradation command value, as indicated by the curve B in FIG. 71, possibly failing to perform highly accurate gradation control.

Figure 72:
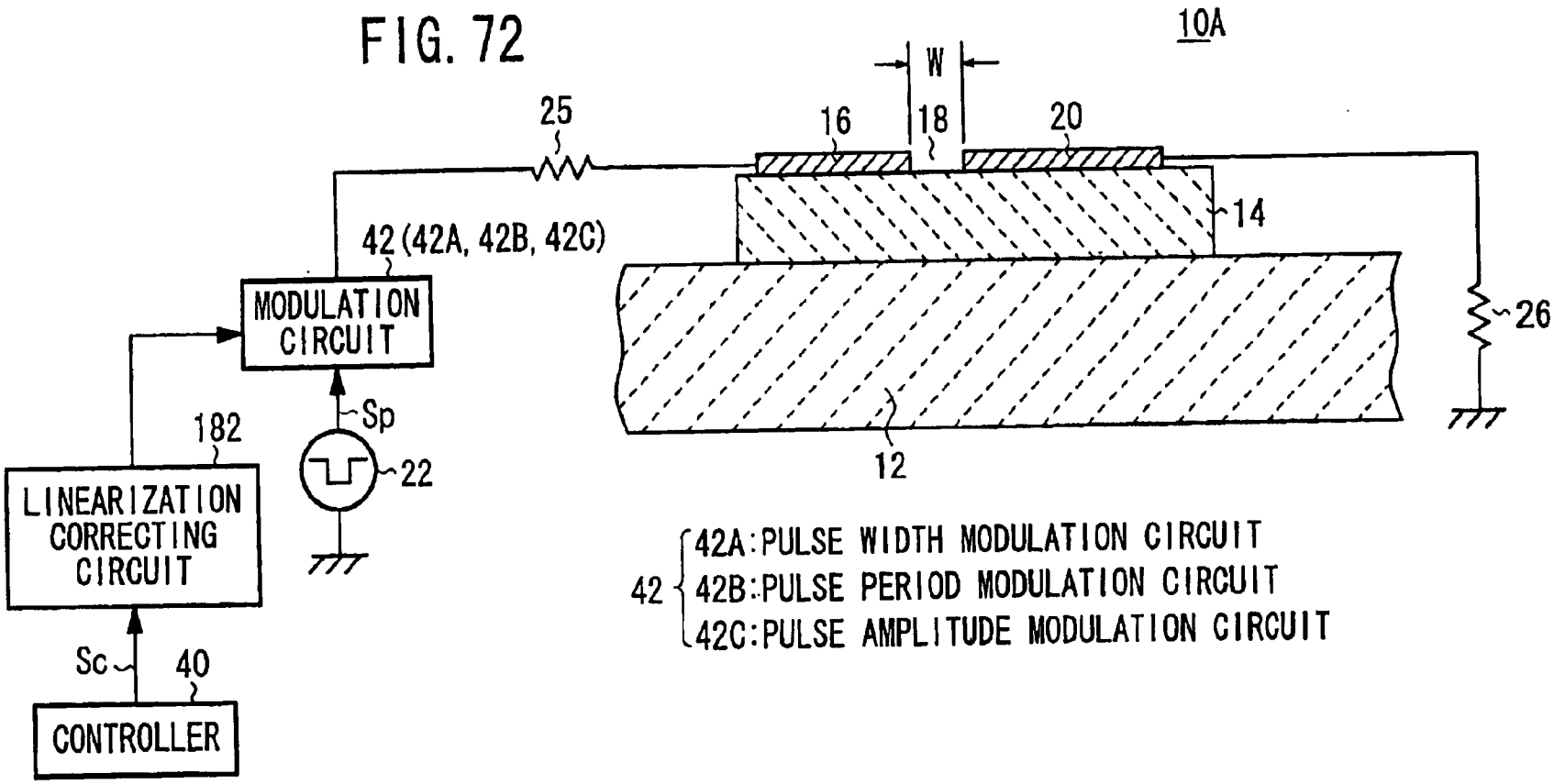
FIG. 72 is a view showing an arrangement for making linear a change in luminance with respect to a change in a gradation command value in the display according to the first embodiment.

For solving the above problem with the display free of the second control electrode 180 (the display 100A according to the first embodiment), it is proposed to connect a linearization correcting circuit 182 for correcting gradation command values between the modulation circuit 42 and the controller 40, as shown in FIG. 72.

Figure 73:
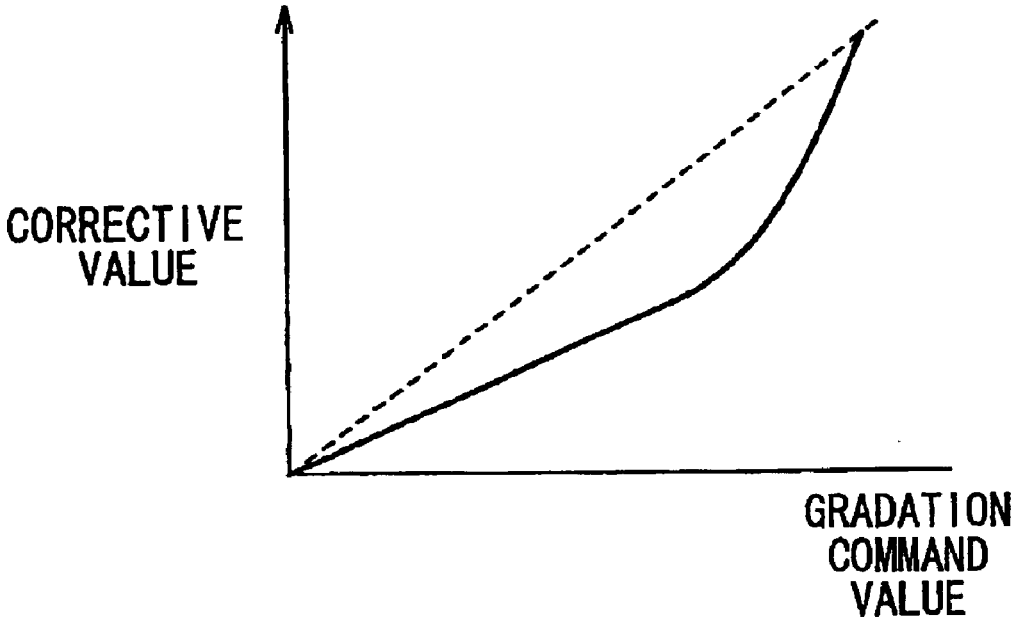
FIG. 73 is a diagram showing the characteristics of corrective values for gradation command values in a linearization correcting circuit.

The linearization correcting circuit 182 corrects gradation command values such that displayed gradations vary linearly based on changes in gradation corrective values. Specifically, as shown in FIG. 73, a corrective value corresponding to an inputted gradation command value is calculated based on a predetermined equation or read from an information table and outputted. Corrective values calculated by the equation or registered in the information table are set such that displayed gradations vary linearly based on changes in the corrective values. The corrective values vary according to such characteristics that they vary essentially linearly during a period in which the pulse width of the pulse signal Sp is short, and they vary exponentially (or logarithmically) as the pulse width increases.

Figure 74:
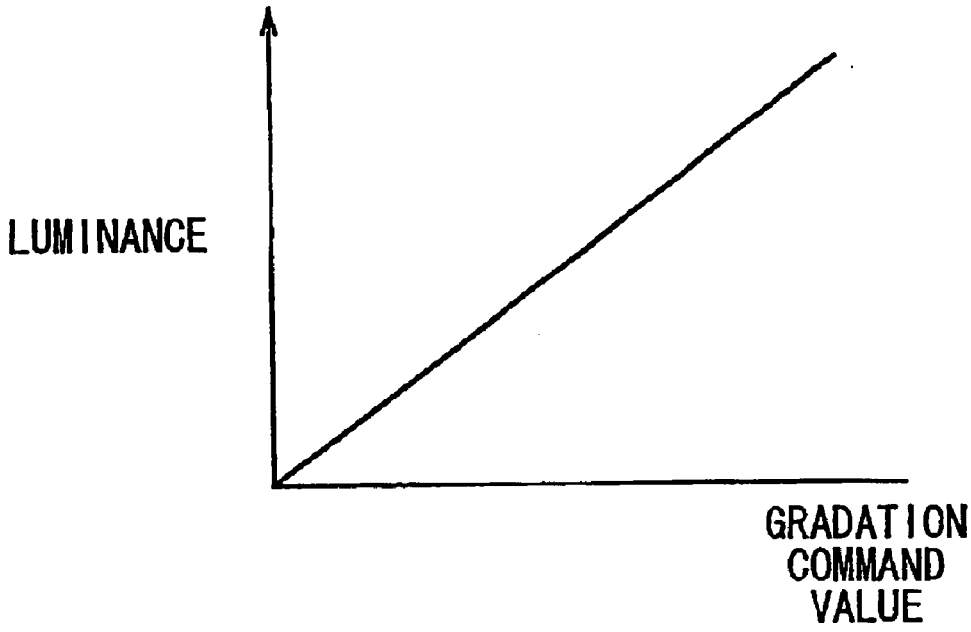
FIG. 74 is a diagram showing a change (linear characteristics) in luminance with respect to a change in a corrected gradation command value.

The linearization correcting circuit 182 makes the luminance vary substantially linearly with respect to changes in the gradation command values, as shown in FIG. 74.

Figures 75A, 75B, 75C:
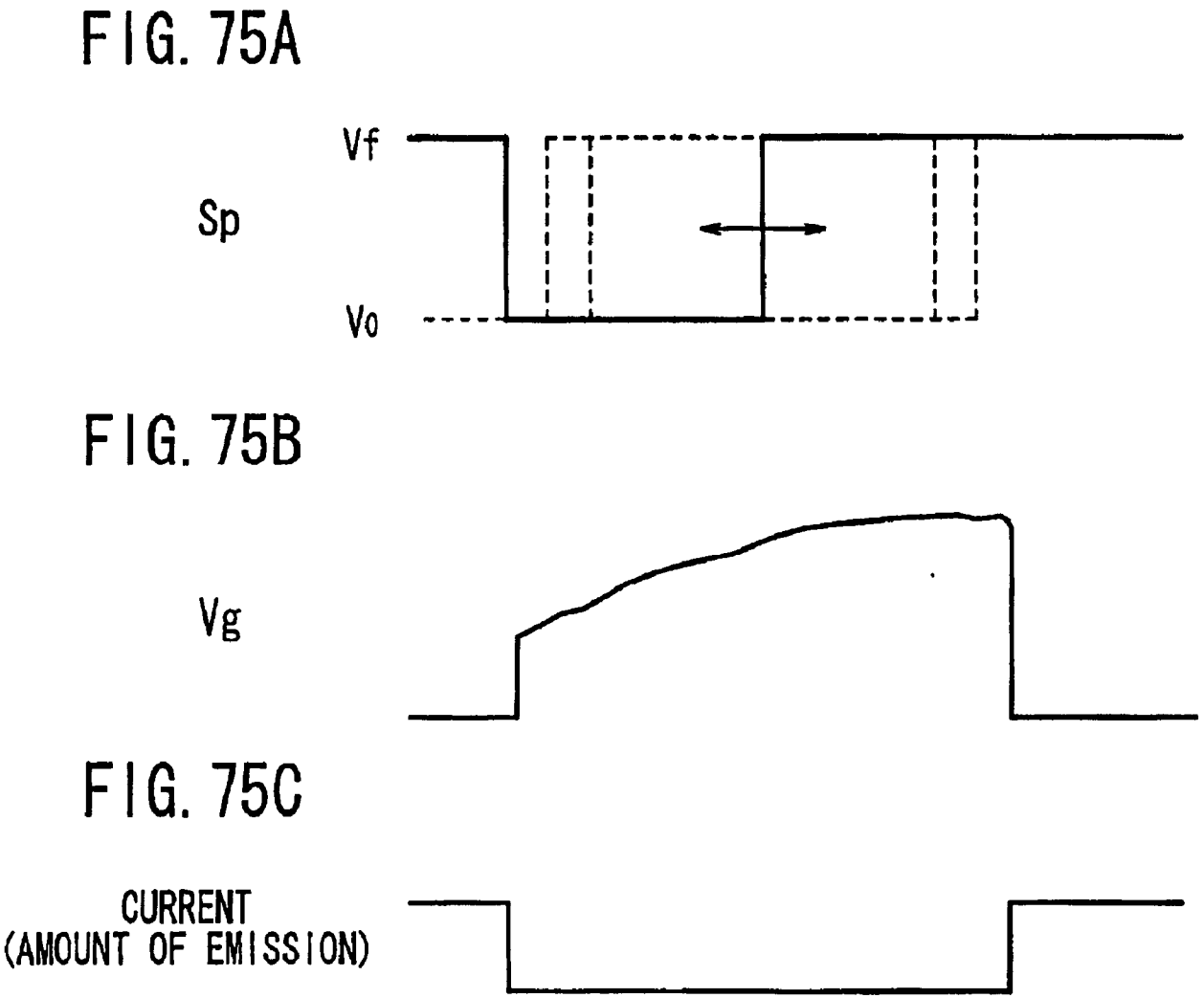
FIG. 75A is a waveform diagram showing a pulse signal applied between a cathode electrode and an anode electrode.
FIG. 75B is a waveform diagram showing a variable voltage applied between a second control electrode and the anode electrode.
FIG. 75C is a waveform diagram showing a corrected change in the amount of emitted electrons.

Since the display 100B according to the second embodiment has the second control electrode 180, as shown in FIGS. 75A and 75B, a variable voltage Vg2 which changes in a pattern opposite to the changes in the amount of emitted electrons as shown in FIG. 70B is applied between the second control electrode 180 and the anode electrode 20. The variable voltage Vg2 has such a waveform that its level increases according to the characteristic curve (see the characteristic curve C in FIG. 70B) of the amount of electrons emitted with time.

By applying the variable voltage Vg2 of the above waveform to the second control electrode 180, the nonlinear change in the amount of emitted electrons (the change with time, see FIG. 70B) is corrected so as to be substantially constant as shown in FIG. 75C, with the result that, as shown in FIG. 74, the luminance changes linearly as the gradation command value changes.

The ability of the emitted electrons to travel straight is further improved by the second control electrode 180, eliminating the crosstalk problem. This leads to a more highly integrated structure of the electron emitter 10 (pixel).

Figure 76:
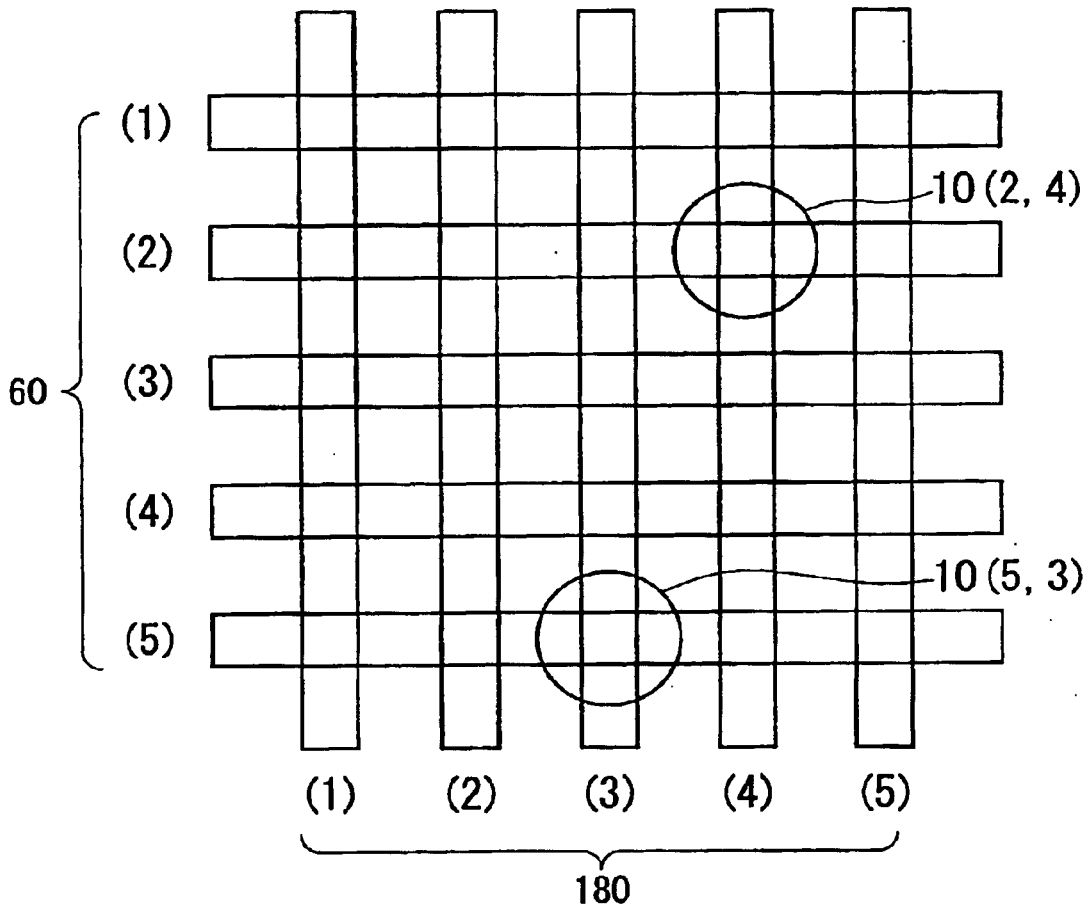
FIG. 76 is a view showing an example in which electron emitters are energized in an active matrix mode using control electrodes and second control electrodes.

As shown in FIG. 76, second control electrodes 180 may be combined with control electrodes 60 to allow electron emitters 10 to be energized in an active matrix mode. For example, the control electrodes 60 are arrayed in rows, and the second control electrodes 180 are arrayed in columns. For selecting the electron emitter 10 (2, 4) in the second row and the fourth column, signals of the on voltage level may be applied respectively to the control electrodes 60 (2) in the second row and the second control electrodes 180 (4) in the fourth column. Similarly, for selecting the electron emitter 10 (5, 3) in the fifth row and the third column, signals of the on voltage level may be applied respectively to the control electrodes 60 (5) in the fifth row and the second control electrodes 180 (3) in the third column.

The display with the above emitter electrons 10 can be manufactured at a reduced cost because driver ICs are not required to be associated with the respective electron emitters 10.

Figure 77:
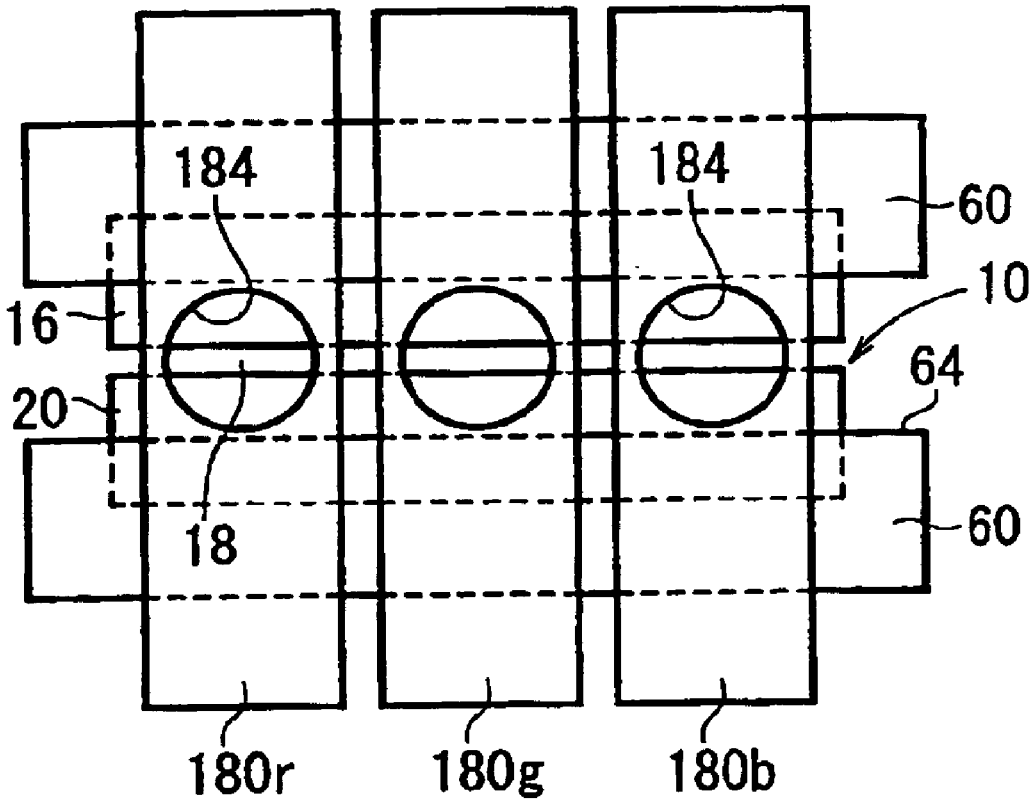
FIG. 77 is a view showing a pixel array for displaying a color image on the display according to the second embodiment.

With the display 100B according to the second embodiment which has the second control electrodes 180, as shown in FIG. 77, a color image can be displayed by one electron emitter 10 by providing the electron emitter 10 with three second control electrodes (a second control electrode 180*r* for red, a second control electrode 180*g* for green, and a second control electrode 180*b* for blue).

For example, the electron emitter 10 can emit blue light by setting the signal between the cathode electrode 16 and the anode electrode 20 thereof and the signal between the control electrode 60 and the anode electrode 20 thereof to an on voltage level and setting the signal between the blue second control electrode 180*b* and the anode electrode 20 to an on voltage level.

With the above arrangement, the pitch of the pixels can be reduced for displaying high-definition images. Thus, the pitch of the pixels is determined by the line width of the second control electrodes 180 and the line width of the fluorescent layer 106 (see FIG. 69). This indicates that the pitch of the pixels is not limited by the size of the electron emitters 10, allowing the display to be designed with increased freedom for displaying high-definition images.

In the example shown in FIG. 77, one electron emitter 10 is combined with three second control electrodes 180*r*, 180*g*, 180*b*. However, the number of second control electrodes 180 combined with one electron emitter 10 may be increased for displaying higher-definition images.

Figure 78:
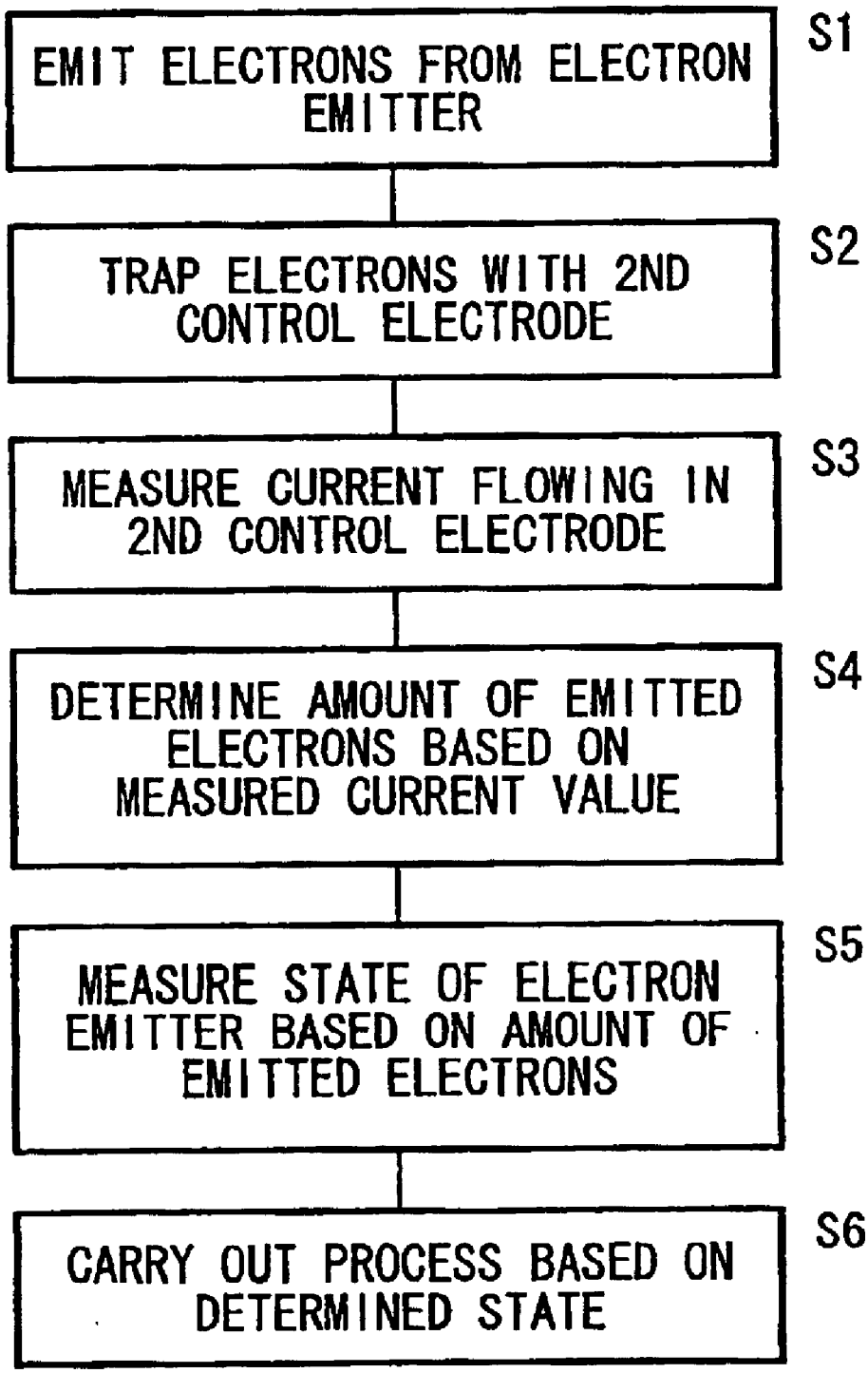
FIG. 78 is a flowchart of a self-diagnostic process for the display according to the second embodiment.

The second control electrode 180 makes it possible to perform the following self-diagnostic function:

Specifically, emitted electrons are trapped by the second control electrode 180, and a current produced by the trapped electrons is detected for diagnosis. The self-diagnostic process will be described below with reference to FIG. 78.

The signal applied between the cathode electrode 16 and the anode electrode 20 and the signal applied between the control electrode 60 and the anode electrode 20 are set to an on voltage level, enabling the electron emitter 10 to emit electrons (step S1). At this time, the electrons are not trapped by the fluorescent layer 106 (and the collector electrode 50), but trapped by the second control electrode 180 (step S2).

A current flowing to the second control electrode 180 is detected (step S3). An amount of emitted electrons is determined based on the measured current (step S4).

The determined amount of emitted electrons is compared with a preset normal value to determine the state of the electron emitter 10. The state represents how the electron emission changes with time and whether the electron emitter has failed or not (step S5).

Then, a process is carried out based on the determined state in step S6. If the electron emitter has failed, then an alarm is outputted. If the time-dependent change in the electron emission differs from a preset state change, then energizing conditions are changed depending on the time-dependent change in the electron emission.

The process (self-diagnostic process) in steps S1 through S6 may be carried out immediately after the display 100B is turned on or at any time.

Modifications of the display 100B according to the second embodiment will be described below with reference to FIGS. 79 through 88.

Figure 79:
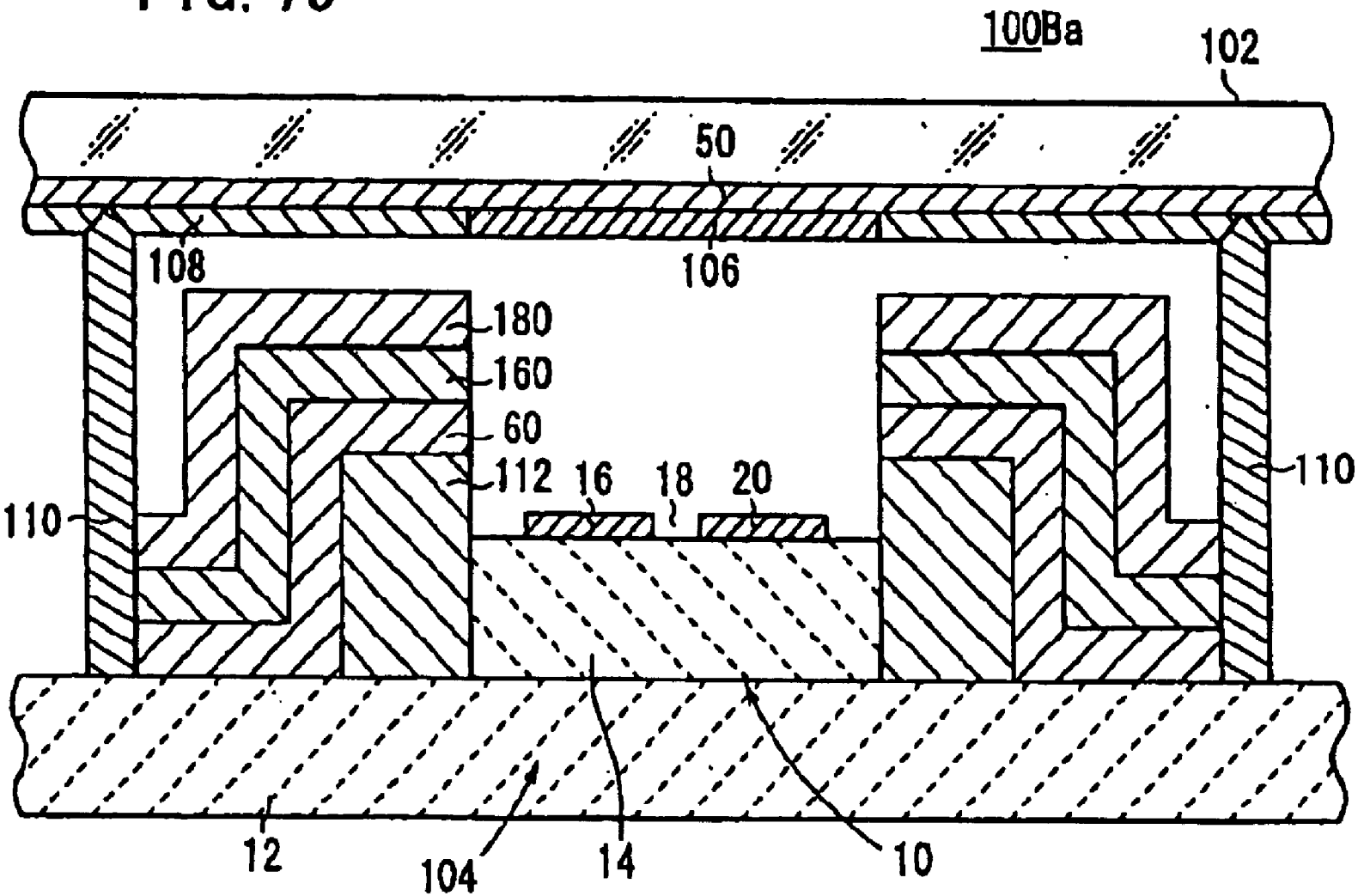
FIG. 79 is a view showing a portion of a display according to a first modification of the second embodiment.

As shown in FIG. 79, a display 100Ba according to a first modification has substantially the same structure as the display 100B according to the second embodiment, but differs therefrom in that the control electrode 60, the insulating layer 160, and the second control electrode 180 are formed continuously from the upper surface of the insulating layer 112 to side faces thereof and a portion of the substrate 12.

Figure 80:
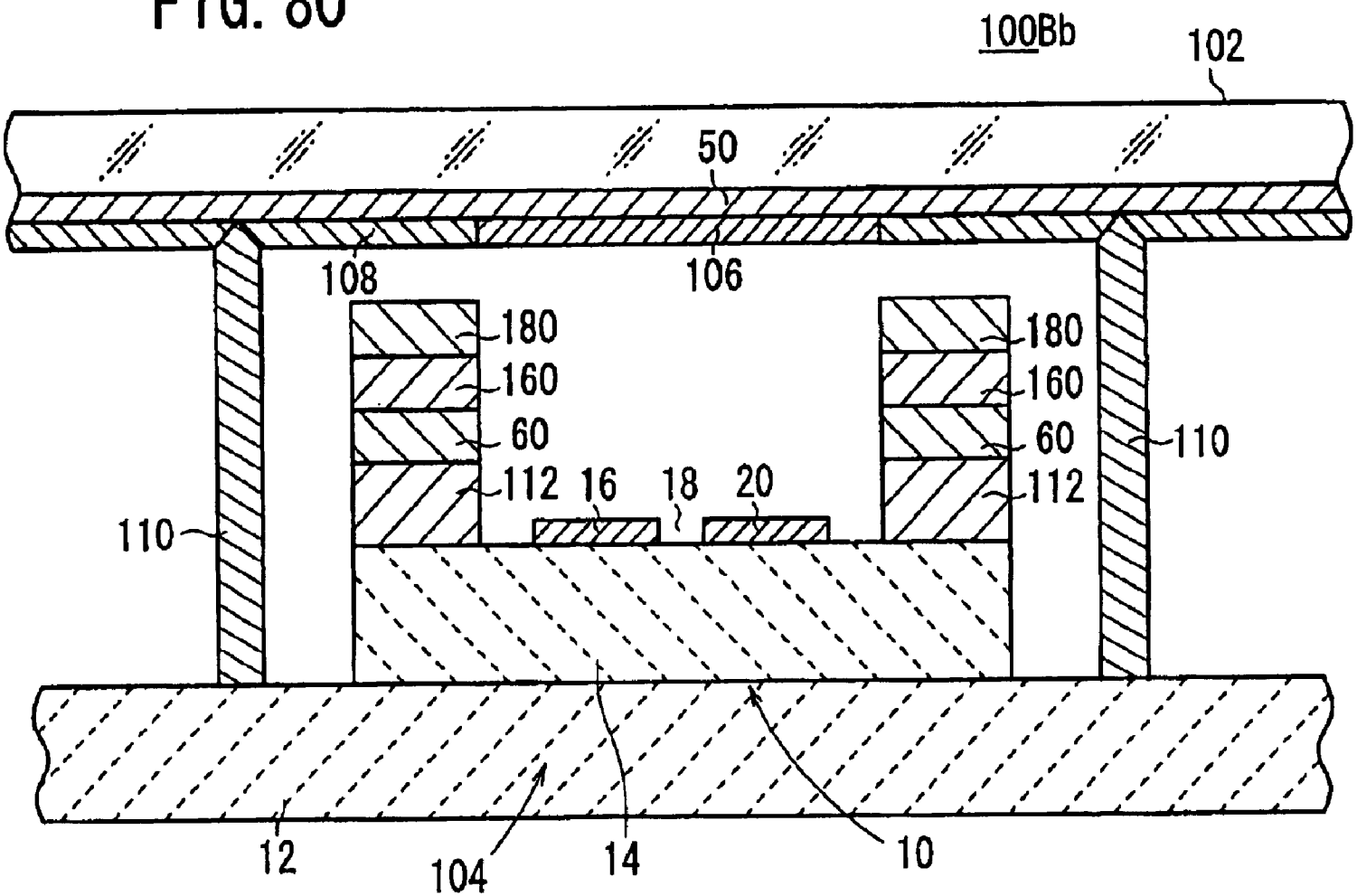
FIG. 80 is a view showing a portion of a display according to a second modification of the second embodiment.

As shown in FIG. 80, a display 100Bb according to a second modification has substantially the same structure as the display 100B according to the second embodiment, but differs therefrom in that the insulating layer 112 is formed on a peripheral region of the upper surface of the electric field receiving member 14, the control electrode 60 is formed on the upper surface of the insulating layer 112, the insulating layer 160 is formed on the upper surface of the control electrode 60, and the second control electrode 180 is formed on the upper surface of the insulating layer 180.

Figure 81:
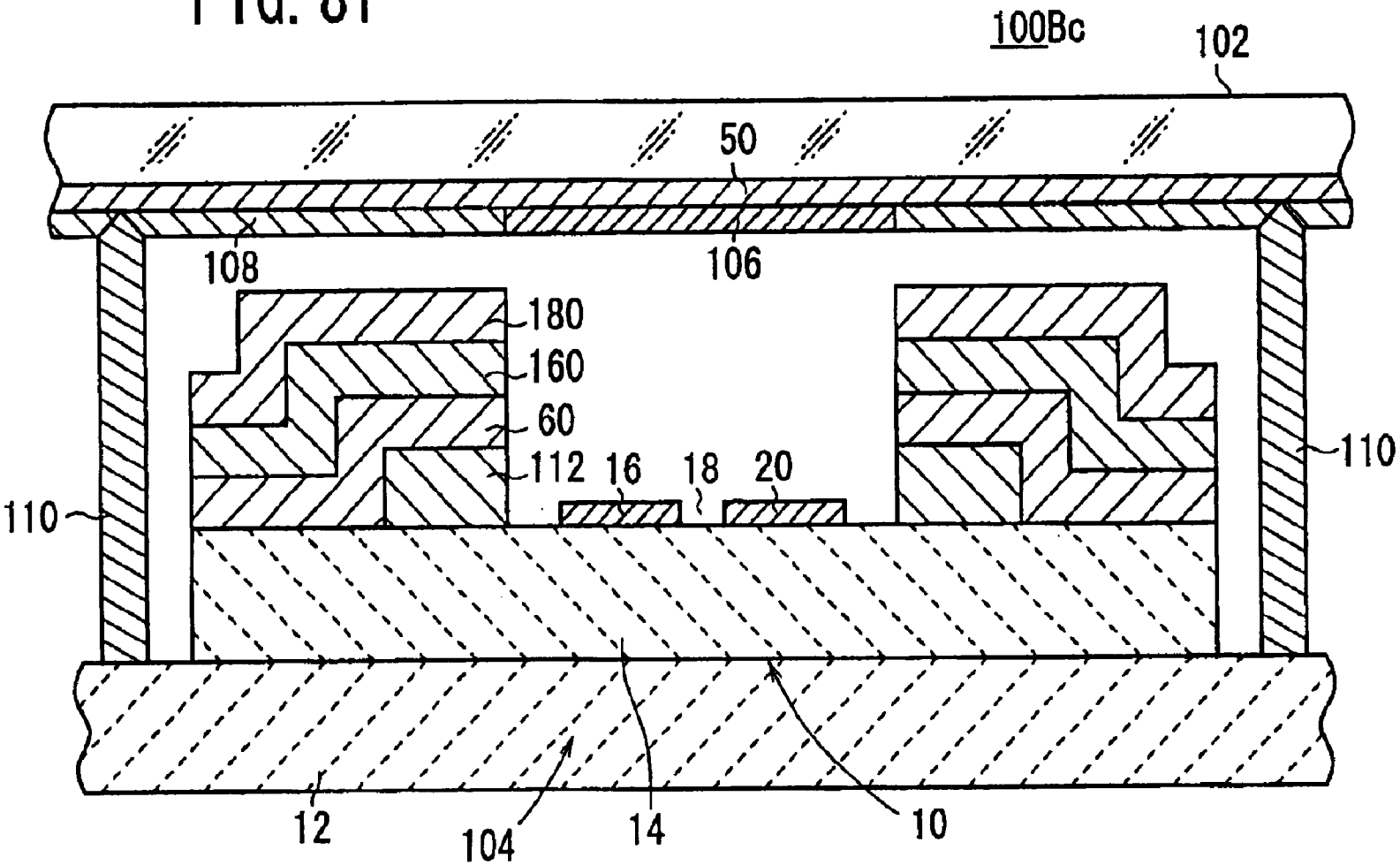
FIG. 81 is a view showing a portion of a display according to a third modification of the second embodiment.

As shown in FIG. 81, a display 100Bc according to a third modification has substantially the same structure as the display 100B according to the second embodiment, but differs therefrom in that the control electrode 60, the insulating layer 160, and the second control electrode 180 are formed continuously from the upper surface of the insulating layer 112 to side faces thereof and a portion (peripheral portion) of the electric field receiving member 14.

Figure 82:
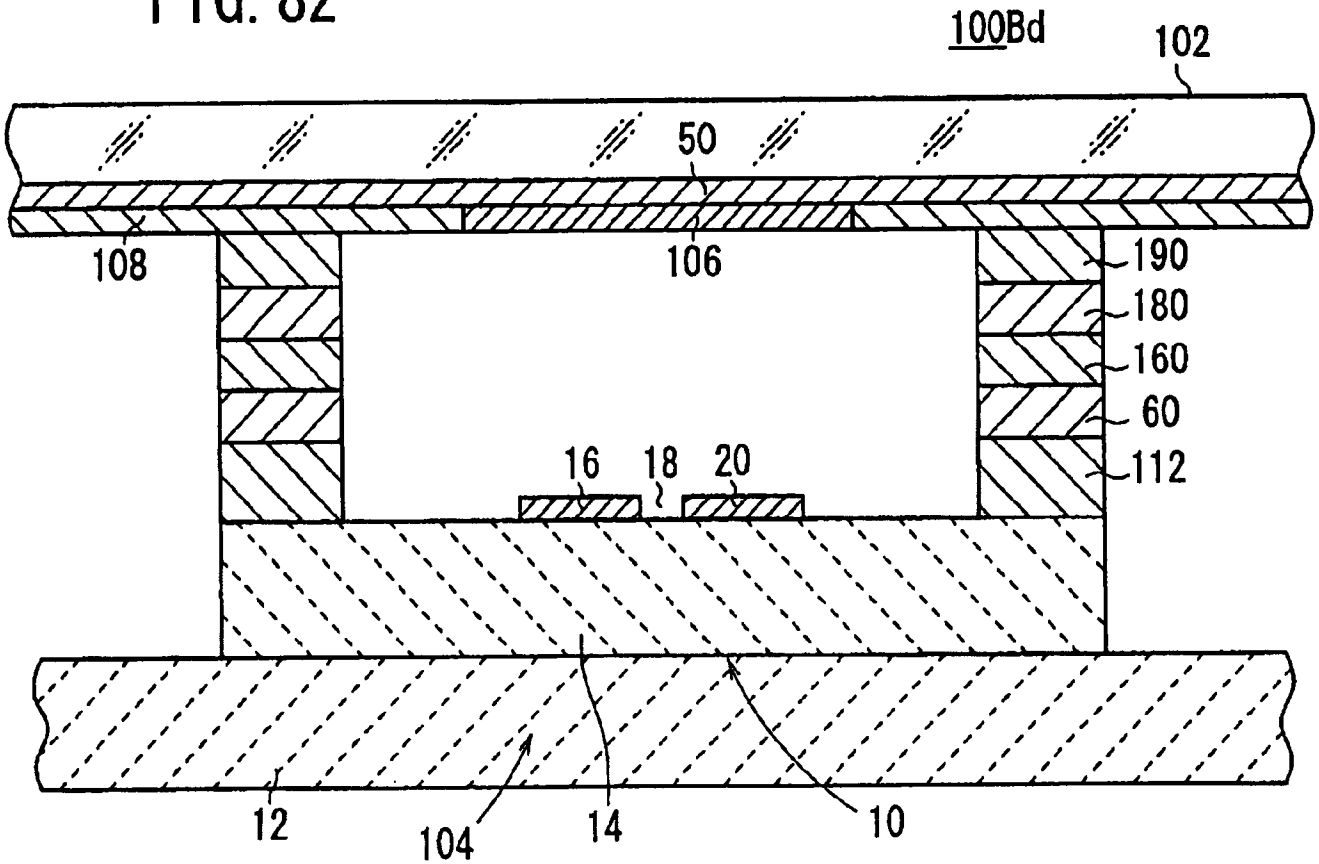
FIG. 82 is a view showing a portion of a display according to a fourth modification of the second embodiment.

As shown in FIG. 82, a display 100Bd according to a fourth modification has substantially the same structure as the display 100B according to the second embodiment, but differs therefrom in that an insulating layer 190 is interposed between the second control electrode 180 and the glass substrate 102, with the insulating layer 112, the control electrode 60, the insulating layer 160, the second control electrode 180, and the insulating layer 190 jointly making up a multilayer structure doubling as the beam 110 (see FIG. 69).

Figure 83:
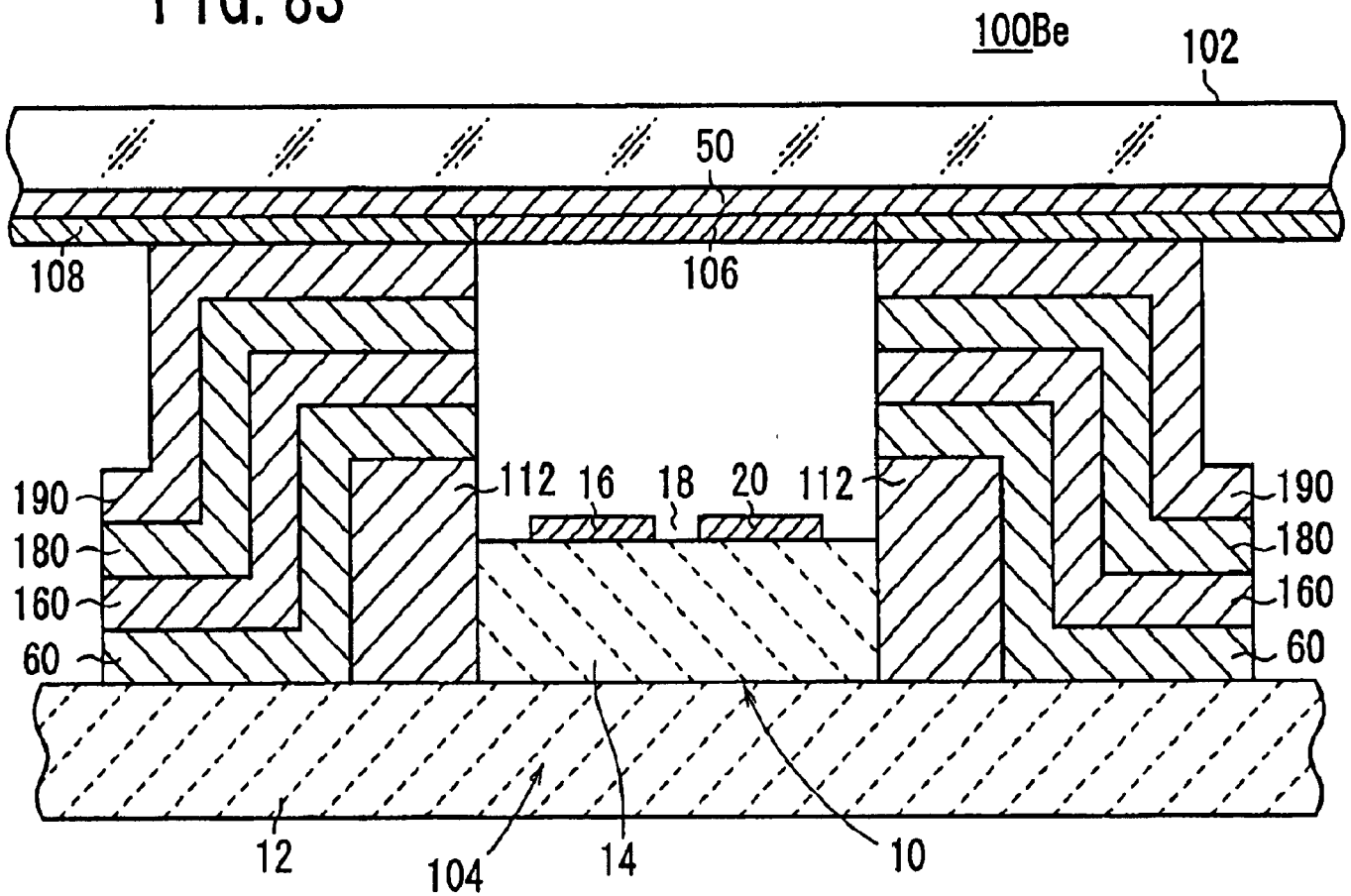
FIG. 83 is a view showing a portion of a display according to a fifth modification of the second embodiment.

As shown in FIG. 83, a display 100Be according to a fifth modification has substantially the same structure as the display 100Ba according to the first modification, but differs therefrom in that the insulating layer 190 is interposed between the second control electrode 180 and the glass substrate 102, with the insulating layer 112, the control electrode 60, the insulating layer 160, the second control electrode 180, and the insulating layer 190 jointly making up a multilayer structure doubling as the beam.

Figure 84:
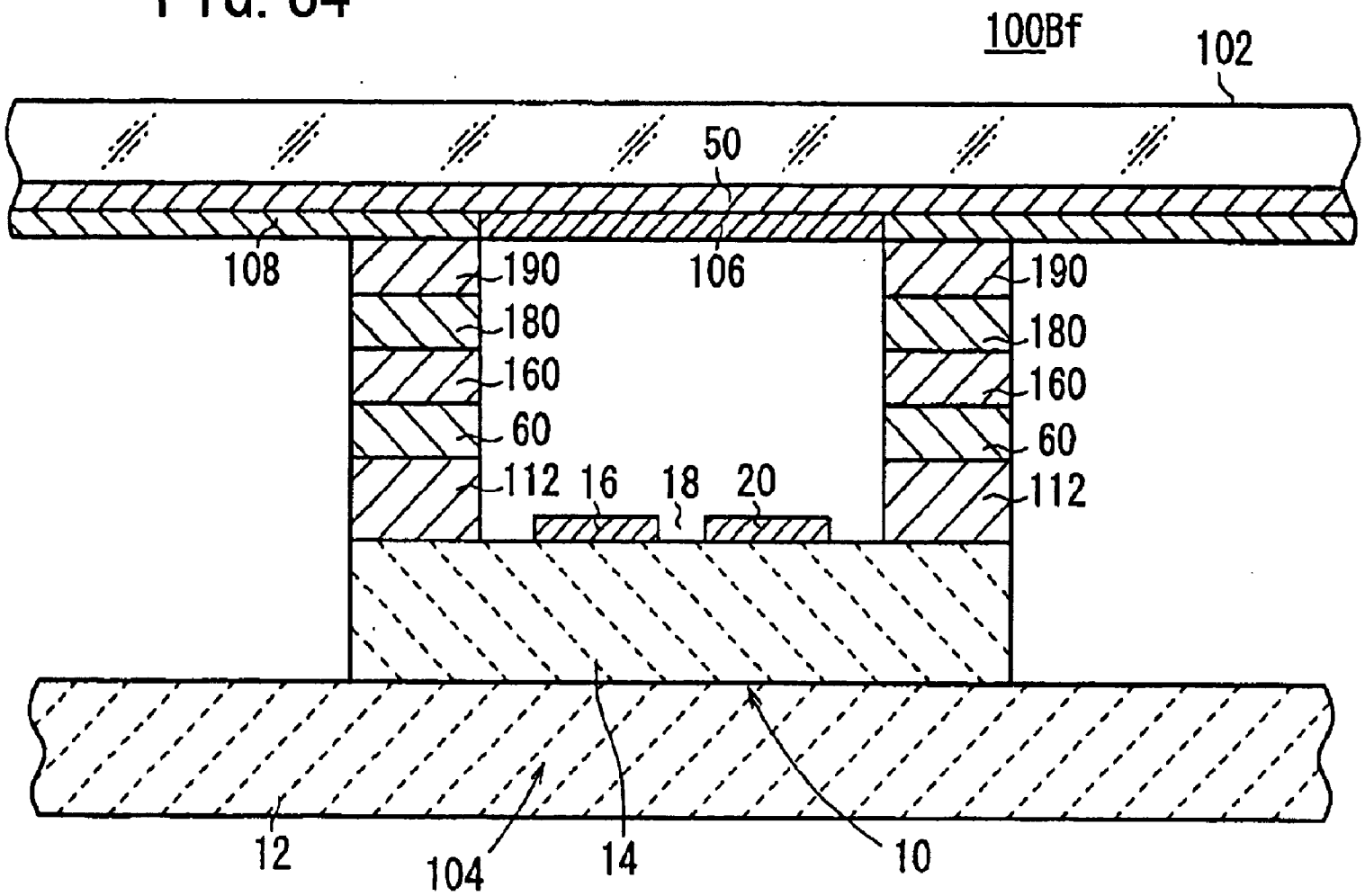
FIG. 84 is a view showing a portion of a display according to a sixth modification of the second embodiment.

As shown in FIG. 84, a display 100Bf according to a sixth modification has substantially the same structure as the display 100Bb according to the second modification, but differs therefrom in that the insulating layer 190 is interposed between the second control electrode 180 and the glass substrate 102, with the insulating layer 112, the control electrode 60, the insulating layer 160, the second control electrode 180, and the insulating layer 190 jointly making up multilayer structure doubling as the beam.

Figure 85:
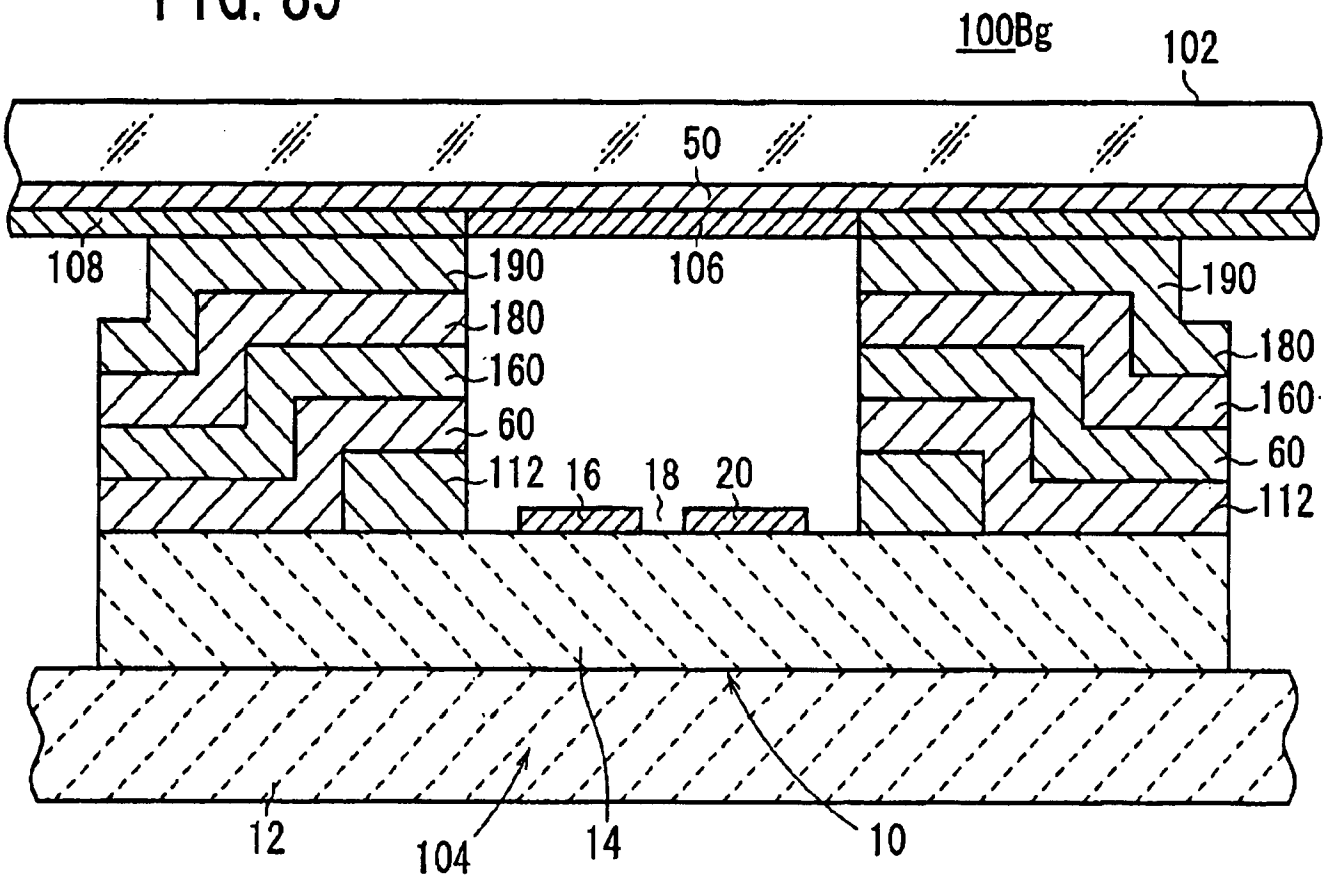
FIG. 85 is a view showing a portion of a display according to a seventh modification of the second embodiment.

As shown in FIG. 85, a display 100Bg according to a seventh modification has substantially the same structure as the display 100Bc according to the third modification, but differs therefrom in that the insulating layer 190 is interposed between the second control electrode 180 and the glass substrate 102, with the insulating layer 112, the control electrode 60, the insulating layer 160, the second control electrode 180, and the insulating layer 190 jointly making up a multilayer structure doubling as the beam.

Figure 86:
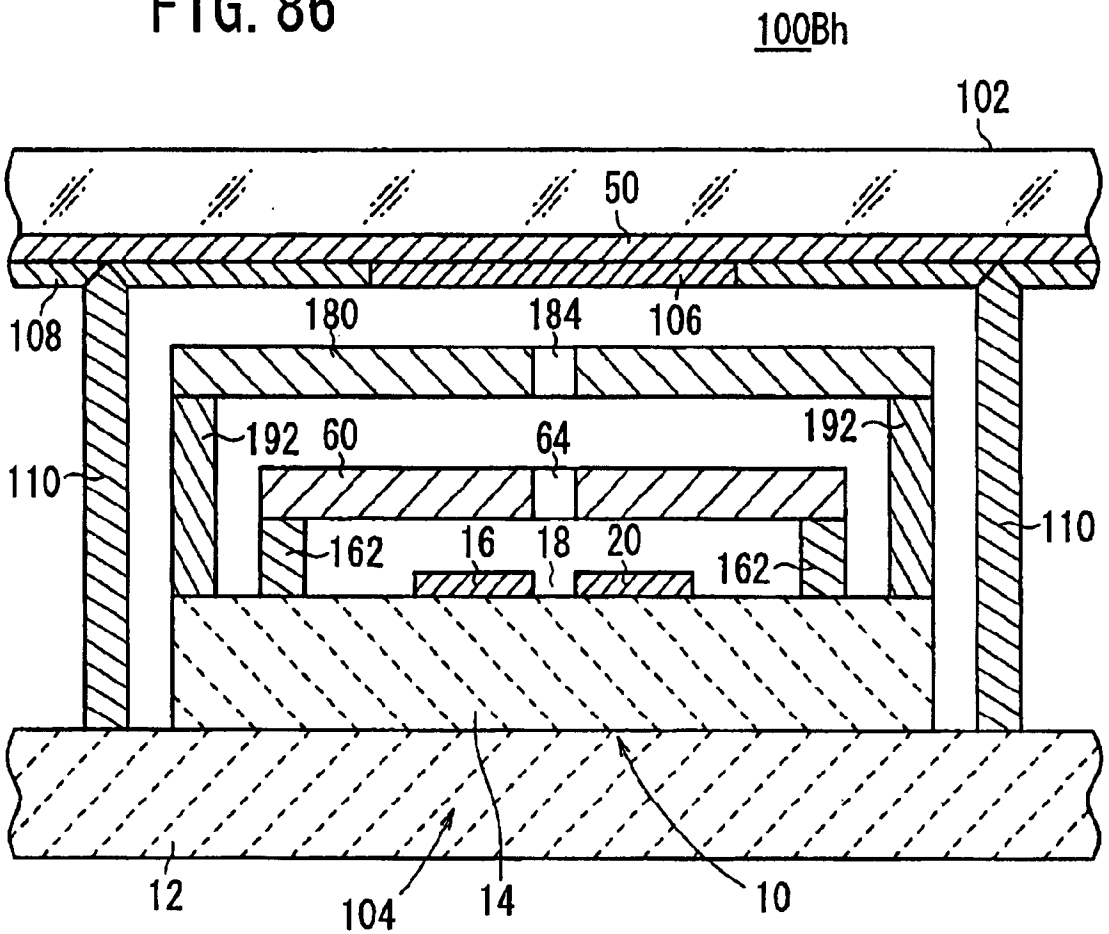
FIG. 86 is a view showing a portion of a display according to an eighth modification of the second embodiment.

As shown in FIG. 86, a display 100Bh according to an eighth modification has substantially the same structure as the display 100B according to the second embodiment, but differs therefrom in that second beams 162 are fixed to peripheral regions of the upper surface of the electric field receiving member 14 around the cathode electrode 16 and the anode electrode 20 by an adhesive, for example, the control electrode 60 is mounted on and kept taut between the upper surfaces of the second beams 162, third beams 192 are fixed to outer peripheral regions of the upper surface of the electric field receiving member 14 by an adhesive, for example, the second control electrode 180 is mounted on and kept taut between the upper surfaces of the third beams 192.

Figure 87:
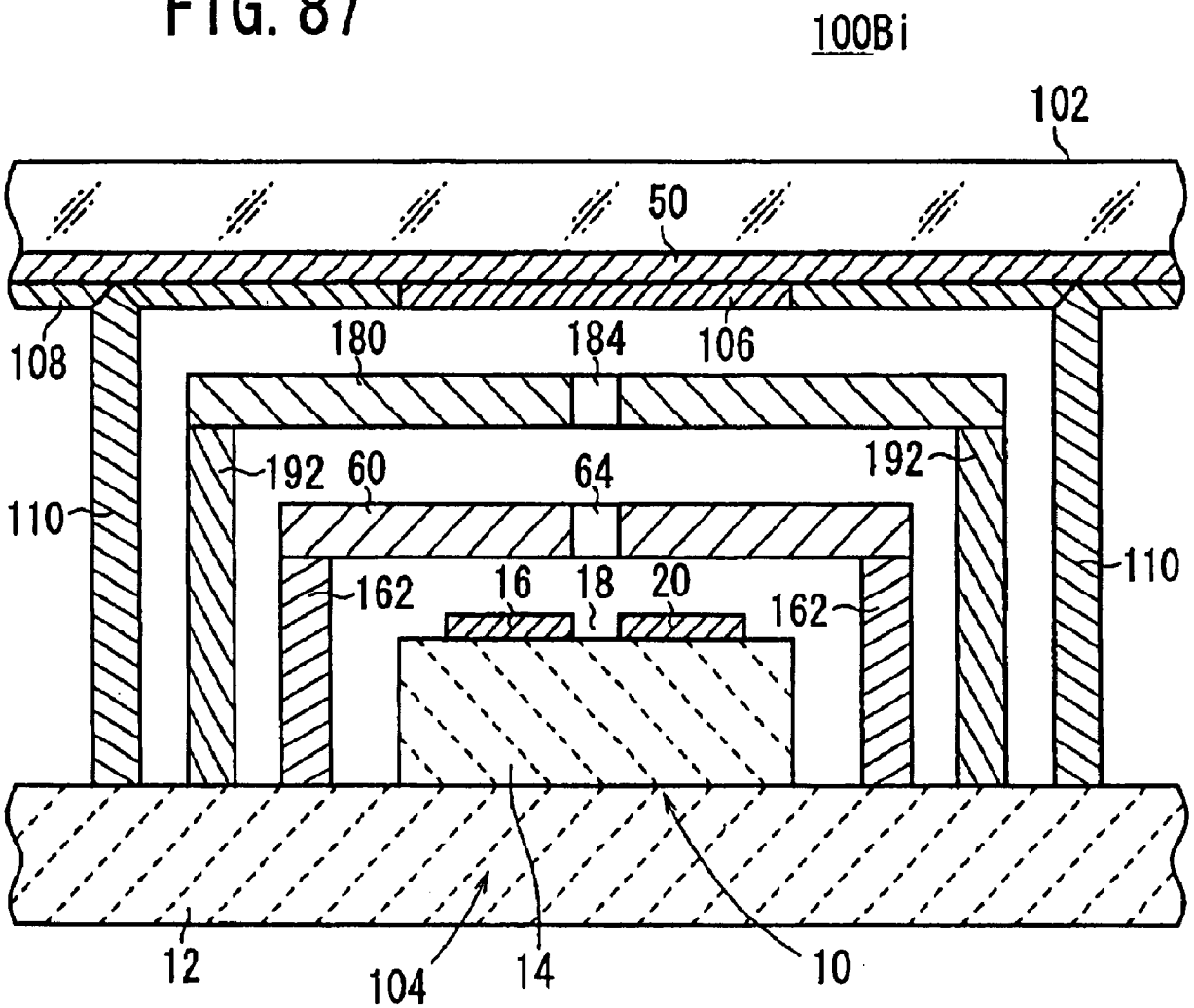
FIG. 87 is a view showing a portion of a display according to a ninth modification of the second embodiment.

As shown in FIG. 87, a display 100Bi according to a ninth modification has substantially the same structure as the display 100B according to the second embodiment, but differs therefrom in that the second beams 162 are fixed to regions of the upper surface of the substrate 12 near the electric field receiving member 14 by an adhesive, for example, the control electrode 60 is mounted on and kept taut between the upper surfaces of the second beams 162, the third beams 192 are fixed to regions of the substrate 12 near the second means 162 by an adhesive, for example, the second control electrode 180 is mounted on and kept taut between the upper surfaces of the third beams 192.

Figure 88:
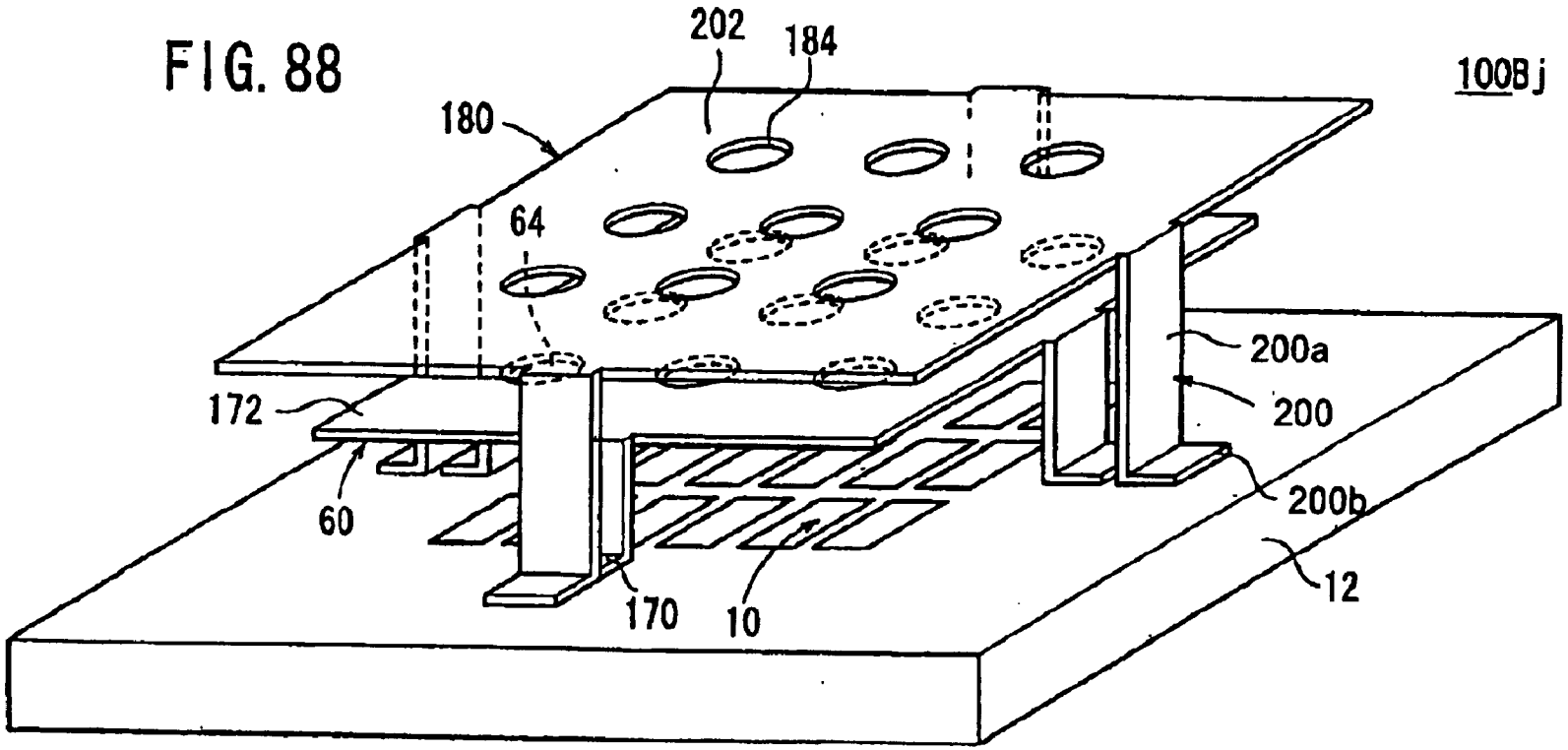
FIG. 88 is a view showing a portion of a display according to a tenth modification of the second embodiment.

As shown in FIG. 88, a display 100Bj according to a tenth modification has substantially the same structure as the display 100Aj (see FIG. 66) according to the tenth modification of the display 100A according to the first embodiment, but differs therefrom in that the second control electrode 180 comprises a plurality of erected members 200 and an electrode body 202 lying parallel to the substrate 12 and integrally formed with the erected members 200. Each of the vertical erected 200 comprises an erected leg 200*a* and a bent foot 200*b* which are integrally joined to each other, and has an L-shaped cross section. The bent feet 200*b* of the erected members 200 are fixed to peripheral regions of the upper surface of the substrate 12 by an adhesive, for example.

A display 100C according to a third embodiment will be described below with reference to FIGS. 89 through 92.

Figure 89:
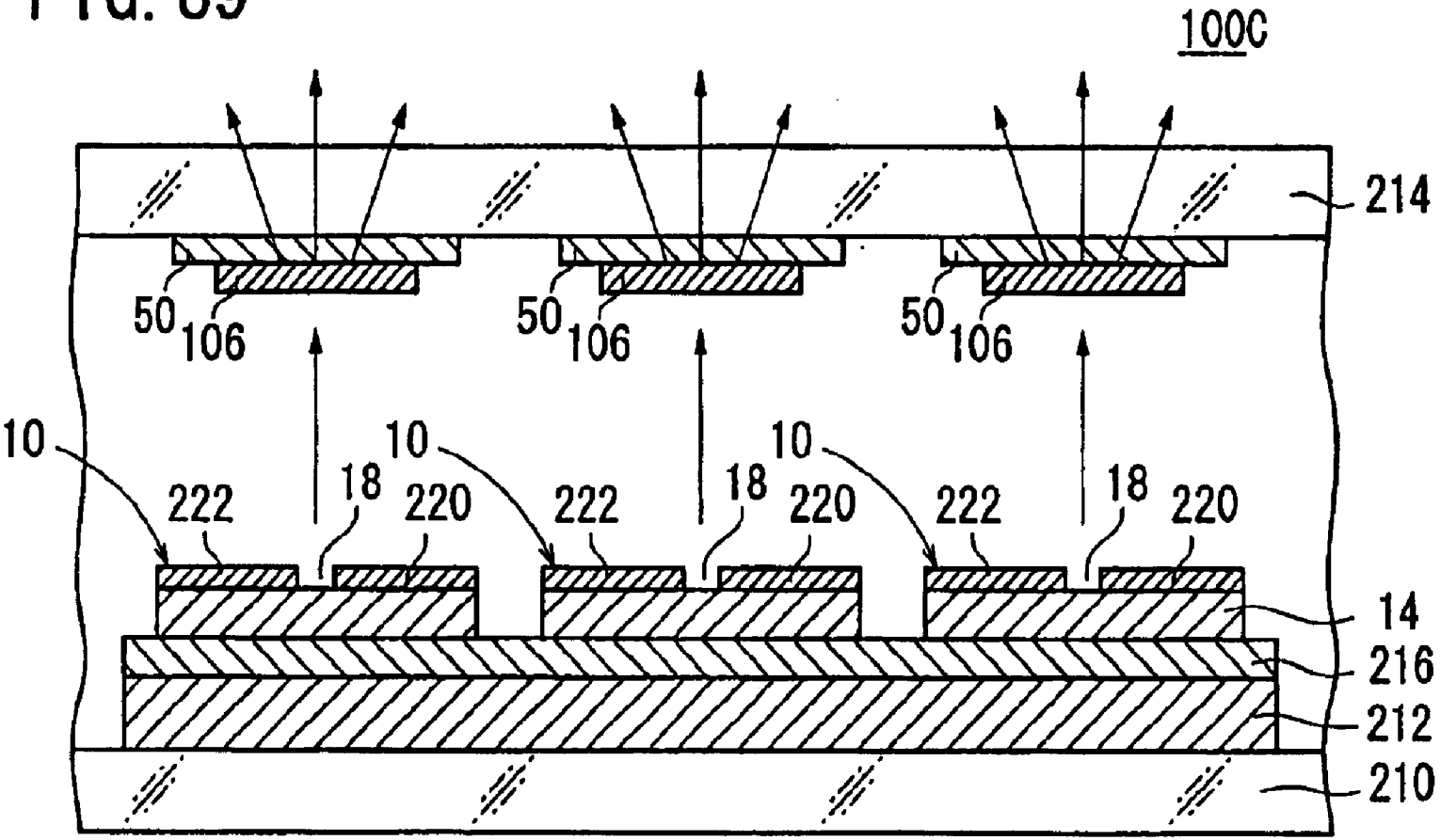
FIG. 89 is a view showing a portion of a display according to a third embodiment of the present invention.

As shown in FIG. 89, the display 100C according to the third embodiment comprises a glass substrate 210 as a base, a plurality of ceramic substrates 212 (only one shown in FIG. 89) disposed on the glass substrate 210, and a glass substrate 214 facing the ceramic substrates 212 and having a surface serving as a display surface.

A matrix of electron emitters 10 providing 256 pixels is mounted on the upper surface of each of the ceramic substrates 212, the matrix having horizontal arrays of electron emitters 10 providing 16 pixels and vertical arrays of electron emitters 10 providing 16 pixels.

One pixel has three electron emitters 10 corresponding respectively to red, green, and blue for displaying color images. In terms of the number of electron emitters 10, there are 256×3=768 electron emitters 10 disposed on the upper surfaces of the ceramic substrates 212. The pitch of the electron emitters 10 is 0.6 mm in the vertical direction and 0.2 mm in the horizontal direction, for example.

A matrix of 64 ceramic substrates 212 is mounted on the upper surface of the glass substrate 210, the matrix having vertical arrays of 8 ceramic substrates 212 and vertical arrays of 8 ceramic substrates 212. Therefore, vertical arrays of 128 pixels and horizontal arrays of 128 pixels are disposed on the glass substrate 210.

Figure 90:
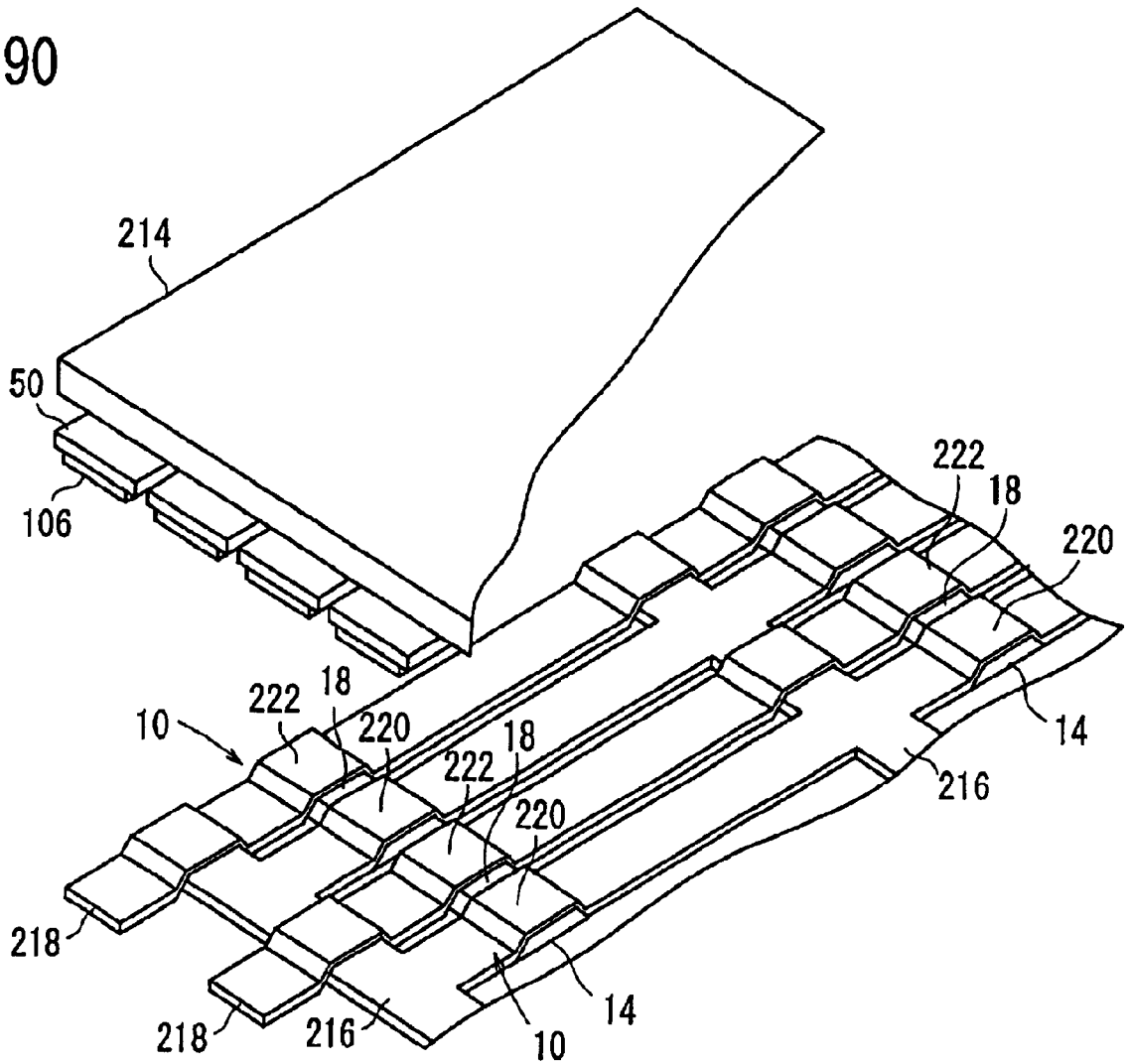
FIG. 90 is a perspective view of a portion of the display according to the third embodiment.
Figure 91:
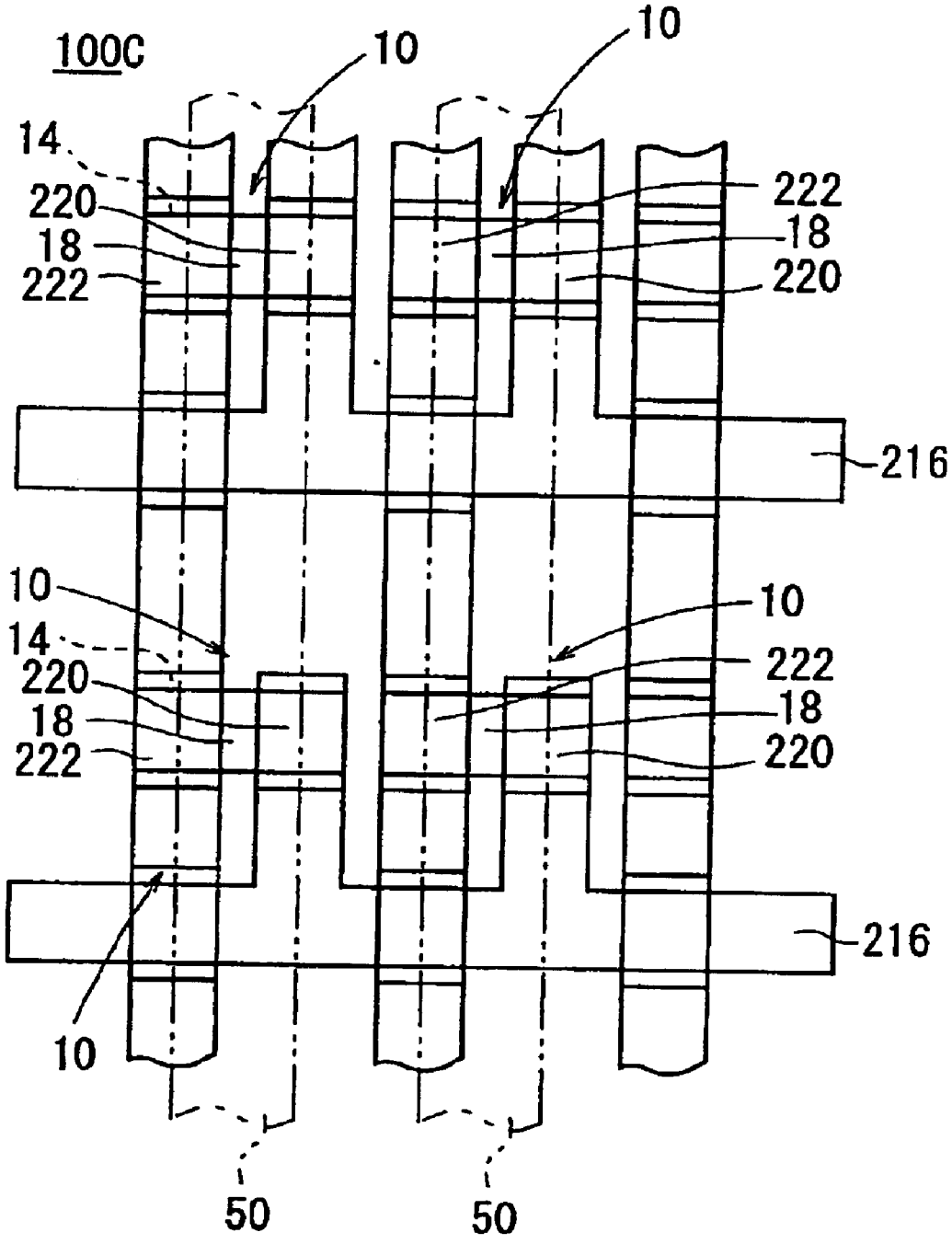
FIG. 91 is a plan view showing a row electrode pattern and a column electrode pattern in the display according to the third embodiment.

On one surface provided by the matrix of 64 ceramic substrates 212, as shown in FIGS. 90 and 91, there are formed horizontal row electrode patterns 216 corresponding to the respective rows of the display 100C and vertical column electrode patterns 218 corresponding to the respective columns of the display 100C. The row electrode patterns 216 have integrally formed cathode electrodes 220 extending vertically at respective positions. The column electrode patterns 218 have regions horizontally facing the respective cathode electrodes 220. The regions of the column electrode patterns 218 which face the respective cathode electrodes 220 will hereinafter be referred to as anode electrodes 222.

Each of the electron emitters 10 comprises a cathode electrode 220, an anode electrode 222, and an electric field receiving member 14 formed beneath the cathode electrode 220 and the anode electrode 222.

In each of the electron emitters 10, a slit 18 is defined between the cathode electrode 220 and the anode electrode 222, with the electric field receiving member 14 therebeneath being exposed through the slit 18. The cathode electrode 220 corresponds to the cathode electrode 16 of the display 100A according to the first embodiment, for example, and the anode electrode 222 corresponds to the anode electrode 20 of the display 100A. Unlike the anode electrode 20, the anode electrode 222 is supplied with ON and OFF signals depending on an image signal through the column electrode pattern 218. The electric field receiving member 14 is separated between the electron emitters 10. Specific materials which the electric field receiving member 14 is made of have been described above, and will not be described below.

A plurality of collector electrodes 50 are formed on the reverse side (facing the electron emitters 10) of the glass substrate 214 which provides the display surface. Each of the collector electrodes 50 is made of an ITO film, for example. The collector electrodes 50 are formed in common facing the slits 18 of the electron emitters 10 arrayed in the columns. Fluorescent layers 106 of corresponding colors are formed on the lower surfaces of the collector electrodes 50.

Although not shown in FIGS. 89 through 91, beams 110 as shown in FIG. 57, for example, may be formed at desired positions between the glass substrate 214 which provides the display surface and the ceramic substrates 212 on which the electron emitters 10 are disposed.

In the embodiment shown in FIG. 89, the ceramic substrates 212 are disposed on the glass substrate 210 as the base, and the electric field receiving members 14 and the electrode patterns 216, 218 are formed on one surface provided by the upper surfaces of the ceramic substrates 212, thus providing the electron emitters 10.

Alternatively, the electric field receiving members 14 and the electrode patterns 216, 218 may be directly formed on the glass substrate 210 as the base, providing the electron emitters 10.

A drive circuit 230 for the display 100C according to the third embodiment will be described below with reference to FIG. 92.

Figure 92:
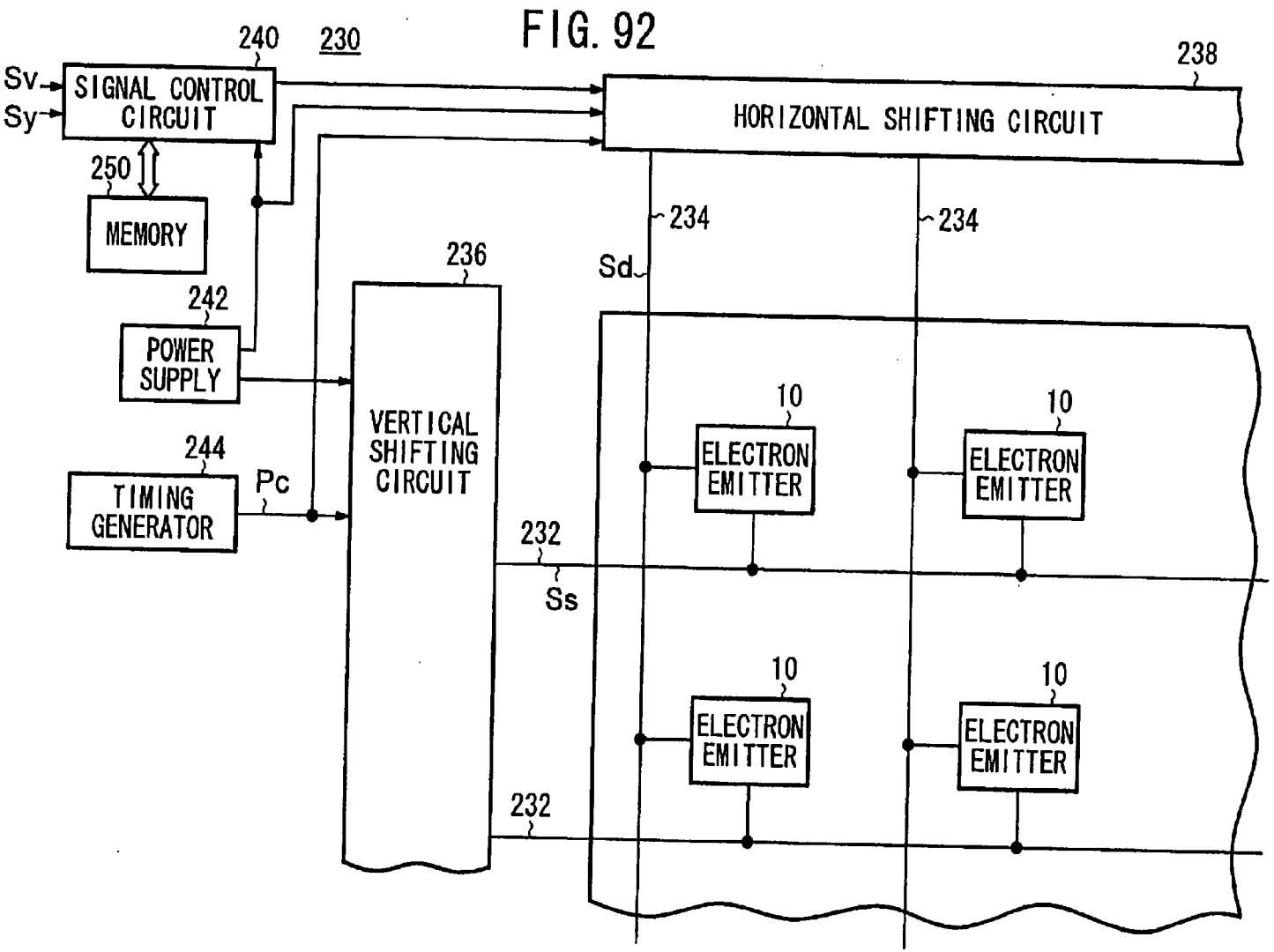
FIG. 92 is a block diagram of a drive circuit for the display according to the third embodiment.

As shown in FIG. 92, the drive circuit 230 has as many row select lines 232 as the number of rows of electron emitters 10 and as many signal lines 234 as the number of columns of electron emitters 10.

The drive circuit 230 also has a vertical shifting circuit 236 for supplying drive signals Ss selectively to the row select lines 232 for successively selecting the rows of electron emitters 10, a horizontal shifting circuit 238 for outputting parallel data signals Sd to the signal lines 234 to supply the data signals Sd to the electron emitters 10 of the row which has been selected by the vertical shifting circuit 236, and a signal control circuit 240 for controlling the vertical shifting circuit 236 and the horizontal shifting circuit 238 based on a video signal Sv and a synchronizing signal Sc which are inputted thereto. The vertical shifting circuit 236, the horizontal shifting circuit 238, and the signal control circuit 240 are supplied with a power supply voltage from a power supply 242.

Figure 93:
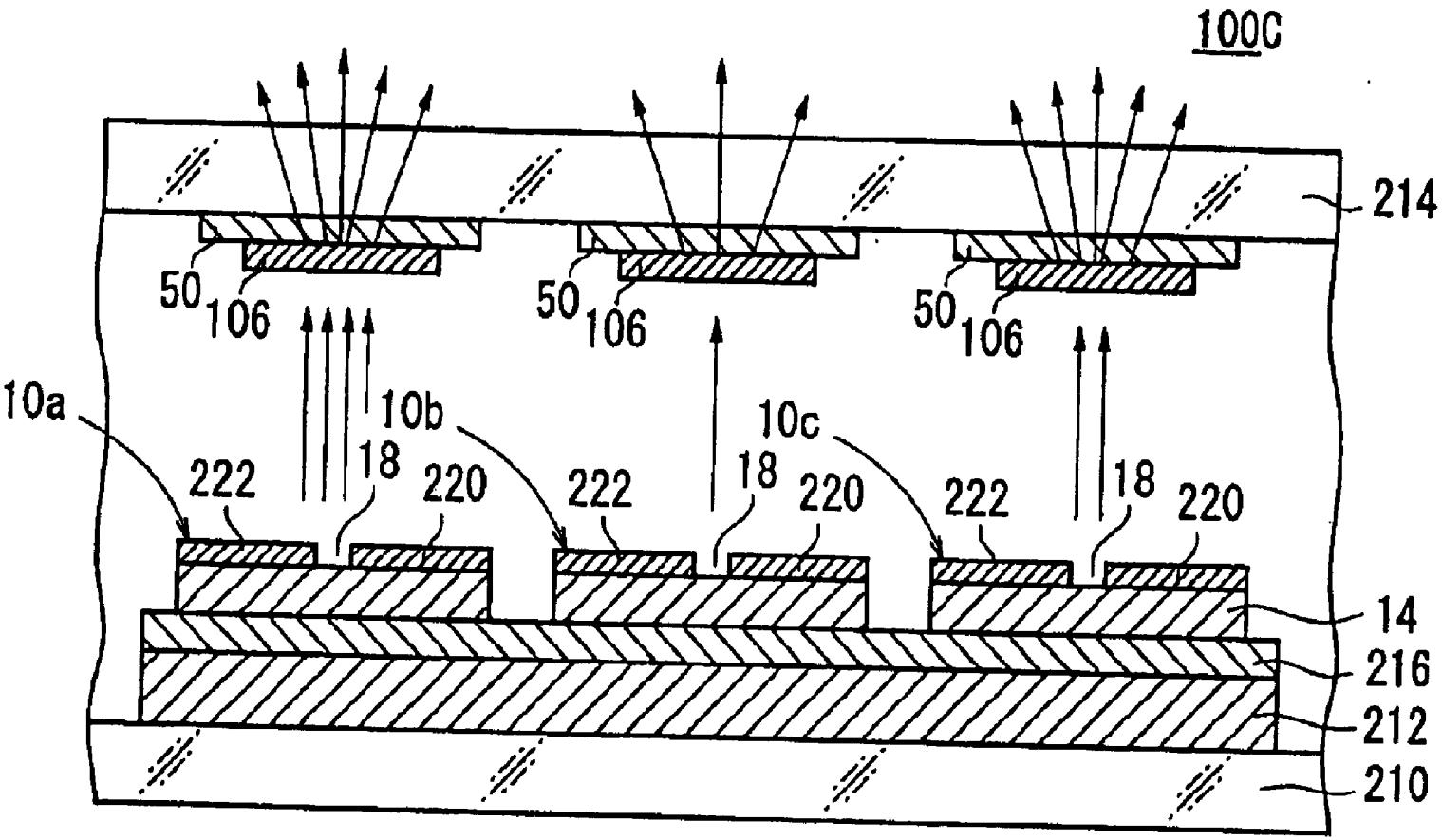
FIG. 93 is a view illustrative of variations of the amount of electrons emitted from electron emitters due to manufacturing variations.

As shown in FIG. 93, even if the power supply voltage of one voltage level is applied to three electron emitters, the electron emitters may emit different amounts of electrons due to manufacturing variations. In FIG. 93, the first electron emitter 10*a* emits a greatest amount of electrons, the third electron emitter 10*c* emits an amount of electrons which is close to a prescribed amount, and the second electron emitter 10*b* emits a least amount of electrons.

As shown in FIG. 92, the signal control circuit 240 has a memory 250 for correcting luminance. The memory 250 stores a luminance correction table which contains luminance corrective data for correcting at least luminance variations of the electron emitters 10.

The signal control circuit 240 generates data signals Sd for the respective rows of electron emitters. At this time, the signal control circuit 240 corrects the data signal Sd by referring to the luminance correction table stored in the memory 250.

The luminance correction table is generated by displaying a uniform image on the display 100C, for example, and detecting luminance levels of all the electron emitters 10. Specifically, a signal representing an intermediate level of the gray scale (e.g., a 128th gradation level among 256 gradation levels of a full scale) is given to all the electron emitters 10 of the display 100C, and luminance levels of all the electron emitters 10 are measured by a luminance meter to determine a measured luminance distribution of the display 100C.

Thereafter, luminance target values for the respective electron emitters 10 are calculated, and luminance correction coefficients for the respective electron emitters 10 are calculated based on the luminance target values for the respective electron emitters 10. Specifically, the measured luminance distribution of the display 100C is smoothened based on the measured luminance levels of the electron emitters 10 to determine a theoretical luminance distribution (a distribution of luminance target values). The smoothening process may be an averaging method, a method of least squares, a higher-order curve approximation method, etc.

If there is an electron emitter 10 whose measured luminance level is extremely low, then it is preferable that the measured luminance level of that electron emitter 10 be ignored, and the smoothening process be carried out to determine a theoretical luminance distribution represented by a smooth curve.

The luminance variations of the electron emitters can thus be eliminated by the above luminance correction for improved displayed image quality.

The luminance correction may alternatively be carried out by a moving average method. According to the moving average method, the luminance levels of an electron emitter 10 (a central electron emitter 10) and a plurality of electron emitters 10 disposed therearound are averaged, and the average luminance level is used as a luminance target value for the central electron emitter 10. Based on the measured luminance value of the central electron emitter 10 and the luminance target value for the central electron emitter 10, a luminance correction coefficient for the central electron emitter 10 is determined.

The moving average method is advantageous for a large-size display apparatus which comprises a matrix of displays 100C. With the moving average method, it is possible to reduce variations of luminance distributions of the displays 100C and make seams between the displays 100C less visible. Furthermore, the individual luminance levels of the displays 100C can be effectively used, so that the displays 100 which can emit bright light do not need to be reduced in luminance.

After the luminance target values for all the electron emitters 10 have been calculated, a bottom-up process or a top-down process may be employed. According to the bottom-up process, an electron emitter 10 is searched for which is given a minimum one of all the calculated luminance target values. Thereafter, the present luminance target value for the found electron emitter 10 is incremented a certain value, producing a new luminance target value.

The bottom-up process is effective to eliminate the disadvantage that images displayed by respective displays 100C of a large-size display apparatus are separated from each other, i.e., to keep a continuous image, and also to make the best use of the display capability of the displays 100C.

According to the top-down process, electron emitters 10 are searched for which are given luminance target values in excess of a preset threshold value, of all the calculated luminance target values. Thereafter, the present luminance target values for the found electron emitters 10 are decremented to the threshold value.

The top-down process is also effective to eliminate the disadvantage that images displayed by respective displays 100C of a large-size display apparatus are separated from each other.

The above luminance correction coefficients should preferably be calculated in view of color temperature.

The displays 100A through 100C according to the first through third embodiments (including the modifications) offer the following advantages:

(1) The displays can be thinner (the panel thickness= several mm) than CRTs.

(2) Since the displays emit natural light from the fluorescent layer 106, they can provide a wide angle of view which is about 180° unlike LCDs (liquid crystal displays) and LEDs (light-emitting diodes).

(3) Since the displays employ a surface electron source, they produce less image distortions than CRTs.

(4) The displays can respond more quickly than LCDs, and can display moving images free of after image with a high-speed response on the order of $\mu$sec.

(5) The displays consume an electric power of about 100 W in terms of a 40-inch size, and hence is characterized by lower power consumption than CRTS, PDPs (plasma displays), LCDs, and LEDs.

(6) The displays have a wider operating temperature range (−40 to +85° C.) than PDPs and LCDs. LCDs have lower response speeds at lower temperatures.

(7) The displays can produce higher luminance than conventional FED displays as the fluorescent material can be excited by a large current output.

(8) The displays can be driven at a lower voltage than conventional FED displays because the drive voltage can be controlled by the polarization inverting characteristics and film thickness of the piezoelectric material.

Because of the above various advantages, the displays can be used in a variety of applications described below.

(1) Since the displays can produce higher luminance and consume lower electric power, they are optimum for use as 30- through 60-inch displays for home use (television and home theaters) and public use (waiting rooms, karaoke rooms, etc.).

(2) Inasmuch as the displays can produce higher luminance, can provide large screen sizes, can display full-color images, and can display high-definition images, they are optimum for use as horizontally or vertically long, specially shaped displays, displays in exhibitions, and message boards for information guides.

(3) Because the displays can provide a wider angle of view due to higher luminance and fluorescent excitation, and can be operated in a wider operating temperature range due to vacuum modularization thereof, they are optimum for use as displays on vehicles. Displays for use on vehicles need to have a horizontally long 8-inch size whose horizontal and vertical lengths have a ratio of 15:9 (pixel pitch=0.14 mm), an operating temperature in the range from −30 to +85° C., and a luminance level ranging from 500 to 600 cd/m$^2$ in an oblique direction.

Because of the above various advantages, the electron emitters can be used as a variety of light sources described below.

(1) Since the electron emitters can produce higher luminance and consume lower electric power, they are optimum for use as projector light sources which are required to have a luminance level of 2000 lumens.

(2) Because the electron emitters can easily provide a high-luminance two-dimensional array light source, can be operated in a wide temperature range, and have their light emission efficiency unchanged in outdoor environments, they are promising as an alternative to LEDs. For example, the electron emitters are optimum as an alternative to two-dimensional array LED modules for traffic signal devices. At 25° C. or higher, LEDs have an allowable current lowered and produce low luminance.

The electron emitter, the method of driving the electron emitter, the display, and the method of driving the display according to the present invention are not limited to the above embodiments, but may be embodied in various arrangement without departing from the scope of the present invention.

What is claimed is:

1. An electron emitter comprising:

an electric field receiving member made of a dielectric material;

a cathode electrode formed on one surface of said electric field receiving member;

an anode electrode formed on said one surface of said electric field receiving member, with a slit defined between said cathode electrode and said anode electrode; and a modulation circuit for modulating a voltage signal applied between said cathode electrode and said anode electrode to control at least an amount of emitted electrons.

2. An electron emitter according to claim 1, further comprising a collector electrode for trapping said emitted electrons, wherein a positive bias voltage with respect to said anode electrode is applied to said collector electrode to accelerate said emitted electrons.

3. An electron emitter according to claim 1, wherein said electric field receiving member is made of a piezoelectric material, an anti-ferrodielectric material, or an electrostrictive material.

4. An electron emitter comprising:

an anode electrode formed on a substrate;

an electric field receiving member formed on said substrate to over said anode electrode and made of a dielectric material;

a cathode electrode formed on said electric field receiving member; and a modulation circuit for modulating a voltage signal applied between said cathode electrode and said anode electrode to control at least an amount of emitted electrons.

5. An electron emitter according to claim 4, wherein said electric field receiving member is made of a piezoelectric material, an anti-ferrodielectric material, or an electrostrictive material.

6. An electron emitter comprising:

an anode electrode formed on a substrate;

an electric field receiving member formed on said substrate to cover said anode electrode and made of a dielectric material;

a cathode electrode formed on said electric field receiving member;

a modulation circuit for modulating a voltage signal applied between said cathode electrode and said anode electrode to control at least an amount of emitted electrons; and a collector electrode for trapping said emitted electrons, wherein a positive bias voltage with respect to said anode electrode is applied to said collector electrode to accelerate said emitted electrons.

7. An electron emitter comprising:

an electric field receiving member made of a dielectric material;

a cathode electrode formed on one surface of said electric field receiving member;

an anode electrode formed on said one surface of said electric field receiving member, with a slit defined between said cathode electrode and said anode electrode; and a control electrode disposed over said cathode electrode and said anode electrode.

8. An electron emitter according to claim 7, further comprising:

a first modulation circuit for modulating a first voltage signal applied between said cathode electrode and said anode electrode to control at least an amount of emitted electrons; and a second modulation circuit for modulating a second voltage signal applied between said control electrode and said anode electrode to control at least an amount of emitted electrons.

9. An electron emitter according to claim 7, wherein said control electrode is formed on a spacer which is formed on a peripheral region of said electric field receiving member.

10. An electron emitter according to claim 7, wherein said control electrode is formed on a spacer which is formed on at least said cathode electrode and said anode electrode.

11. An electron emitter according to claim 7, further comprising a second control electrode formed on a second spacer which is formed on a peripheral region of said electric field receiving member.

12. An electron emitter according to claim 7, further comprising a collector electrode for trapping said emitted electrons, wherein a positive bias voltage with respect to said anode electrode is applied to said collector electrode to accelerate said emitted electrons.

13. An electron emitter according to claim 7, wherein said electric field receiving member is made of a piezoelectric material, an anti-ferrodielectric material, or an electrostrictive material.

14. An electron emitter comprising:

an anode electrode formed on a substrate;

an electric field receiving member formed on said substrate to cover said anode electrode and made of a dielectric material;

a cathode electrode formed on said electric field receiving member;

a control electrode disposed over said cathode electrode; and a collector electrode for trapping said emitted electrons, wherein a positive bias voltage with respect to said anode electrode is applied to said collector electrode to accelerate said emitted electrons.

15. An electron emitter according to claim 14, further comprising:

a first modulation circuit for modulating a first voltage signal applied between said cathode electrode and said anode electrode to control at least an amount of emitted electrons; and a second modulation circuit for modulating a second voltage signal applied between said control electrode and said anode electrode to control at least an amount of emitted electrons.

16. An electron emitter according to claim 14, wherein said control electrode is formed on a spacer which is formed on a peripheral region of said electric field receiving member.

17. An electron emitter according to claim 14, wherein said control electrode is formed on a spacer which is formed on at least said cathode electrode.

18. An electron emitter according to claim 14, further comprising a second control electrode formed on a second spacer which is formed on a peripheral region of said electric field receiving member.

19. An electron emitter according to claim 14, wherein said electric field receiving member is made of a piezoelectric material, an anti-ferrodielectric material, or an electrostrictive material.

20. A method of driving an electron emitter having an electric field receiving member made of a dielectric material and a cathode electrode and an anode electrode which are formed in contact with said electric field receiving member, wherein said cathode electrode is formed on one surface of said electric field receiving member, and said anode electrode is formed on said one surface of said electric field receiving member, with a slit defined between said anode electrode and said cathode electrode, said method comprising the step of:

modulating a pulse signal applied between said cathode electrode and said anode electrode to control at least an amount of emitted electrons.

21. A display comprising:

a two-dimensional array of electron emitters;

a collector electrode facing said electron emitters; and a plurality of fluorescent layers spaced by respective distances from said electron emitters;

each of said electron emitters comprising:

an electric field receiving member made of a dielectric material;

a cathode electrode and an anode electrode which are formed in contact with said electric field receiving member; and a modulation circuit for modulating a voltage signal applied between said cathode electrode and said anode electrode to control a displayed gradation.

22. A display according to claim 21, wherein said modulation circuit comprises a circuit for carrying out pulse-width-modulating said voltage signal based on a gradation command value, further comprising a linearization correcting circuit connected to an input of said modulation circuit, for correcting said gradation command value in order to convert a change in the displayed gradation based on a change in said gradation command value into linear characteristics.

23. A display according to claim 21, wherein said cathode electrode is formed on one surface of said electric field receiving member, and said anode electrode is formed on said one surface of said electric field receiving member, with a slit defined between said anode electrode and said cathode electrode.

24. A display according to claim 23, wherein said control electrode is formed on a spacer which is formed on at least said cathode electrode and said anode electrode.

25. A display according to claim 21, wherein said anode electrode is formed on a substrate, said electric field receiving member is formed on said substrate to cover said anode electrode, and said cathode electrode is formed on said electric field receiving member.

26. A display according to claim 25, wherein said control electrode is formed on a spacer which is formed on at least said cathode electrode.

27. A display comprising:

a two-dimensional array of electron emitters;

a collector electrode facing said electron emitters;

a plurality of fluorescent layers spaced by respective distances from said electron emitters; and a control electrode disposed between said fluorescent layers and said electron emitters;

each of said electron emitters comprising:

an electric field receiving member made of a dielectric material and a cathode electrode and an anode electrode which are formed in contact with said electric field receiving member.

28. A display according to claim 27, further comprising:

a first modulation circuit for modulating a first voltage signal applied between said cathode electrode and said anode electrode to control a displayed gradation; and a second modulation circuit for modulating a second voltage signal applied between said control electrode and said anode electrode to control a displayed gradation.

29. A display according to claim 28, wherein said first modulation circuit comprises a circuit for carrying out pulse-width-modulating said first voltage signal based on a gradation command value, further comprising a linearization correcting circuit connected to an input of said modulation circuit, for correcting said gradation command value in order to convert a change in the displayed gradation based on a change in said gradation command value into linear characteristics.

30. A display according to claim 27, wherein said cathode electrode is formed on one surface of said electric field receiving member, and said anode electrode is formed on said one surface of said electric field receiving member, with a slit defined between said anode electrode and said cathode electrode.

31. A display according to claim 30, wherein said control electrode is formed on a spacer which is formed on at least said cathode electrode and said anode electrode.

32. A display according to claim 27, wherein said anode electrode is formed on a substrate, said electric field receiving member is formed said substrate to cover said anode electrode, and said cathode electrode is formed on said electric field receiving member.

33. A display according to claim 32, wherein said control electrode is formed on a spacer which is formed on at least said cathode electrode.

34. A display according to claim 27, wherein a plurality of control electrodes capable of applying an independent voltage signal to one electron emitter are facing each other.

35. A display according to claim 27, wherein said control electrode is divided into control electrodes associated with respective rows.

36. A display according to claim 27, wherein said control electrode is divided into control electrodes associated with respective columns.

37. A display according to claim 27, wherein said control electrode is divided into control electrodes associated with the respective electron emitters.

38. A display according to claim 27, wherein said control electrode is divided into control electrodes associated with respective groups of the electron emitters.

39. A display according to claim 38, wherein said control electrode is divided into control electrodes associated with respective groups of the electron emitters each for displaying either one of three primary colors.

40. A display according to claim 27, wherein said control electrode is formed on a spacer which is formed on a peripheral region of said electric field receiving member.

41. A display according to claim 27, further comprising second control electrode disposed between said control electrode and said fluorescent layers.

42. A display according to claim 41, further comprising a third modulation circuit for modulating a third voltage signal applied between said second control electrode and said anode electrode to convert a change in the displayed gradation modulated by at least said first modulation circuit into linear characteristics.

43. A display according to claim 41, having a self-diagnostic function for trapping emitted electrons with said second control electrode and detecting a current produced by the trapped electrons for diagnosis.

44. A display according to claim 41, wherein a plurality of control electrodes capable of applying an independent voltage signal to one electron emitter are facing each other.

45. A display according to claim 41, wherein said second control electrode is divided into second control electrodes associated with respective rows.

46. A display according to claim 45, wherein said control electrode is divided into control electrodes associated with respective columns.

47. A display according to claim 45, wherein said second control electrodes are further divided into second control electrodes in each of said rows.

48. A display according to claim 41, wherein said second control electrode is divided into second control electrodes associated with respective columns.

49. A display according to claim 48, wherein said control electrode is divided into control electrodes associated with respective rows.

50. A display according to claim 48, wherein said second control electrodes are further divided into second control electrodes in each of said columns.

51. A display according to claim 41, wherein said second control electrode is divided into second control electrodes associated with the respective electron emitters.

52. A display according to claim 41, wherein said second control electrode is divided into second control electrodes associated with respective groups of the electron emitters.

53. A display according to claim 52, wherein said second control electrode is divided into second control electrodes associated with respective groups of the electron emitters each for displaying either one of three primary colors.

54. A display according to claim 41, wherein said second control electrode is formed on a second spacer which is formed on a peripheral region of said electric field receiving member.

55. A method of driving an electron emitter having an electric field receiving member made of a dielectric material and a cathode electrode and an anode electrode which are formed in contact with said electric field receiving member, said method comprising the step of:

modulating a pulse signal applied between said cathode electrode and said anode electrode to control at least an amount of emitted electrons.

56. A method according to claim 55, wherein said anode electrode is formed on a substrate, said electric field receiving member is formed on said substrate to cover said anode electrode, and said cathode electrode is formed on said electric field receiving member.

57. A method of driving an electron emitter having an anode electrode formed on a substrate, an electric field receiving member formed on said substrate to cover said anode electrode and made of a dielectric material, and a cathode electrode formed on said electric field receiving member, said method comprising the steps of:

providing a control electrode disposed over said cathode electrode;

applying a constant first pulse signal between said cathode electrode and said anode electrode; and modulating a second pulse signal applied between said control electrode and said anode electrode to control at least an amount of emitted electrons.

58. A method of driving an electron emitter having an electric field receiving member made of a dielectric material, a cathode electrode formed on one surface of said electric field receiving member, and an anode electrode formed on said one surface of said electric field receiving member, with a slit defined between said cathode electrode and said anode electrode, said method comprising the step of:

providing a control electrode disposed over said cathode electrode and said anode electrode;

applying a constant first pulse signal between said cathode electrode and said anode electrode; and modulating a second pulse signal applied between said control electrode and said anode electrode to control at least an amount of emitted electrons.

59. A method of driving a display having a two-dimensional array of electron emitters, and a plurality of fluorescent layers spaced by respective distances from said electron emitters, each of said electron emitters having an electric field receiving member made of a dielectric material, and a cathode electrode and an anode electrode which are formed in contact with said electric field receiving member, said method comprising the step of:

modulating a voltage signal applied between said cathode electrode and said anode electrode of each of said electron emitters to control a displayed gradation.

60. A method according to claim 59, wherein said anode electrode is formed on a substrate, said electric field receiving member is formed said substrate to cover said anode electrode, and said cathode electrode is formed on said electric field receiving member.

61. A method according to claim 59, wherein said step of modulating a voltage signal comprises the step of pulse-width-modulating said voltage signal based on a gradation command value, further comprising the step of correcting said gradation command value in order to convert a change in the displayed gradation based on a change in said gradation command value into linear characteristics.

62. A method according to claim 59, wherein said cathode electrode is formed on one surface of said electric field receiving member, and said anode electrode is formed on said one surface of said electric field receiving member, with a slit defined between said anode electrode and said cathode electrode.

63. A method of driving display having a two-dimensional array of electron emitters, a collector electrode facing said electron emitters, a plurality of fluorescent layers spaced by respective distance from said electron emitters; and a control electrode disposed between said fluorescent layers and said electron emitters, each of said electron emitters having an electric field receiving member made of a dielectric material, and a cathode electrode and an anode electrode which are formed in contact with said electric field receiving member, said method comprising the steps of:

modulating a first voltage signal applied between said cathode electrode and said anode electrode and modulating a second voltage signal applied between said control electrode and said anode electrode to control a displayed gradation.

64. A method according to claim 63, wherein said anode electrode is formed on a substrate, said electric field receiving member is formed said substrate to cover said anode electrode, and said cathode electrode is formed on said electric field receiving member.

65. A method according to claim 63, wherein said step of modulating a first voltage signal comprises the step of pulse-width-modulating said first voltage signal based on a gradation command value, further comprising the step of correcting said gradation command value in order to convert a change in the displayed gradation based on a change in said gradation command value into linear characteristics.

66. A method according to claim 63, wherein a second control electrode is disposed between said control electrode and said fluorescent layers, and said step of modulating a first voltage signal comprises the step of pulse-width-modulating said first voltage signal based on a gradation command value, further comprising the step of modulating a third voltage signal applied between said second control electrode and said anode electrode, thereby to convert a change in the displayed gradation based on a change in said gradation command value into linear characteristics.

67. A method according to claim 63, wherein said cathode electrode is formed on one surface of said electric field receiving member, and said anode electrode is formed on said one surface of said electric field receiving member, with a slit defined between said anode electrode and said cathode electrode.

* * * * *

UNITED STATES PATENT AND TRADEMARK OFFICE

CERTIFICATE OF CORRECTION

PATENT NO. : 6,946,800 B2
DATED : September 20, 2005
INVENTOR(S) : Yukihisa Takeuchi et al.

It is certified that error appears in the above-identified patent and that said Letters Patent is hereby corrected as shown below:

Column 23,
Line 17, change "52" to -- 62 --.

Column 43,
Line 27, change "over" to -- cover --.

Column 45,
Line 64, add, -- ; -- after "material".

Column 46,
Line 29, add -- on -- after "formed".
Line 57, add -- a -- after "comprising".

Column 48,
Lines 29 and 62, add -- on -- after "formed".
Line 45, add -- a -- after "driving".
Line 48, change "distance" to -- distances --.

Signed and Sealed this

Twenty-seventh Day of December, 2005

JON W. DUDAS
*Director of the United States Patent and Trademark Office*

UNITED STATES PATENT AND TRADEMARK OFFICE

CERTIFICATE OF CORRECTION

PATENT NO. : 6,946,800 B2
APPLICATION NO. : 10/374955
DATED : September 20, 2005
INVENTOR(S) : Yukihisa Takeuchi et al.

It is certified that error appears in the above-identified patent and that said Letters Patent is hereby corrected as shown below:

Column 23, line 17, Title, the recitation "52" (replaced by --62-- in the Certificate of Correction issued December 27, 2005) should be reinstated.

Signed and Sealed this

Eighth Day of August, 2006

JON W. DUDAS
*Director of the United States Patent and Trademark Office*